US010563459B2

(12) United States Patent
Vail, III et al.

(10) Patent No.: US 10,563,459 B2
(45) Date of Patent: Feb. 18, 2020

(54) MUD MOTOR ASSEMBLY

(71) Applicant: Smart Drilling and Completion, Inc., Bothell, WA (US)

(72) Inventors: William Banning Vail, III, Bothell, WA (US); Tomislav Skerl, Houston, TX (US); Damir S. Skerl, Houston, TX (US)

(73) Assignee: Smart Drilling and Completion, Inc., Bothell, WA (US)

( * ) Notice: Subject to any disclaimer, the term of this patent is extended or adjusted under 35 U.S.C. 154(b) by 151 days.

(21) Appl. No.: 15/404,649

(22) Filed: Jan. 12, 2017

(65) Prior Publication Data

US 2017/0122033 A1 May 4, 2017

Related U.S. Application Data

(63) Continuation-in-part of application No. 15/054,066, filed on Feb. 25, 2016, now Pat. No. 9,803,424, which (Continued)

(51) Int. Cl.
*E21B 4/02* (2006.01)
*F03B 13/02* (2006.01)

(52) U.S. Cl.
CPC ..... *E21B 4/02* (2013.01); *F03B 13/02* (2013.01)

(58) Field of Classification Search
CPC . E21B 7/04; E21B 7/067; E21B 7/068; E21B 4/00; E21B 4/02
See application file for complete search history.

(56) References Cited

U.S. PATENT DOCUMENTS 4,159,149 A * 6/1979 Castanoli ..... E21C 35/20 175/106
4,348,007 A * 9/1982 Malzacher ..... E21B 15/003 254/106

(Continued)

FOREIGN PATENT DOCUMENTS

CA 2837082 11/2012
WO WO 2009/065523 5/2009

OTHER PUBLICATIONS

Official Action for Canadian Patent Application No. 2837082, dated Mar. 2, 2018, 4 pages.

(Continued)

*Primary Examiner* — David Carroll
(74) *Attorney, Agent, or Firm* — Sheridan Ross P.C.

(57) ABSTRACT

A longer-lasting, lower cost, more powerful, all metal, mud motor than the presently available progressing cavity type mud motors for drilling boreholes into the earth. A mud motor apparatus possessing one single drive shaft that turns a rotary drill bit, which apparatus is attached to a drill pipe which provides high pressure mud to the mud motor, wherein the drive shaft receives at least a first portion of its rotational torque from any high pressure mud flowing through a first hydraulic chamber within the apparatus, and receives at least a second portion of its rotational torque from any high pressure mud flowing through a second hydraulic chamber within the apparatus. A typical mud motor apparatus possesses two or more hydraulic chambers, each having its own power stroke, and return stroke, which act together in a controlled fashion to provide continuous power to a rotary drill bit.

10 Claims, 121 Drawing Sheets

Related U.S. Application Data is a continuation-in-part of application No. 15/042,072, filed on Feb. 11, 2016, now Pat. No. 9,611,693, which is a continuation of application No. 13/987,992, filed on Sep. 20, 2013, now abandoned, which is a continuation-in-part of application No. 13/506,887, filed on May 22, 2012, now Pat. No. 9,051,781, which is a continuation-in-part of application No. 13/068,133, filed on May 2, 2011, now Pat. No. 9,027,673, which is a continuation-in-part of application No. 12/653,740, filed on Dec. 17, 2009, now Pat. No. 8,651,177.

(60) Provisional application No. 62/425,829, filed on Nov. 23, 2016, provisional application No. 62/387,977, filed on Jan. 12, 2016, provisional application No. 62/284,157, filed on Sep. 21, 2015, provisional application No. 62/283,226, filed on Aug. 24, 2015, provisional application No. 62/177,232, filed on Mar. 7, 2015, provisional application No. 62/176,777, filed on Feb. 27, 2015, provisional application No. 61/960,208, filed on Sep. 11, 2013, provisional application No. 61/959,021, filed on Aug. 12, 2013, provisional application No. 61/956,218, filed on Jun. 3, 2013, provisional application No. 61/855,480, filed on May 15, 2013, provisional application No. 61/744,188, filed on Sep. 20, 2012, provisional application No. 61/688,726, filed on May 18, 2012, provisional application No. 61/687,394, filed on Apr. 24, 2012, provisional application No. 61/633,776, filed on Feb. 18, 2012, provisional application No. 61/629,000, filed on Nov. 12, 2011, provisional application No. 61/573,631, filed on Sep. 8, 2011, provisional application No. 61/519,487, filed on May 23, 2011, provisional application No. 61/517,218, filed on Apr. 15, 2011, provisional application No. 61/465,608, filed on Mar. 22, 2011, provisional application No. 61/462,393, filed on Feb. 2, 2011, provisional application No. 61/461,266, filed on Jan. 14, 2011, provisional application No. 61/460,053, filed on Dec. 23, 2010, provisional application No. 61/459,896, filed on Dec. 20, 2010, provisional application No. 61/458,490, filed on Nov. 24, 2010, provisional application No. 61/458,403, filed on Nov. 22, 2010, provisional application No. 61/456,986, filed on Nov. 15, 2010, provisional application No. 61/455,123, filed on Oct. 13, 2010, provisional application No. 61/404,970, filed on Oct. 12, 2010, provisional application No. 61/401,974, filed on Aug. 19, 2010, provisional application No. 61/399,938, filed on Jul. 20, 2010, provisional application No. 61/399,110, filed on Jul. 6, 2010, provisional application No. 61/397,848, filed on Jun. 16, 2010, provisional application No. 61/396,940, filed on Jun. 5, 2010, provisional application No. 61/396,420, filed on May 25, 2010, provisional application No. 61/396,030, filed on May 19, 2010, provisional application No. 61/395,081, filed on May 6, 2010, provisional application No. 61/274,215, filed on Aug. 13, 2009.

(56) References Cited

U.S. PATENT DOCUMENTS

| | | | | |
|---|---|---|---|---|
| 5,785,509 | A | 7/1998 | Harris et al. | |
| 5,911,284 | A | 6/1999 | von Gynz-Rekowski | |
| 9,027,673 | B2 | 5/2015 | Vail, III | |
| 9,051,781 | B2 | 6/2015 | Vail, III | |
| 9,284,780 | B2 | 3/2016 | Chitwood et al. | |
| 9,611,693 | B2 | 4/2017 | Vail, III | |
| 9,803,424 | B2 * | 10/2017 | Vail, III | E21B 4/003 |
| 2001/0052704 | A1 * | 12/2001 | Bosley | E21B 47/0008 290/52 |
| 2010/0101775 | A1 * | 4/2010 | Revheim | E21B 33/05 166/70 |
| 2010/0139983 | A1 * | 6/2010 | Hallworth | E21B 7/06 175/73 |
| 2015/0083500 | A1 * | 3/2015 | Vail, III | E21B 4/003 175/107 |
| 2015/0292265 | A1 | 10/2015 | Vail, III | |
| 2015/0315846 | A1 * | 11/2015 | Tulloch | C09J 183/04 175/57 |
| 2016/0177627 | A1 | 6/2016 | Vail, III | |
| 2017/0356247 | A1 | 12/2017 | Vail, III | |

OTHER PUBLICATIONS

Notice of Allowance for U.S. Appl. No. 15/054,066, dated Jul. 3, 2017 7 pages.
Official Action for U.S. Appl. No. 15/452,534, dated Apr. 27, 2018, 8 pages.
Intent to Grant for European Patent Application No. 12789232.1, dated Jul. 1, 2016 7 pages.
Official Action for U.S. Appl. No. 15/042,072, dated Aug. 11, 2016 7 pages.
Notice of Allowance for U.S. Appl. No. 15/042,072, dated Nov. 23, 2016 7 pages.
Official Action for U.S. Appl. No. 14/697,506, dated Sep. 27, 2016 5 pages.
Notice of Allowance for U.S. Appl. No. 14/697,506, dated Apr. 26, 2017 9 pages.

* cited by examiner

RAISED GUIDE FOR PAWL B CAPTURE PIN

HOUSING

CRANKSHAFT A

INTERNAL CRANKSHAFT A BEARING

DRIVE SHAFT

PISTON A

BACKSTOP A

BYPASS TUBE A-1

BYPASS TUBE A-2

DPCHA

EPCHA

BPCHA

BACKSTOP TO HOUSING WELD

PISTON A TO CRANKSHAFT A WELD

MUD MOTOR ASSEMBLY

HISTORY OF RELATED U.S. PATENT APPLICATIONS TO WHICH PRIORITY IS CLAIMED

The present application is a continuation-in-part (C.I.P.) application of co-pending U.S. patent application Ser. No. 15/054,066, filed Feb. 25, 2016, that is entitled "Mud Motor Assembly," an entire copy of which is incorporated herein by reference. (Seals-9)

Ser. No. 15/054,066 is a continuation-in-part (C.I.P.) application of co-pending U.S. patent application Ser. No. 15/042,072, filed on Feb. 11, 2016, that is entitled "Mud Motor Assembly", an entire copy of which is incorporated herein by reference. (Seals-8)

Ser. No. 15/042,072 is a continuation application of U.S. patent application Ser. No. 13/987,992, filed on Sep. 20, 2013, that is entitled "Mud Motor Assembly", an entire copy of which is incorporated herein by reference. (Seals-4)

U.S. patent application Ser. No. 13/987,992, filed on Sep. 20, 2013, claimed priority to the five U.S. Provisional applications respectively identified by (a.), (b.), (c.), (d.), and (e.) as follows:

(a.) Applicant claims priority for this application to U.S. Provisional Patent Application Ser. No. 61/744,188 filed on Sep. 20, 2012, that is entitled "Additional Comments on The Mark IV Mud Motor", an entire copy of which is incorporated herein by reference, unless there is a direct conflict with the disclosure herein, and in such case, the disclosure herein shall take precedence. (PPA-51)

(b.) Applicant further claims priority for this application to the U.S. Provisional patent application mailed to the USPTO on May 15, 2013 with a Certificate of Deposit by Express Mail, Express Mail Number EU 900 555 035 US, that is entitled "Additional Comments on The Mark IV Mud Motor—Part 2", now U.S. Provisional Patent Application Ser. No. 61/855,480, having the filing date of May 15, 2013, an entire copy of which is incorporated herein by reference, unless there is a direct conflict with the disclosure herein, and in such case, the disclosure herein shall take precedence. (PPA-52)

(c.) Applicant claims priority for this application to U.S. Provisional Patent Application Ser. No. 61/956,218 filed on Jun. 3, 2013, that is entitled "Additional Comments on The Mark IV Mud Motor—Part 3", an entire copy of which is incorporated herein by reference, unless there is a direct conflict with the disclosure herein, and in such case, the disclosure herein shall take precedence. (PPA-53)

(d.) Applicant claims priority for this application to U.S. Provisional Patent Application Ser. No. 61/959,021 filed on Aug. 12, 2013, that is entitled "Additional Comments on The Mark IV Mud Motor—Part 4", an entire copy of which is incorporated herein by reference, unless there is a direct conflict with the disclosure herein, and in such case, the disclosure herein shall take precedence. (PPA-54)

(e.) Applicant claims priority for this application to U.S. Provisional patent application mailed to the USPTO on Sep. 11, 2013 with a Certificate of Deposit by Express Mail, Express Mail Number EI 996 065 345 US, that is entitled "Additional Comments on The Mark IV Mud Motor—Part 5", now U.S. Provisional Patent Application Ser. No. 61/960,208 filed on Sep. 11, 2013, an entire copy of which is incorporated herein by reference, unless there is a direct conflict with the disclosure herein, and in such case, the disclosure herein shall take precedence. (PPA-55)

Ser. No. 13/987,992 is a continuation-in-part (C.I.P.) application of U.S. patent application Ser. No. 13/506,887, filed on May 22, 2012, that is entitled "Mud Motor Assembly", now U.S. Pat. No. 9,051,781 B2, that issued on Jun. 9, 2015, an entire copy of which is incorporated herein by reference. (Seals-3)

U.S. patent application Ser. No. 13/506,887, filed on May 22, 2012, claimed priority to the six U.S. Provisional applications respectively identified as (A.), (B.), (C.), (D.), (E.), and (F.) as follows:

(A.) U.S. Provisional Patent Application No. 61/519,487, filed May 23, 2011, that is entitled "Modeling of Lateral Extended Reach Drill Strings and Performance of the Leaky Seal™ with Cross-Over", an entire copy of which is incorporated herein by reference. (PPA-45)

(B.) U.S. Provisional Patent Application No. 61/573,631, filed Sep. 8, 2011, that is entitled "Selected Embodiments of the New Mud Motor", an entire copy of which is incorporated herein by reference. (PPA-46)

(C.) U.S. Provisional Patent Application No. 61/629,000, filed Nov. 12, 2011, that is entitled "Selected Embodiments of the New Mud Motor—Part II", an entire copy of which is incorporated herein by reference. (PPA-47)

(D.) U.S. Provisional Patent Application No. 61/633,776, filed Feb. 18, 2012, that is entitled "Selected Embodiments of the New Mud Motor—Part III", an entire copy of which is incorporated herein by reference. (PPA-48)

(E.) U.S. Provisional Patent Application No. 61/687,394, filed Apr. 24, 2012, that is entitled "Selected Embodiments of the New Mud Motor—Part IV", an entire copy of which is incorporated herein by reference. (PPA-49)

(F.) The U.S. Provisional patent application that was mailed to the USPTO on May 18, 2012, by U.S. Express Mail, Express Mail Label No. EH 689 324 240 US, using a Certificate of Deposit by Express Mail, now U.S. Provisional Application Ser. No. 61/688,726, having a filing date of May 18, 2012, that is entitled "Modeling of Lateral Extended Reach Drill Strings and Performance of the Leaky Seal™ with Cross-Over—Part II", an entire copy of which is incorporated herein by reference. (PPA-50)

Ser. No. 13/506,887, filed on May 22, 2012, is a continuation-in-part (C.I.P.) application of U.S. patent application Ser. No. 13/068,133, filed on May 2, 2011, that is entitled "Universal Drilling and Completion System", now U.S. Pat. No. 9,027,673 B2, that issued on May 12, 2015, an entire copy of which is incorporated herein by reference. (Seals-2)

U.S. patent application Ser. No. 13/068,133, filed on May 2, 2011, claimed priority from the following nineteen (19) U.S. Provisional patent applications:

(1) U.S. Provisional Patent Application No. 61/395,081, filed May 6, 2010, that is entitled "Annular Pressure Smart Shuttle", an entire copy of which is incorporated herein by reference. (PPA-22)

(2) U.S. Provisional Patent Application No. 61/396,030, filed on May 19, 2010, that is entitled "The Hydroelectric Drilling Machine", an entire copy of which is incorporated herein by reference. (PPA-23)

(3) U.S. Provisional Patent Application No. 61/396,420, filed on May 25, 2010, that is entitled "Universal Drilling and Completion System", an entire copy of which is incorporated herein by reference. (PPA-24)

(4) U.S. Provisional Patent Application No. 61/396,940, filed on Jun. 5, 2010, that is entitled "Subterranean Drilling Machine with Counter-Rotating Cutters", an entire copy of which is incorporated herein by reference. (PPA-25)

(5) U.S. Provisional Patent Application No. 61/465,608, filed on Mar. 22, 2011, that is entitled "Drilling Machine with Counter-Rotating Cutters to Drill Multiple Slots in a Formation to Produce Hydrocarbons", an entire copy of which is incorporated herein by reference. (PPA-26)

(6) U.S. Provisional Patent Application No. 61/397,848, filed on Jun. 16, 2010, that is entitled "Modified Pelton Type Tangential Turbine Hydraulic Drives to Replace Electric Motors in Electrical Submersible Pumps", an entire copy of which is incorporated herein by reference. (PPA-27)

(7) U.S. Provisional Patent Application No. 61/399,110, filed on Jul. 6, 2010, that is entitled "Hydraulic Subsea System Used to Remove Hydrocarbons From Seawater in the Event of a Seafloor Oil/Gas Well Failure", an entire copy of which is incorporated herein by reference. (PPA-28)

(8) U.S. Provisional Patent Application No. 61/399,938, filed on Jul. 20, 2010, that is entitled "Deep Upweller", an entire copy of which is incorporated herein by reference. (PPA-29)

(9) U.S. Provisional Patent Application No. 61/401,974, filed on Aug. 19, 2010, that is entitled "Universal Drilling and Completion System and Deep Upweller", an entire copy of which is incorporated herein by reference. (PPA-30)

(10) U.S. Provisional Patent Application No. 61/404,970, filed on Oct. 12, 2010, that is entitled "UDCS and Pelton-like Turbine Powered Pumps", an entire copy of which is incorporated herein by reference. (PPA-35)

(11) U.S. Provisional Patent Application No. 61/455,123, filed on Oct. 13, 2010, that is entitled "UDCS Presentation", an entire copy of which is incorporated herein by reference. (PPA-36)

(12) U.S. Provisional Patent Application No. 61/456,986, filed on Nov. 15, 2010, that is entitled "New Vane Mud Motor for Downhole Drilling Applications", an entire copy of which is incorporated herein by reference. (PPA-37)

(13) U.S. Provisional Patent Application No. 61/458,403, filed on Nov. 22, 2010, that is entitled "Leaky Seal for Universal Drilling and Completion System", an entire copy of which is incorporated herein by reference. (PPA-38)

(14) U.S. Provisional Patent Application No. 61/458,490, filed on Nov. 24, 2010, that is entitled "Transverse Flow Channel Mud Motor", an entire copy of which is incorporated herein by reference. (PPA-39)

(15) U.S. Provisional Patent Application No. 61/459,896, filed on Dec. 20, 2010, that is entitled "The Force Sub", an entire copy of which is incorporated herein by reference. (PPA-40)

(16) U.S. Provisional Patent Application No. 61/460,053, filed on Dec. 23, 2010, that is entitled "The Force Sub—Part 2", an entire copy of which is incorporated herein by reference. (PPA-41)

(17) U.S. Provisional Patent Application No. 61/461,266, filed on Jan. 14, 2011, that is entitled "The Force Sub—Part 3", an entire copy of which is incorporated herein by reference. (PPA-42)

(18) U.S. Provisional Patent Application No. 61/462,393, filed on Feb. 2, 2011, that is entitled "UDCS, The Force Sub, and The Torque Sub", an entire copy of which is incorporated herein by reference. (PPA-43)

(19) U.S. Provisional Patent Application No. 61/517,218, filed on Apr. 15, 2011, that is entitled "UDCS, The Force Sub, and The Torque Sub—Part 2", an entire copy of which is incorporated herein by reference. (PPA-44)

Ser. No. 13/068,133, filed on May 2, 2011, is a continuation-in-part (C.I.P.) application of U.S. patent application Ser. No. 12/653,740, filed on Dec. 17, 2009, that is entitled "Long-Lasting Hydraulic Seals for Smart Shuttles for Coiled Tubing Injectors, and for Pipeline Pigs", now U.S. Pat. No. 8,651,177 B2, that issued on Feb. 18, 2014, an entire copy of which is incorporated herein by reference. (Seals-1)

U.S. patent application Ser. No. 12/653,740, filed on Dec. 17, 2009, claimed priority from U.S. Provisional Patent Application No. 61/274,215, filed on Aug. 13, 2009, that is entitled "Long-Lasting Hydraulic Seals for Smart Shuttles, for Coiled Tubing Injectors, and for Pipeline Pigs", an entire copy of which is incorporated herein by reference. (PPA-21)

PRIORITY CLAIMS FROM PREVIOUS U.S. PATENT APPLICATIONS

Applicant claims priority as follows:

Applicant claims priority for this application to U.S. Provisional Patent Application Ser. No. 62/176,777 filed on Feb. 27, 2015, that is entitled "Additional Comments on The Mark IV Mud Motor—Part 6", an entire copy of which is incorporated herein by reference, unless there is a direct conflict with the disclosure herein, and in such case, the disclosure herein shall take precedence. (PPA-56)

Applicant further claims priority for this application to U.S. Provisional Patent Application Ser. No. 62/177,232 filed on Mar. 7, 2015 that is entitled "Additional Comments on The Mark IV Mud Motor—Part 7", an entire copy of which is incorporated herein by reference, unless there is a direct conflict with the disclosure herein, and in such case, the disclosure herein shall take precedence. (PPA-57)

Applicant claims priority for this application to U.S. Provisional Patent Application Ser. No. 62/283,226 filed on Aug. 24, 2015, that is entitled "Additional Comments on The Mark IV Mud Motor—Part 8", an entire copy of which is incorporated herein by reference, unless there is a direct conflict with the disclosure herein, and in such case, the disclosure herein shall take precedence. (PPA-58)

Applicant claims priority for this application to U.S. Provisional Patent Application Ser. No. 62/284,157 filed on Sep. 21, 2015, that is entitled "Additional Comments on The Mark IV Mud Motor—Part 9", an entire copy of which is incorporated herein by reference, unless there is a direct conflict with the disclosure herein, and in such case, the disclosure herein shall take precedence. (PPA-59)

Applicant claims priority for this application to U.S. Provisional Patent Application Ser. No. 62/387,977 filed on Jan. 12, 2016 that is entitled "Additional Comments on The Mark IV Mud Motor—Part 10", an entire copy of which is incorporated herein by reference, unless there is a direct conflict with the disclosure herein, and in such case, the disclosure herein shall take precedence. (PPA-60)

Applicant claims priority for this application to U.S. Provisional Patent Application Ser. No. 62/425,829 filed on Nov. 23, 2016 that is entitled "Additional Comments on the Mark IV Mud Motor—Part 11", an entire copy of which is incorporated herein by reference, unless there is a direct conflict with the disclosure herein, and in such case, the disclosure herein shall take precedence. (PPA-61)

Applicant claims priority for this application to the above defined U.S. patent application Ser. No. 15/054,066, filed Feb. 25, 2016, that is entitled "Mud Motor Assembly", an entire copy of which is incorporated herein by reference. (Seals-9)

Applicant claims priority for this application to the above defined U.S. patent application Ser. No. 15/042,072, filed on Feb. 11, 2016, that is entitled "Mud Motor Assembly", an entire copy of which is incorporated herein by reference. (Seals-8)

Applicant claims priority for this application to the above defined U.S. patent application Ser. No. 13/987,992, filed on Sep. 20, 2013, which application claimed priority to the above five Provisional patent applications respectively identified by (a.), (b.), (c.), (d.), and (e.), and applicant also claims priority to those same five Provisional patent applications that are not repeated here again solely in the interests of brevity. (Seals-4 and related PPA's)

Applicant claims priority for this application to the above defined U.S. patent application Ser. No. 13/506,887, filed on May 22, 2012, which application claimed priority to the above six Provisional patent applications respectively identified as (A.), (B.), (C.), (D.), (E.), and (F.), and applicant also claims priority to those same six Provisional patent applications that are not repeated here again solely in the interests of brevity. (Seals-3 and related PPA's)

Applicant claims priority for this application to above defined U.S. patent application Ser. No. 13/068,133, filed on May 2, 2011, which application claimed priority to the above nineteen Provisional patent applications respectively identified as (1), (2), (3), . . . (17), (18) and (19), and applicant also claims priority to those same nineteen U.S. Provisional patent applications that are not repeated here again solely in the interests of brevity.

(Seals-2 & related PPA's)

Applicant also claims priority for this application to the above defined U.S. patent application Ser. No. 12/653,740, filed on Dec. 17, 2009, and also claims priority for this application to the above U.S. Provisional Patent Application No. 61/274,215, filed on Aug. 13, 2009.

(Seals-1 and one related PPA)

CROSS-REFERENCES TO RELATED U.S. PATENT APPLICATIONS

The present application is related to U.S. patent application Ser. No. 12/583,240, filed on Aug. 17, 2009, that is entitled "High Power Umbilicals for Subterranean Electric Drilling Machines and Remotely Operated Vehicles", an entire copy of which is incorporated herein by reference. Ser. No. 12/583,240 was published on Dec. 17, 2009 having Publication Number US 2009/0308656 A1, an entire copy of which is incorporated herein by reference.

The present application is related U.S. patent application Ser. No. 12/005,105, filed on Dec. 22, 2007, that is entitled "High Power Umbilicals for Electric Flowline Immersion Heating of Produced Hydrocarbons", an entire copy of which is incorporated herein by reference. Ser. No. 12/005,105 was published on Jun. 26, 2008 having Publication Number US 2008/0149343 A1, an entire copy of which is incorporated herein by reference.

The present application is related to U.S. patent application Ser. No. 10/800,443, filed on Mar. 14, 2004, that is entitled "Substantially Neutrally Buoyant and Positively Buoyant Electrically Heated Flowlines for Production of Subsea Hydrocarbons", an entire copy of which is incorporated herein by reference. Ser. No. 10/800,443 was published on Dec. 9, 2004 having Publication Number US 2004/0244982 A1, an entire copy of which is incorporated herein by reference. Ser. No. 10/800,443 issued as U.S. Pat. No. 7,311,151 B2 on Dec. 25, 2007.

The present application is related U.S. patent application Ser. No. 10/729,509, filed on Dec. 4, 2003, that is entitled "High Power Umbilicals for Electric Flowline Immersion Heating of Produced Hydrocarbons", an entire copy of which is incorporated herein by reference. Ser. No. 10/729,509 was published on Jul. 15, 2004 having the Publication Number US 2004/0134662 A1, an entire copy of which is incorporated herein by reference. Ser. No. 10/729,509 issued as U.S. Pat. No. 7,032,658 B2 on the date of Apr. 25, 2006, an entire copy of which is incorporated herein by reference.

The present application is related to U.S. patent application Ser. No. 10/223,025, filed Aug. 15, 2002, that is entitled "High Power Umbilicals for Subterranean Electric Drilling Machines and Remotely Operated Vehicles", an entire copy of which is incorporated herein by reference. Ser. No. 10/223,025 was published on Feb. 20, 2003, having Publication Number US 2003/0034177 A1, an entire copy of which is incorporated herein by reference. Ser. No. 10/223,025 issued as U.S. Pat. No. 6,857,486 B2 on the date of Feb. 22, 2005, an entire copy of which is incorporated herein by reference.

The present application is related to U.S. patent application Ser. No. 13/694,884, filed Jan. 15, 2013, that is entitled "Drilling Apparatus", an entire copy of which is incorporated herein by reference.

Applicant does not claim priority from the above six U.S. patent application Ser. Nos. 12/583,240, 12/005,105, 10/800,443, 10/729,509, 10/223,025, and 13/694,884.

OTHER RELATED U.S. APPLICATIONS

The following applications are related to this application, but applicant does not claim priority from the following related applications.

This application relates to Ser. No. 09/375,479, filed Aug. 16, 1999, having the title of "Smart Shuttles to Complete Oil and Gas Wells", that issued on Feb. 20, 2001, as U.S. Pat. No. 6,189,621 B1, an entire copy of which is incorporated herein by reference.

This application also relates to application Ser. No. 09/487,197, filed Jan. 19, 2000, having the title of "Closed-Loop System to Complete Oil and Gas Wells", that issued on Jun. 4, 2002 as U.S. Pat. No. 6,397,946 B1, an entire copy of which is incorporated herein by reference.

This application also relates to application Ser. No. 10/162,302, filed Jun. 4, 2002, having the title of "Closed-Loop Conveyance Systems for Well Servicing", that issued as U.S. Pat. No. 6,868,906 B1 on Mar. 22, 2005, an entire copy of which is incorporated herein by reference.

This application also relates to application Ser. No. 11/491,408, filed Jul. 22, 2006, having the title of "Methods and Apparatus to Convey Electrical Pumping Systems into Wellbores to Complete Oil and Gas Wells", that issued as U.S. Pat. No. 7,325,606 B1 on Feb. 5, 2008, an entire copy of which is incorporated herein by reference.

And this application also relates to application Ser. No. 12/012,822, filed Feb. 5, 2008, having the title of "Methods and Apparatus to Convey Electrical Pumping Systems into Wellbores to Complete Oil and Gas Wells", that was Published as US 2008/128128 A1 on Jun. 5, 2008, that issued as U.S. Pat. No. 7,836,950 B2 on Nov. 23, 2010, an entire copy of which is incorporated herein by reference.

RELATED FOREIGN APPLICATIONS

The following foreign applications are related to this application, but applicant does not claim priority from the following related foreign applications.

This application relates to PCT Application Serial Number PCT/US00/22095, filed Aug. 9, 2000, having the title of "Smart Shuttles to Complete Oil and Gas Wells", that has International Publication Number WO 01/12946 A1, that has International Publication Date of Feb. 22, 2001, that issued as European Patent No. 1,210,498 B1 on the date of Nov. 28, 2007, an entire copy of which is incorporated herein by reference.

This application also relates to Canadian Serial No. CA2000002382171, filed Aug. 9, 2000, having the title of "Smart Shuttles to Complete Oil and Gas Wells", that was published on Feb. 22, 2001, as CA 2382171 AA, that issued as Canadian Patent 2,382,171 on Apr. 6, 2010, an entire copy of which is incorporated herein by reference.

This application further relates to PCT Patent Application Number PCT/US02/26066 filed on Aug. 16, 2002, entitled "High Power Umbilicals for Subterranean Electric Drilling Machines and Remotely Operated Vehicles", that has the International Publication Number WO 03/016671 A2, that has International Publication Date of Feb. 27, 2003, that issued as European Patent No. 1,436,482 B1 on the date of Apr. 18, 2007, an entire copy of which is incorporated herein by reference.

This application further relates to Norway Patent Application No. 2004 0771 filed on Aug. 16, 2002, having the title of "High Power Umbilicals for Subterranean Electric Drilling Machines and Remotely Operated Vehicles", that issued as Norway Patent No. 326,447 that issued on Dec. 8, 2008, an entire copy of which is incorporated herein by reference. This application further relates to PCT Patent Application Number PCT/US2011/035496, filed on May 6, 2011, having the title of "Universal Drilling and Completion System", that has the International Publication Number WO 2011/140426 A1, that has the International Publication Date of Nov. 10, 2011, an entire copy of which is incorporated herein by reference.

This application further relates to PCT Patent Application Number PCT/US2012/039172, filed on May 23, 2012, having the title of "Mud Motor Assembly", that has the International Publication Number WO 2012/162408 A1, that has the International Publication Date of Nov. 29, 2012, an entire copy of which is incorporated herein by reference.

This application further relates to Canadian Patent Application Number 2,837,082, filed on May 23, 2012, having the title of "Mud Motor Assembly", an entire copy of which is incorporated herein by reference.

CROSS-REFERENCES TO RELATED U.S. PROVISIONAL PATENT APPLICATIONS

This application relates to Provisional Patent Application No. 60/313,654 filed on Aug. 19, 2001, that is entitled "Smart Shuttle Systems", an entire copy of which is incorporated herein by reference.

This application also relates to Provisional Patent Application No. 60/353,457 filed on Jan. 31, 2002, that is entitled "Additional Smart Shuttle Systems", an entire copy of which is incorporated herein by reference.

This application further relates to Provisional Patent Application No. 60/367,638 filed on Mar. 26, 2002, that is entitled "Smart Shuttle Systems and Drilling Systems", an entire copy of which is incorporated herein by reference.

And yet further, this application also relates the Provisional Patent Application No. 60/384,964 filed on Jun. 3, 2002, that is entitled "Umbilicals for Well Conveyance Systems and Additional Smart Shuttles and Related Drilling Systems", an entire copy of which is incorporated herein by reference.

This application also relates to Provisional Patent Application No. 60/432,045, filed on Dec. 8, 2002, that is entitled "Pump Down Cement Float Valves for Casing Drilling, Pump Down Electrical Umbilicals, and Subterranean Electric Drilling Systems", an entire copy of which is incorporated herein by reference.

And yet further, this application also relates to Provisional Patent Application No. 60/448,191, filed on Feb. 18, 2003, that is entitled "Long Immersion Heater Systems", an entire copy of which is incorporated herein by reference.

Ser. No. 10/223,025 claimed priority from the above Provisional Patent Application No. 60/313,654, No. 60/353,457, No. 60/367,638 and No. 60/384,964.

Ser. No. 10/729,509 claimed priority from various Provisional patent applications, including Provisional Patent Application No. 60/432,045, and 60/448,191.

The present application also relates to Provisional Patent Application No. 60/455,657, filed on Mar. 18, 2003, that is entitled "Four SDCI Application Notes Concerning Subsea Umbilicals and Construction Systems", an entire copy of which is incorporated herein by reference.

The present application further relates to Provisional Patent Application No. 60/504,359, filed on Sep. 20, 2003, that is entitled "Additional Disclosure on Long Immersion Heater Systems", an entire copy of which is incorporated herein by reference.

The present application also relates to Provisional Patent Application No. 60/523,894, filed on Nov. 20, 2003, that is entitled "More Disclosure on Long Immersion Heater Systems", an entire copy of which is incorporated herein by reference.

The present application further relates to Provisional Patent Application No. 60/532,023, filed on Dec. 22, 2003, that is entitled "Neutrally Buoyant Flowlines for Subsea Oil and Gas Production", an entire copy of which is incorporated herein by reference.

And yet further, the present application relates to Provisional Patent Application No. 60/535,395, filed on Jan. 10, 2004, that is entitled "Additional Disclosure on Smart Shuttles and Subterranean Electric Drilling Machines", an entire copy of which is incorporated herein by reference.

Ser. No. 10/800,443 claimed priority from U.S. Provisional Patent Applications No. 60/455,657, No. 60/504,359, No. 60/523,894, No. 60/532,023, and No. 60/535,395.

Further, the present application relates to Provisional Patent Application No. 60/661,972, filed on Mar. 14, 2005, that is entitled "Electrically Heated Pumping Systems Disposed in Cased Wells, in Risers, and in Flowlines for Immersion Heating of Produced Hydrocarbons", an entire copy of which is incorporated herein by reference.

Yet further, the present application relates to Provisional Patent Application No. 60/665,689, filed on Mar. 28, 2005, that is entitled "Automated Monitoring and Control of Electrically Heated Pumping Systems Disposed in Cased Wells, in Risers, and in Flowlines for Immersion Heating of Produced Hydrocarbons", an entire copy of which is incorporated herein by reference.

Further, the present application relates to Provisional Patent Application No. 60/669,940, filed on Apr. 9, 2005, that is entitled "Methods and Apparatus to Enhance Performance of Smart Shuttles and Well Locomotives", an entire copy of which is incorporated herein by reference.

And further, the present application relates to Provisional Patent Application No. 60/761,183, filed on Jan. 23, 2006, that is entitled "Methods and Apparatus to Pump Wirelines into Cased Wells Which Cause No Reverse Flow", an entire copy of which is incorporated herein by reference.

And yet further, the present application relates to Provisional Patent Application No. 60/794,647, filed on Apr. 24, 2006, that is entitled "Downhole DC to AC Converters to Power Downhole AC Electric Motors and Other Methods to Send Power Downhole", an entire copy of which is incorporated herein by reference.

Still further, the present application relates to Provisional Patent Application No. 61/189,253, filed on Aug. 15, 2008, that is entitled "Optimized Power Control of Downhole AC and DC Electric Motors and Distributed Subsea Power Consumption Devices", an entire copy of which is incorporated herein by reference.

And further, the present application relates to Provisional Patent Application No. 61/190,472, filed on Aug. 28, 2008, that is entitled "High Power Umbilicals for Subterranean Electric Drilling Machines and Remotely Operated Vehicles", an entire copy of which is incorporated herein by reference.

And finally, the present application relates to Provisional Patent Application No. 61/192,802, filed on Sep. 22, 2008, that is entitled "Seals for Smart Shuttles", an entire copy of which is incorporated herein by reference.

Ser. No. 12/583,240 claimed priority from Provisional Patent Application Ser. No. 61/189,253, No. 61/190,472, No. 61/192,802, No. 61/270,709, and No. 61/274,215.

Entire copies of Provisional patent applications are incorporated herein by reference, unless unintentional errors have been found and specifically identified. Several such unintentional errors are herein noted. Provisional Patent Application Ser. No. 61/189,253 was erroneously referenced as Ser. No. 60/189,253 within Provisional Patent Application Ser. No. 61/270,709 and within Provisional Patent Application No. 61/274,215 mailed to the USPTO on Aug. 13, 2009, and these changes are noted here, and are incorporated by herein by reference. Entire copies of the cited Provisional patent applications are incorporated herein by reference unless they present information which directly conflicts with any explicit statements in the application herein.

RELATED U.S. DISCLOSURE DOCUMENTS

This application further relates to disclosure in U.S. Disclosure Document No. 451,044, filed on Feb. 8, 1999, that is entitled 'RE:—Invention Disclosure—"Drill Bit Having Monitors and Controlled Actuators"', an entire copy of which is incorporated herein by reference.

This application further relates to disclosure in U.S. Disclosure Document No. 458,978 filed on Jul. 13, 1999 that is entitled in part "RE:—INVENTION DISCLOSURE MAILED Jul. 13, 1999", an entire copy of which is incorporated herein by reference.

This application further relates to disclosure in U.S. Disclosure Document No. 475,681 filed on Jun. 17, 2000 that is entitled in part "ROV Conveyed Smart Shuttle System Deployed by Workover Ship for Subsea Well Completion and Subsea Well Servicing", an entire copy of which is incorporated herein by reference.

This application further relates to disclosure in U.S. Disclosure Document No. 496,050 filed on Jun. 25, 2001 that is entitled in part "SDCI Drilling and Completion Patents and Technology and SDCI Subsea Re-Entry Patents and Technology", an entire copy of which is incorporated herein by reference.

This application further relates to disclosure in U.S. Disclosure Document No. 480,550 filed on Oct. 2, 2000 that is entitled in part "New Draft Figures for New Patent Applications", an entire copy of which is incorporated herein by reference.

This application further relates to disclosure in U.S. Disclosure Document No. 493,141 filed on May 2, 2001 that is entitled in part "Casing Boring Machine with Rotating Casing to Prevent Sticking Using a Rotary Rig", an entire copy of which is incorporated herein by reference.

This application further relates to disclosure in U.S. Disclosure Document No. 492,112 filed on Apr. 12, 2001 that is entitled in part "Smart Shuttle™. Conveyed Drilling Systems", an entire copy of which is incorporated herein by reference.

This application further relates to disclosure in U.S. Disclosure Document No. 495,112 filed on Jun. 11, 2001 that is entitled in part "Liner/Drainhole Drilling Machine", an entire copy of which is incorporated herein by reference.

This application further relates to disclosure in U.S. Disclosure Document No. 494,374 filed on May 26, 2001 that is entitled in part "Continuous Casting Boring Machine", an entire copy of which is incorporated herein by reference.

This application further relates to disclosure in U.S. Disclosure Document No. 495,111 filed on Jun. 11, 2001 that is entitled in part "Synchronous Motor Injector System", an entire copy of which is incorporated herein by reference.

And yet further, this application also relates to disclosure in U.S. Disclosure Document No. 497,719 filed on Jul. 27, 2001 that is entitled in part "Many Uses for The Smart Shuttle™ and Well Locomotive™", an entire copy of which is incorporated herein by reference.

This application further relates to disclosure in U.S. Disclosure Document No. 498,720 filed on Aug. 17, 2001 that is entitled in part "Electric Motor Powered Rock Drill Bit Having Inner and Outer Counter-Rotating Cutters and Having Expandable/Retractable Outer Cutters to Drill Boreholes into Geological Formations", an entire copy of which is incorporated herein by reference.

Still further, this application also relates to disclosure in U.S. Disclosure Document No. 499,136 filed on Aug. 26, 2001, that is entitled in part 'Commercial System Specification PCP-ESP Power Section for Cased Hole Internal Conveyance "Large Well Locomotive™"', an entire copy of which is incorporated herein by reference.

And yet further, this application also relates to disclosure in U.S. Disclosure Document No. 516,982 filed on Aug. 20, 2002, that is entitled "Feedback Control of RPM and Voltage of Surface Supply", an entire copy of which is incorporated herein by reference.

And further, this application also relates to disclosure in U.S. Disclosure Document No. 531,687 filed May 18, 2003, that is entitled "Specific Embodiments of Several SDCI Inventions", an entire copy of which is incorporated herein by reference.

Further, the present application relates to U.S. Disclosure Document No. 572,723, filed on Mar. 14, 2005, that is entitled "Electrically Heated Pumping Systems Disposed in Cased Wells, in Risers, and in Flowlines for Immersion Heating of Produced Hydrocarbons", an entire copy of which is incorporated herein by reference.

Yet further, the present application relates to U.S. Disclosure Document No. 573,813, filed on Mar. 28, 2005, that is entitled "Automated Monitoring and Control of Electrically Heated Pumping Systems Disposed in Cased Wells, in Risers, and in Flowlines for Immersion Heating of Produced Hydrocarbons", an entire copy of which is incorporated herein by reference.

Further, the present application relates to U.S. Disclosure Document No. 574,647, filed on Apr. 9, 2005, that is entitled "Methods and Apparatus to Enhance Performance of Smart Shuttles and Well Locomotives", an entire copy of which is incorporated herein by reference.

Yet further, the present application relates to U.S. Disclosure Document No. 593,724, filed Jan. 23, 2006, that is entitled "Methods and Apparatus to Pump Wirelines into Cased Wells Which Cause No Reverse Flow", an entire copy of which is incorporated herein by reference.

Further, the present application relates to U.S. Disclosure Document No. 595,322, filed Feb. 14, 2006, that is entitled "Additional Methods and Apparatus to Pump Wirelines into Cased Wells Which Cause No Reverse Flow", an entire copy of which is incorporated herein by reference.

And further, the present application relates to U.S. Disclosure Document No. 599,602, filed on Apr. 24, 2006, that is entitled "Downhole DC to AC Converters to Power Downhole AC Electric Motors and Other Methods to Send Power Downhole", an entire copy of which is incorporated herein by reference.

And finally, the present application relates to the U.S. Disclosure Document that is entitled "Seals for Smart Shuttles" that was mailed to the USPTO on the Date of Dec. 22, 2006 by U.S. Mail, Express Mail Service having Express Mail Number EO 928 739 065 US, an entire copy of which is incorporated herein by reference.

Various references are referred to in the above defined U.S. Disclosure Documents. For the purposes herein, the term "reference cited in applicant's U.S. Disclosure Documents" shall mean those particular references that have been explicitly listed and/or defined in any of applicant's above listed U.S. Disclosure Documents and/or in the attachments filed with those U.S. Disclosure Documents. Applicant explicitly includes herein by reference entire copies of each and every "reference cited in applicant's U.S. Disclosure Documents".

To best knowledge of applicant, all copies of U.S. patents that were ordered from commercial sources that were specified in the U.S. Disclosure Documents are in the possession of applicant at the time of the filing of the application herein.

RELATED U.S. TRADEMARKS

Applications for U.S. Trademarks have been filed in the USPTO for several terms used in this application. An application for the Trademark "Smart Shuttle" was filed on Feb. 14, 2001 that is Ser. No. 76/213,676, an entire copy of which is incorporated herein by reference. The term Smart Shuttle® is now a Registered Trademark. The "Smart Shuttle™" is also called the "Well Locomotive". An application for the Trademark "Well Locomotive" was filed on Feb. 20, 2001 that is Ser. No. 76/218,211, an entire copy of which is incorporated herein by reference. The term Well Locomotive® is now a registered Trademark. An application for the Trademark of "Downhole Rig" was filed on Jun. 11, 2001 that is Ser. No. 76/274,726, an entire copy of which is incorporated herein by reference. An application for the Trademark "Universal Completion Device" was filed on Jul. 24, 2001 that is Ser. No. 76/293,175, an entire copy of which is incorporated herein by reference. An application for the Trademark "Downhole BOP" was filed on Aug. 17, 2001 that is Ser. No. 76/305,201, an entire copy of which is incorporated herein by reference.

Accordingly, in view of the Trademark Applications, the term "smart shuttle" will be capitalized as "Smart Shuttle"; the term "well locomotive" will be capitalized as "Well Locomotive"; the term "downhole rig" will be capitalized as "Downhole Rig"; the term "universal completion device" will be capitalized as "Universal Completion Device"; and the term "downhole bop" will be capitalized as "Downhole BOP".

Other U.S. Trademarks related to the invention disclosed herein include the following: "Subterranean Electric Drilling Machine", or "SEDM™"; "Electric Drilling Machine™", or "EDM™"; "Electric Liner Drilling Machine™", or "ELDM™"; "Continuous Casing Casting Machine™", or "CCCM™"; "Liner/Drainhole Drilling Machine™", or "LDDM™"; "Drill and Drag Casing Boring Machine™", or "DDCBM™"; "Next Step Drilling Machine™", or "NSDM™"; "Next Step Electric Drilling Machine™", or "NSEDM™"; "Next Step Subterranean Electric Drilling Machine™", or "NSSEDM™"; and "Subterranean Liner Expansion Tool™", or "SLET™"

Other additional Trademarks related to the invention disclosed herein are the following: "Electrically Heated Composite Umbilical™", or "EHCU™"; "Electric Flowline Immersion Heater Assembly™", or "EFIHA™"; and "Pump-Down Conveyed Flowline Immersion Heater Assembly™", or "PDCFIHA™".

Yet other additional Trademarks related to the invention disclosed herein are the following: "Adaptive Electronics Control System™", or "AECS™"; "Subsea Adaptive Electronics Control System™", or "SAECS™"; "Adaptive Power Control System™", or "APCS™"; and "Subsea Adaptive Power Control System™", or "SAPCS™".

The Universal Drilling and Completion System™ is comprised of the Universal Drilling Machine™ and the Universal Completion Machine™.

UDCS™ is the trademarked abbreviation for the Universal Drilling and Completion System. UDM™ is the trademarked abbreviation for the Universal Drilling Machine™. UCM™ is the trademarked abbreviation for the Universal Completion Machine™. The Leaky Seal™, The Force Sub™ and The Torque Sub™ are used in various embodiments of these systems and machines.

The Mud Motor Apparatus described herein is now called The Mark IV Mud Motor™ and The Steel Mud Motor™ for commercial purposes. Appropriate applications have been filed for various trademarks in the USPTO.

BACKGROUND OF THE INVENTION

1. Field of the Invention

The general field of the invention relates to the drilling and completion of wellbores in geological formations, primarily in the oil and gas industries.

Commercially available progressing cavity mud motors are used in many drilling applications. The particular field of the invention relates to a new type of long-lasting mud motor that is not based upon the typical progressing cavity design, but may be used in many similar or analogous applications.

2. Description of the Related Art

Typical rotary drilling systems may be used to drill oil and gas wells. Here, a surface rig rotates the drill pipe attached to the rotary drill bit at depth. Mud pressure down the drill pipe circulates through the bit and carries chips to the surface via annular mud flow.

Alternatively, a mud motor may be placed at the end of a drill pipe, which uses the power from the mud flowing downhole to rotate a drill bit. Mud pressure still carries chips to the surface, often via annular mud flow.

Typical mud motors as presently used by the oil and gas industry are based upon a progressing cavity design, typically having a rubber type stator and a steel rotor. These are positive displacement devices that are hydraulically efficient at converting the power available from the mud flow into rotational energy of the drill bit. These devices convert that energy by having an intrinsically asymmetric rotor within the stator cavity—so that following pressurization with mud, a torque develops making the rotor spin. These devices also generally have tight tolerance requirements.

In practice, mud motors tend to wear out relatively rapidly, requiring replacement that involves tripping the drill string to replace the mud motor. Tripping to replace a mud motor is a very expensive process. In addition, there are problems using these mud motors at higher temperatures. It is probably fair to say, that if the existing mud motors were much more long-lasting, that these would be used much more frequently in the industry. This is so in part because the rotary steering type directional drilling controls function well with mud motors, providing relatively short radii of curvature as compared to standard rotary drilling long with drill pipes. Mud motors also work well with industry-standard LWD/MWD data acquisition systems.

As an alternative to using mud motors, there are turbine drilling systems available today. These are not positive displacement type motors. They work at relatively high RPM to achieve hydraulic efficiency, often require a gear box to reduce the rotational speed of any attached rotary drill bit, are expensive to manufacture, and are relatively fragile devices having multiple turbine blades within their interiors.

So, until now, there are two widely used basic alternatives—rotary drilling and the use of mud motors. The mud motors "almost work well enough" to satisfy many industry requirements. However, looking at the progressing cavity design a little more closely also reveals that the rotor must be asymmetric in its stator to develop torque. In general, positive displacement motors suffer from this disadvantage—they are generally not cylindrically symmetric about a rotational axis. This in turn results in requiring that the output of a shaft of the mud motor couple to a "wiggle rod" to decouple the unwanted motion from the rotary drill bit. Such eccentric motion results in unwanted vibrations in adjacent equipment—such as in directional drilling systems.

SUMMARY OF THE INVENTION

An object of the invention is to provide a long-lasting mud motor assembly that may be used in applications where progressing cavity mud motors are presently used.

Another object of the invention is to provide a long-lasting mud motor assembly that continues to function even when its internal parts undergo significant wear.

Another object of the invention is to provide a long-lasting mud motor assembly that is primarily made from all-metal parts.

Another object of the invention is to provide a long-lasting mud motor assembly having internal parts that have relatively loose tolerances that are therefore relatively inexpensive to manufacture.

Another object of the invention is to provide a long-lasting mud motor assembly that is primarily made from all-metal, relatively loosely fitting parts that operates at temperatures much higher than the operational temperatures of typical progressing cavity type mud motors.

Another object of the invention is to provide a long-lasting mud motor assembly having loosely fitting internal parts that allows relatively small amounts of pressurized mud to leak through these loosely fitting internal parts.

Another object of the invention is to provide a long-lasting mud motor assembly having at least one loosely fitting internal piston within a cylindrical housing that forms a leaky seal that allows a predetermined mud flow through the leaky seal during operation.

Another object of the invention is to provide a long-lasting mud motor assembly that produces more power per unit length than standard progressing cavity mud motors.

Yet another object of the invention is to provide a mud motor assembly having a drive shaft that rotates concentrically about an axis of rotation.

Another object of the invention is to provide a mud motor assembly that does not require a wiggle rod to compensate for eccentric motion of internal parts.

In one embodiment, a mud motor apparatus (12) is provided possessing one single drive shaft (20) that turns a rotary drill bit (70), which apparatus is attached to a drill pipe (486) that is a source of high pressure mud (14) to said apparatus, wherein said drive shaft (20) receives at least a first portion (494) of its rotational torque from any high pressure mud (492) flowing through a first hydraulic chamber (84) within said apparatus, and said drive shaft (20) receives at least a second portion (498) of its rotational torque from any high pressure mud (496) flowing through a second hydraulic chamber (98) within said apparatus.

In a second embodiment, a method is provided to provide torque and power to a rotary drill bit (70) rotating clockwise attached to a drive shaft (20) of a mud motor assembly (12) comprising at least the following steps:

a. providing relatively high pressure mud (14) from a drill pipe (486) attached to an uphole end of said mud motor assembly (484);
b. passing at least a first portion (492) of said relatively high pressure mud through a first hydraulic chamber (84) having a first piston (24) that rotates a first crankshaft (22) clockwise about its own rotation axis from its first relative starting position at 0 degrees through a first angle of at least 210 degrees, but less than 360 degrees during its first power stroke (FIGS. 9, 9A, 9B, 9C, 9D, 9E, 9F, and 9G);
c. mechanically coupling said first crankshaft (22) by a first ratchet means (30) to a first portion (44) of said drive shaft (20) to provide clockwise rotational power to said drive shaft during said first power stroke (FIGS. 9, 9A, 9B, 9C, 9D, 9E, 9F, and 9G);
d. passing at least a second portion (496) of said relatively high pressure mud through a second hydraulic chamber (98) having a second piston (28) that rotates a second crankshaft (26) clockwise about its own rotation axis from its first relative starting position of 0 degrees through a second angle of at least 210 degrees, but less than 360 degrees during its second power stroke (502);
e. mechanically coupling said second crankshaft (26) by a second ratchet means (48) to a second portion (62) of said drive shaft (20) to provide clockwise rotational power to said drive shaft during said second power stroke 502; and
f. providing first control means (46) of said first ratchet means (30), and providing second control means (64) of said second ratchet means (48), to control the relative timing of rotations of said first crankshaft and said second crankshaft (FIGS. 20, 21A, and 21 B) so that at the particular time that said first crankshaft (22) has rotated from its first relative starting position through 180 degrees nearing the end of its first power stroke at 210 degrees, said second crankshaft begins its rotational motion from its relative starting position of 0 degrees were it begins its second power stroke 502.

In a third embodiment, said first ratchet means (30) is comprised of a first pawl (40) that is flexibly attached by a first torsion rod spring (350) and second torsion rod spring (352) to said first crankshaft (22), and first pawl latch (44) that is an integral portion of the drive shaft (20).

In a fourth embodiment, said second ratchet means (48) is comprised of a second pawl (58) that is flexibly attached by third torsion rod spring (504) and fourth torsion rod spring (506) to said second crankshaft (26), and second pawl latch (62) that is an integral portion of the drive shaft (20).

In a fifth embodiment, said first control means is comprised of a first pawl lifter means (46) that is an integral portion of the drive shaft (20) that lifts said first pawl (40) in a first fixed relation to said drive shaft (20).

In a sixth embodiment, said second control means is comprised of a second pawl lifter (64) means that is an integral portion of the drive shaft (20) that lifts said second pawl (58) in a second fixed relation to said drive shaft.

In a seventh embodiment, following the clockwise rotation of the said first crankshaft (22) about its rotational axis through an angle of at least 210 degrees during its first power stroke (FIGS. 9, 9A, 9B, 9C, 9D, 9E, 9F, and 9G), said first pawl lifter means (46) disengages said first pawl (40) from said first pawl latch (44), so that first torsion spring (78) returns first crankshaft (22) in a counter-clockwise rotation to its initial starting position completing a first power stroke and first return cycle for said first crankshaft (22) while said drive shaft (20) continues to rotate clockwise unimpeded by the return motion of said first crankshaft (FIG. 9J and FIG. 16B).

In an eighth embodiment, following the clockwise rotation of the said second crankshaft (26) about its rotational axis through an angle of at least 210 degrees during its second power stroke (502), said second pawl lifter means (64) disengages said second pawl (58) from said second pawl latch (62), so that second torsion spring (92) returns second crankshaft (26) in a counter-clockwise rotation to its initial starting position completing a second power stroke and second return cycle for the second crankshaft (26) while said drive shaft (20) continues to rotate clockwise unimpeded by the return motion of said second crankshaft (508 and 510).

In a ninth embodiment, the first torsional energy stored in said first torsion return spring (78) at the end of said first power stroke is obtained by said first crankshaft (22) twisting said first torsion return spring (78) during said first power stroke (FIGS. 9, 9A, 9B, 9C, 9D, 9E, 9F, and 9G).

In a tenth embodiment, the second torsional energy stored in said second torsion return spring (92) at the end of said second power stroke is obtained by said second crankshaft 26 twisting said second torsion return spring (92) during said second power stroke (502).

In an eleventh embodiment, said first power stroke and said second power stroke are repetitiously repeated so that torque and power is provided to said clockwise rotating drive shaft (20) attached to said drill bit (70), whereby said clockwise rotation is that rotation observed looking downhole toward the top of the rotary drill bit.

BRIEF DESCRIPTION OF THE DRAWINGS

FIG. 21B shows the relationship between the maximum lift of the tip of the Pawl A Lifter Lobe 394 and the pressure applied to the Drive Port of Chamber A ("DPCHA").

FIG. 22 shows a side view of one embodiment of the New 4 Piston Mud Motor ("N4PMM").

FIG. 23 shows a section view of one embodiment of a typical Power Section 2.

This concludes the Brief Description of the Drawings. In all, there are 121 Figures, but with two Figures on one page in the case of FIGS. 7B and 7C, there are 120 Sheets of Drawings.

DESCRIPTION OF THE PREFERRED EMBODIMENTS

Figure 1:
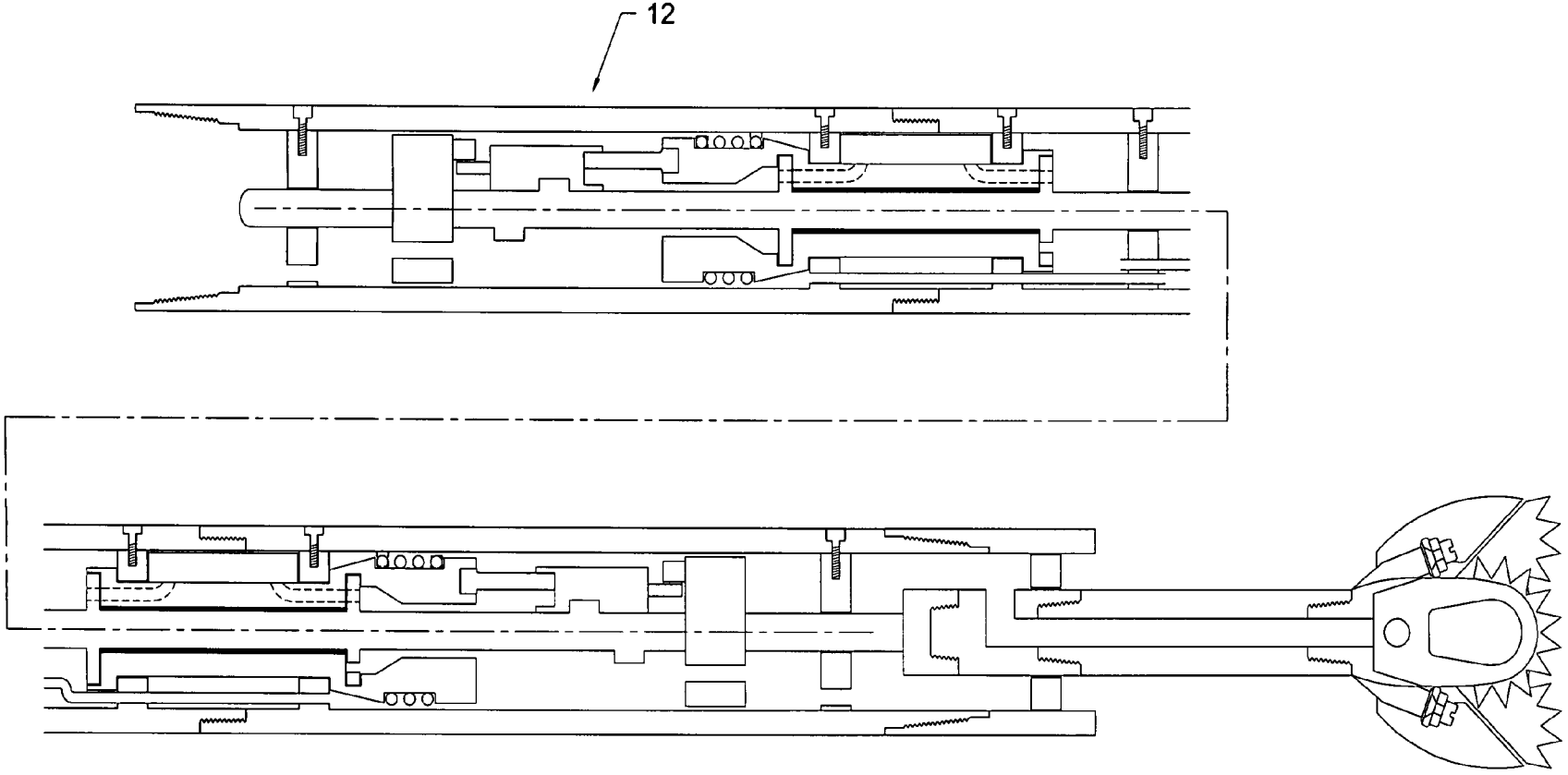
FIG. 1 shows a side view of the Mud Motor Assembly 12.

FIG. 1 shows a side view of the Mud Motor Assembly 12.

High and Low Pressure Mud Flow

Figure 2:
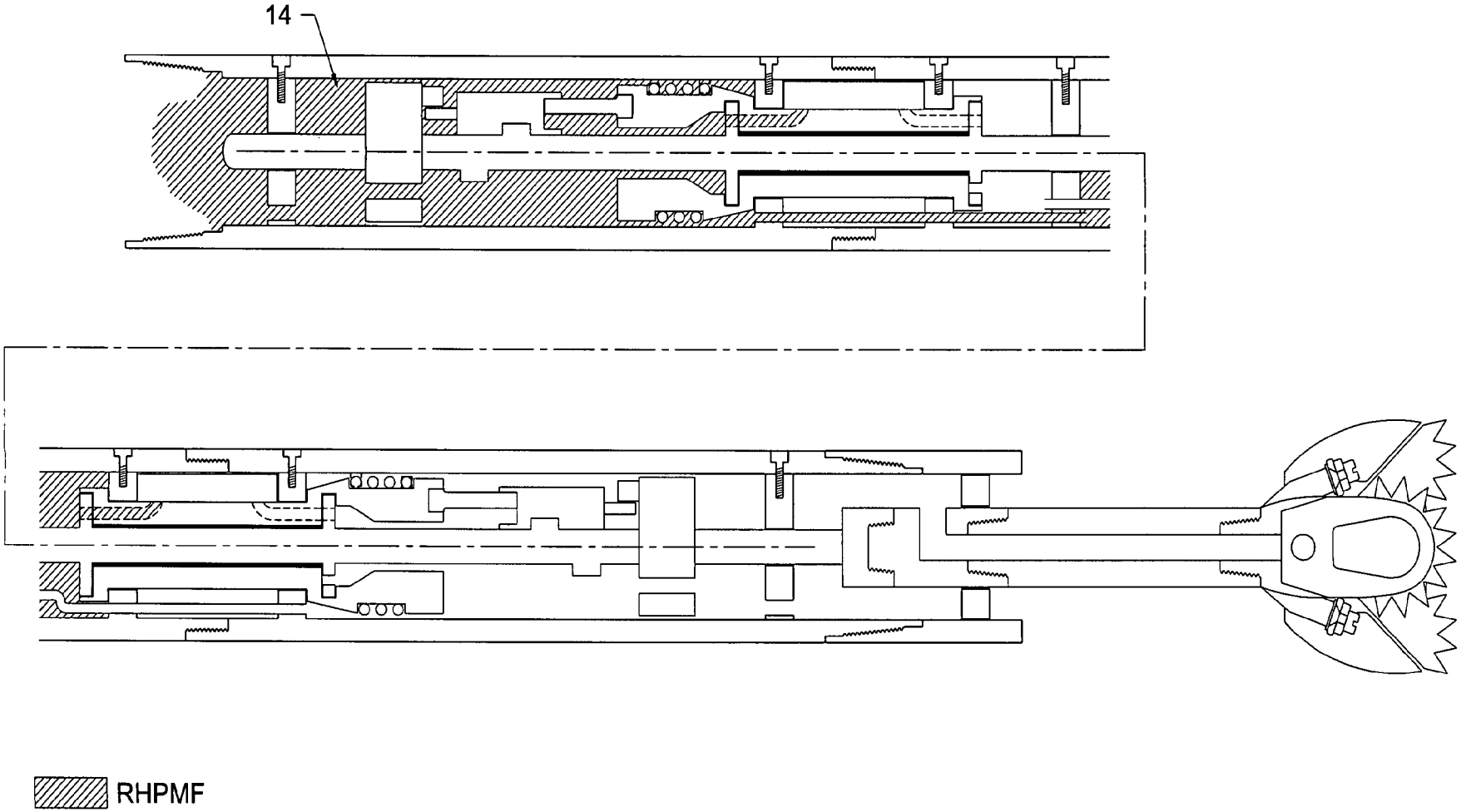
FIG. 2 shows regions within the Mud Motor Assembly having Relatively High Pressure Mud Flow (RHPMF) 14. Special shadings are used in FIGS. 2 and 2A as discussed in the specification.

FIG. 2 shows regions within the Mud Motor Assembly having Relatively High Pressure Mud Flow (RHPMF) 14 designated by the unique shading used only for this purpose defined on the face of FIG. 2.

Figure 2A:
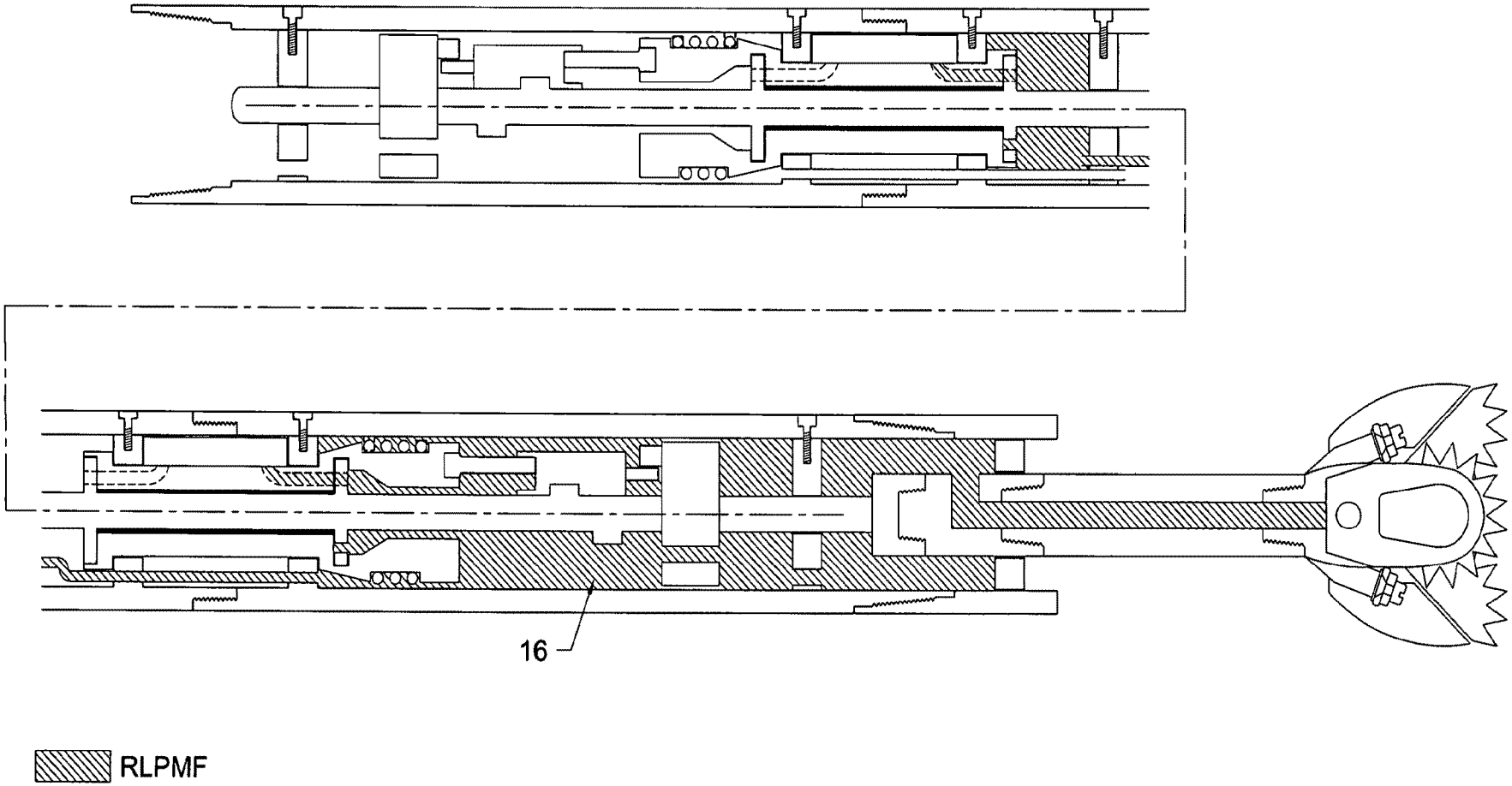
FIG. 2A shows regions within the Mud Motor Assembly having Relatively Low Pressure Mud Flow (RLPMF) 16.

FIG. 2A shows regions within the Mud Motor Assembly having Relatively Low Pressure Mud Flow (RLPMF) 16 designated by the unique shading used only for this purpose defined on the face of FIG. 2A.

Cross-Hatch Shading of Individual Components of Mud Motor Assembly (Forty Three Figures)

Note: There are not a sufficient number of unique shadings for drawing components which can be used to identify individual components of the Mud Motor Assembly and which satisfy the drawing rules at the USPTO. Consequently, in this series of figures, the same identical double cross-hatching is used in each figure to identify a specific component on any one figure, but the same looking double cross-hatching shading is used in all the different figures in this series of figures for component labeling purposes. On any one figure, there is only one component identified with double cross-hatching, but the meaning of that double cross-hatching is unique and applies solely and only to that one figure. In general, the meaning of the double cross-hatching is defined by a relevant box on the face of the figure having an appropriate legend.

Figure 3:
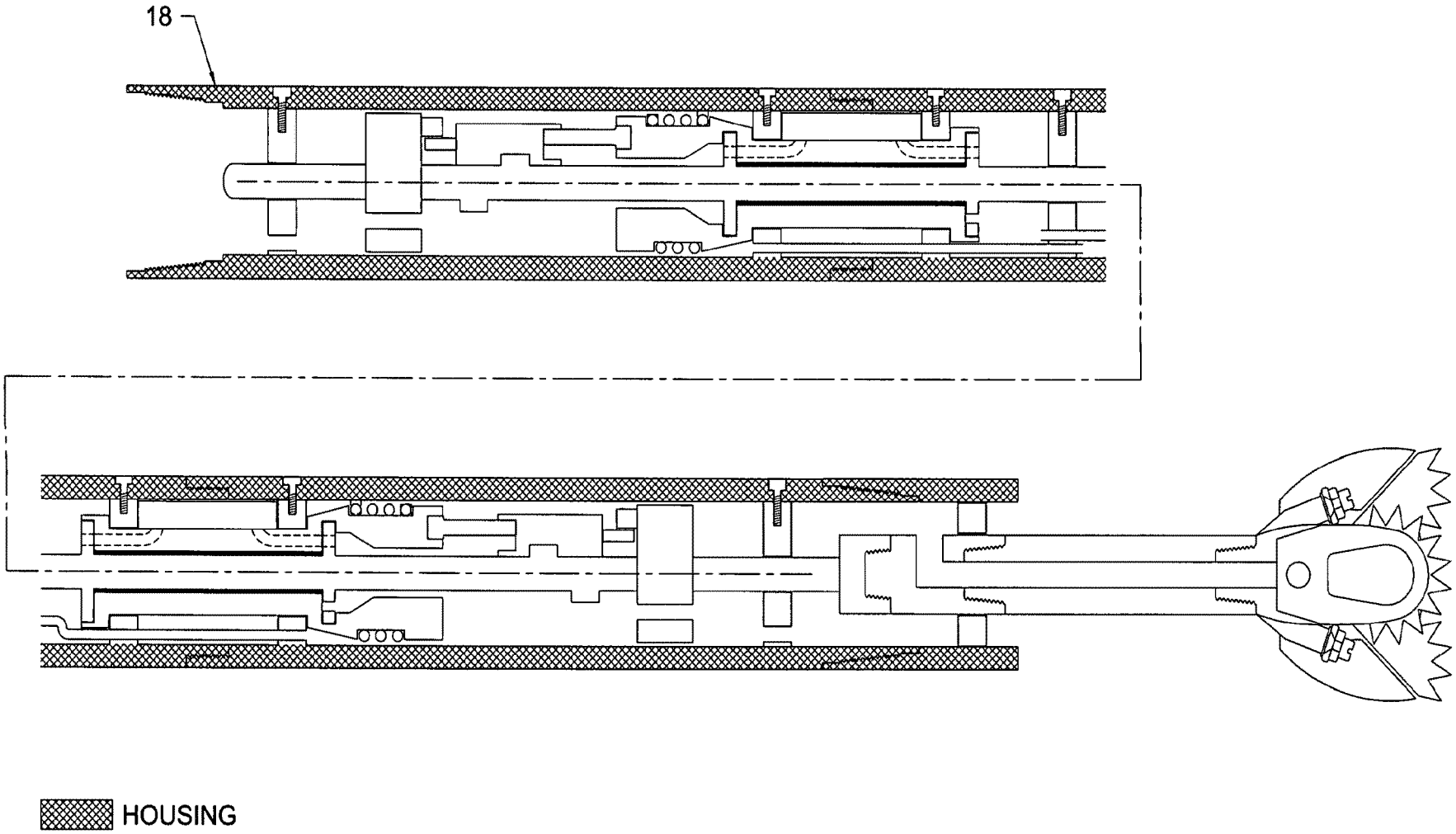
FIG. 3 shows the Housing 18 of the Mud Motor Assembly. Special shadings are used for the series of FIGS. 3, 4 and 5 drawings as discussed in the specification.

FIG. 3 shows the Housing 18 of the Mud Motor Assembly.

Figure 3A:
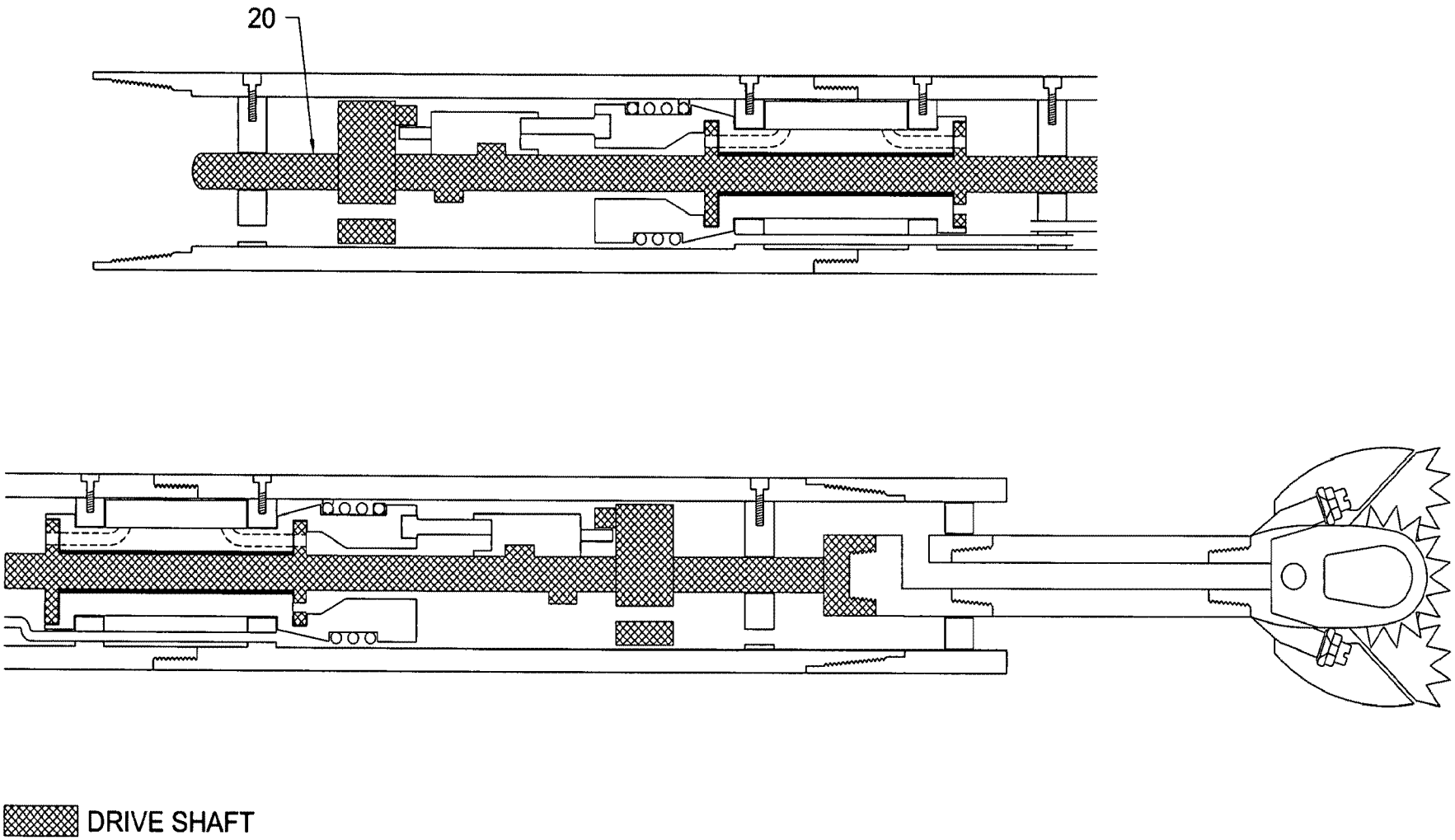
FIG. 3A shows the Drive Shaft 20 of the Mud Motor Assembly.

FIG. 3A shows the Drive Shaft 20 of the Mud Motor Assembly.

Figure 3B:
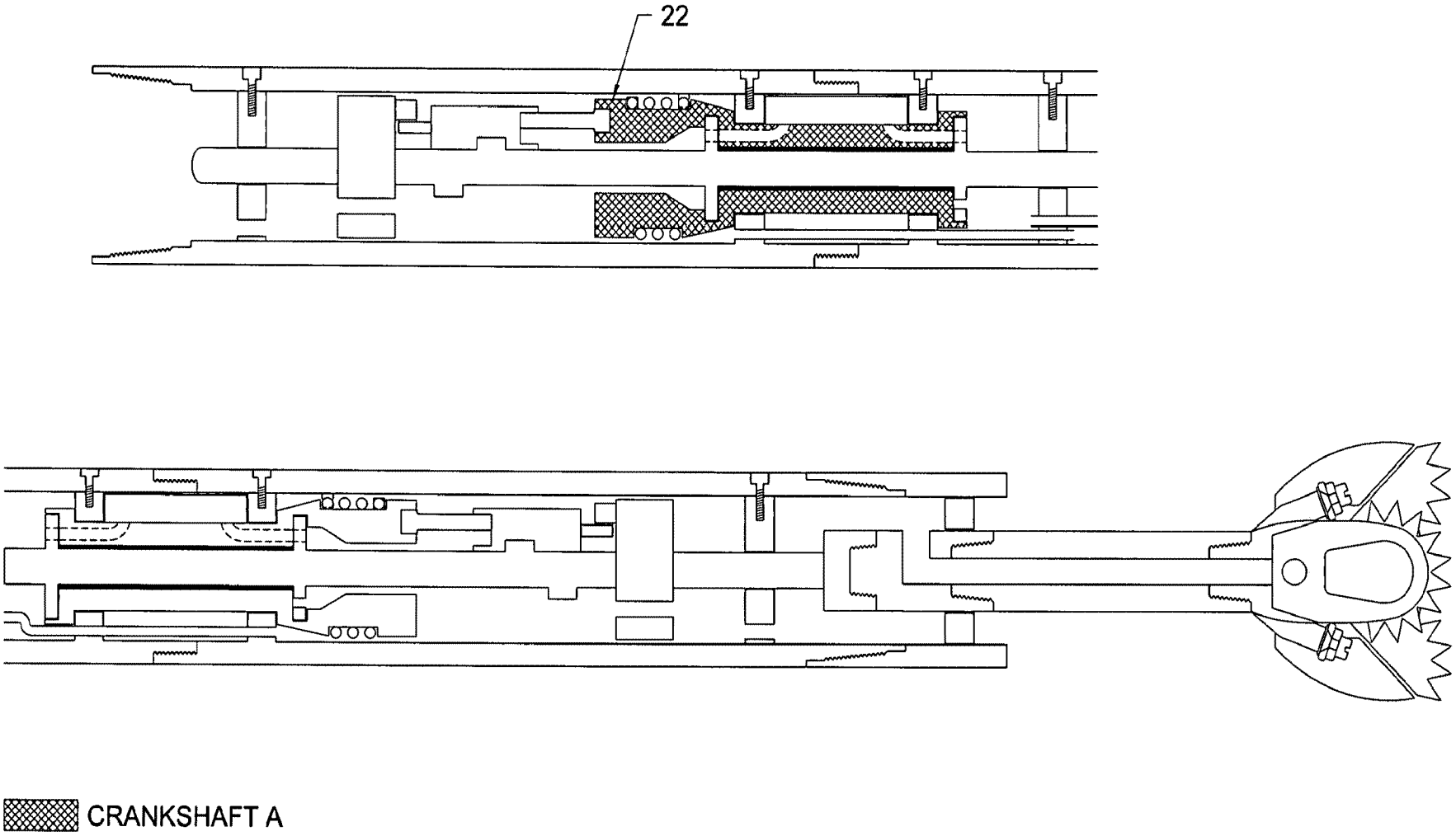
FIG. 3B shows Crankshaft A 22 of the Mud Motor Assembly.

FIG. 3B shows Crankshaft A 22 of the Mud Motor Assembly.

Figure 3C:
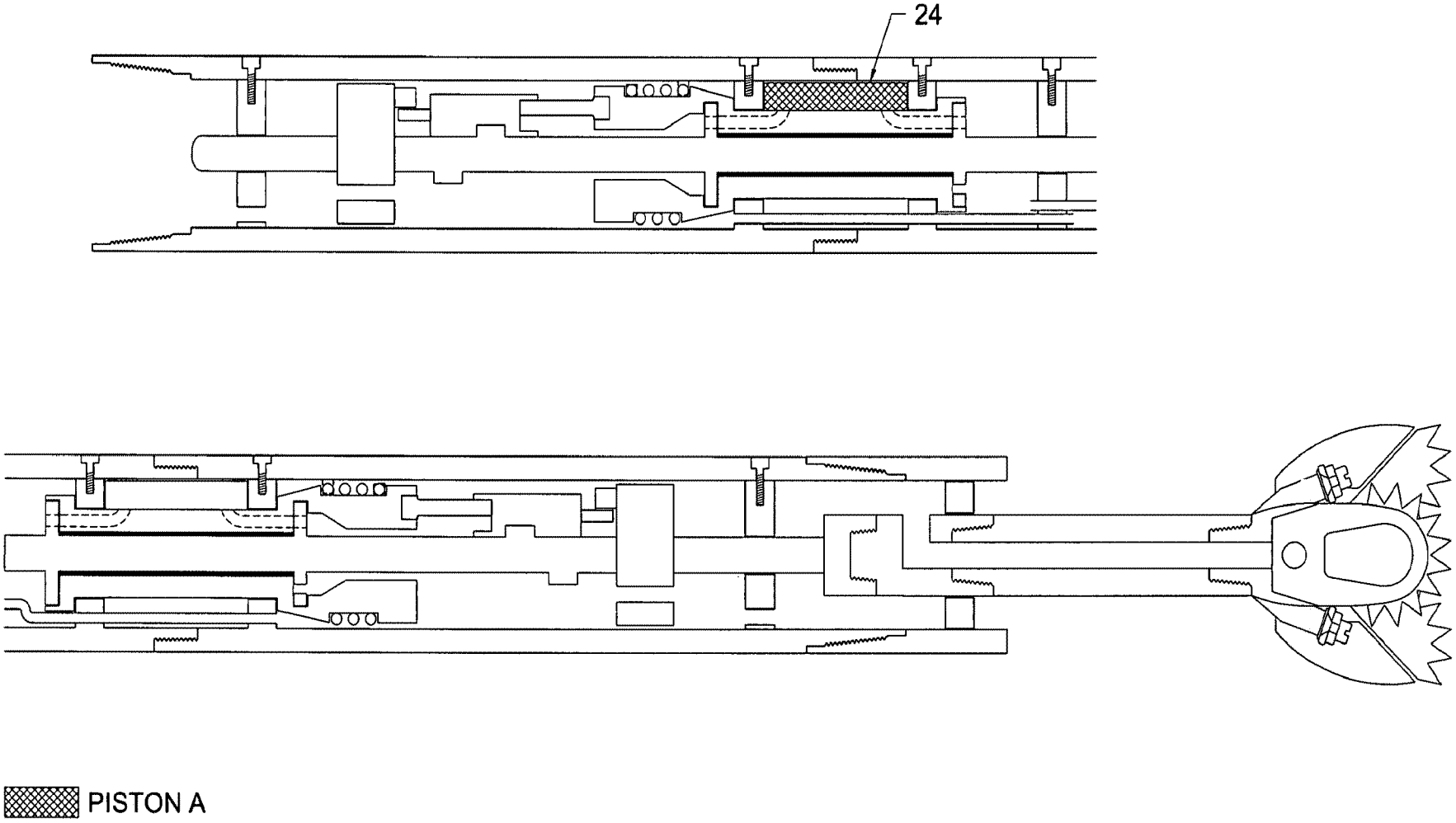
FIG. 3C shows Piston A 24 of the Mud Motor Assembly.

FIG. 3C shows Piston A 24 of the Mud Motor Assembly.

Figure 3D:
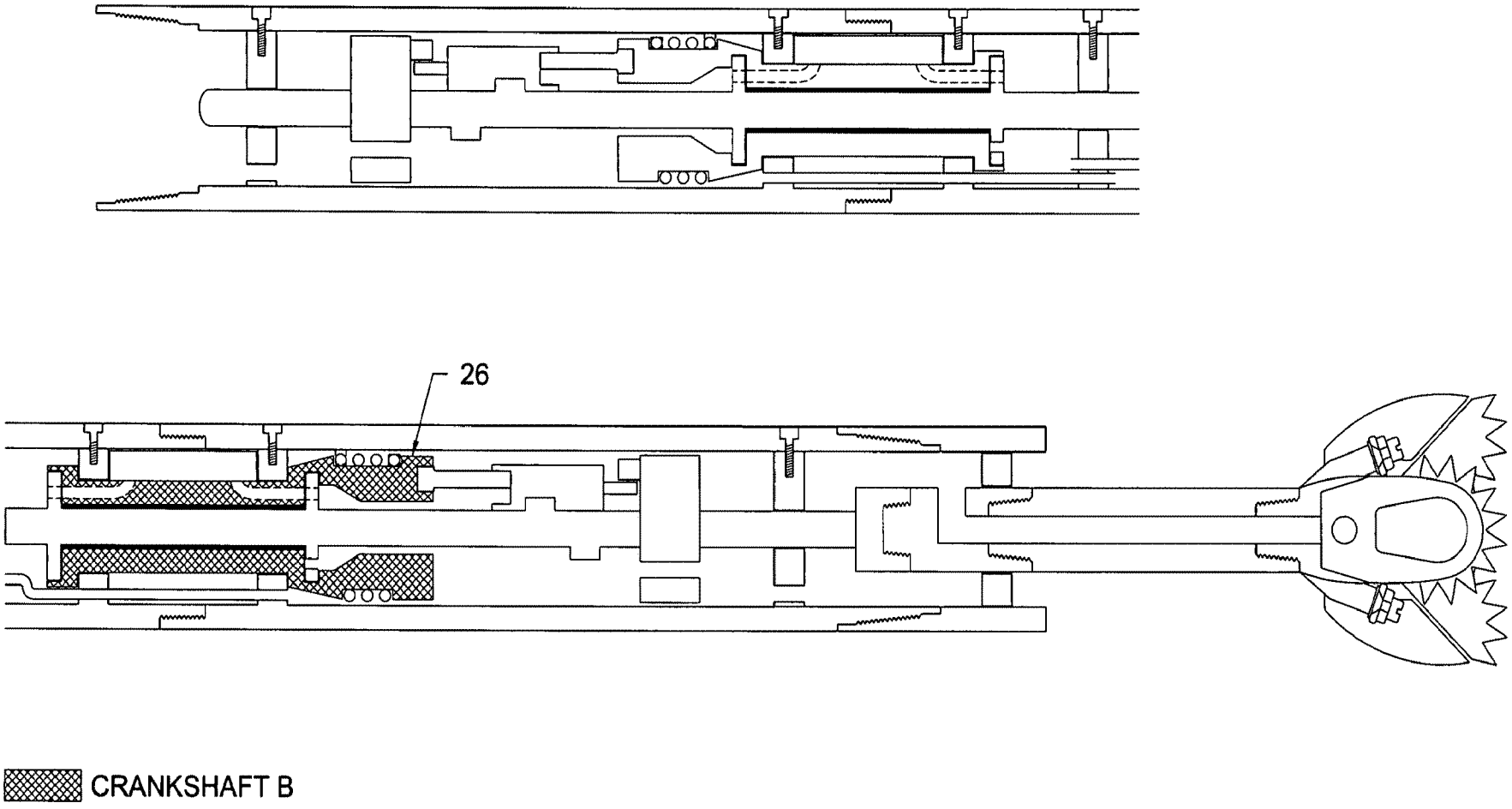
FIG. 3D shows Crankshaft B 26 of the Mud Motor Assembly.

FIG. 3D shows Crankshaft B 26 of the Mud Motor Assembly.

Figure 3E:
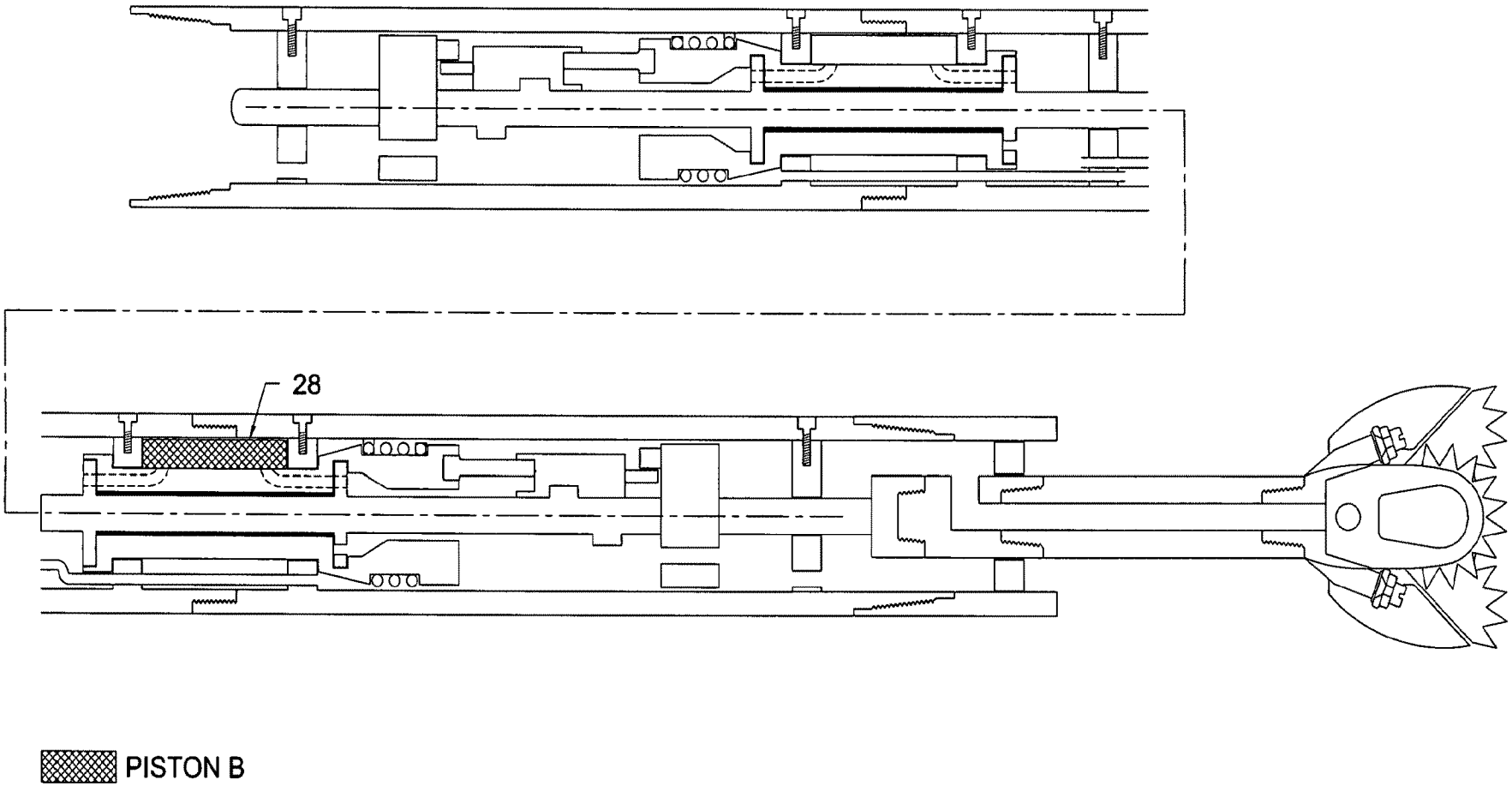
FIG. 3E shows Piston B 28 of the Mud Motor Assembly

FIG. 3E shows Piston B 28 of the Mud Motor Assembly

Figure 3F:
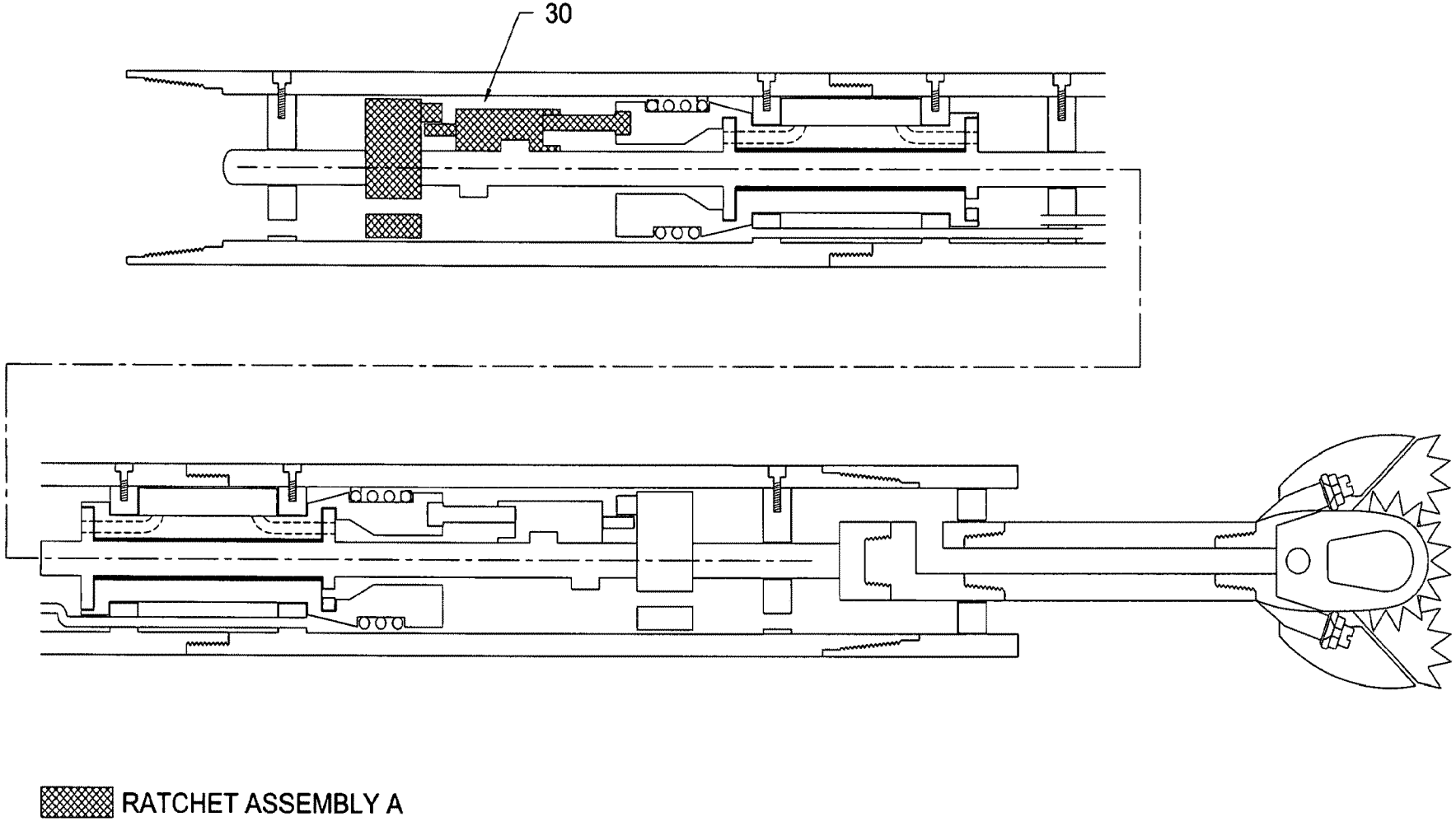
FIG. 3F shows Ratchet Assembly A 30 of the Mud Motor Assembly.

FIG. 3F shows Ratchet Assembly A 30 of the Mud Motor Assembly.

Figure 3G:
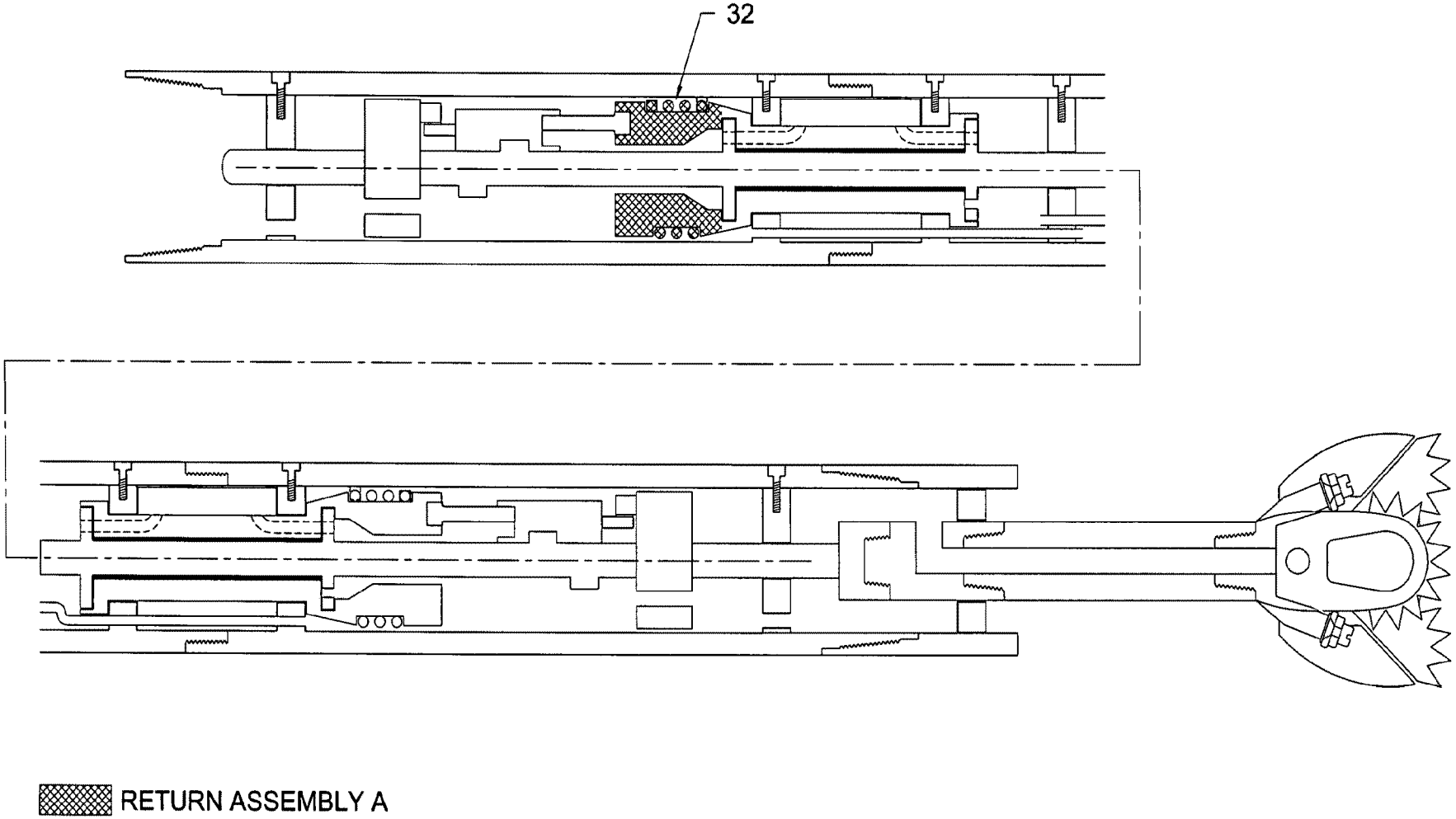
FIG. 3G shows Return Assembly A 32 of the Mud Motor Assembly.

FIG. 3G shows Return Assembly A 32 of the Mud Motor Assembly.

Figure 3H:
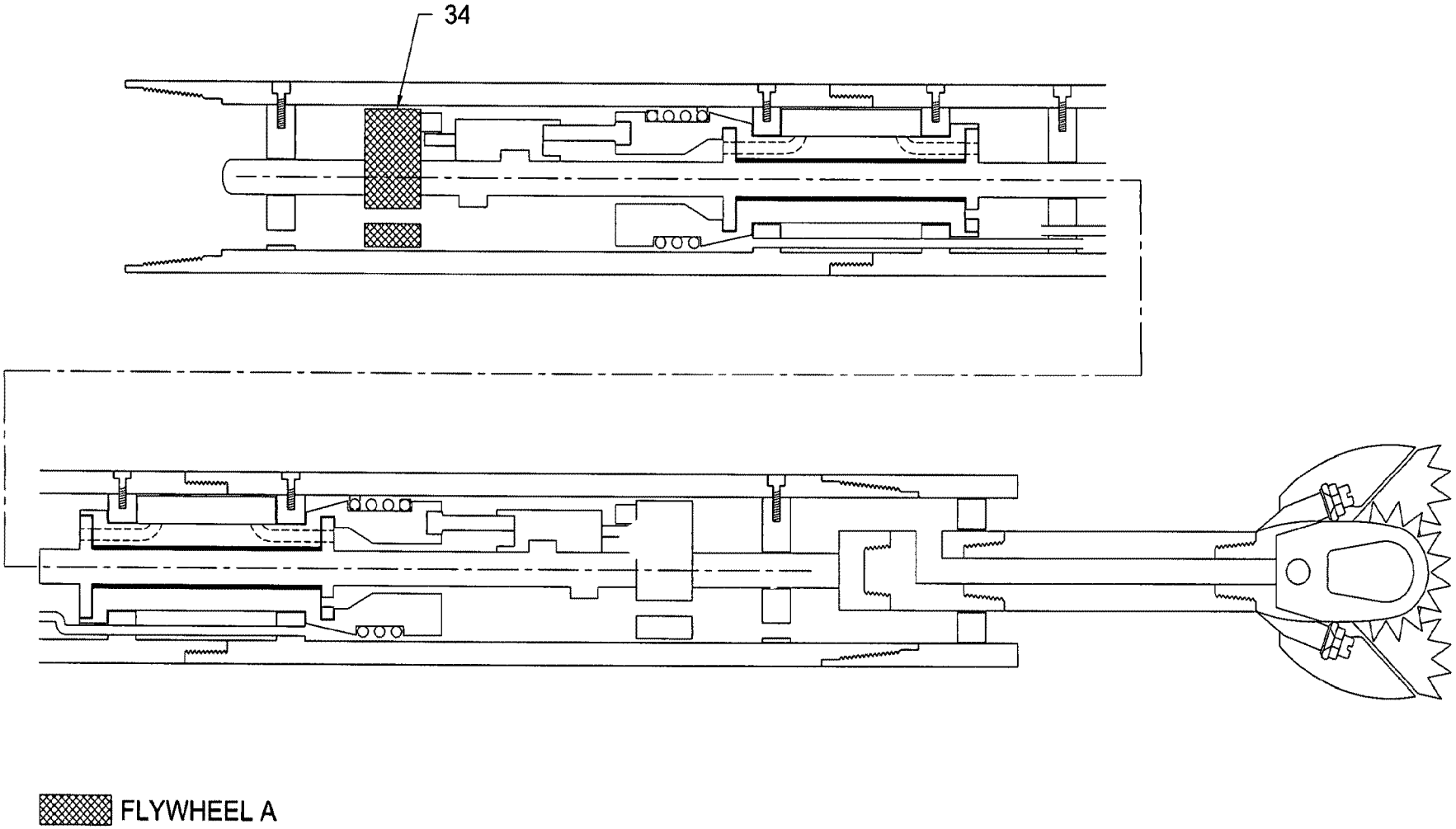
FIG. 3H shows Flywheel A 34 of the Mud Motor Assembly.

FIG. 3H shows Flywheel A 34 of the Mud Motor Assembly.

Figure 3J:
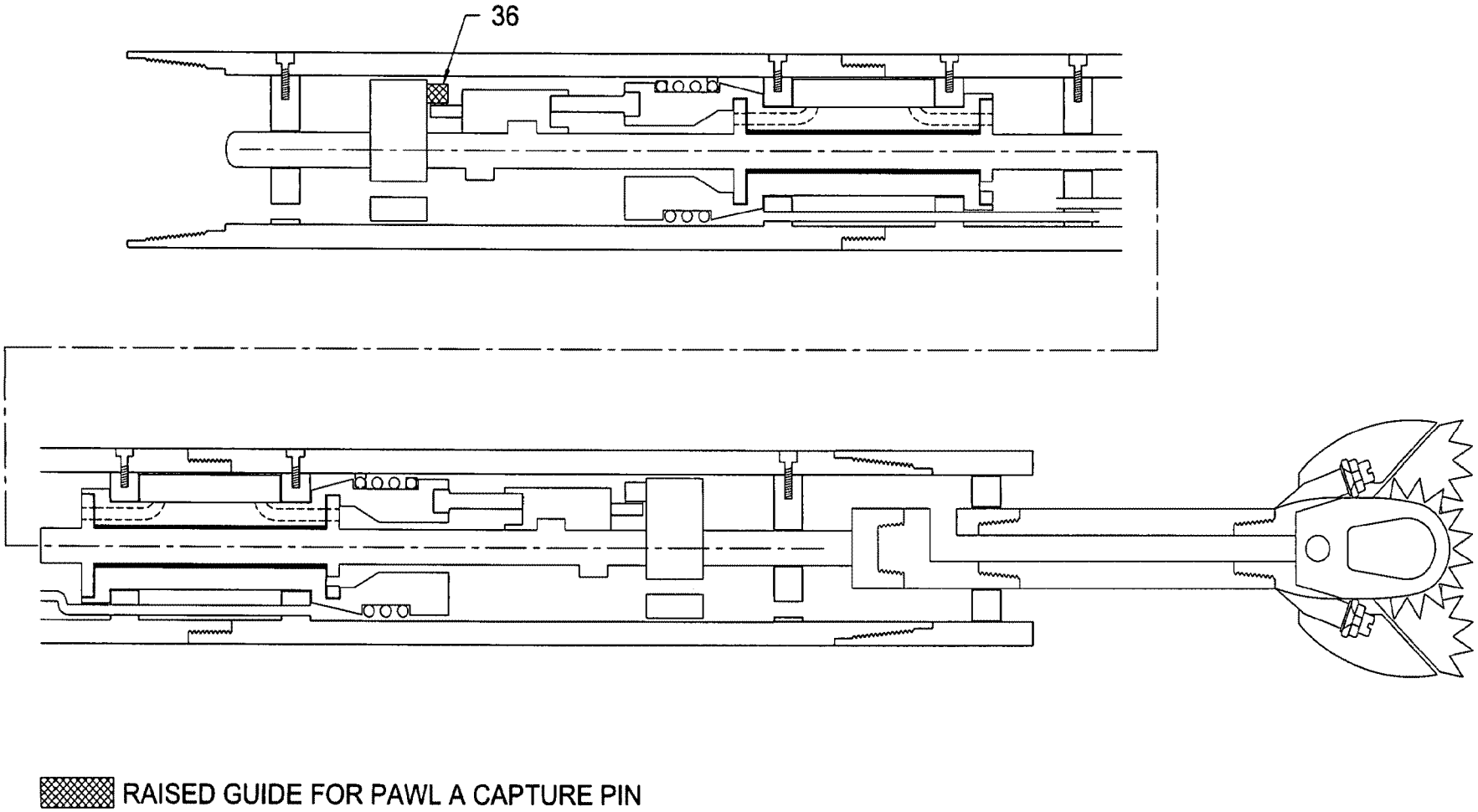
FIG. 3J shows the Raised Guide for Pawl A Capture Pin 36 of the Mud Motor Assembly.

FIG. 3J shows the Raised Guide for Pawl A Capture Pin 36 of the Mud Motor Assembly.

Figure 3K:
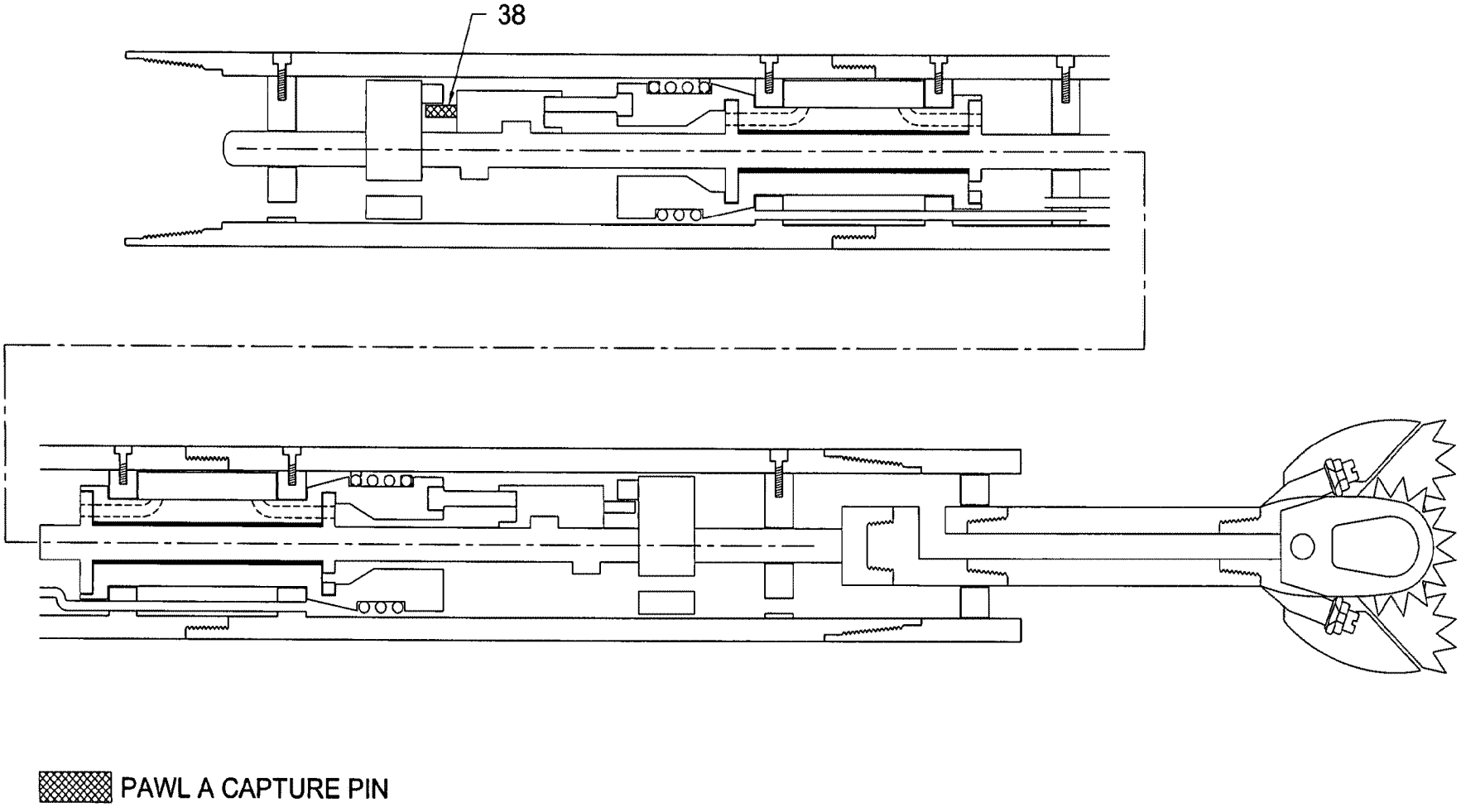
FIG. 3K shows the Pawl A Capture Pin 38 of the Mud Motor Assembly.

FIG. 3K shows the Pawl A Capture Pin 38 of the Mud Motor Assembly.

Figure 3L:
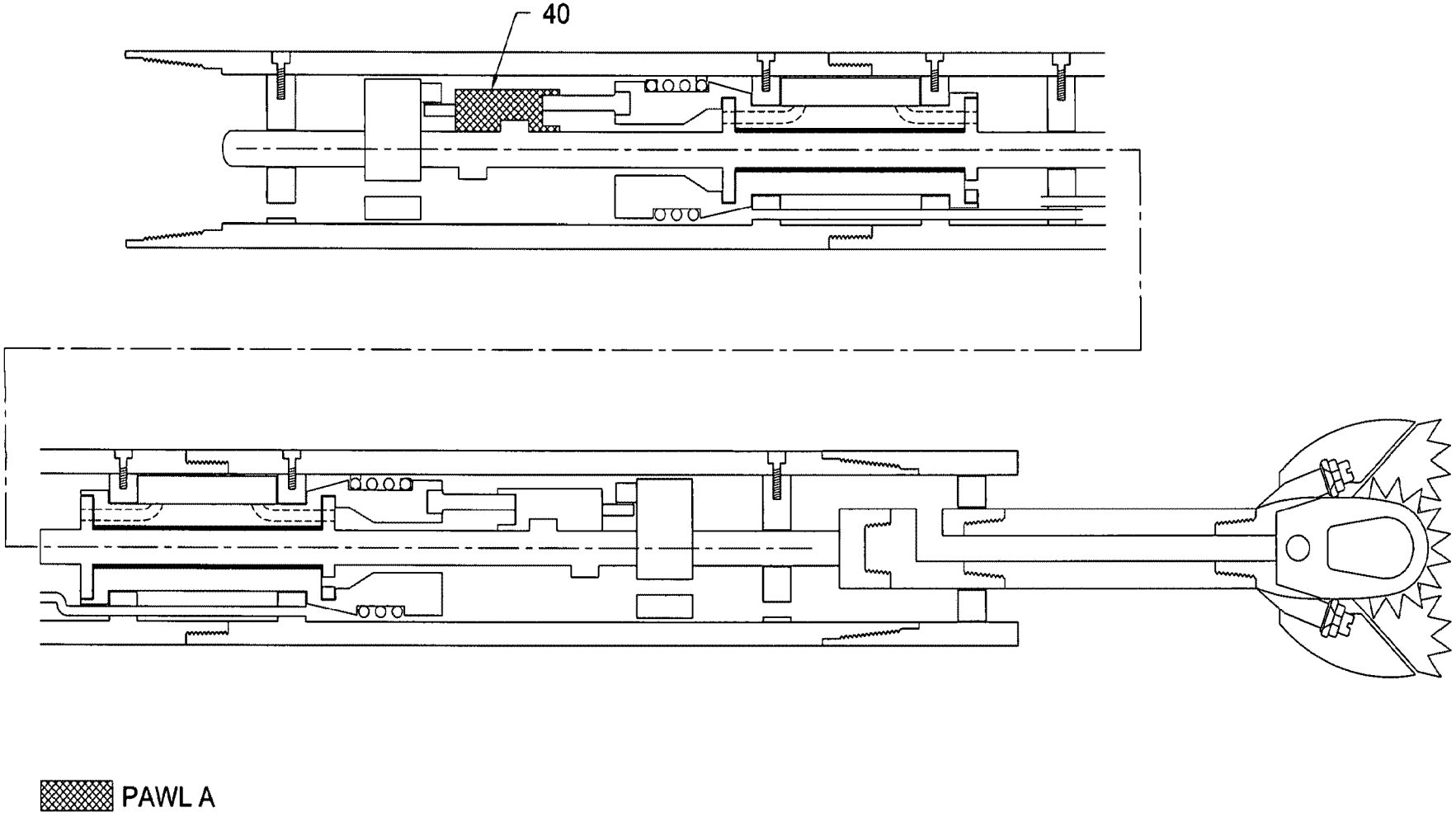
FIG. 3L shows Pawl A 40 of the Mud Motor Assembly.

FIG. 3L shows Pawl A 40 of the Mud Motor Assembly.

Figure 3M:
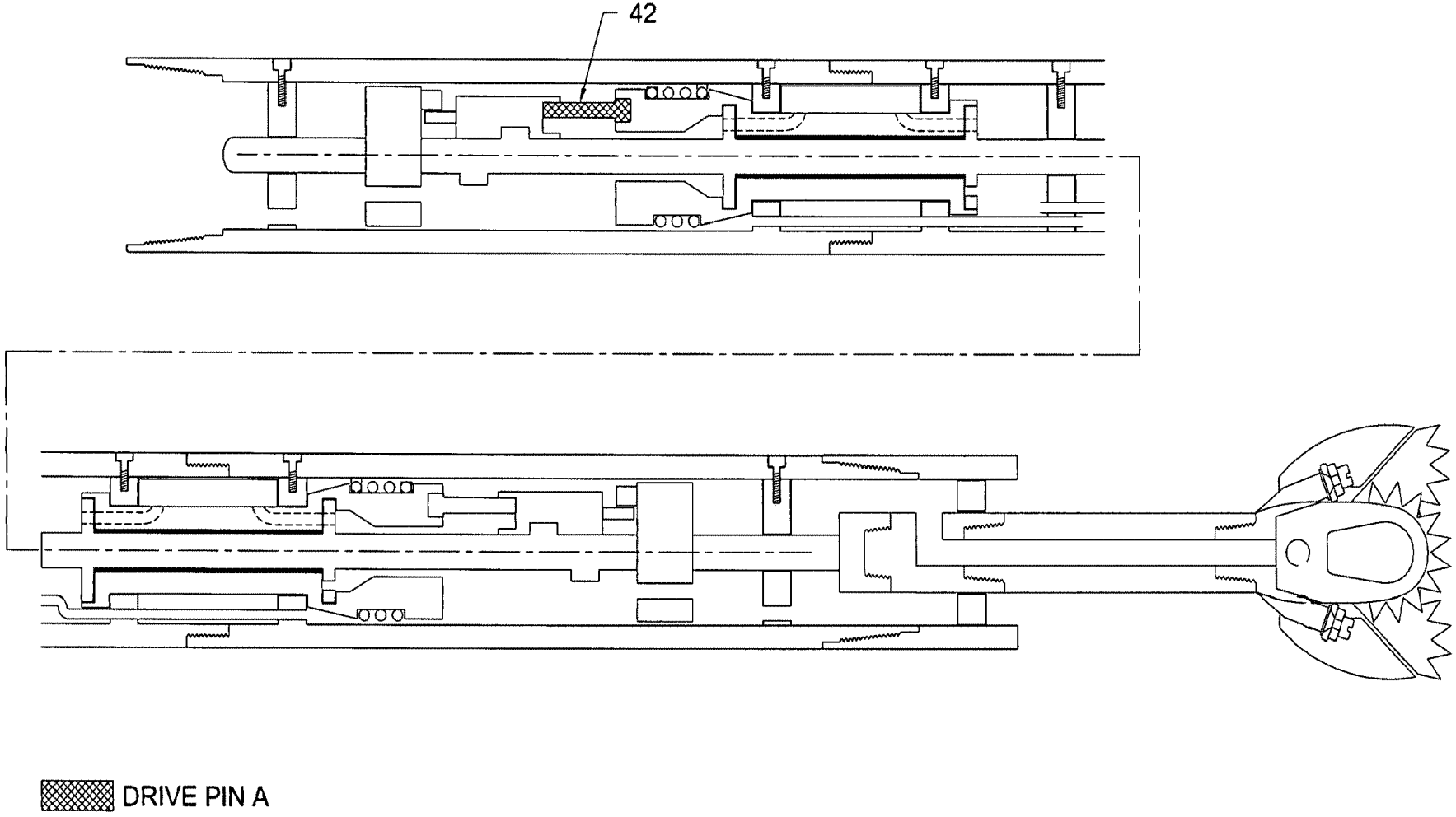
FIG. 3M shows Drive Pin A 42 of the Mud Motor Assembly.

FIG. 3M shows Drive Pin A 42 of the Mud Motor Assembly.

Figure 3N:
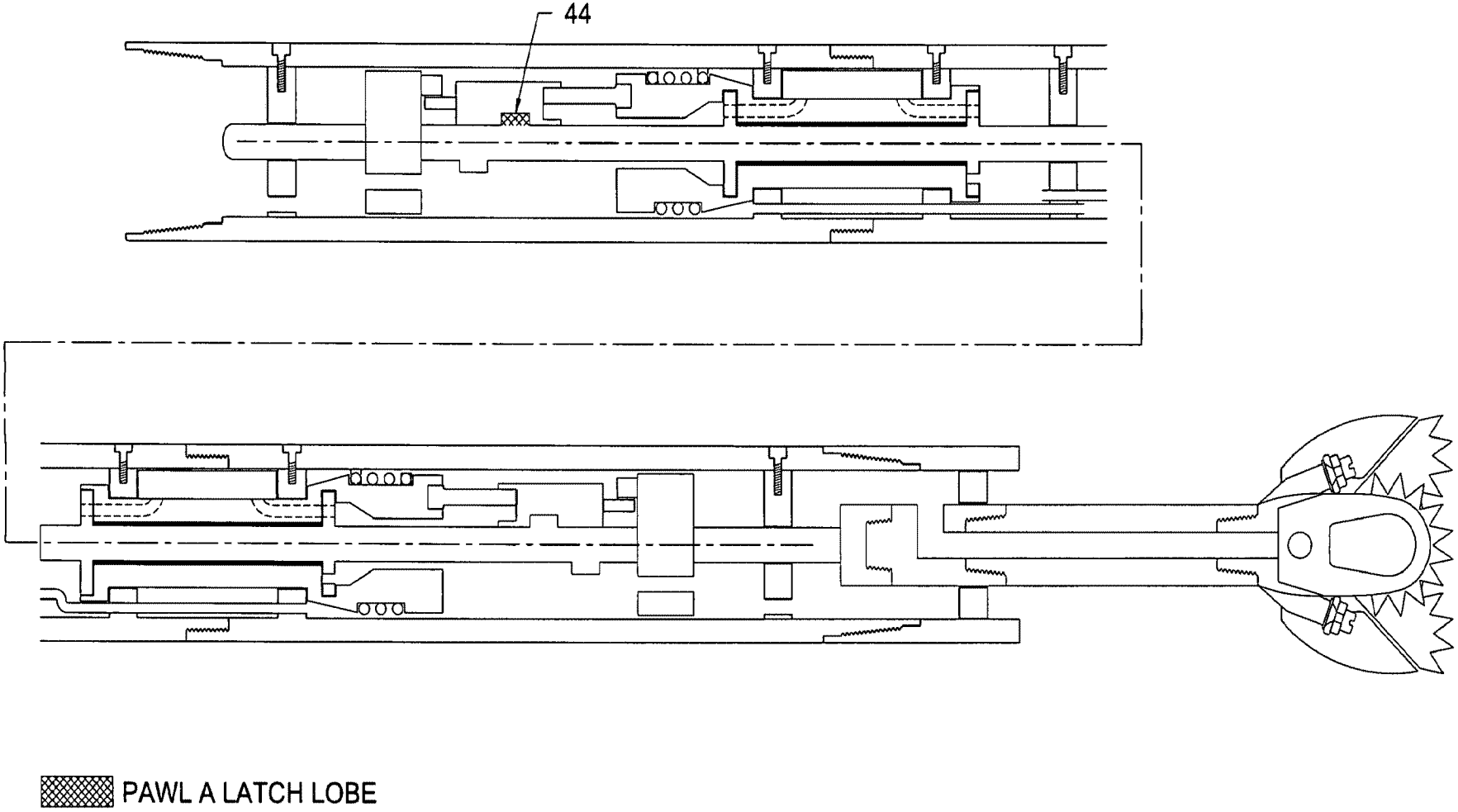
FIG. 3N schematically shows the Pawl A Latch Lobe 44 of the Mud Motor Assembly.

FIG. 3N schematically shows the Pawl A Latch Lobe 44 of the Mud Motor Assembly.

Figure 3P:
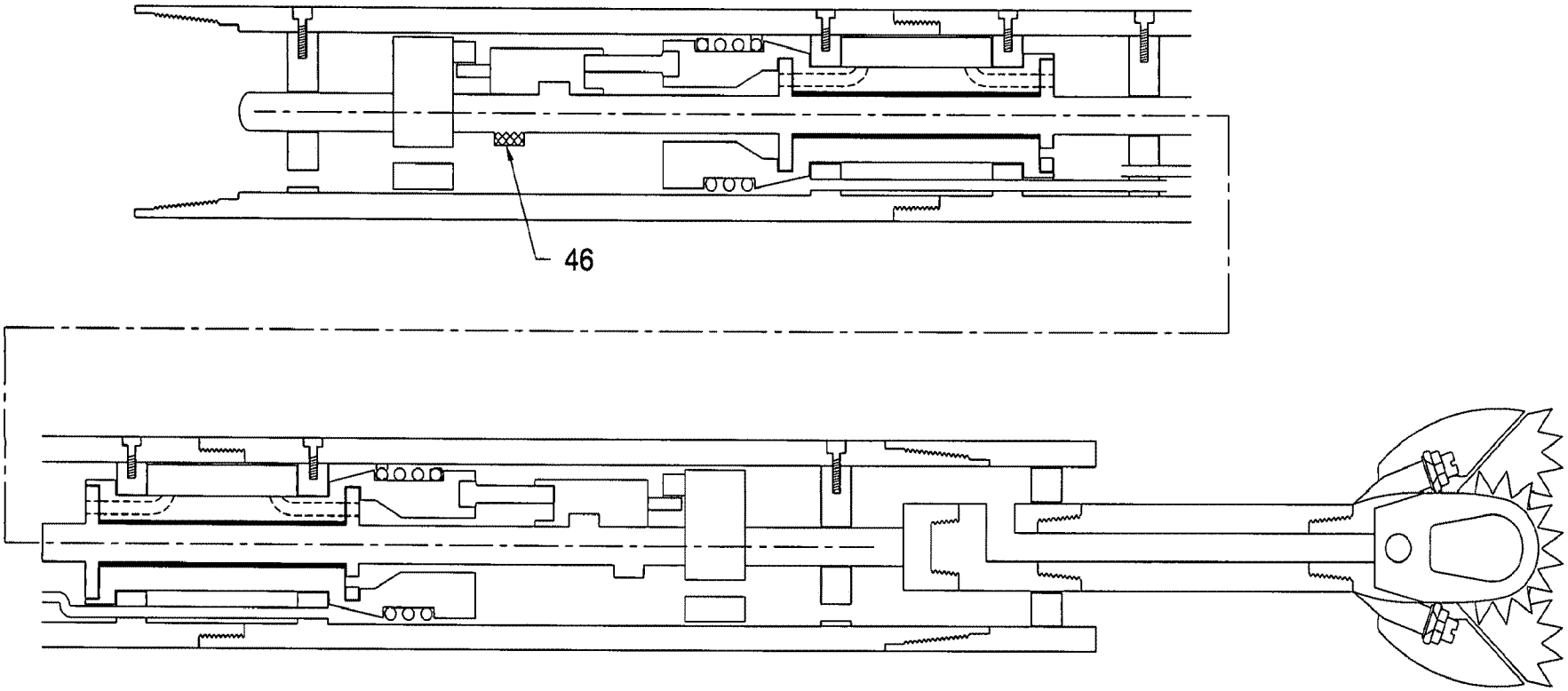
FIG. 3P schematically shows the Pawl A Lifter Lobe 46 of the Mud Motor Assembly.

FIG. 3P schematically shows the Pawl A Lifter Lobe 46 of the Mud Motor Assembly.

Figure 4:
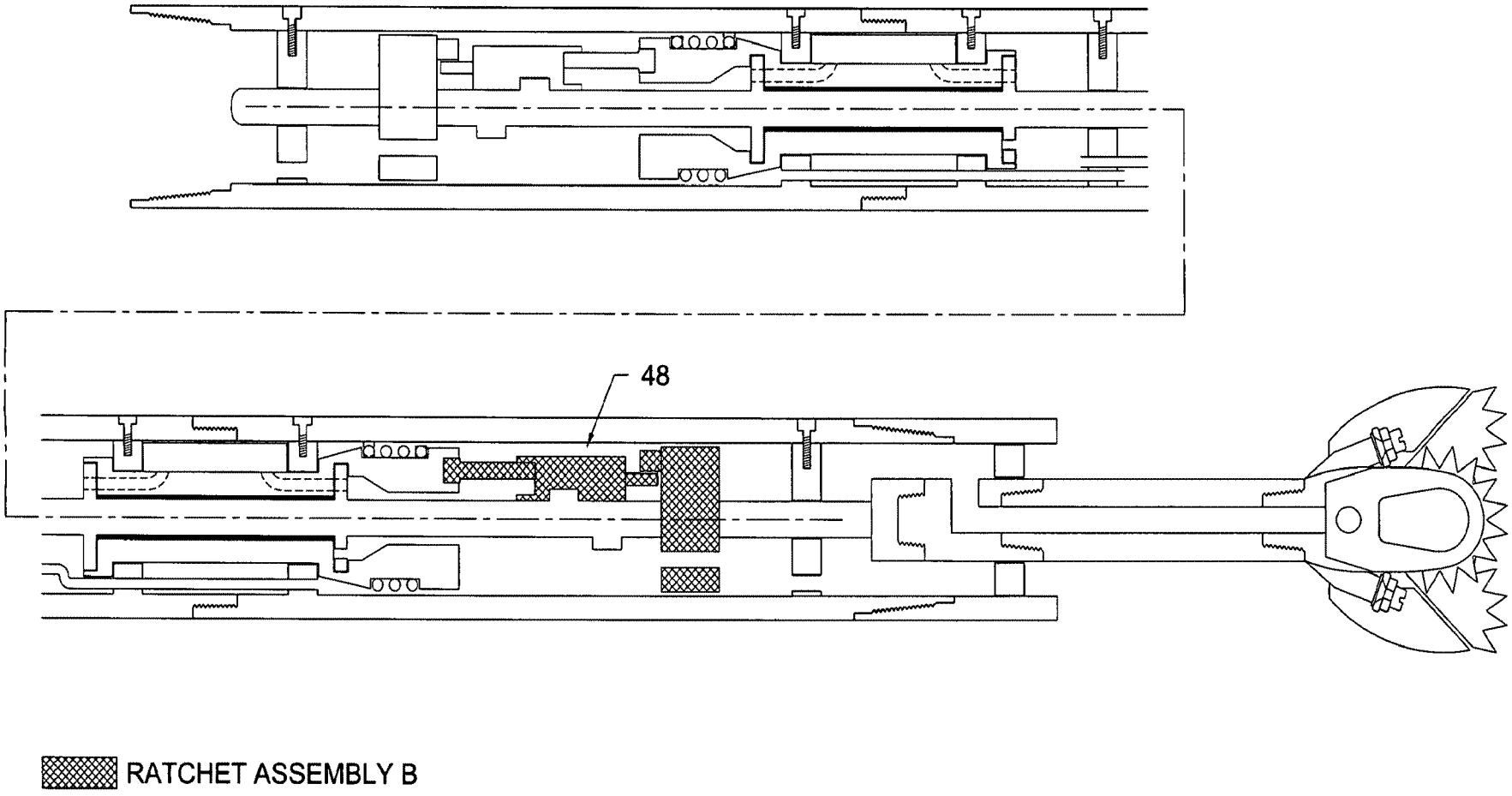
FIG. 4 shows Ratchet Assembly B 48 of the Mud Motor Assembly.

FIG. 4 shows Ratchet Assembly B 48 of the Mud Motor Assembly.

Figure 4A:
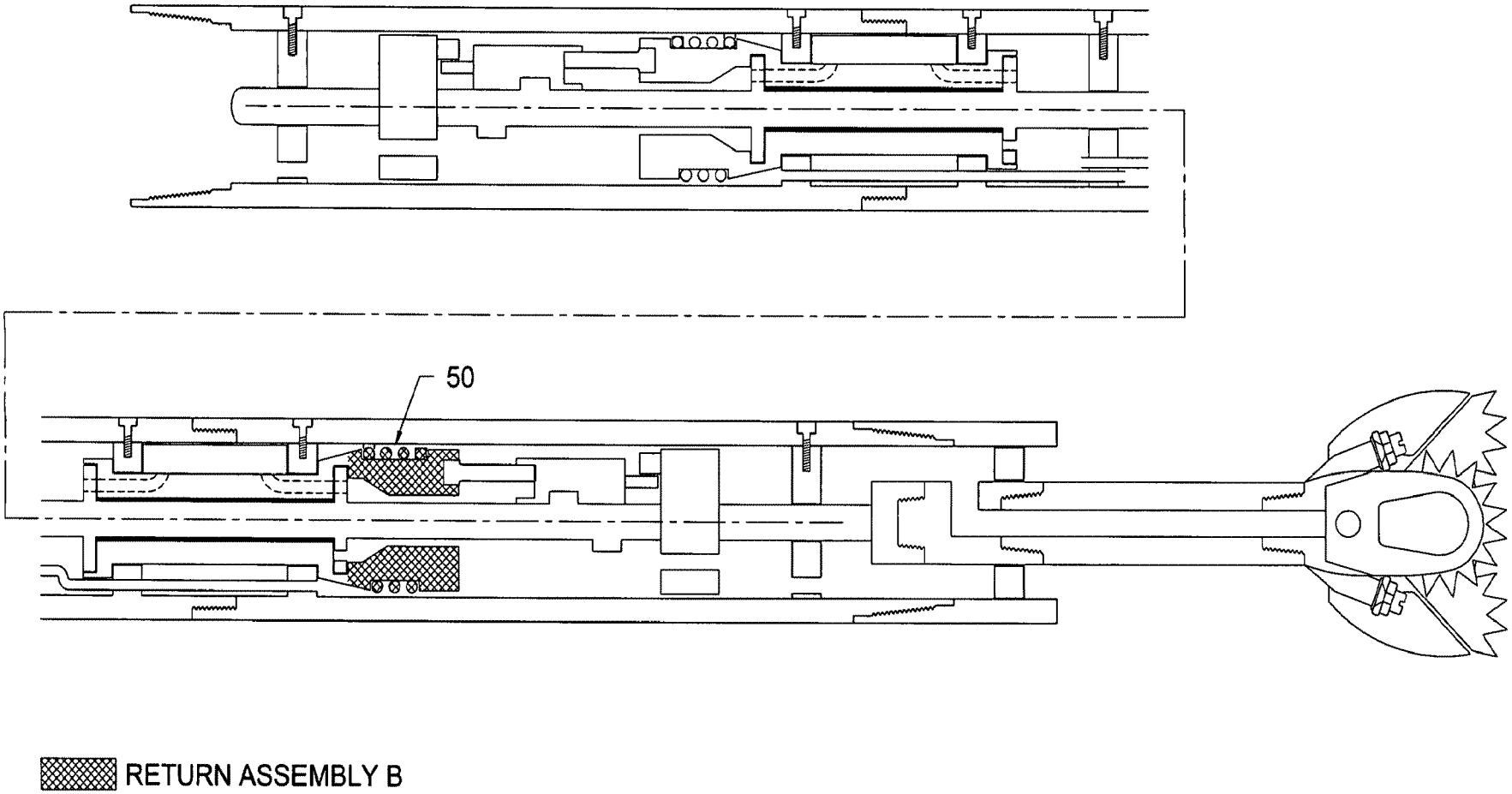
FIG. 4A shows Return Assembly B 50 of the Mud Motor Assembly.

FIG. 4A shows Return Assembly B 50 of the Mud Motor Assembly.

Figure 4B:
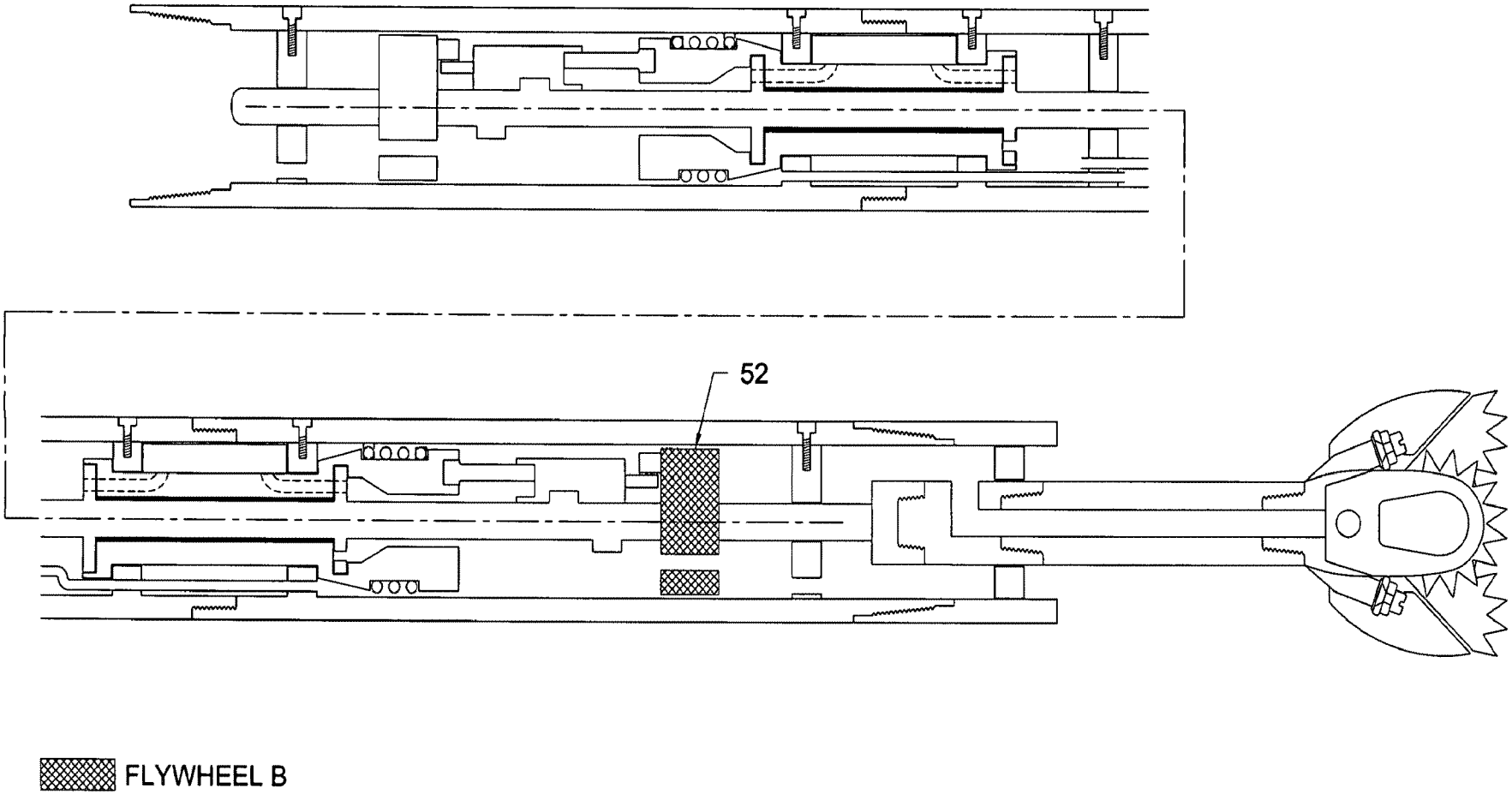
FIG. 4B shows Flyweel B 52 of the Mud Motor Assembly.

FIG. 4B shows Flyweel B 52 of the Mud Motor Assembly.

Figure 4C:
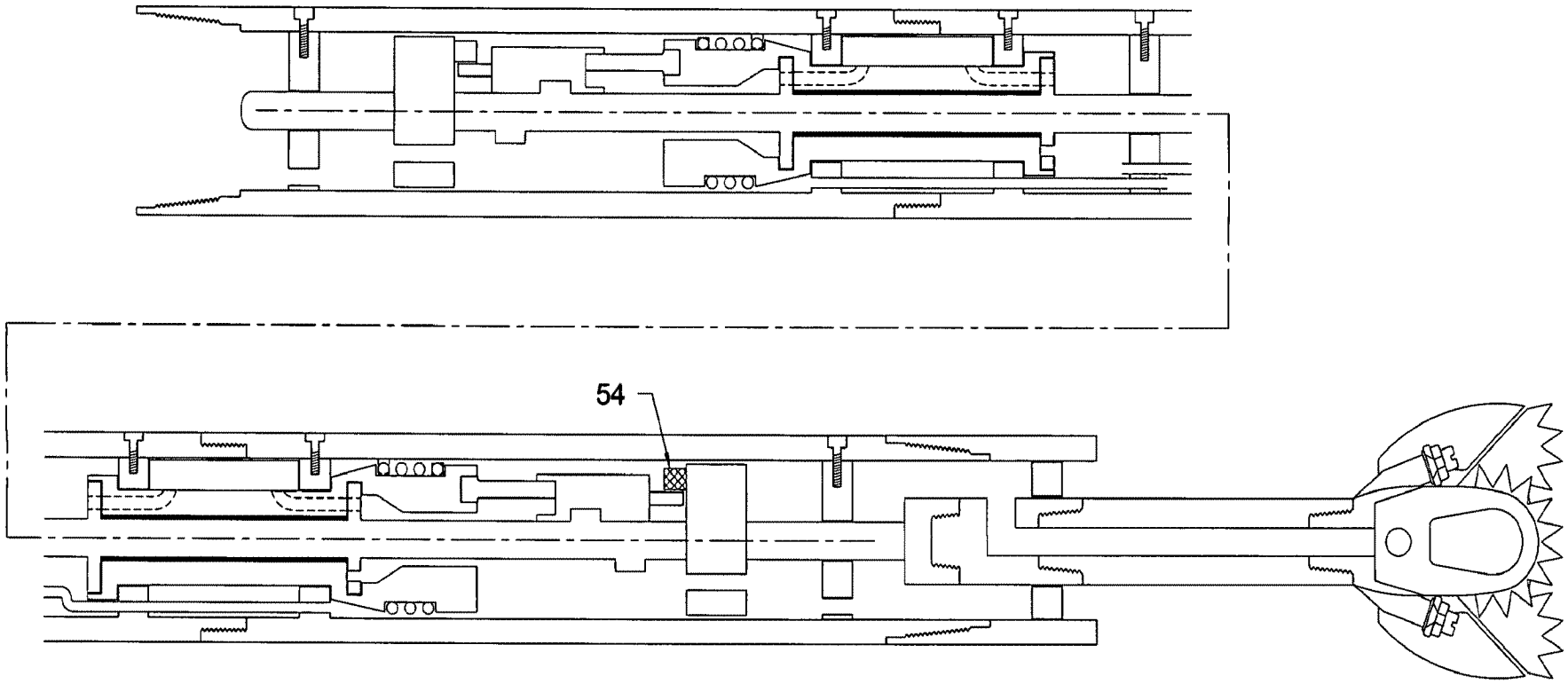
FIG. 4C shows the Raised Guide for Pawl B Capture Pin 54 of the Mud Motor Assembly.

FIG. 4C shows the Raised Guide for Pawl B Capture Pin 54 of the Mud Motor Assembly.

Figure 4D:
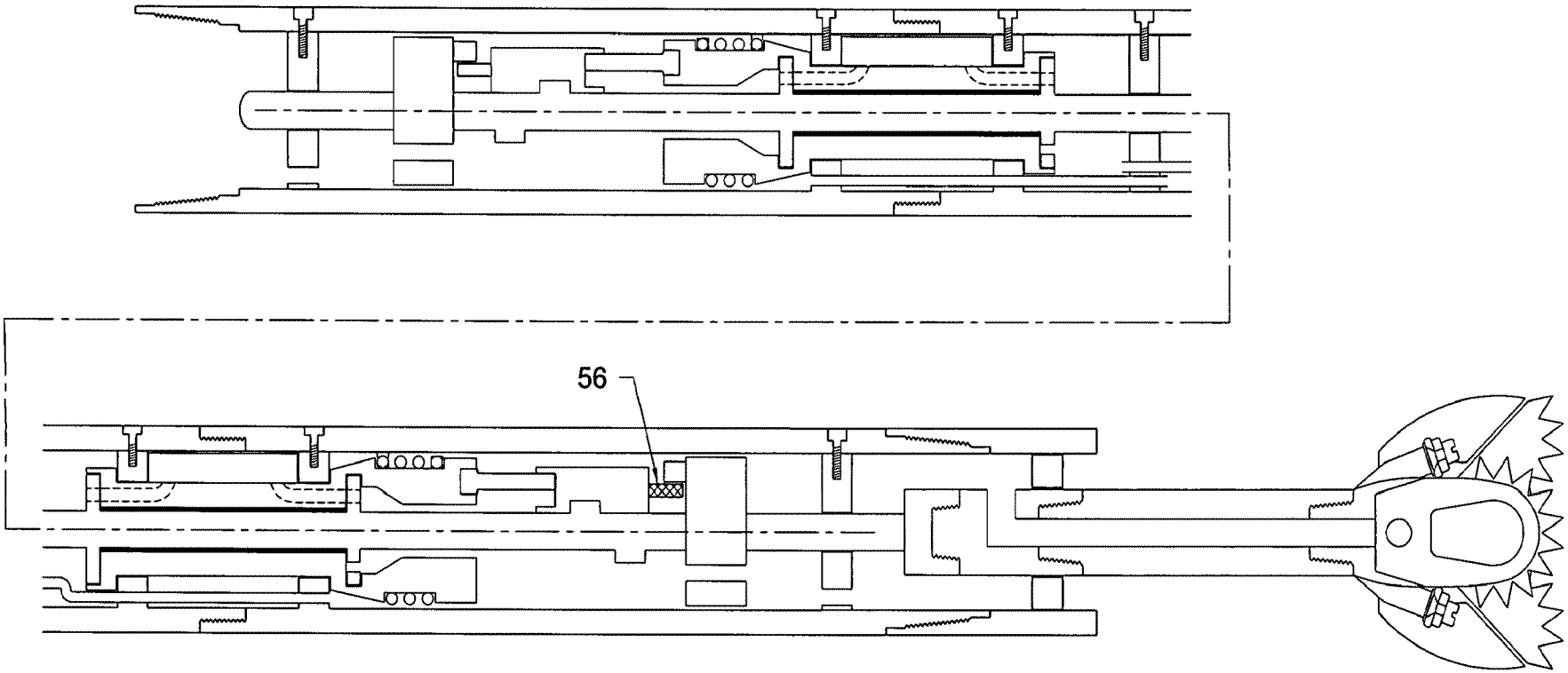
FIG. 4D shows the Pawl B Capture Pin 56 of the Mud Motor Assembly.

FIG. 4D shows the Pawl B Capture Pin 56 of the Mud Motor Assembly.

Figure 4E:
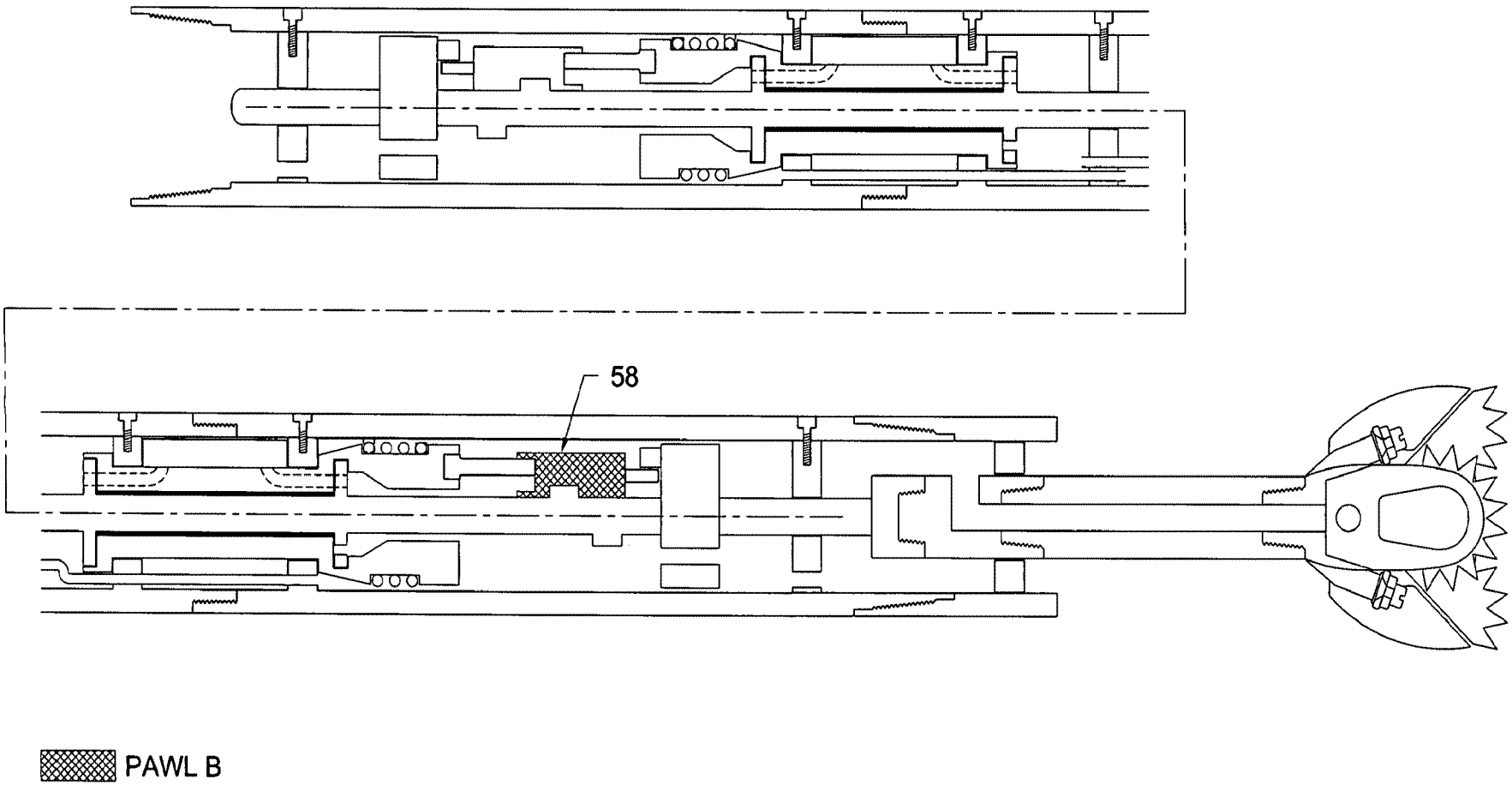
FIG. 4E shows Pawl B 58 of the Mud Motor Assembly.

FIG. 4E shows Pawl B 58 of the Mud Motor Assembly.

Figure 4F:
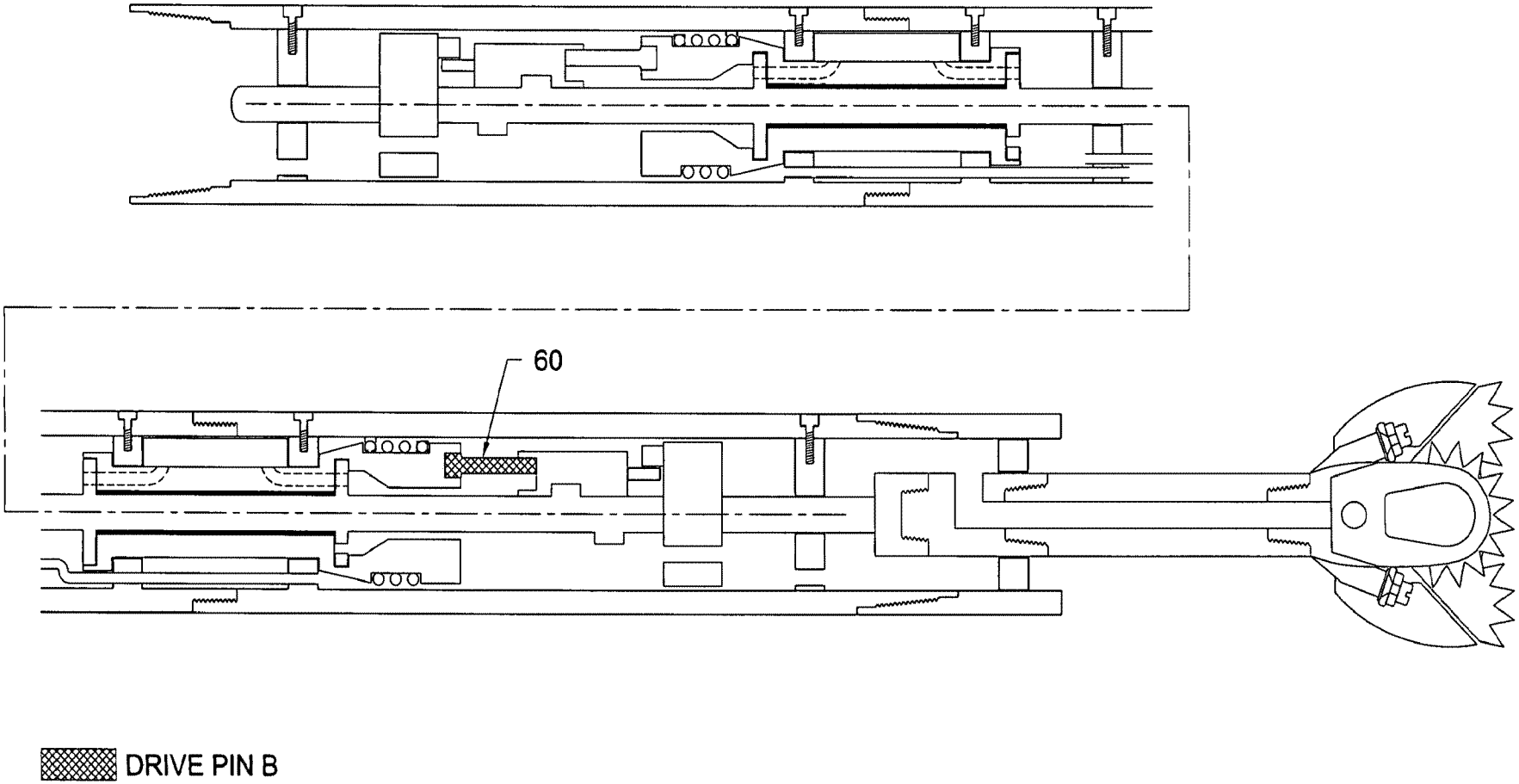
FIG. 4F shows Drive Pin B 60 of the Mud Motor Assembly.

FIG. 4F shows Drive Pin B 60 of the Mud Motor Assembly.

Figure 4G:
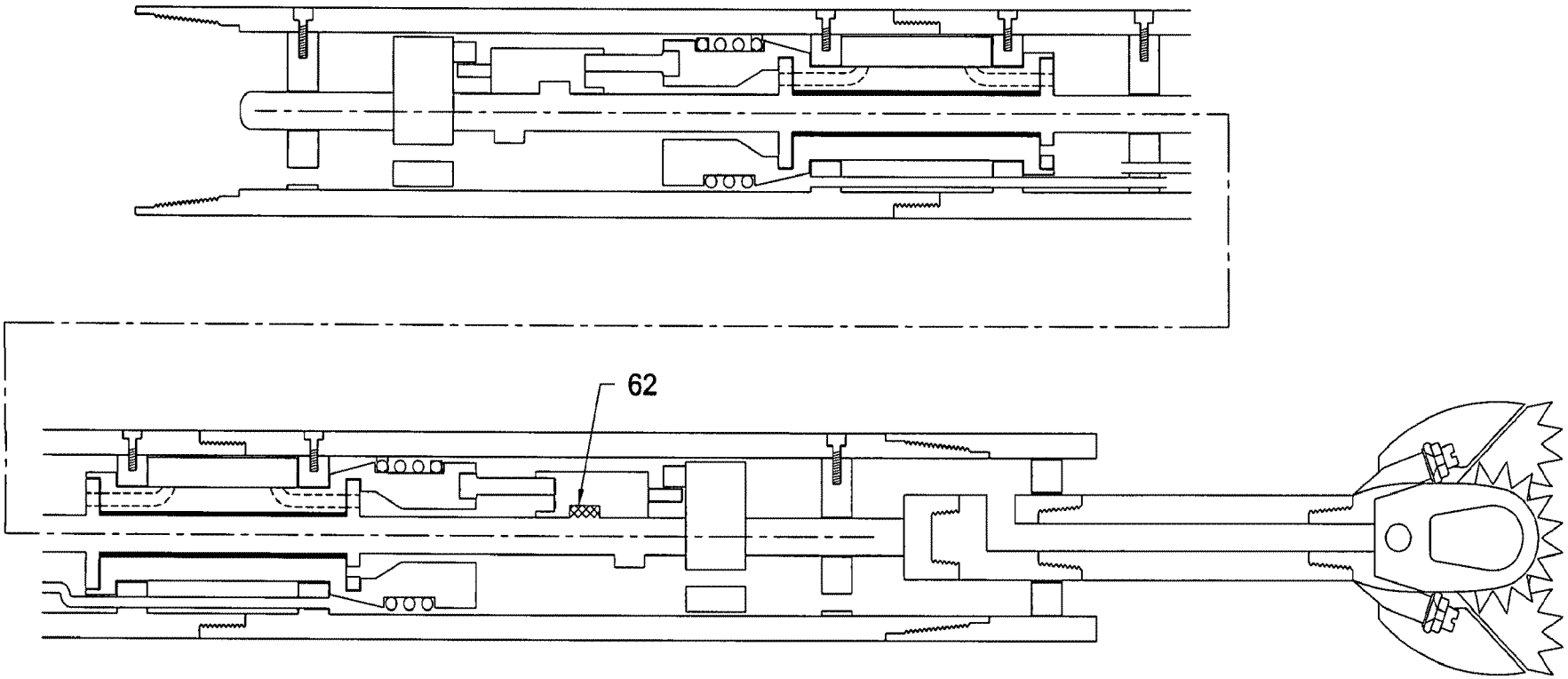
FIG. 4G schematically shows the Pawl B Latch Lobe 62 of the Mud Motor Assembly.

FIG. 4G schematically shows the Pawl B Latch Lobe 62 of the Mud Motor Assembly.

Figure 4H:
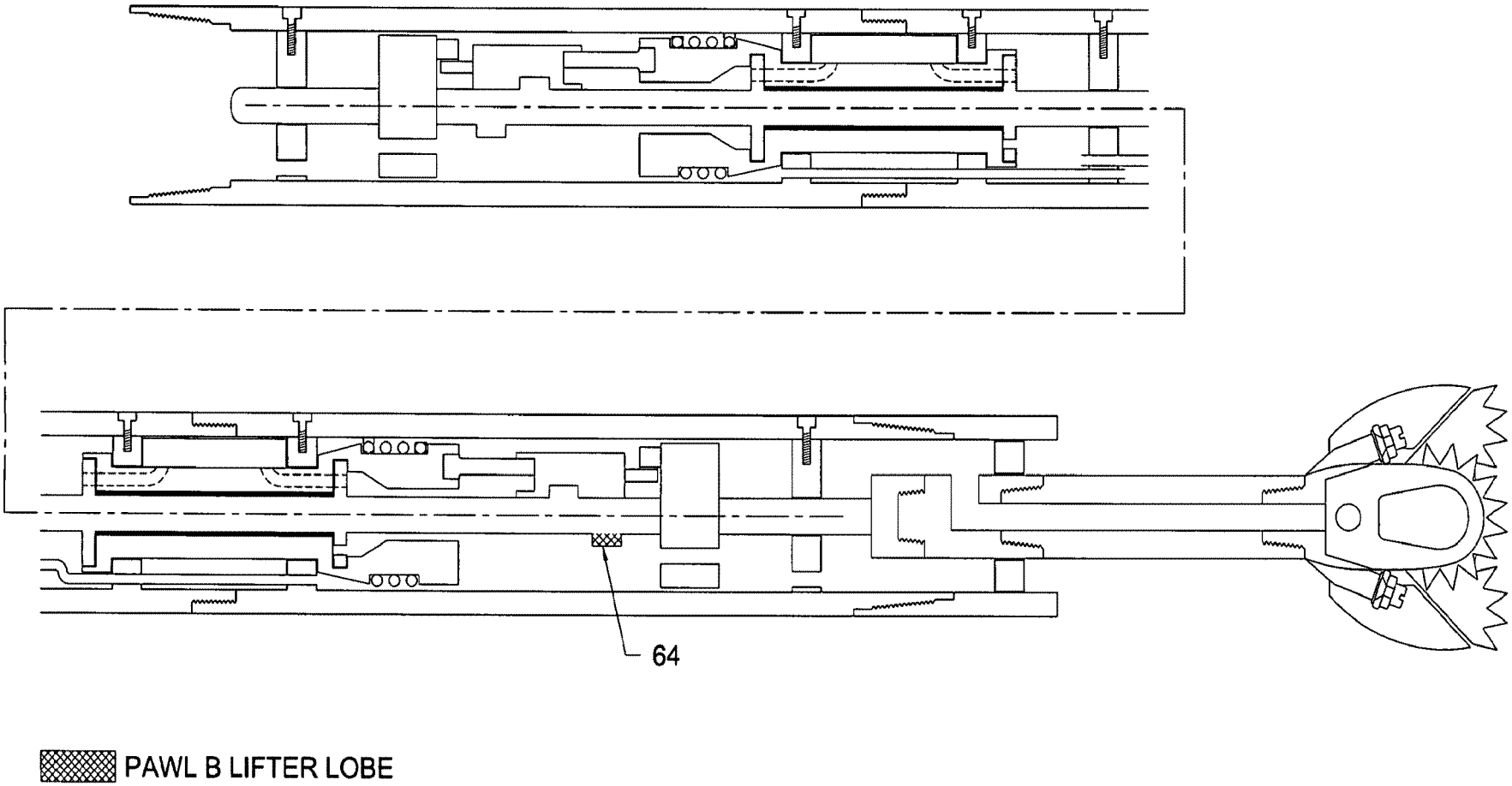
FIG. 4H schematically shows the Pawl B Lifter Lobe 64 of the Mud Motor Assembly.

FIG. 4H schematically shows the Pawl B Lifter Lobe 64 of the Mud Motor Assembly.

Figure 4J:
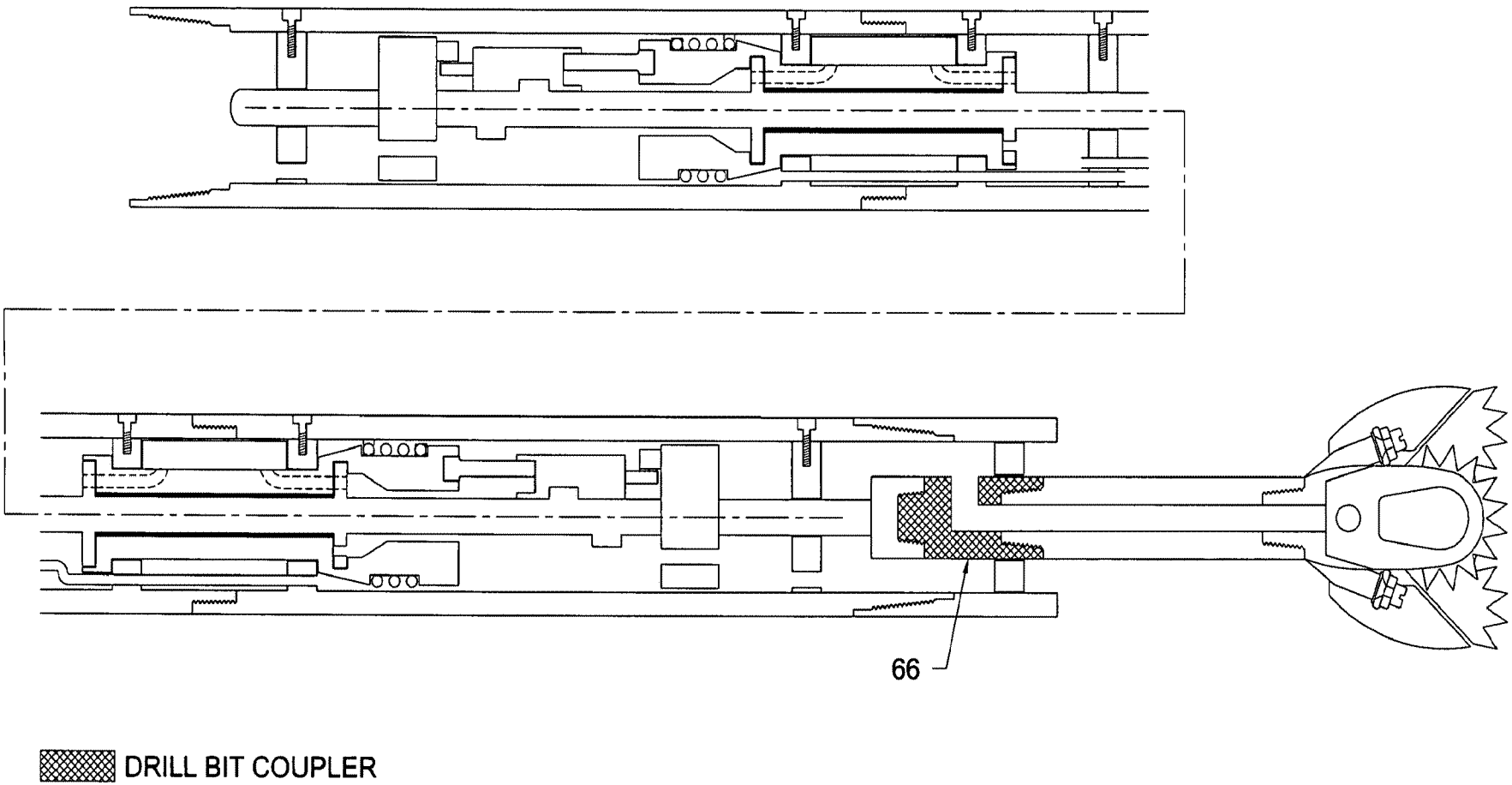
FIG. 4J shows the Drill Bit Coupler 66 of the Mud Motor Assembly.

FIG. 4J shows the Drill Bit Coupler 66 of the Mud Motor Assembly.

Figure 4K:
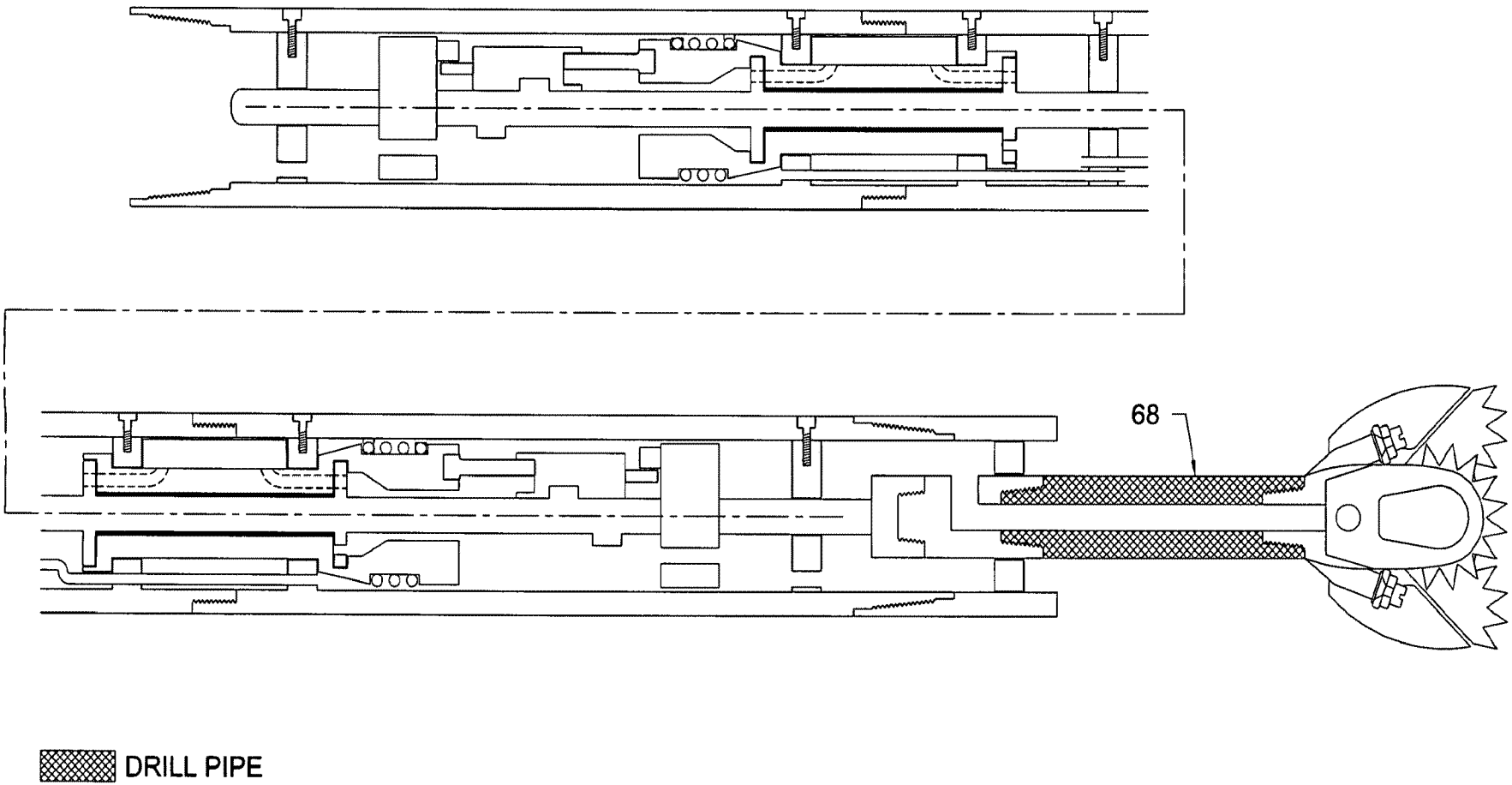
FIG. 4K shows the Drill Pipe 68 of the Mud Motor Assembly.

FIG. 4K shows the Drill Pipe 68 of the Mud Motor Assembly.

Figure 4L:
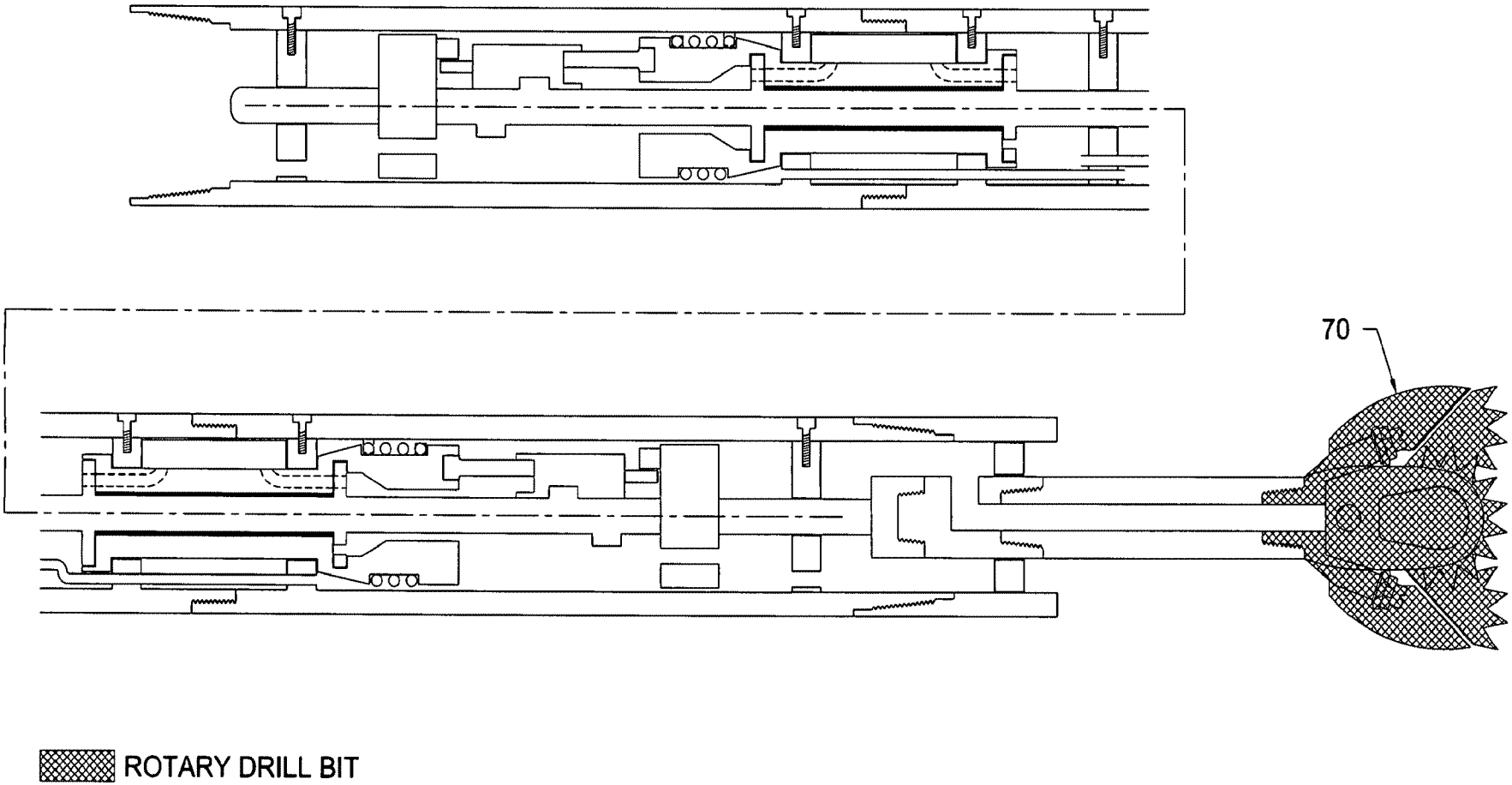
FIG. 4L shows the Rotary Drill Bit 70 of the Mud Motor Assembly.

FIG. 4L shows the Rotary Drill Bit 70 of the Mud Motor Assembly.

Figure 4M:
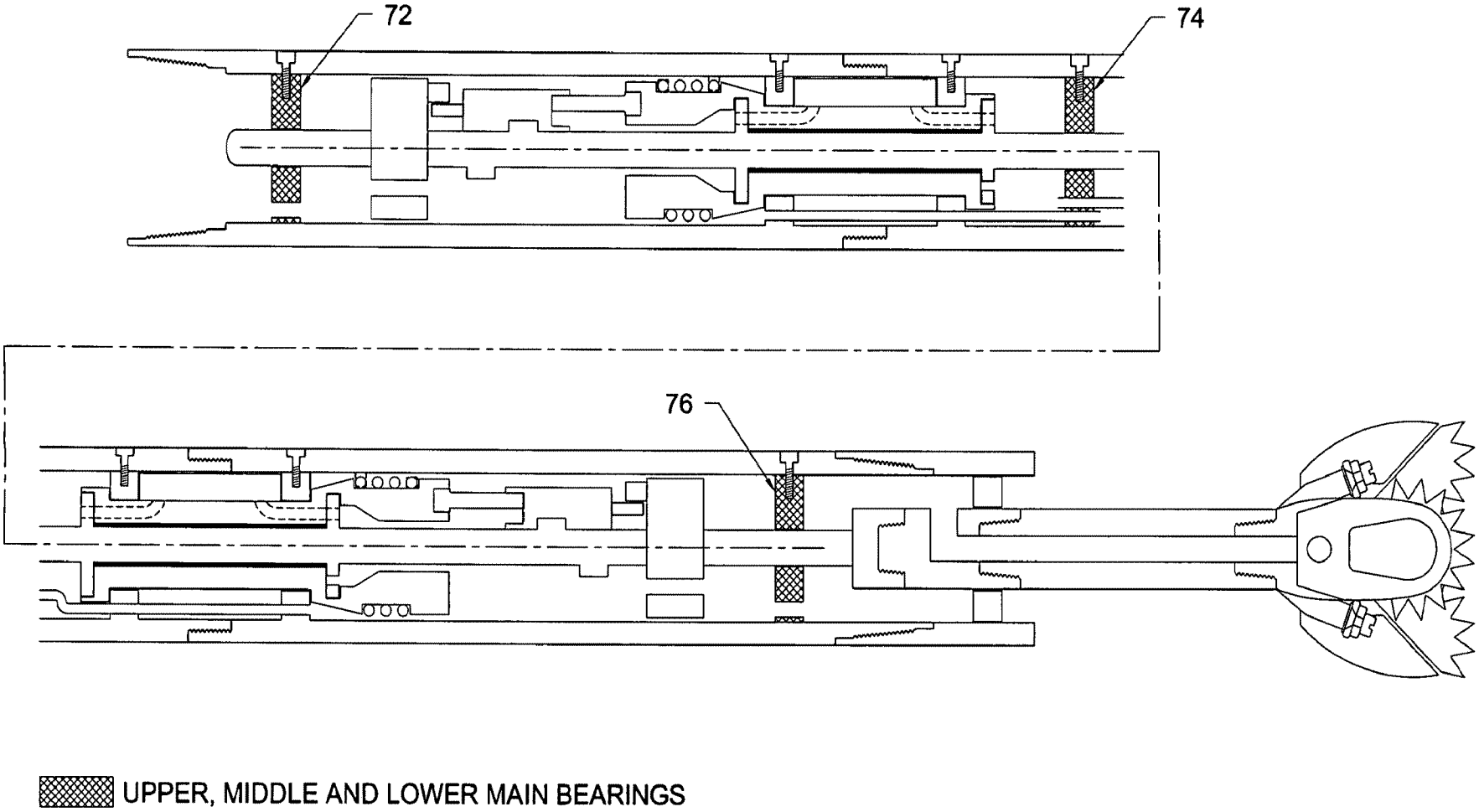
FIG. 4M shows the Upper, Middle and Lower Main Bearings (respectively numerals 72, 74, and 76 from left-to-right) of the Mud Motor Assembly.

FIG. 4M shows the Upper, Middle and Lower Main Bearings (respectively numerals 72, 74, and 76 from left-to-right) of the Mud Motor Assembly.

Figure 4N:
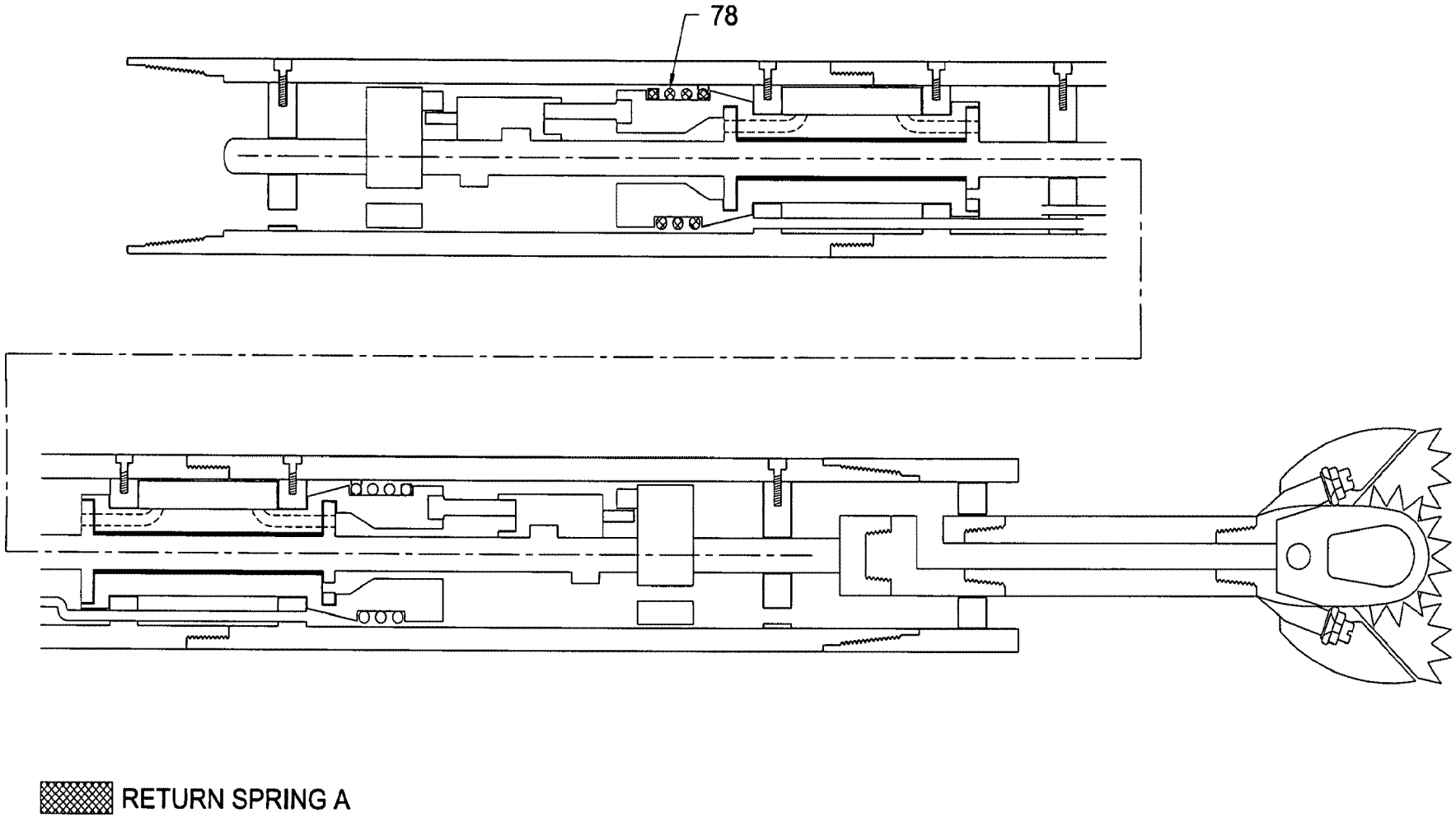
FIG. 4N shows Return Spring A 78 of the Mud Motor Assembly.

FIG. 4N shows Return Spring A 78 of the Mud Motor Assembly.

Figure 4P:
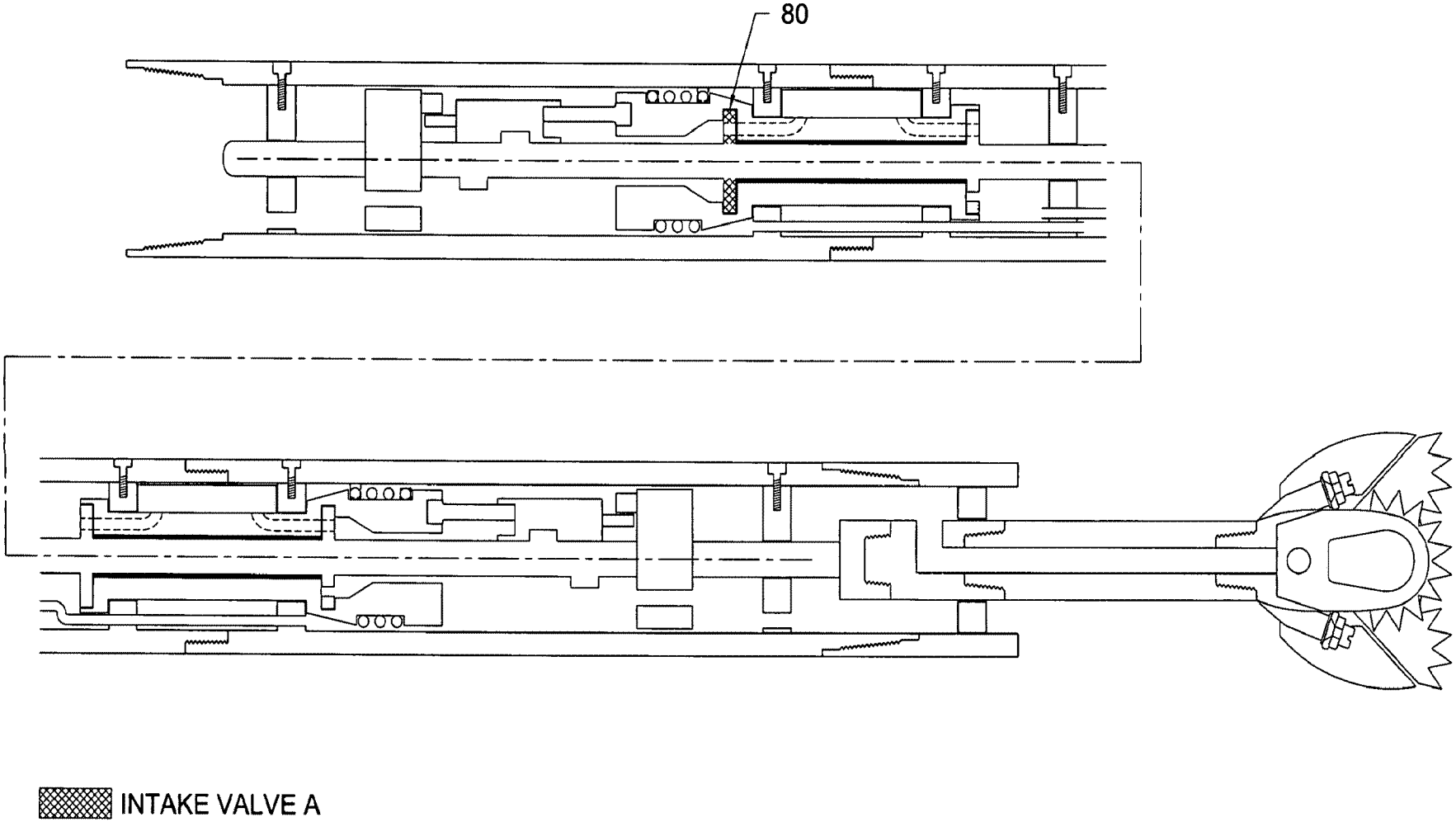
FIG. 4P shows Intake Valve A 80 of the Mud Motor Assembly.

FIG. 4P shows Intake Valve A 80 of the Mud Motor Assembly.

Figure 5:
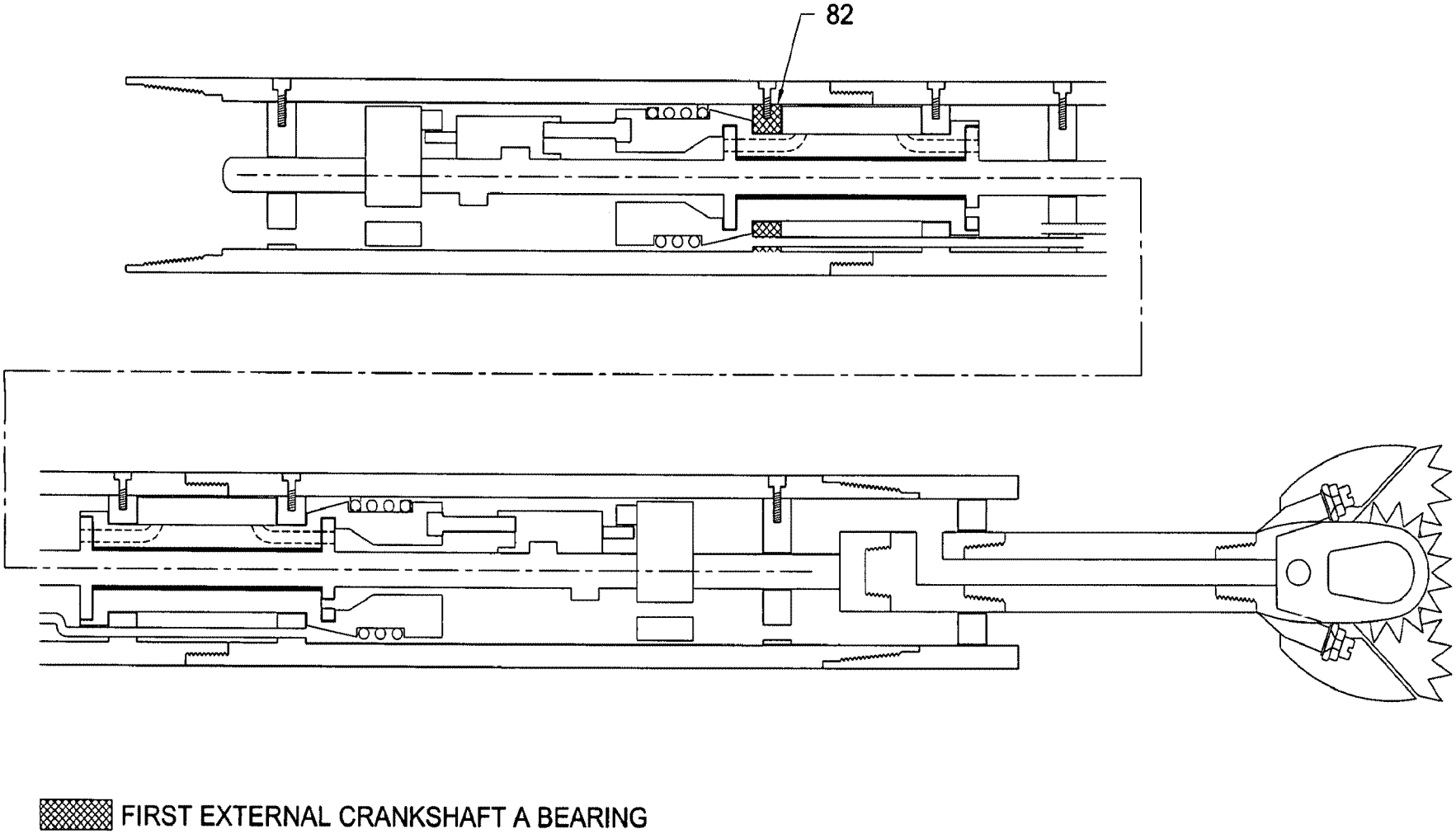
FIG. 5 shows the First External Crankshaft A Bearing 82 of the Mud Motor Assembly.

FIG. 5 shows the First External Crankshaft A Bearing 82 of the Mud Motor Assembly.

Figure 5A:
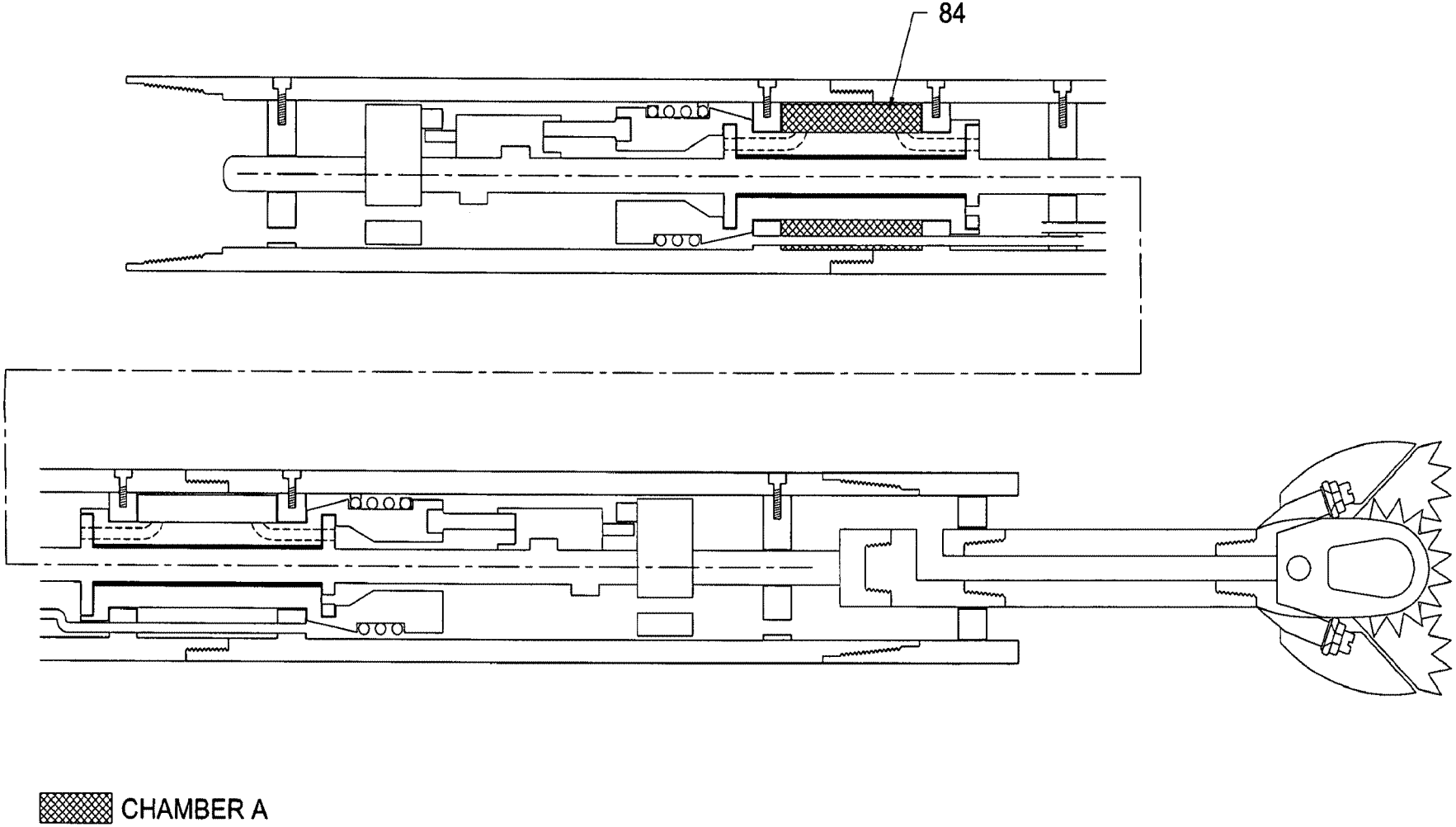
FIG. 5A schematically shows Chamber A 84 of the Mud Motor Assembly.

FIG. 5A schematically shows Chamber A 84 of the Mud Motor Assembly.

Figure 5B:
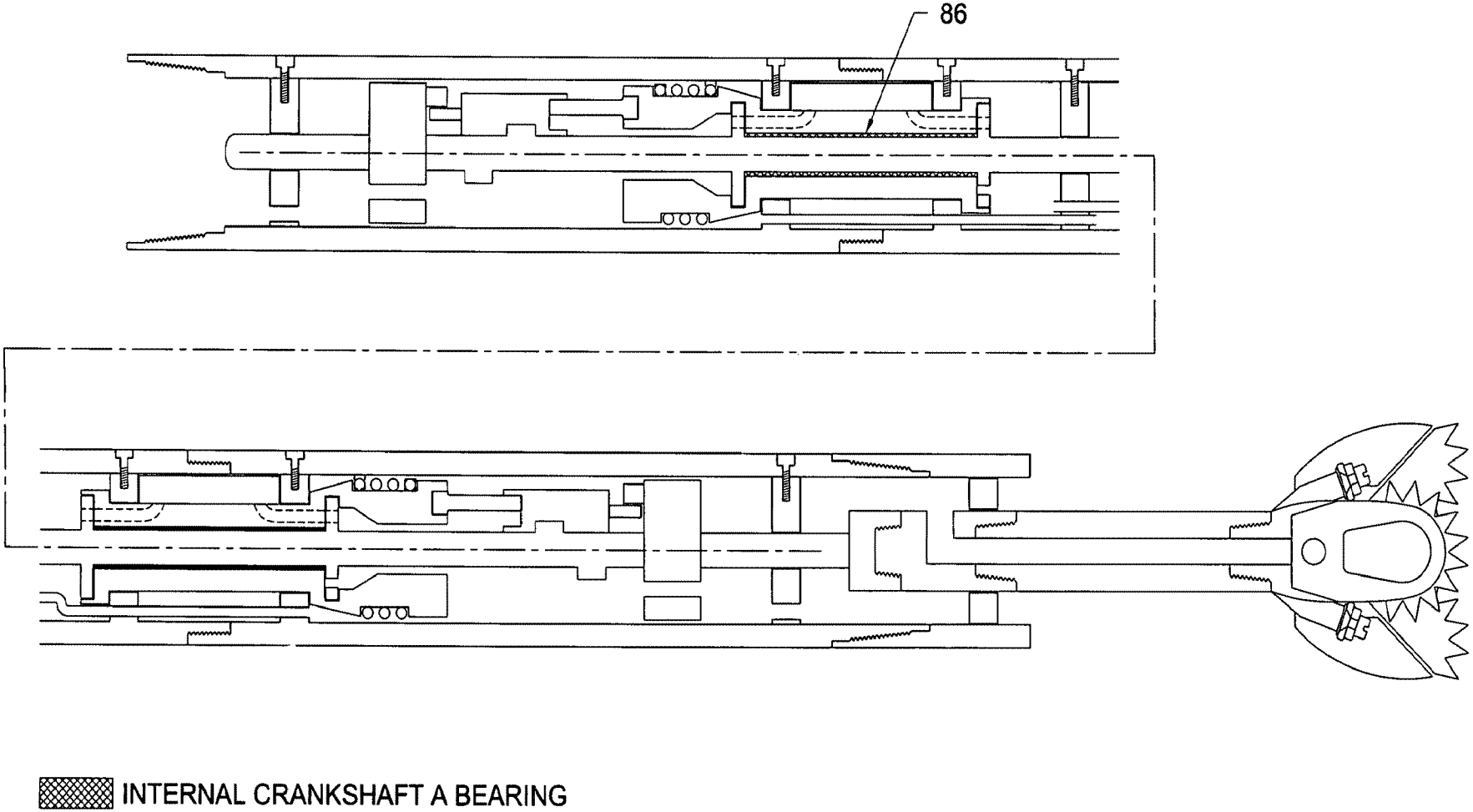
FIG. 5B shows the Internal Crankshaft A Bearing 86 of the Mud Motor Assembly.

FIG. 5B shows the Internal Crankshaft A Bearing 86 of the Mud Motor Assembly.

Figure 5C:
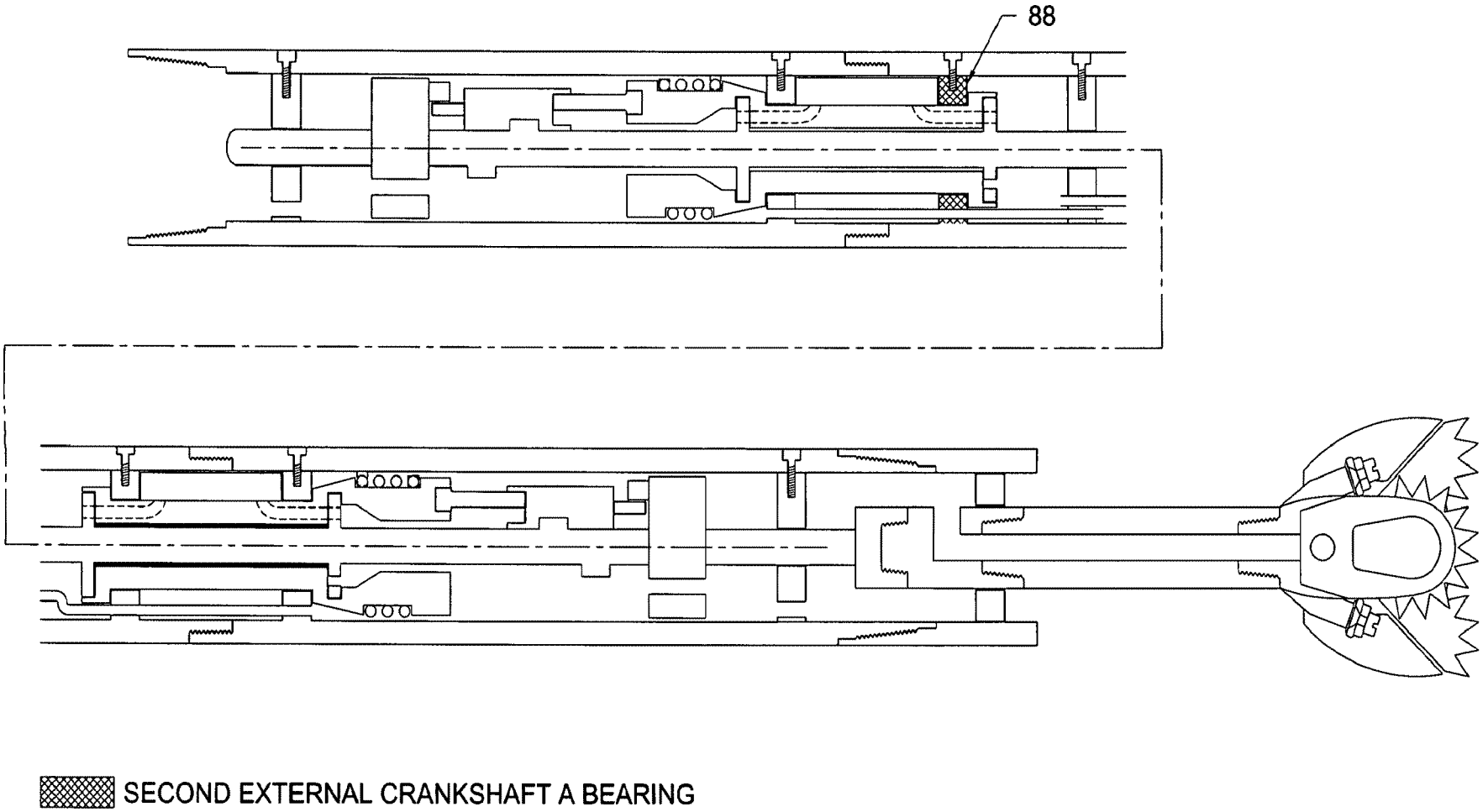
FIG. 5C shows Second External Crankshaft A Bearing 88 of the Mud Motor Assembly.

FIG. 5C shows Second External Crankshaft A Bearing 88 of the Mud Motor Assembly.

Figure 5D:
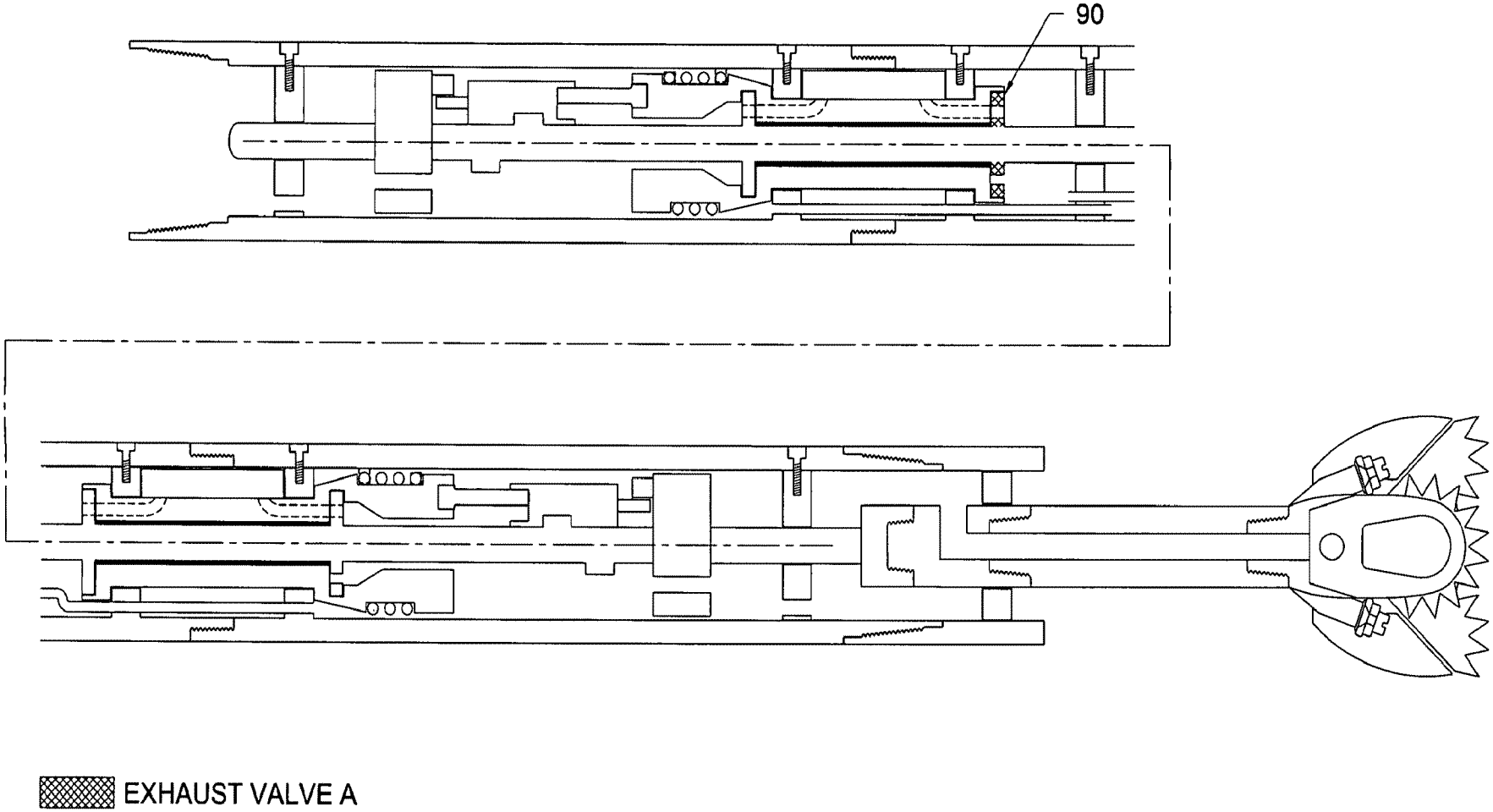
FIG. 5D shows Exhaust Valve A 90 of the Mud Motor Assembly.

FIG. 5D shows Exhaust Valve A 90 of the Mud Motor Assembly.

Figure 5E:
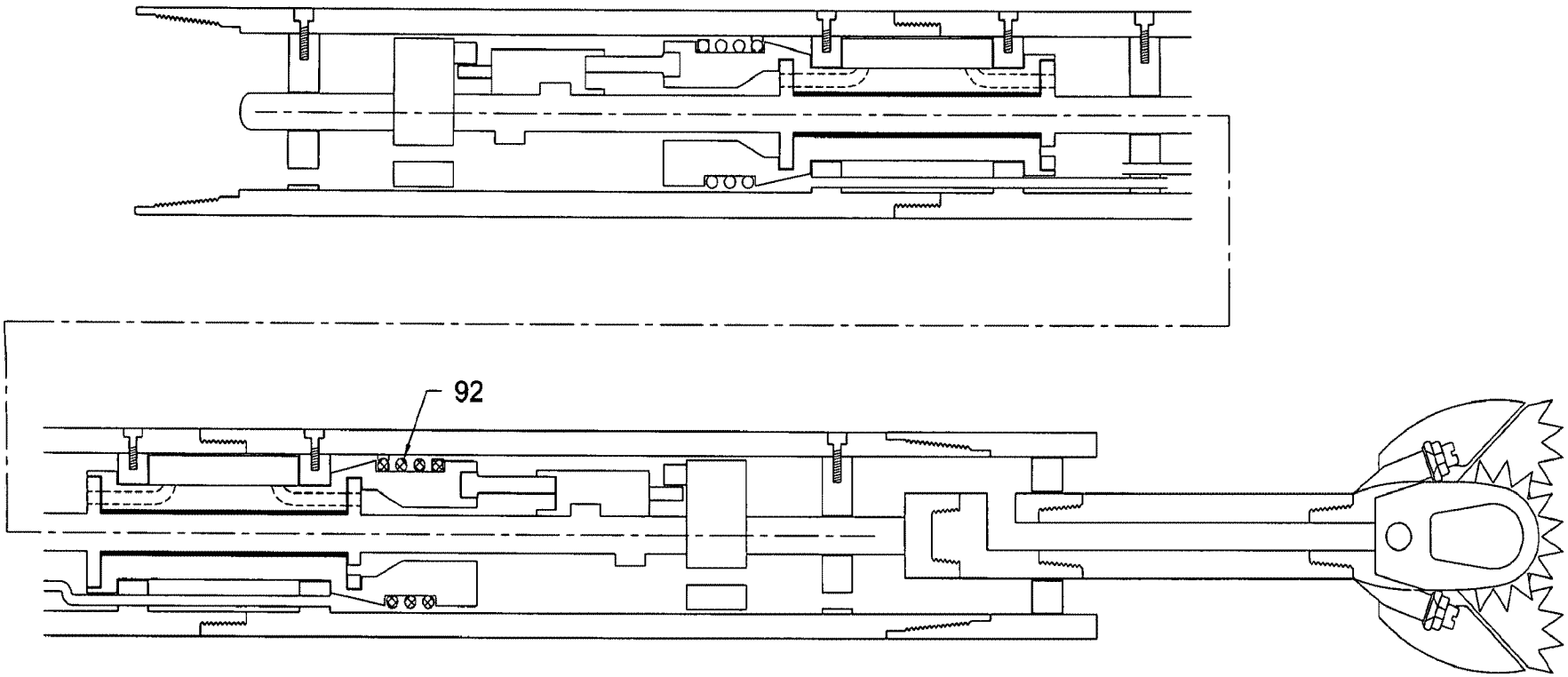
FIG. 5E shows Return Spring B 92 of the Mud Motor Assembly.

FIG. 5E shows Return Spring B 92 of the Mud Motor Assembly.

Figure 5F:
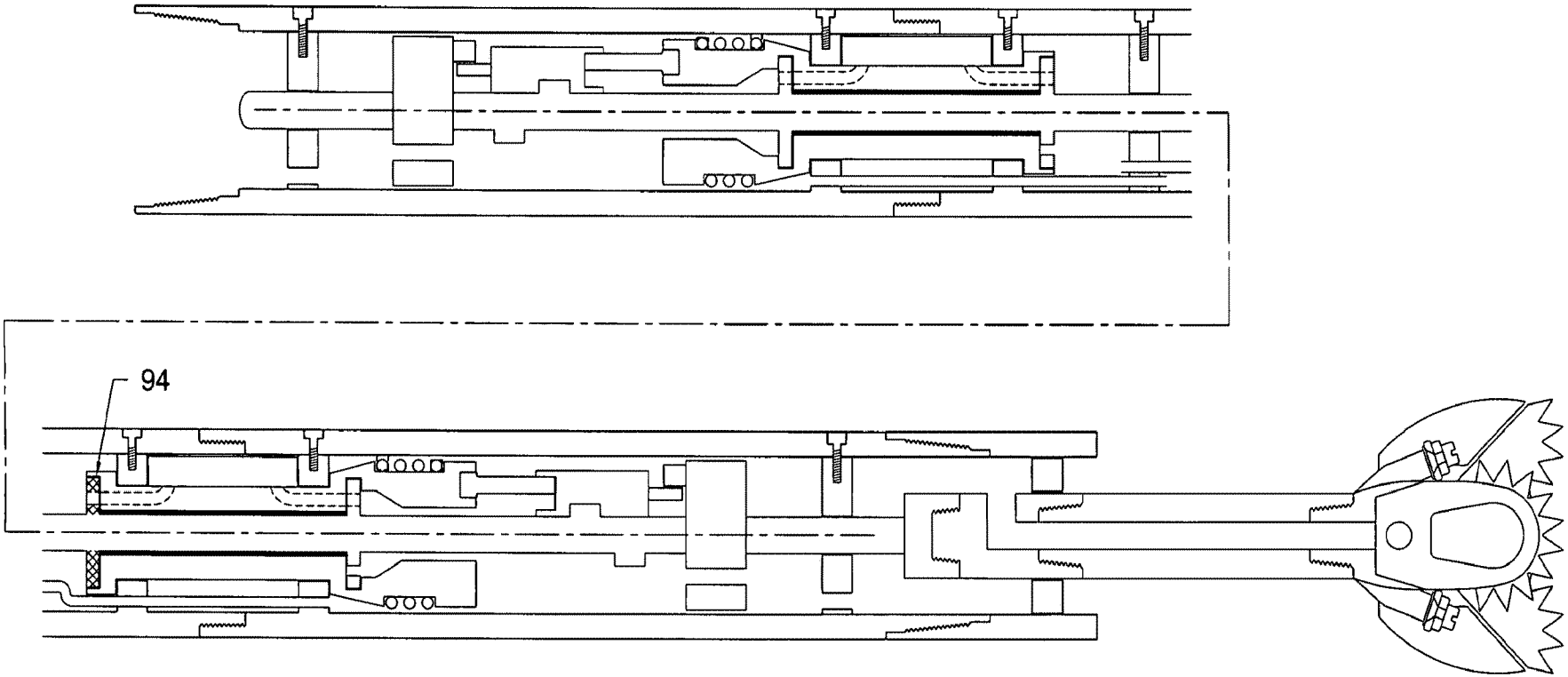
FIG. 5F shows Intake Valve B 94 of the Mud Motor Assembly.

FIG. 5F shows Intake Valve B 94 of the Mud Motor Assembly.

Figure 5G:
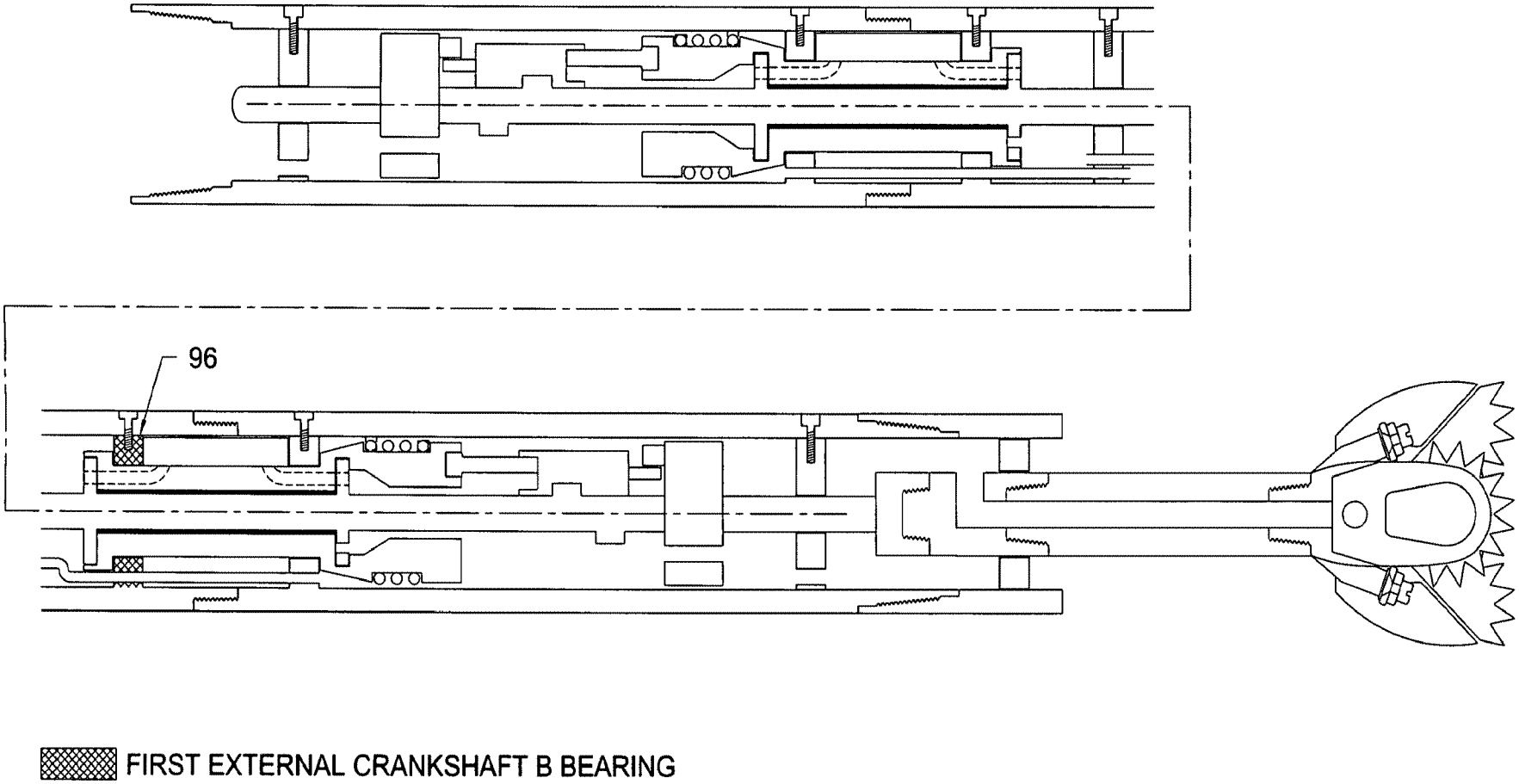
FIG. 5G shows the First External Crankshaft B Bearing 96 of the Mud Motor Assembly.

FIG. 5G shows the First External Crankshaft B Bearing 96 of the Mud Motor Assembly.

Figure 5H:
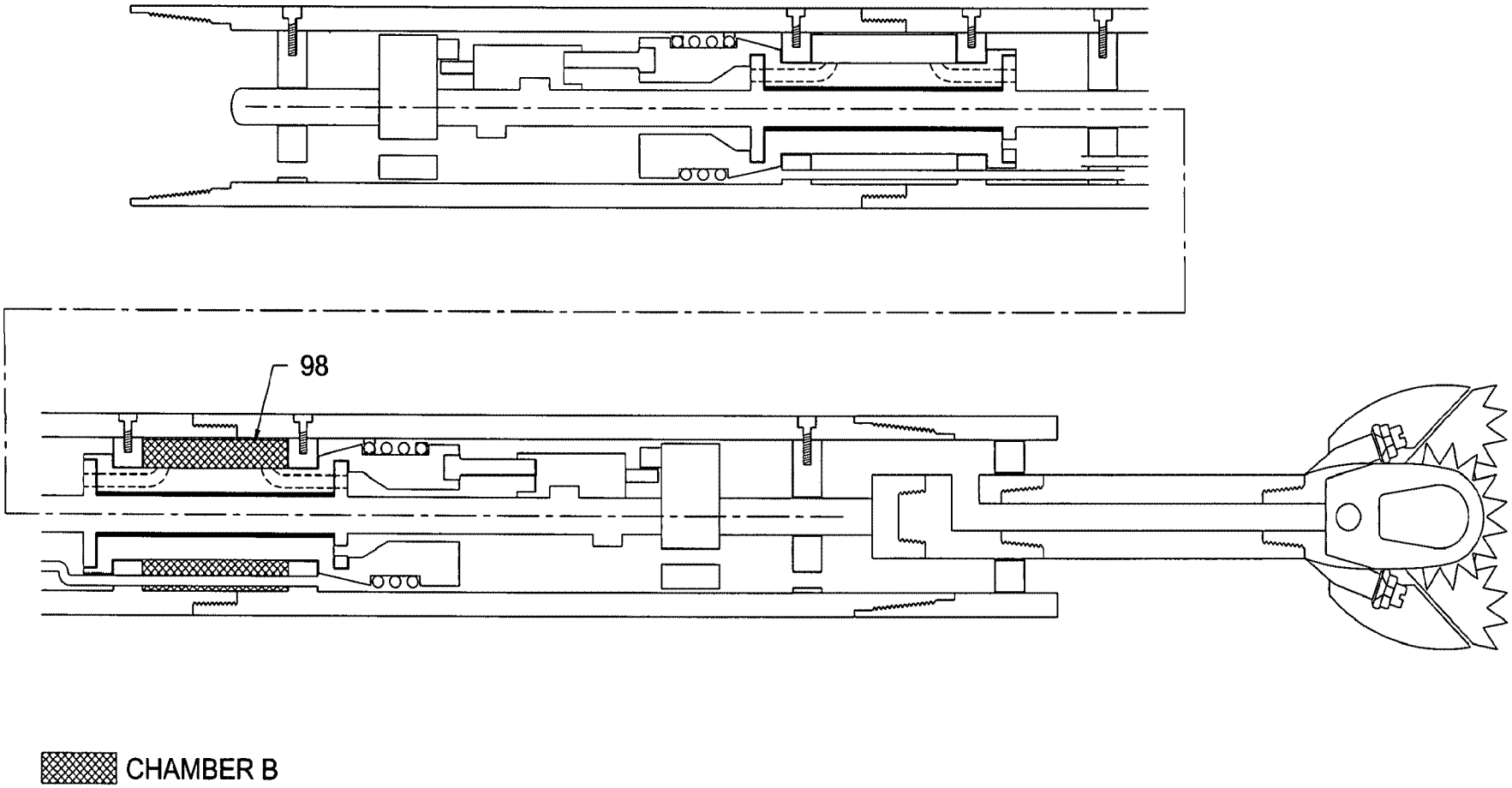
FIG. 5H schematically shows Chamber B 98 of the Mud Motor Assembly.

FIG. 5H schematically shows Chamber B 98 of the Mud Motor Assembly.

Figure 5J:
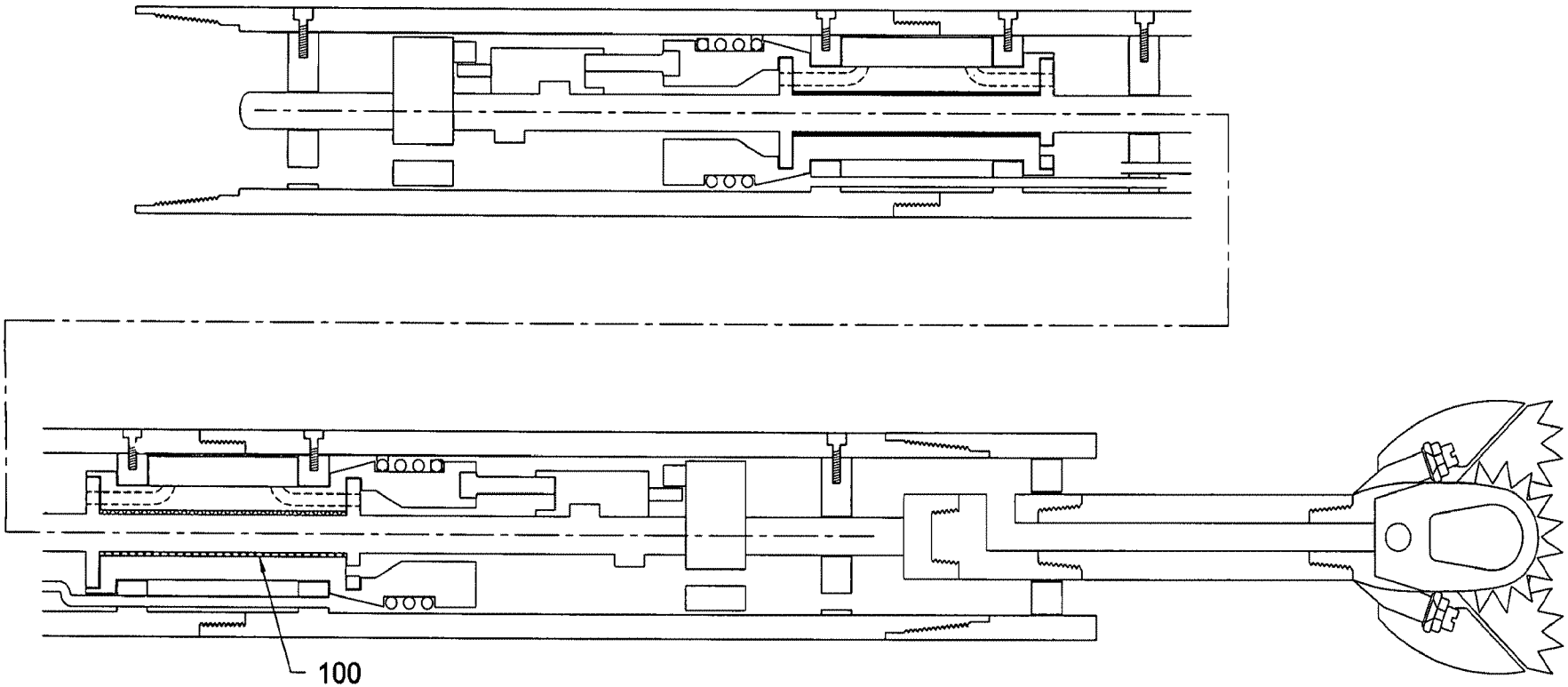
FIG. 5J shows the Internal Crankshaft B Bearing 100 of the Mud Motor Assembly.

FIG. 5J shows the Internal Crankshaft B Bearing 100 of the Mud Motor Assembly.

Figure 5K:
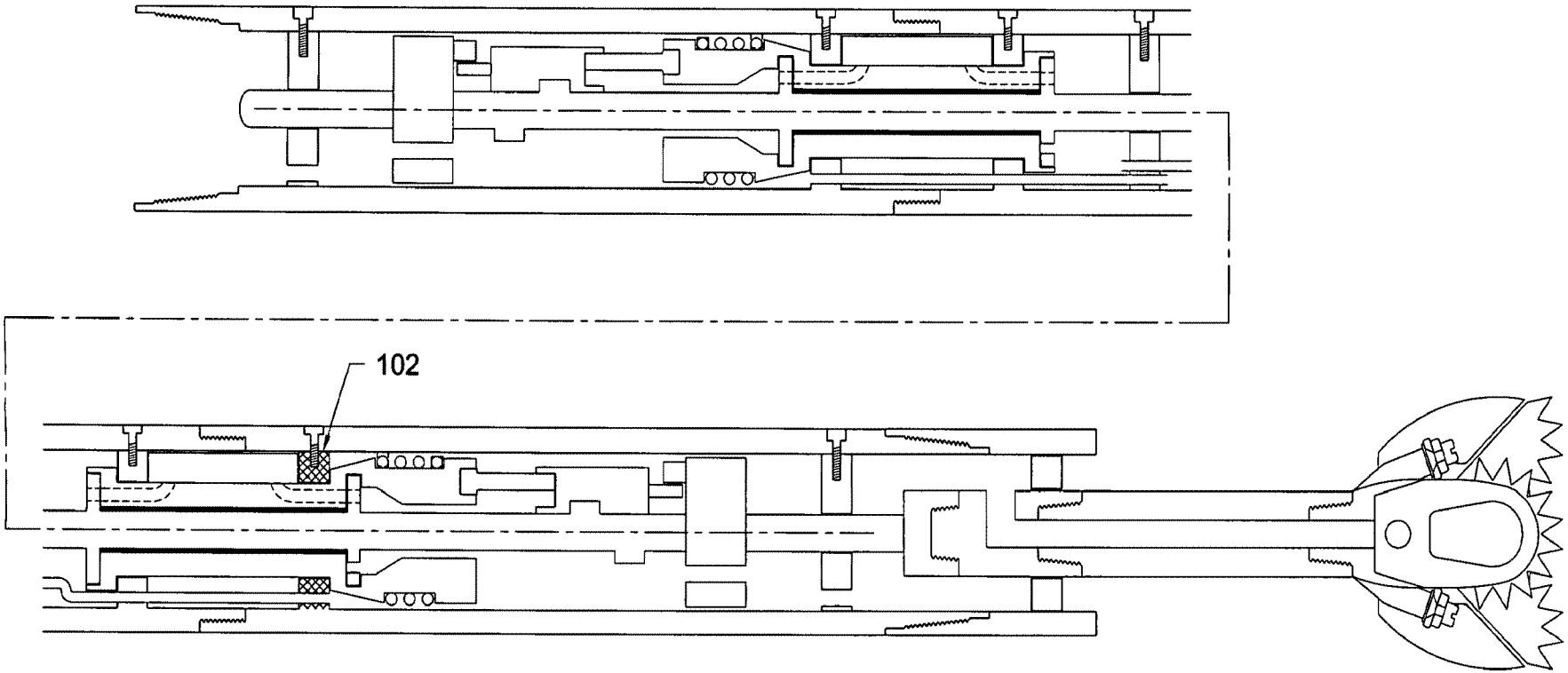
FIG. 5K shows the Second External Crankshaft B Bearing 102 of the Mud Motor Assembly.

FIG. 5K shows the Second External Crankshaft B Bearing 102 of the Mud Motor Assembly.

Figure 5L:
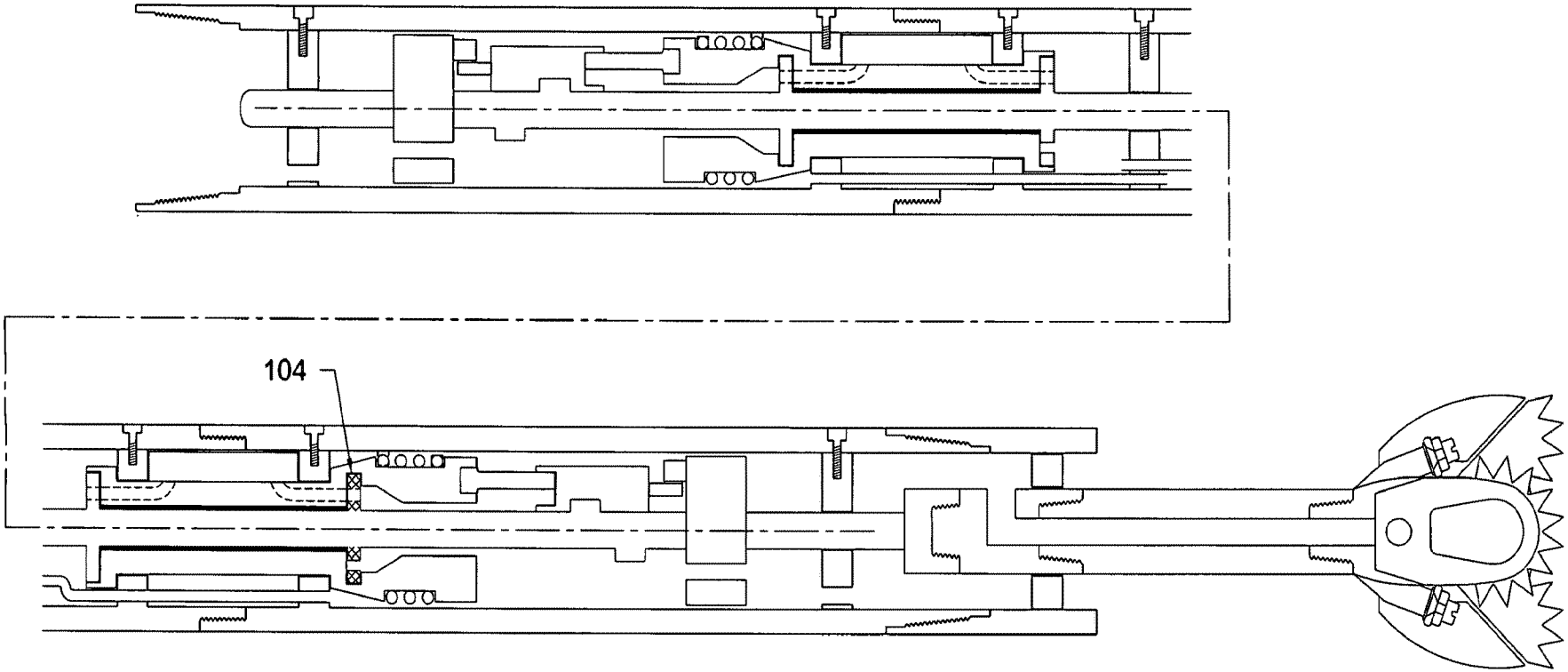
FIG. 5L shows the Exhaust Valve B 104 of the Mud Motor Assembly.

FIG. 5L shows the Exhaust Valve B 104 of the Mud Motor Assembly.

Figure 5M:
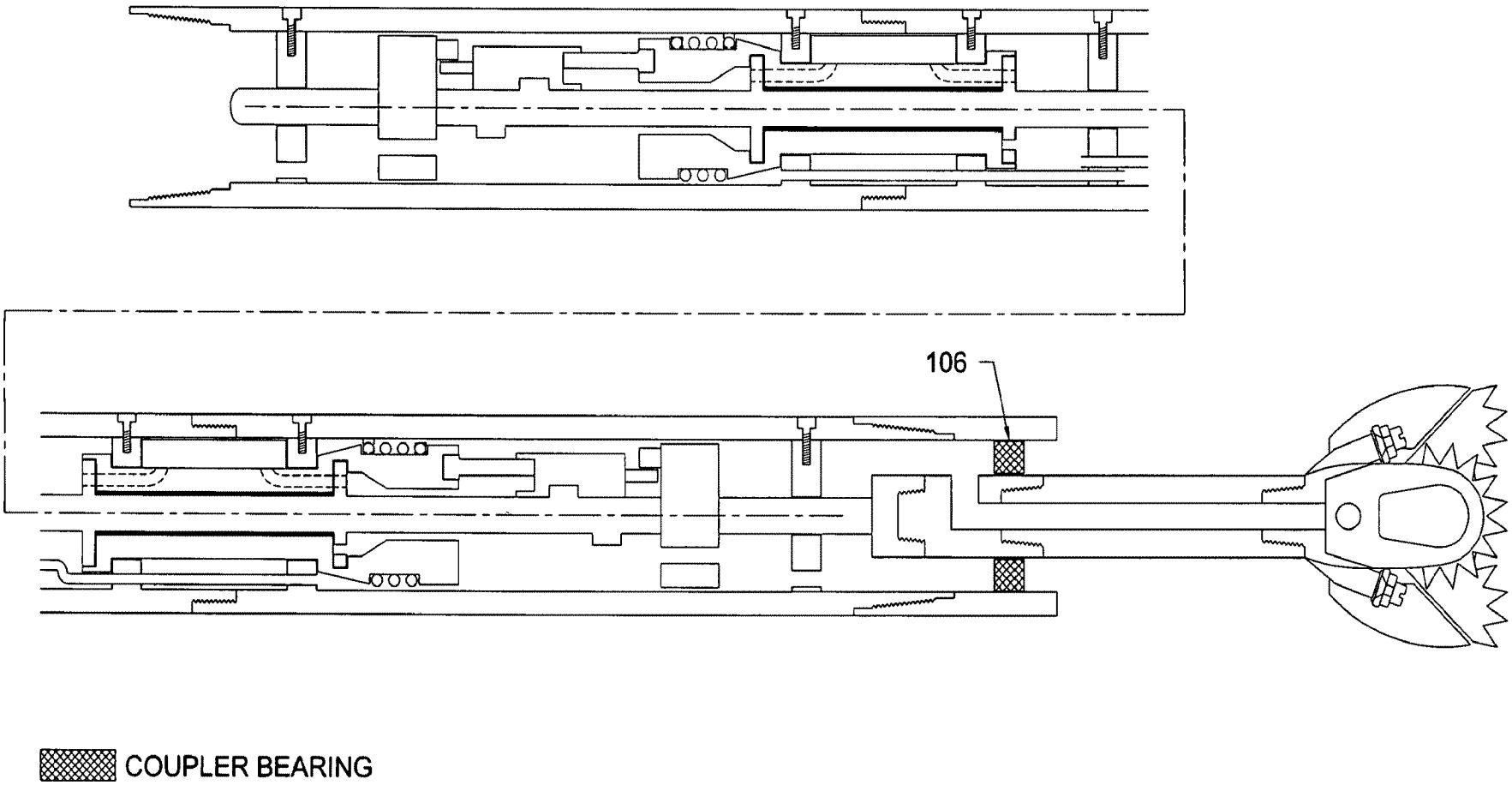
FIG. 5M shows the Coupler Bearing 106 of the Mud Motor Assembly.

FIG. 5M shows the Coupler Bearing 106 of the Mud Motor Assembly.

Enlarged Portions of Mud Motor Assembly (Eight Figures)

Figure 6:
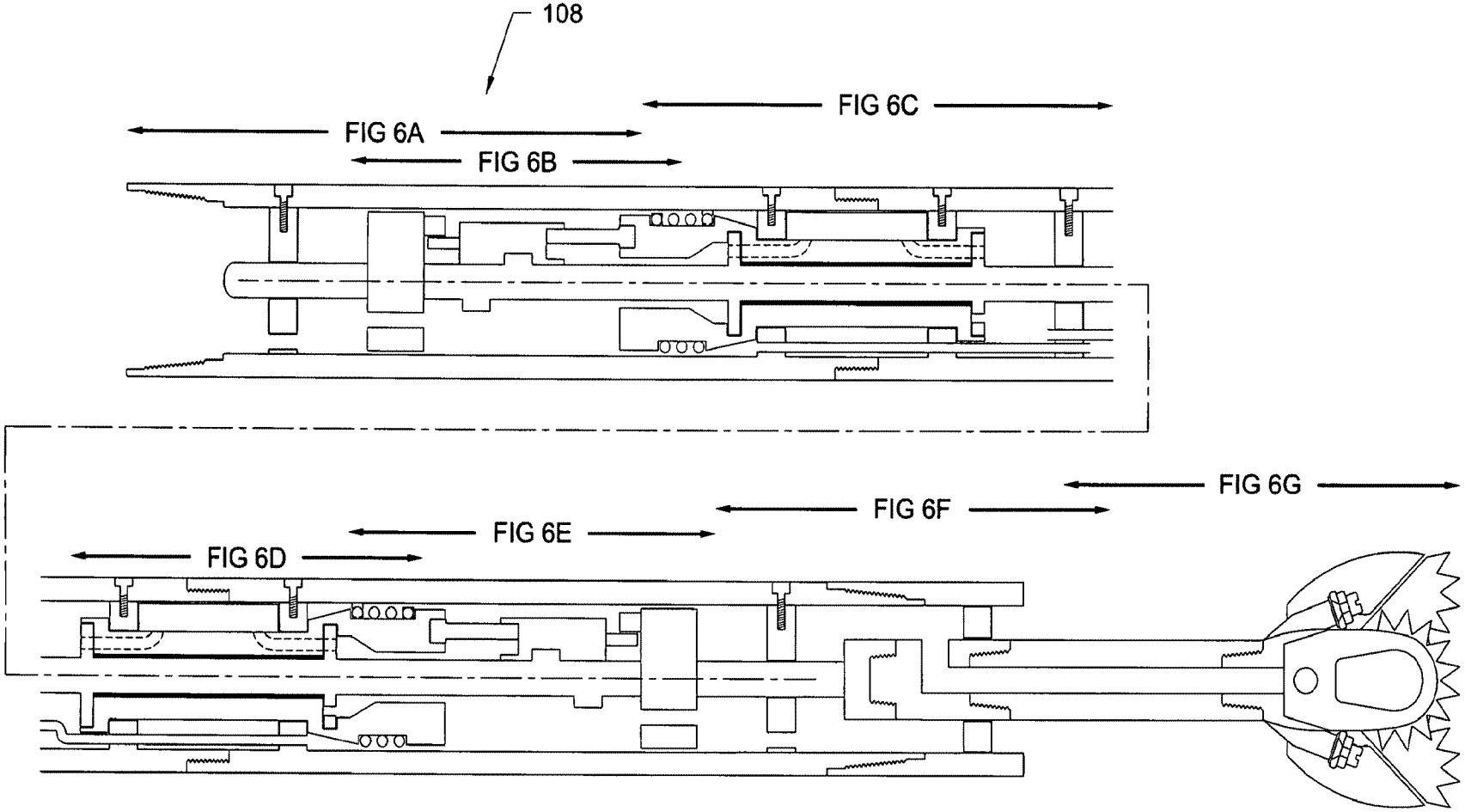
FIG. 6 side view of the Mud Motor Assembly 108 which is longitudinally divided into portions shown in FIGS. 6A, 6B, 6C, 6D, 6E, 6F and 6G.

FIG. 6 shows a particular side view of the Mud Motor Assembly 108 which is longitudinally divided into seven portions respectively identified by double-ended arrows meant to designate the particular longitudinal portions appearing in FIGS. 6A, 6B, 6C, 6D, 6E, 6F and 6G.

Figure 6A:
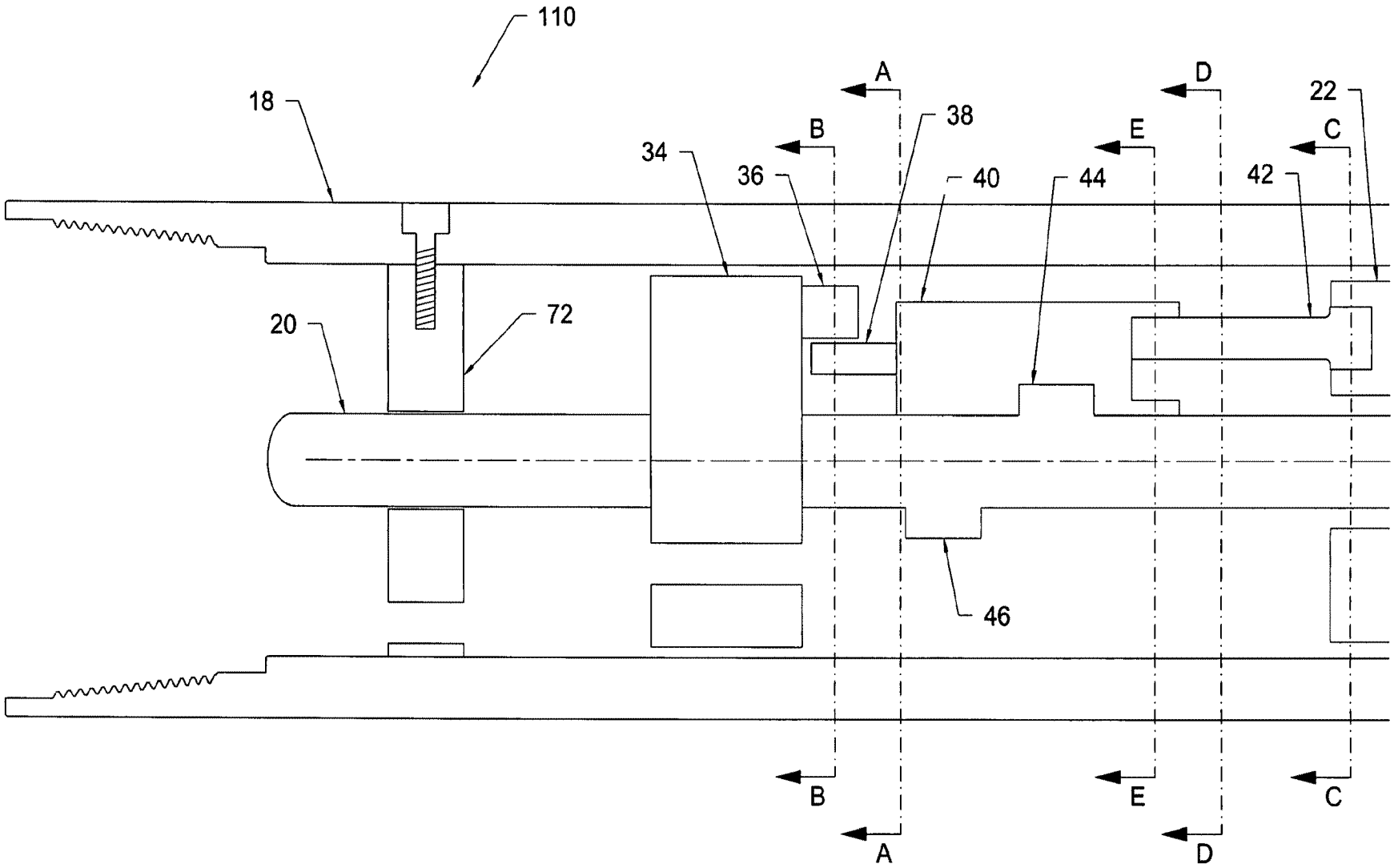
FIG. 6A shows an enlarged first longitudinal portion 110 of the Mud Motor Assembly as noted on FIG. 6.

FIG. 6A shows an enlarged first longitudinal portion 110 of the Mud Motor Assembly as noted on FIG. 6. Cross-sections AA, BB, CC, DD and EE are defined in FIG. 6A.

Figure 6B:
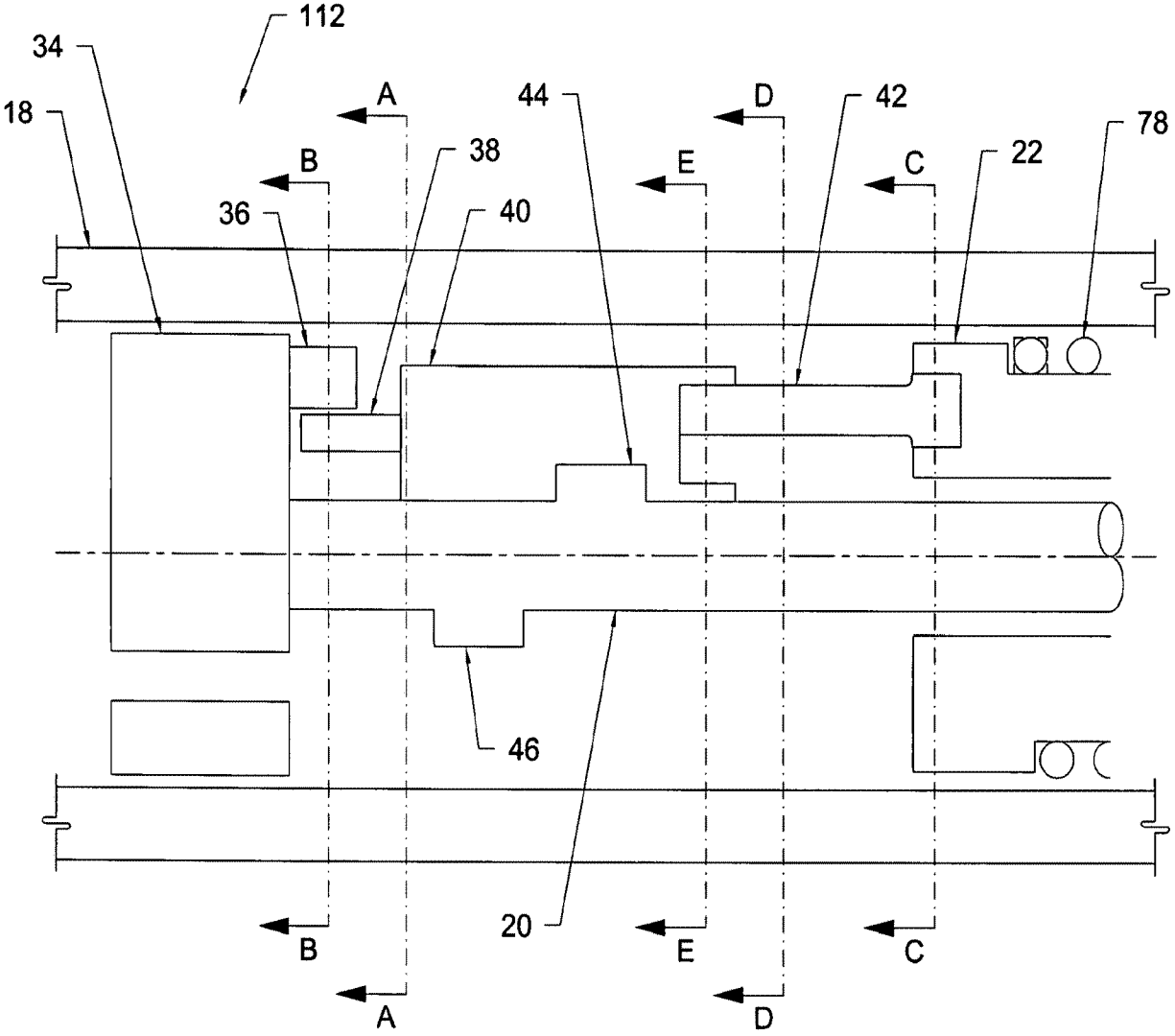
FIG. 6B shows an enlarged second longitudinal portion 112 of the Mud Motor Assembly.

FIG. 6B shows an enlarged second longitudinal portion 112 of the Mud Motor Assembly as noted on FIG. 6. Cross-sections AA, BB, CC, DD and EE are defined in FIG. 6B.

Figure 6C:
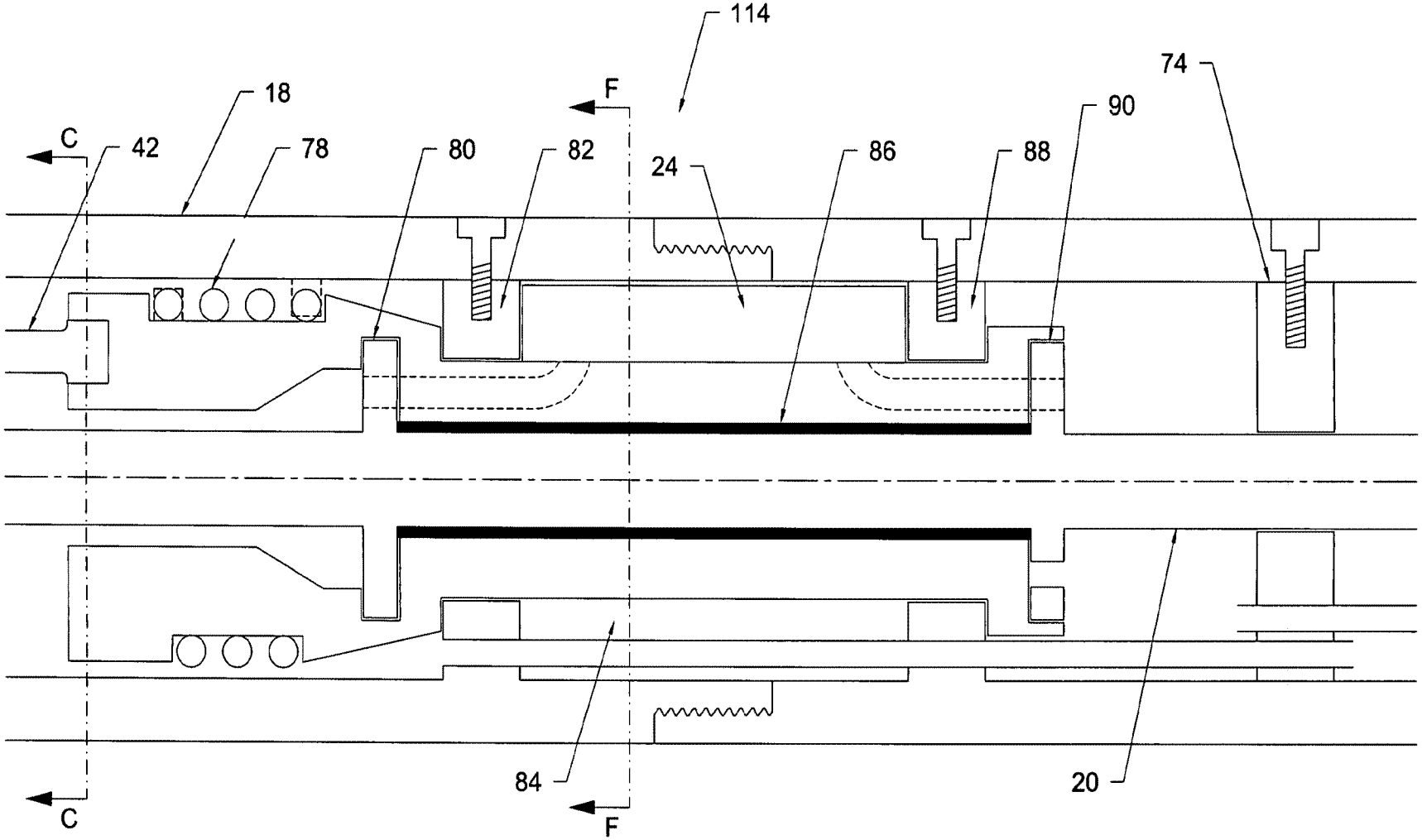
FIG. 6C shows an enlarged third longitudinal portion 114 of the Mud Motor Assembly.

FIG. 6C shows an enlarged third longitudinal portion 114 of the Mud Motor Assembly as noted on FIG. 6. Cross-section CC is defined in FIG. 6C.

Figure 6D:
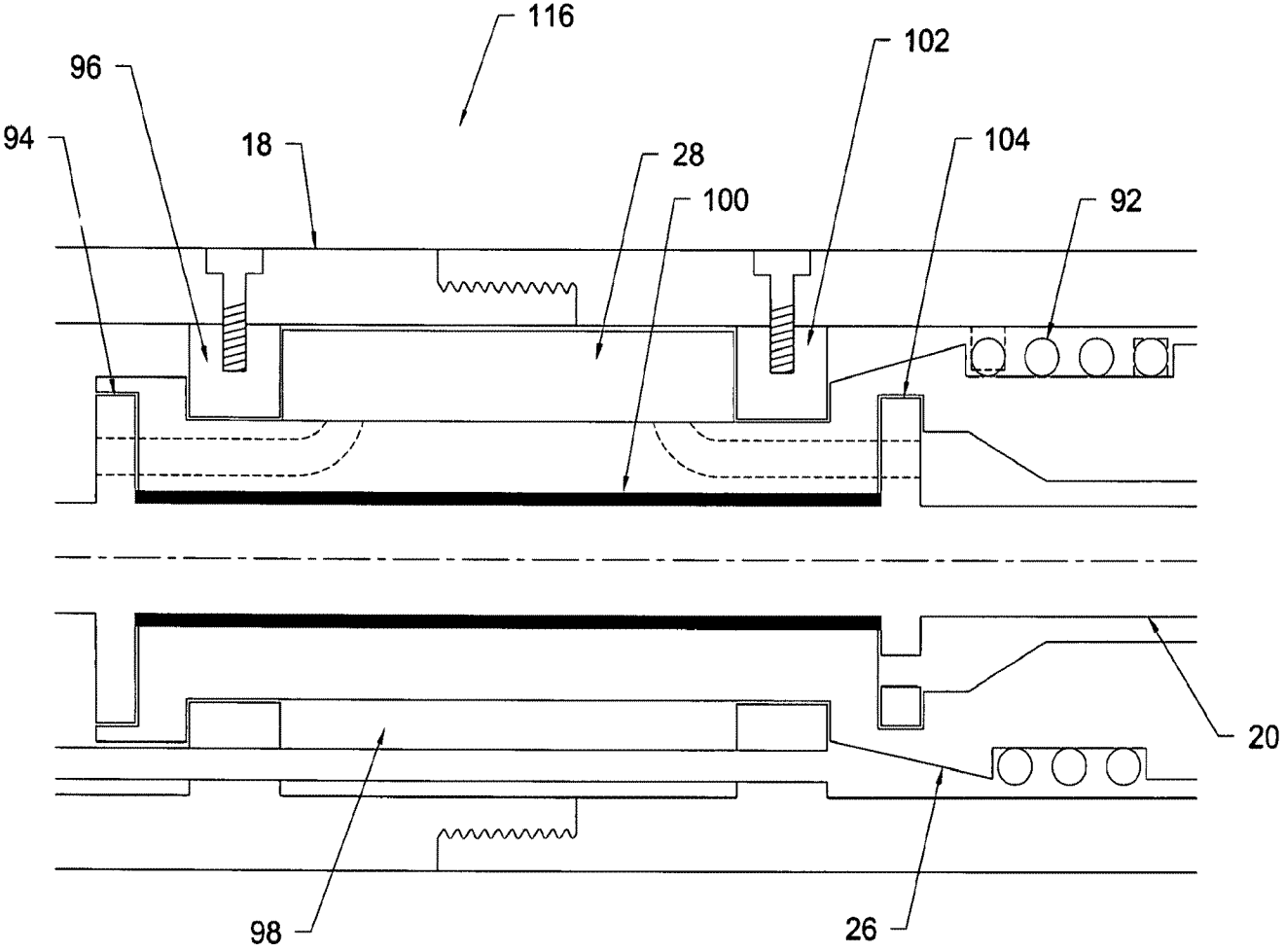
FIG. 6D shows an enlarged fourth longitudinal portion 116 of the Mud Motor Assembly.

FIG. 6D shows an enlarged fourth longitudinal portion 116 of the Mud Motor Assembly as noted on FIG. 6.

Figure 6E:
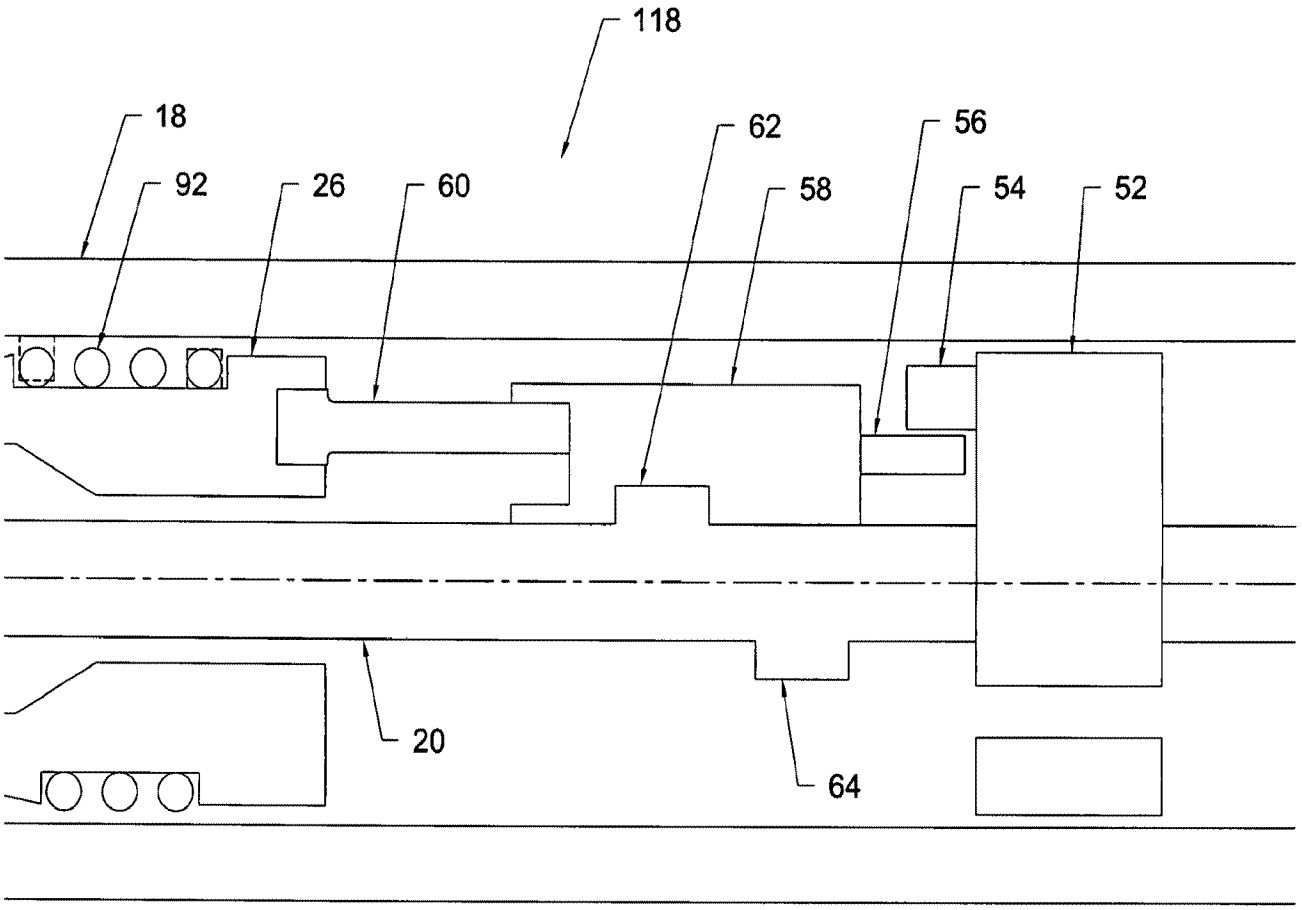
FIG. 6E shows an enlarged fifth longitudinal portion 118 of the Mud Motor Assembly.

FIG. 6E shows an enlarged fifth longitudinal portion 118 of the Mud Motor Assembly as noted on FIG. 6.

Figure 6F:
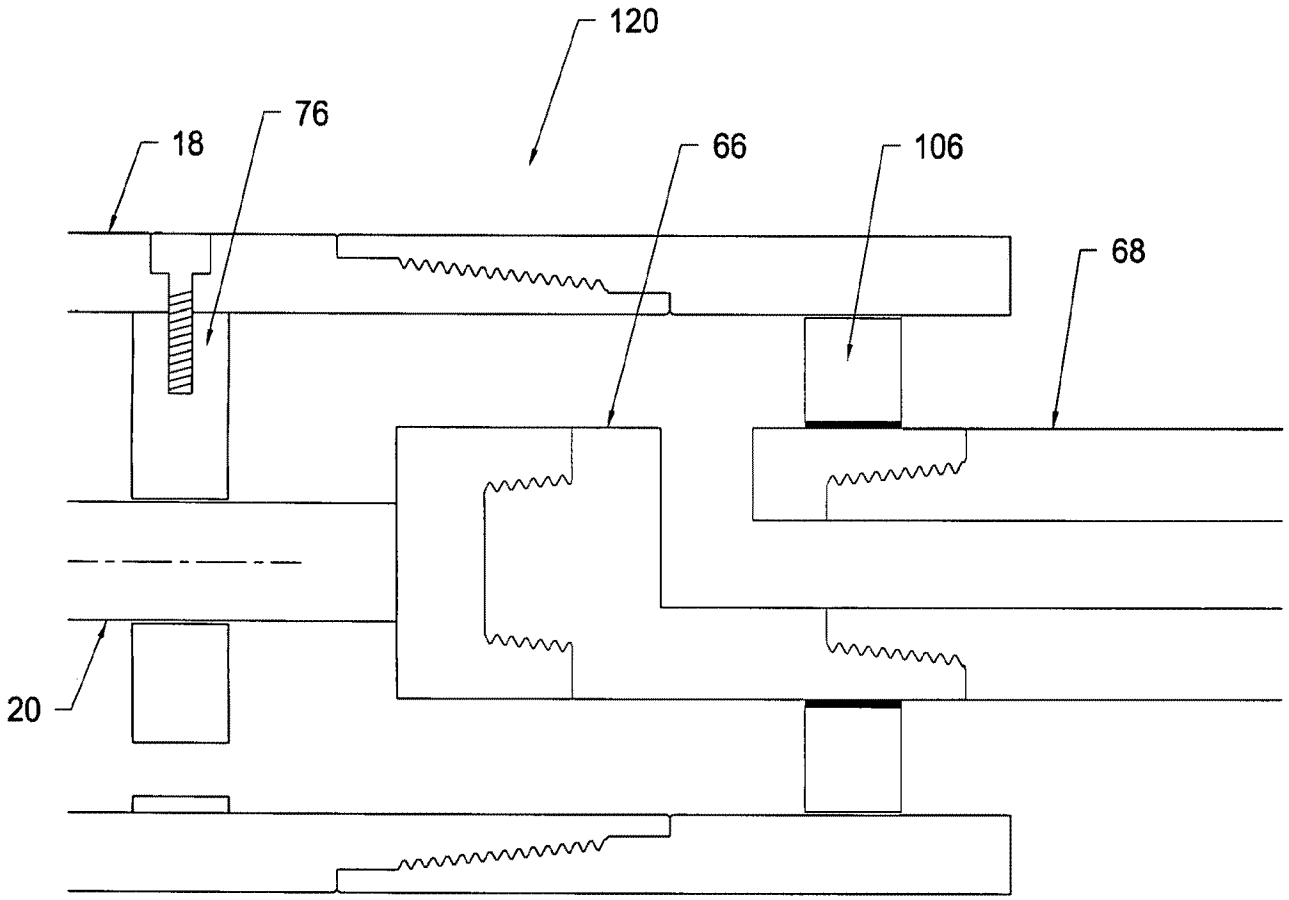
FIG. 6F shows an enlarged sixth longitudinal portion 120 of the Mud Motor Assembly.

FIG. 6F shows an enlarged sixth longitudinal portion 120 of the Mud Motor Assembly as noted on FIG. 6.

Figure 6G:
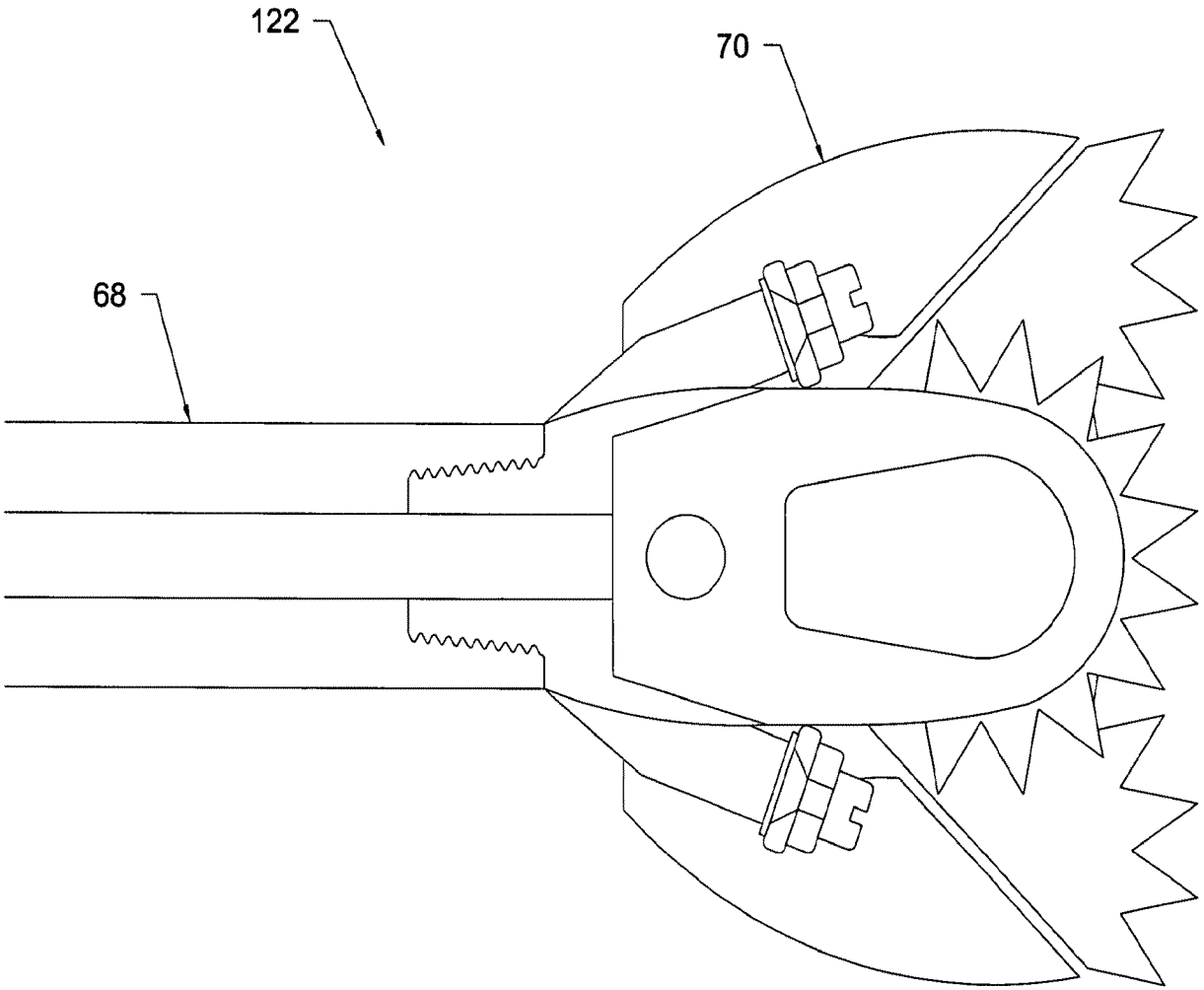
FIG. 6G shows an enlarged seventh longitudinal portion 122 of the Mud Motor Assembly.

FIG. 6G shows an enlarged seventh longitudinal portion 122 of the Mud Motor Assembly as noted on FIG. 6.

Schematic Views of Hydraulic Chambers S and T (Four Figures)

FIG. 7

Figure 7:
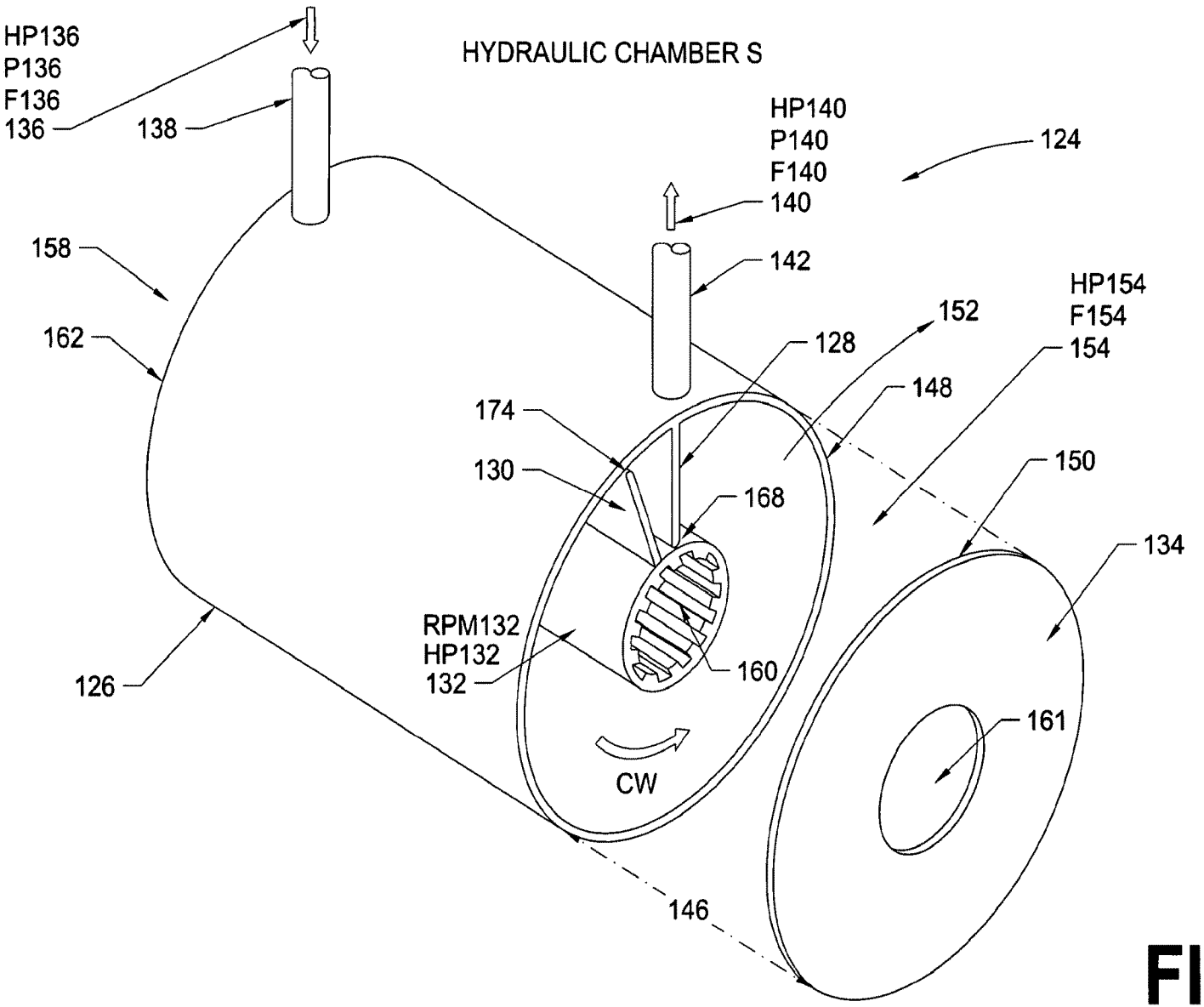
FIG. 7 shows an Isometric View of Hydraulic Chamber S 124 that is a schematic portion of one embodiment of one embodiment of a Mud Motor Assembly.

FIG. 7 shows an Isometric View of Hydraulic Chamber S 124 that is a schematic portion of one embodiment of one embodiment of a Mud Motor Assembly. This view is looking uphole. It posses cylindrical housing 126 and integral interior backstop 128 that may be welded to the interior of the housing 126. Piston S 130 is welded to rotating shaft 132 that rotates in the clockwise direction (see the legend CW) looking downhole.

Lower plate 134 and upper plate 135 (not shown) form a hydraulic cavity. Relatively high pressure mud 136 is forced into input port 138, and relatively low pressure mud 140 flows out of the hydraulic chamber through exhaust port 142. The distance of separation 146 between the downhole edge 148 of the cylindrical housing and the uphole face 150 of lower plate 134 results in a gap between these components that generally results in mud flowing in direction 152 during the Power Stroke of Piston S 130. The distance of separation and other relevant geometric details defines of the leaky seal 154. Different distances of separation may be chosen. For example, various embodiments of the invention may choose this distance to be 0.010, 0.020, 0.030 or 0.040 inches. A close tolerance in one embodiment might be chosen to be 0.001 inches. A loose tolerance in another embodiment might be chosen to be 0.100 inches. How much mud per unit time F154 flows out of this leaky seal 154 at a given pressure P136 of mud flowing into input port 138 is one parameter of significant interest. Rotating shaft 132 is constrained to rotate concentrically within the interior of cylindrical housing 126 by typical bearing assemblies 156 (not shown for brevity) that are suitably affixed to a splined shaft (158 not shown), a portion of which slips into splined shaft interior 160 through hole 161 in lower plate 134.

In FIG. 7, pressure P136 is applied to input port 138 that causes mud to flow into that input port 138 at the rate of F136. Typical units of pressure P136 are in psi (pounds per square inch) and typical units of mud flow rates F136 into that input port 138 are in gpm (gallons per minute). In FIG. 7, mud 140 flows out of the exhaust port 142 at the rate of F140 and at pressure P140. In a hypothetical example, there might be only one leaky seal 154 in Hydraulic Chamber S, and then mud flows out of leaky seal 154 at the rate of F154. In the further hypothetical example that leaky seal 154 might be a tight seal and impervious to leakage, then the flow rate F136 into the Hydraulic Chamber S would then equal the flow rate F140 out of the Hydraulic Chamber S. The horsepower HP136 delivered to the mud 136 flowing into the input port 138 is given by the following:

$$HP136=P136\times F136 \quad \text{(Equation 1)}$$

The horsepower HP140 delivered to the mud 140 flowing out the exhaust port 142 is given by the following:

$$HP140=P140\times F140 \quad \text{(Equation 2)}$$

The difference in the two horsepower's is used to provide rotational power to the rotating shaft 132 (HP132) and to overcome mechanical and fluid frictional effects (HPF). So, in this case of a tight seal 154: HP132=

$$\text{HP136}-\text{HP140}-\text{HPFS} \quad \text{(Equation 3)}$$

(In general, HPFS=HPMS+HPFS, where HPMS provide the combined mechanical frictional losses and HPF are combined fluid frictional losses in Hydraulic Chamber S, and each of these components, can be further subdivided into individual subcomponents.)

This rotational power can be used to do work—including providing the rotational power to rotate a drill bit during a portion of the "Power Stroke" of Piston S 130. The rotational speed of the Piston S 130 is given by the volume swept out by the piston as it rotates about the axis of rotating shaft 132. That rotational speed is in RPM, and is defined by RPM132. If the volume swept out by Piston S due to a hypothetical 360 degree rotation is VPS360, then one estimate of the RPM is given by the following:

$$RPM=VPS360/F136 \quad \text{(Equation 4)}$$

However, if there is fluid flow F154 through leaky seal 154, then part of the power is delivered to mud flowing out of the leaky seal that is HP154. In this case, the power delivered to the rotating shaft is then given by:

$$HP132=HP136-HP140-HPFS-HP154 \quad \text{(Equation 5)}$$

In general, hydraulic cavities are relatively expensive to manufacture. And, close tolerances typically lead to relatively earlier failures—especially in the case of using Hydraulic Chamber S to provide rotational energy from mud flowing down a drill string. The looser the tolerances on the leaky seal, the less expensive, and more prone to long service lives. So, there is a trade-off between loss of horsepower delivered to mud flowing through leaky seal 154 in this one example, and expense and longevity of the related Hydraulic Chamber S.

The Hydraulic Chamber S shown in FIG. 7 may have many leaky seals.

Leaky seal 154 has been described. However, there may be another leaky seal 158 between the analogous seal between the upper edge 162 of housing 126 and the downhole face 164 (not shown) of upper plate 135 (not shown). Yet another leaky seal 168 exists between the outer radial portion of the rotating shaft 170 (not shown) and the inner edge of the backstop 172 (not shown). Yet another leaky seal 174 exists between the outer radial edge of Piston S 176 (not shown) and the inside surface of the housing 178 (not shown).

The mud flow rates associated with these leaky seals 154, 158, 168 and 174 are respectively F154, F158, F168, and F174. The horsepower's consumed by these leaking seals are respectively HP154, HP158, HP168 and HP174. In this case, the power delivered to the rotating shaft during the Powered Stroke of Piston is then given by:

$$HP132=HP136-HP140-HPFS-HP154-HP158-HP168-HP174 \quad \text{(Equation 6)}$$

The Power Stroke of Piston S 130 is defined as when Piston S is rotating CW as shown in FIG. 7. Of course, as shown there, Piston S 130 will eventually rotate through an angle approaching 360 degrees, and will hit the backstop 128. Therefore, to extract further power, Piston S 130 must be "reset" by rotation CCW back to its original starting position. This is called the Reset Stroke of Piston S 130. To provide continuous rotation to a rotating drill bit then requires other features to be described in the following.

FIG. 7A

Figure 7A:
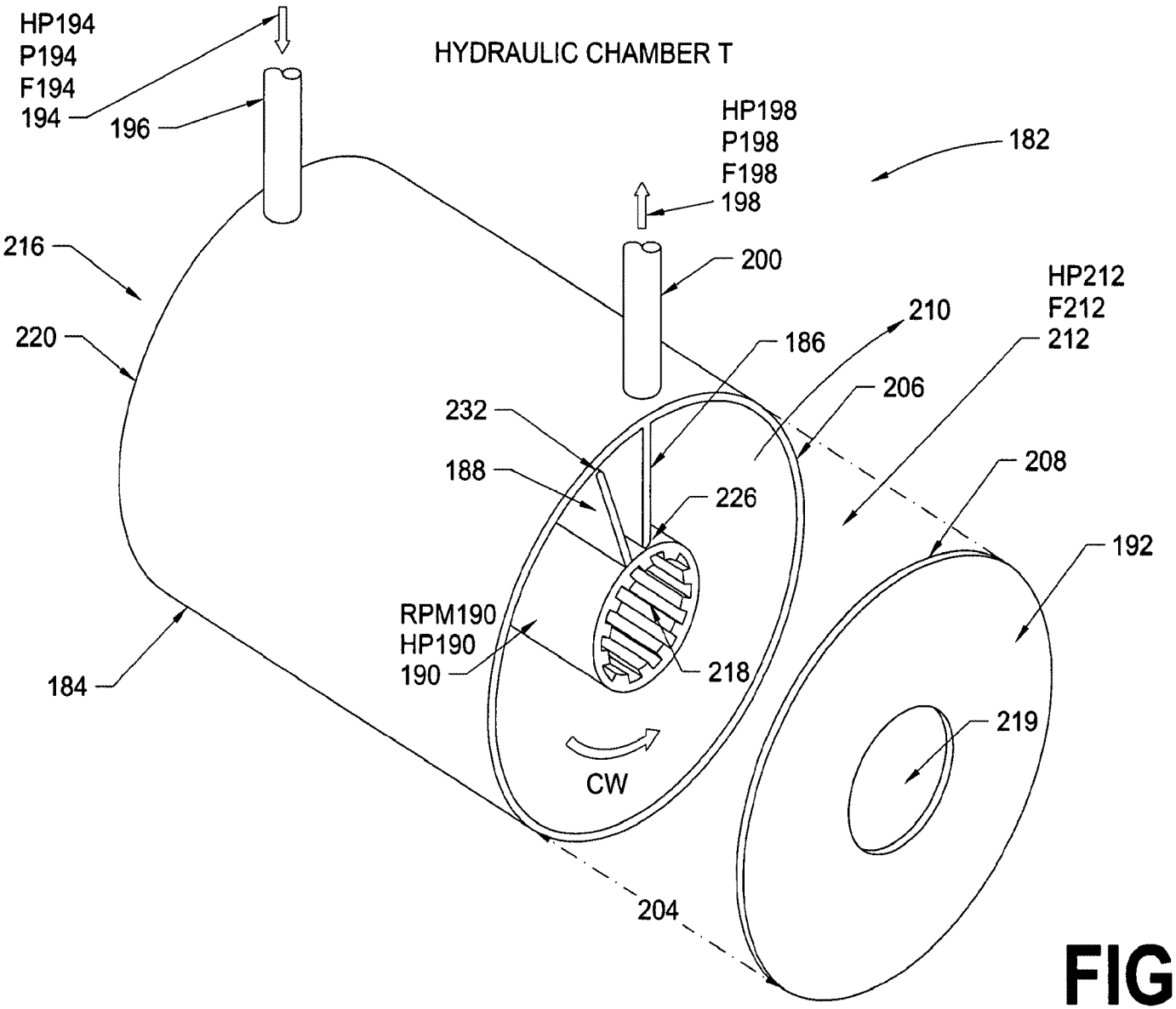
FIG. 7A shows an Isometric View of Hydraulic Chamber T 182 that is a schematic portion of one embodiment of one embodiment of a Mud Motor Assembly.

FIG. 7A shows an Isometric View of Hydraulic Chamber T 182 that is a schematic portion of one embodiment of one embodiment of a Mud Motor Assembly. This view is looking uphole. It posses cylindrical housing 184 and integral interior backstop 186 that may be welded to the interior of the housing 184. Piston T 188 is welded to rotating shaft 190 that rotates in the clockwise direction (see the legend CW) looking downhole. Lower plate 192 and upper plate 193 (not shown) form a hydraulic cavity. Relatively high pressure mud 194 is forced into input port 196, and relatively low pressure mud 198 flows out of the hydraulic chamber through exhaust port 200. The distance of separation 204 between the downhole edge 206 of the cylindrical housing and the uphole face 208 of lower plate 192 results in a gap between these components that generally results in mud flowing in direction 210 during the Power Stroke of Piston T 188. The distance of separation and other relevant geometric details defines of the leaky seal 212. Different distances of separation may be chosen. For example, various embodiments of the invention may choose this distance to be 0.010, 0.020, 0.030 or 0.040 inches. A close tolerance in one embodiment might be chosen to be 0.001 inches. A loose tolerance in another embodiment might be chosen to be 0.100 inches. A loose tolerance in another embodiment might be chosen to be 0.100 inches. How much mud per unit time F212 flows out of this leaky seal 212 at a given pressure P194 of mud flowing into input port 196 is one parameter of significant interest.

Rotating shaft 190 is constrained to rotate concentrically within the interior of cylindrical housing 184 by typical bearing assemblies 214 (not shown for brevity) that are suitably affixed to a splined shaft (216 not shown), a portion of which slips into splined shaft interior 218 through hole 219 in lower plate 192.

In FIG. 7A, pressure P194 is applied to input port 196 that causes mud to flow into that input port 196 at the rate of F194. Typical units of pressure P194 are in psi (pounds per square inch) and typical units of mud flow rates F194 into that input port 196 are in gpm (gallons per minute). In FIG.

7A, mud 198 flows out of the exhaust port 200 at the rate of F198 and at pressure P198. In a hypothetical example, there might be only one leaky seal 212 in Hydraulic Chamber T, and then mud flows out of leaky seal 212 in a direction 210 at the rate of F212. In the further hypothetical example that leaky seal 212 might be a tight seal and impervious to leakage, then the flow rate F194 into the Hydraulic Chamber T would then equal the flow rate F198 out of the Hydraulic Chamber T. The horsepower HP194 delivered to the mud 194 flowing into the input port 196 is given by the following:

$$HP194=P194\times F194 \quad \text{(Equation 7)}$$

The horsepower HP198 delivered to the mud 198 flowing out the exhaust port 200 is given by the following:

$$HP198=P198\times F198 \quad \text{(Equation 8)}$$

The difference in the two horsepower's is used to provide rotational power to the rotating shaft 190 (HP190) and to overcome mechanical and fluid frictional effects in chamber T (HPFT). So, in this case of a tight seal 212:

$$HP212=HP194-HP198-HPFT \quad \text{(Equation 9)}$$

(In general, HPFT=HPMT+HPFT, where HPMT provide the combined mechanical frictional losses HPMT and HPFT are combined fluid frictional losses in Chamber T, and each of these components, can be further subdivided into individual subcomponents.) This rotational power can be used to do work—including providing the rotational power to rotate a drill bit during a portion of the "Power Stroke" of Piston T 188. The rotational speed of the Piston T 188 is given by the volume swept out by the piston as it rotates about the axis of rotating shaft 190. That rotational speed is in RPM, and is defined by RPM190. If the volume swept out by Piston T due to a hypothetical 360 degree rotation is VPT360, then one estimate of the RPM is given by the following:

$$RPM=VPT360/F136 \quad \text{(Equation 10)}$$

However, if there is fluid flow F212 through leaky seal 212, then part of the power is delivered to mud flowing out of the leaky seal that is HP212. In this case, the power delivered to the rotating shaft is then given by:

$$HP190=HP194-HP198-HPFT-HP212 \quad \text{(Equation 11)}$$

In general, hydraulic cavities are relatively expensive to manufacture. And, close tolerances typically lead to relatively earlier failures—especially in the case of using Hydraulic Chamber T to provide rotational energy from mud flowing down a drill string. The looser the tolerances on the leaky seal, the less expensive, and more prone to long service lives. So, there is a trade-off between loss of horsepower delivered to mud flowing through leaky seal 212 in this one example, and expense and longevity of the related Hydraulic Chamber T.

The Hydraulic Chamber T shown in FIG. 7A may have many leaky seals. Leaky seal 212 has been described. However, there may be another leaky seal 216 between the analogous seal between the upper edge 220 of housing 184 and the downhole face 222 (not shown) of upper plate 193 (not shown). Yet another leaky seal 226 exists between the outer radial portion of the rotating shaft 228 (not shown) and the inner edge of the backstop 230 (not shown). Yet another leaky seal 232 exists between the outer radial edge of Piston T 234 (not shown) and the inside surface of the housing 236 (not shown).

The mud flow rates associated with these leaky seals 212, 216, 226 and 232 are respectively F212, F216, F226, and 232. The horsepower's consumed by these leaking seals are respectively HP212, HP216, HP226 and HP232. In this case, the power delivered to the rotating shaft during the Powered Stroke of Piston T is then given by:

$$HP190=HP194-HP198-HPFT-HP212-HP216-HP226-HP232 \quad \text{(Equation 12)}$$

The Power Stroke of Piston T 188 is defined as when Piston T is rotating CW as shown in FIG. 7A. Of course, as shown there, Piston T 188 will eventually rotate through an angle approaching 360 degrees, and will hit the backstop 186. Therefore, to extract further power, Piston T 188 must be "reset" by rotation CCW back to its original starting position. This is called the Reset Stroke of Piston T 188. To provide continuous rotation to a rotating drill bit then requires other features to be described in the following.

Figure 7B:
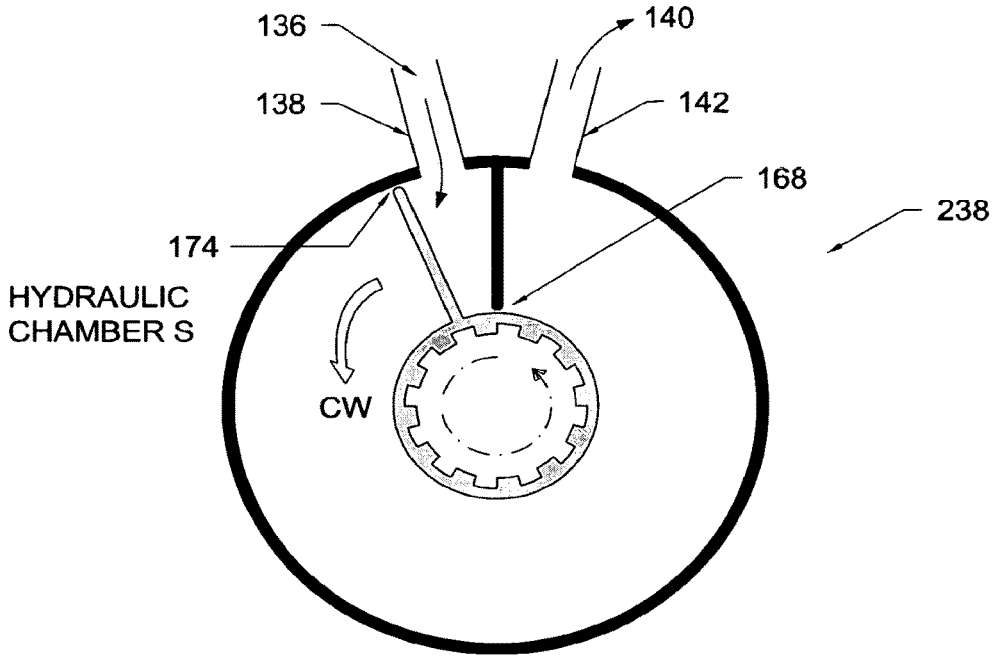
FIG. 7B shows a end view 238 of Chamber S looking uphole which is shown isometrically in FIG. 7.
Figure 7C:
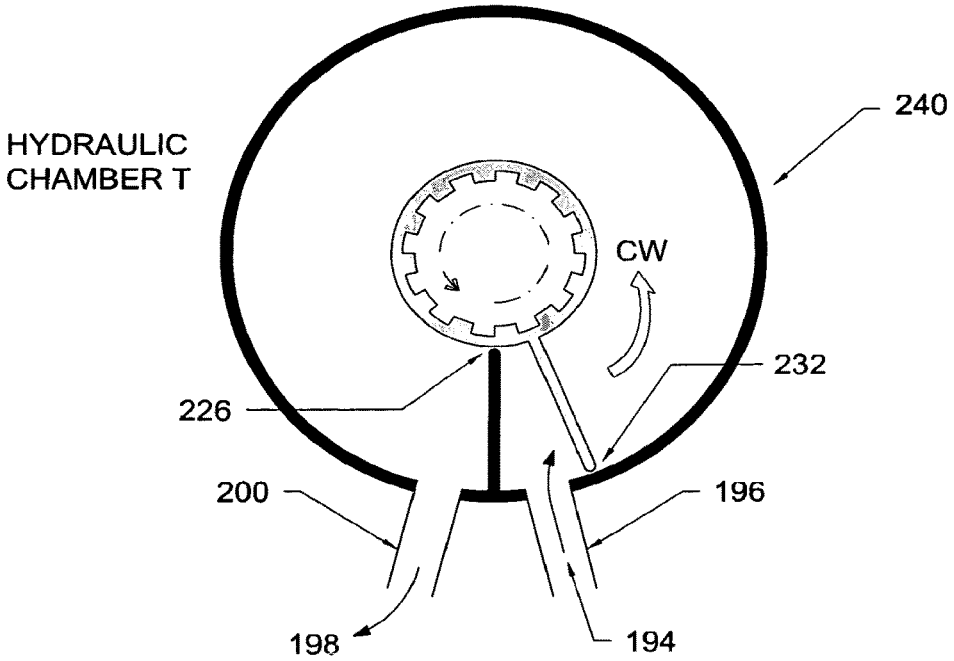
FIG. 7C shows an End View 240 of Chamber T looking uphole which is shown isometrically in FIG. 7A.

FIGS. 7B and 7C

FIG. 7B shows a end view 238 of Chamber S looking uphole which is shown isometrically in FIG. 7. The other numerals have been previously defined above.

FIG. 7C shows an End View 240 of Chamber T looking uphole which is shown isometrically in FIG. 7A. The other numerals have been previously defined above.

Two Hydraulic Chambers

Various possibilities were examined that provided a mud motor assembly having two hydraulic chambers, each having its own power stroke and return stroke, acting together, and providing continuous power to a rotary drill bit.

With regards to FIG. 7, it states above: "Rotating shaft 132 is constrained to rotate concentrically within the interior of cylindrical housing 126 by typical bearing assemblies 156 (not shown for brevity) that are suitably affixed to a splined shaft (158 not shown), a portion of which slips into splined shaft interior 160 through hole 161 in lower plate 134."

With regards to FIG. 7A, it states above: "Rotating shaft 190 is constrained to rotate concentrically within the interior of cylindrical housing 184 by typical bearing assemblies 214 (not shown for brevity) that are suitably affixed to a splined shaft (216 not shown), a portion of which slips into splined shaft interior 218 through hole 219 in lower plate 192."

In a series of preferred embodiments of the invention, methods and apparatus are disclosed that allow two separate Power Chambers, each having its own Power Stoke, and Return Stroke, to provide continuous rotation to a to a rotary drill bit. In terms of the simple diagrams in FIGS. 7 and 7A, 7B, and 7C, different methods and apparatus are disclosed that allow Hydraulic Chamber S and Hydraulic Chamber T to provide continuous rotation to a rotary drill drill bit. The applicant has investigated several different approaches to this problem including several that are briefly listed below.

A First Embodiment of the Invention Using a Shuttling Splined Shaft

In a first preferred embodiment of the invention, a special splined shaft 242 (not shown) with a first splined head 244 (not shown) and a second splined head 246 (not shown) is used to accomplish this goal. This invention is disclosed in detail in Ser. No. 61/573,631 This embodiment of the device generally works as follows:

a. During the Power Stroke of Hydraulic Chamber S, first splined head 244 is engaged with splined shaft interior 160.

b. During the Return Stoke of Hydraulic Chamber S, first splined head 244 is disengaged from splined shaft interior 160.

c. During the Power Stroke of Hydraulic Chamber T, second splined head 246 is engaged within splined shaft interior 218.

d. During the Return Stoke of Hydraulic Chamber T, second splined head 246 is disengaged within splined shaft interior 218.

Basically, the single splined shaft having two splined heads shuttles back and forth during the appropriate power strokes to provide continuous rotation of the drive shaft that is suitably coupled to the rotating drill bit. Different methods and apparatus are used to suitably control the motion of the two splined heads. Many methods and apparatus here use hydraulic power for the Return Strokes of the Pistons within the Hydraulic Chambers. This approach, while very workable, requires additional hydraulic passageways within the Hydraulic Chambers to make the hydraulic Return Stokes work.

A Second Embodiment of the Invention Using a Shuttling Backstop

Another embodiment of the invention is disclosed in Ser. No. 61/629,000. Here, a different version of the backstop 128 is slid through a new slot plate 134 in and out of the hydraulic cavity so that Piston S 130 can continuously rotate—which is attached to the rotating shaft 132.

However, this sliding backstop method requires relatively large motions of the sliding backstop that is a disadvantage of this approach.

A Third Embodiment of the Invention Using Hydraulic Return Mechanisms

Another embodiment of the invention is described in Ser. No. 61/629,000. Here, a Return Springs are used for the Return Stokes, but there is a Distributor section to establish proper timing. A Distributor for the purposes herein directs the incoming high pressure mud to various tubes connected to hydraulic chambers, etc. The Distributor here sets the timing—much like an ignition distributor on an old V-8. This approach may not "free run" without the Distributor section. By "Free Run", means when the mud flow starts, the mud motor begins to rotate and requires no separate devices to synchronize its internal functioning.

A Fourth Embodiment of the Invention—The "Mark IV Mud Motor"

The preferred embodiment of the invention described herein has advantages over the first, second and third approaches. With the exception of FIGS. 7, 7A, 7B, and 7C, the figures in this application are directed at this fourth approach. In Ser. No. 61/629,000, in Ser. No. 61/633,776 and in Ser. No. 61/687,394 this fourth approach is called "The Mark IV Mud Motor™". The Mark IV is drives from the 4th fundamental approach to provide continuous rotation of the rotary drill bit by two separate Hydraulic Chambers each having its own Power Stroke and Return Stroke—and which "Free Runs".

General Comments About Quasi-Positive Displacement Mud Motors

Typical rotary drilling systems may be used to drill oil and gas wells. Here, a surface rig rotates the drill pipe attached to the rotary drill bit at depth. Mud pressure carries chips to the surface via annular mud flow.

Alternatively, a mud motor may be placed at the end of a drill pipe 482 (not shown), which uses the power from the mud flowing downhole to rotate a drill bit. Mud pressure still carries chips to the surface, often via annular mud flow.

Typical mud motors as used by the oil and gas industry are based upon the a progressing cavity design, typically having a rubber stator and a steel rotor. These are positive displacement devices that are hydraulically efficient at turning the power available from the mud flow into rotational energy of the drill bit. These devices convert that energy by having intrinsically asymmetric rotors within the stator cavity—so that following pressurization with mud, a torque develops making the rotor spin. These devices also generally have tight tolerance requirements. However, in practice, mud motors tend to wear out relatively rapidly, requiring replacement that involves tripping the drill string to replace the mud motor. Tripping to replace a mud motor is a very expensive process. In addition, there are problems using these mud motors at higher temperatures. It is probably fair to say, that if the existing mud motors were much more long-lasting, that these would be used much more frequently in the industry. This is so in part because the rotary steering type directional drilling controls work well with mud motors, providing relatively short radii of curvature as compared to standard rotary drilling with drill pipes. Mud motors also work well with industry-standard LWD/MWD data acquisition systems.

An alternative to using mud motors, there are the turbine drilling systems available today. These are not positive displacement type motors. They work at relatively high RPM to achieve hydraulic efficiency, often require a gear box to reduce the rotational speed of any attached rotary drill bit, are expensive to manufacture, and are relatively fragile devices having multiple turbine blades within their interiors.

So, until now, there are two basic alternatives. The mud motors "almost work well enough" to satisfy many industry requirements. However, looking at the progressing cavity design a little more closely also reveals that the stator must be asymmetric in its stator to develop torque. In general, positive displacement motors suffer from this disadvantage—they are generally not cylindrically symmetric about a rotational axis. This in turn results in requiring that the output of a shaft of the mud motor couple to a "wiggle rod" to decouple the unwanted motion from the rotary drill bit.

The applicant began investigating motor designs having parts that run concentrically about an axis. If all the parts are truly concentric about a rotational axis, then in principle, there is no difference between right and left, and no torque can develop. However, the applicant decided to investigate if it was possible to make motors that are "almost" positive displacement motors that can be described as "quasi-positive displacement motors" which do develop such torque. The Mark IV Mud Motor is one such design. It runs about a concentric axis. However, the existence of leaky seals within its interior means that it is not a true positive displacement mud motor. If the leaky seals leak about 10% of the fluid from within a hydraulic chamber to the mud flow continuing downhole without imparting the energy from the leaked fluids to the piston, nevertheless, the piston would still obtain 90% of its power from the mud flow. In this case, a relatively minor fraction of the horsepower, such as 15% would be "lost". These leaky seal devices can then be classified as "quasi-positive displacement motors". For example, such motors may have relatively loose fitting components that reduce manufacturing costs. But more importantly, as the interior parts of these motors wear, the motor keeps operating. Therefore, these "quasi-positive displacement motors" have the intrinsic internal design to guarantee long lasting operation under adverse environmental conditions. Further, many of the embodiments, the "quasi-positive displacement motors" are made of relatively loose fitting metal components, so that high temperature operation is possible. The materials are selected so that there is no galling during operation, or jamming due to thermal expansion.

Right-Hand Rule for Mud Motor Assembly

Figure 8:
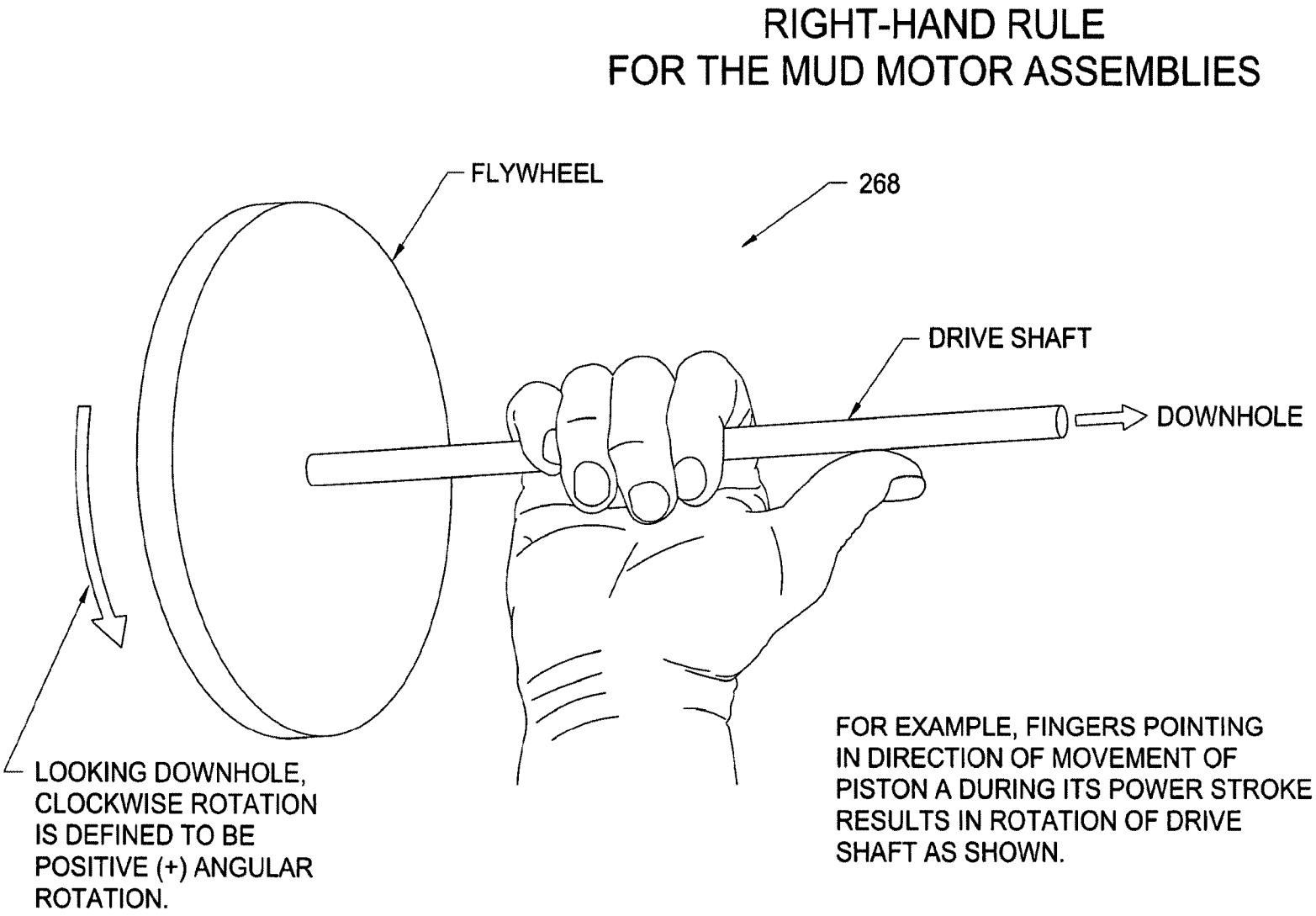
FIG. 8 shows the Right-Hand Rule 268 appropriate for the Mud Motor Assembly.

FIG. 8 shows the Right-Hand Rule 268 appropriate for the Mud Motor Assembly. In FIG. 8, the uphole view is looking to the left-hand side, and the downhole view is looking to the right-hand side.

As an example, the Drive Shaft in FIG. 8 can be chosen to be Drive Shaft 20 in FIG. 3A. And, for example, the flywheel can be chosen to be Flywheel A 34 in FIG. 3H. It is conceivable to make another assembly drawing appropriate for only this situation that could be labeled with numeral 270 (not shown), but in the interests of brevity, this approach will not be used any further.

Position of Piston A During Its Power Stroke and Return Stroke (Thirteen Figures)

Figure 9:
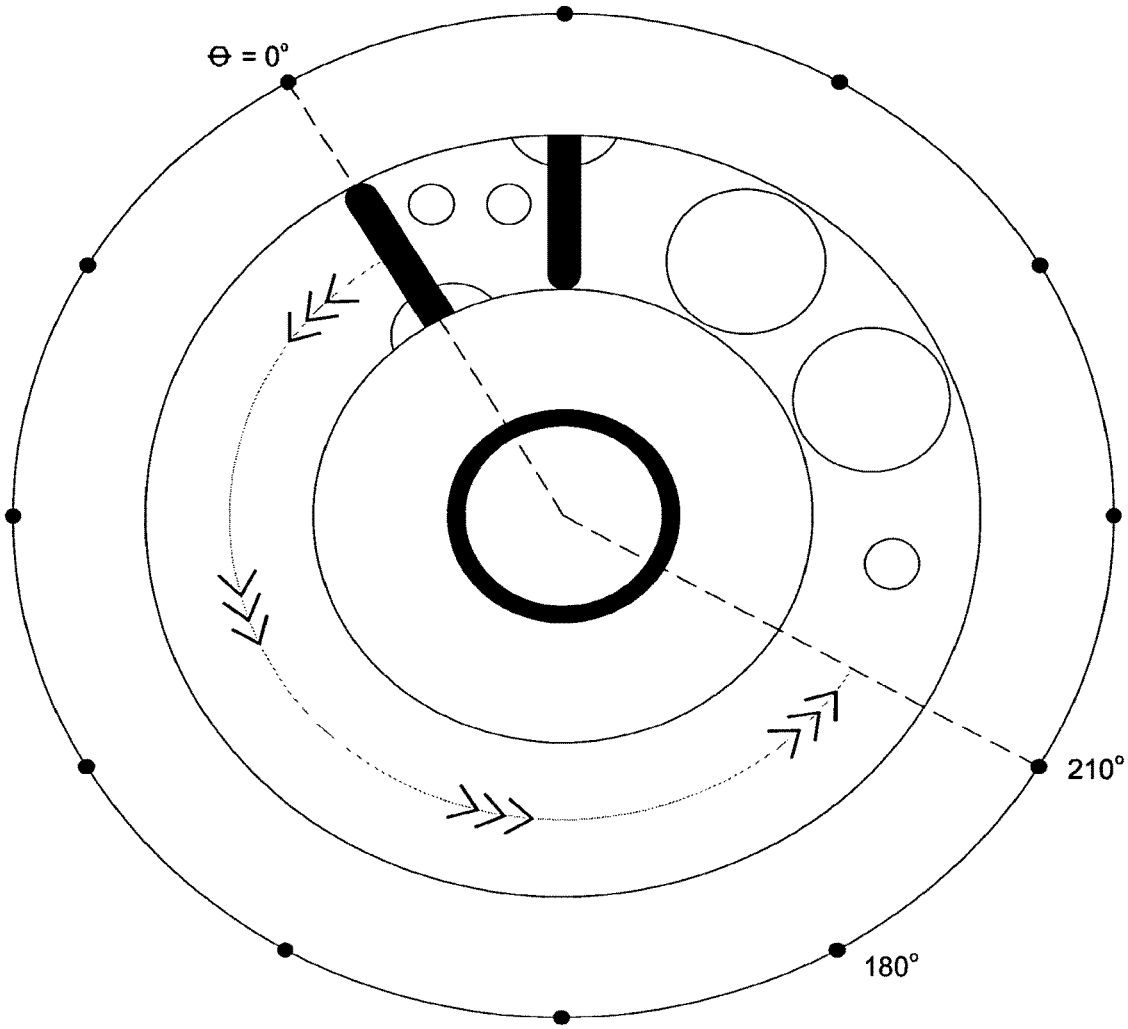
FIG. 9 shows a cross-section view FF of the Mud Motor Assembly in FIG. 6C with Piston A at angle theta of 0 Degrees in the Mud Motor Assembly.

FIG. 9 shows a cross-section view FF of the Mud Motor Assembly in FIG. 6C with Piston A at angle theta of 0 Degrees in the Mud Motor Assembly. This view is looking uphole. The position of theta equal 0 degrees is defined as that position of Piston A when mud pressure inside Chamber A reaches a sufficient pressure where Piston A just begins initial movement during the Power Stroke of Piston A.

Figure 9A:
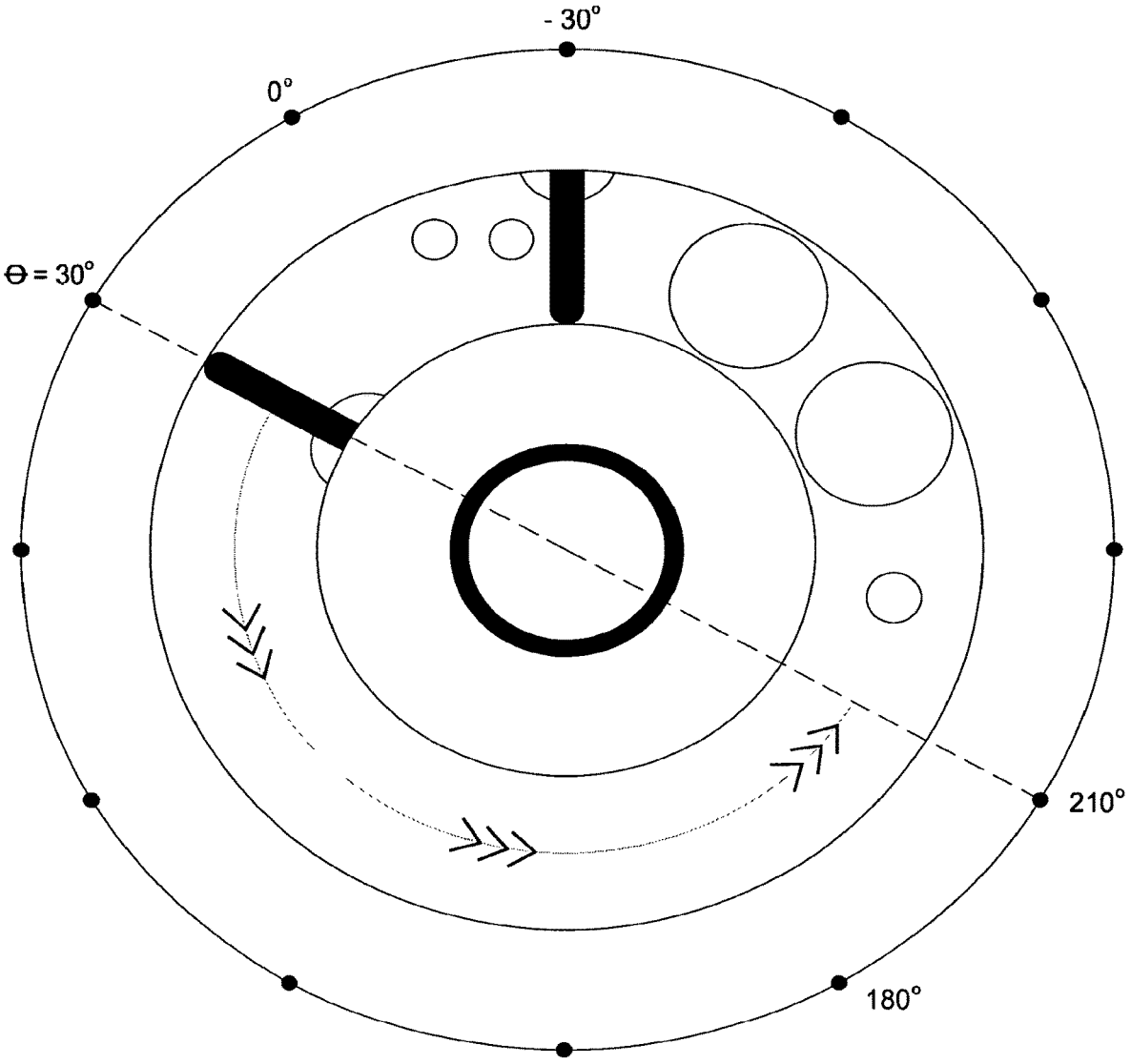
FIG. 9A shows Piston A in Position at 30 Degrees in the Mud Motor Assembly during its Power Stroke.

FIG. 9A shows Piston A in Position at 30 Degrees in the Mud Motor Assembly during its Power Stroke.

Figure 9B:
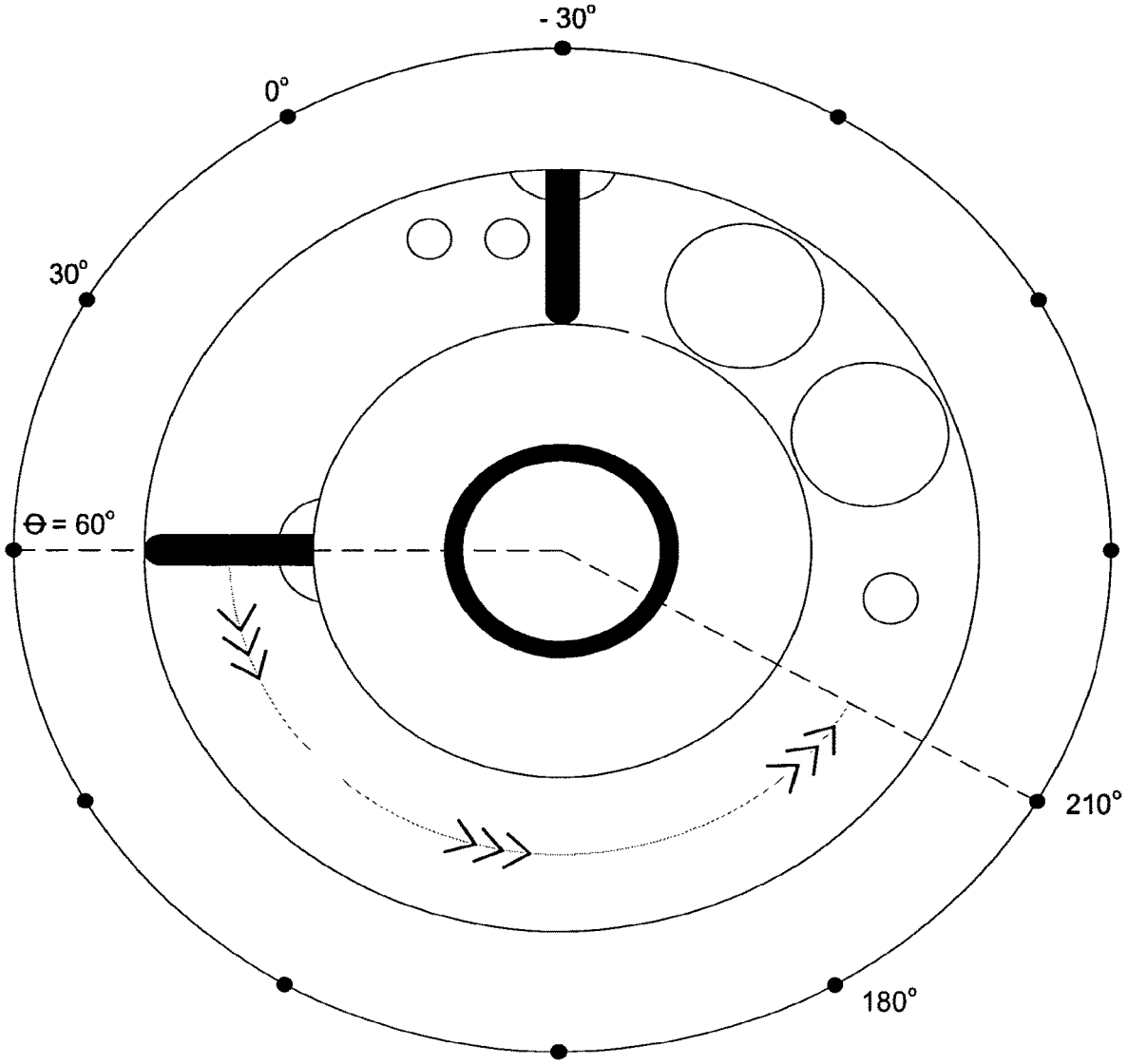
FIG. 9B shows Piston A in Position at 60 Degrees in the Mud Motor Assembly during its Power Stroke.

FIG. 9B shows Piston A in Position at 60 Degrees in the Mud Motor Assembly during its Power Stroke.

Figure 9C:
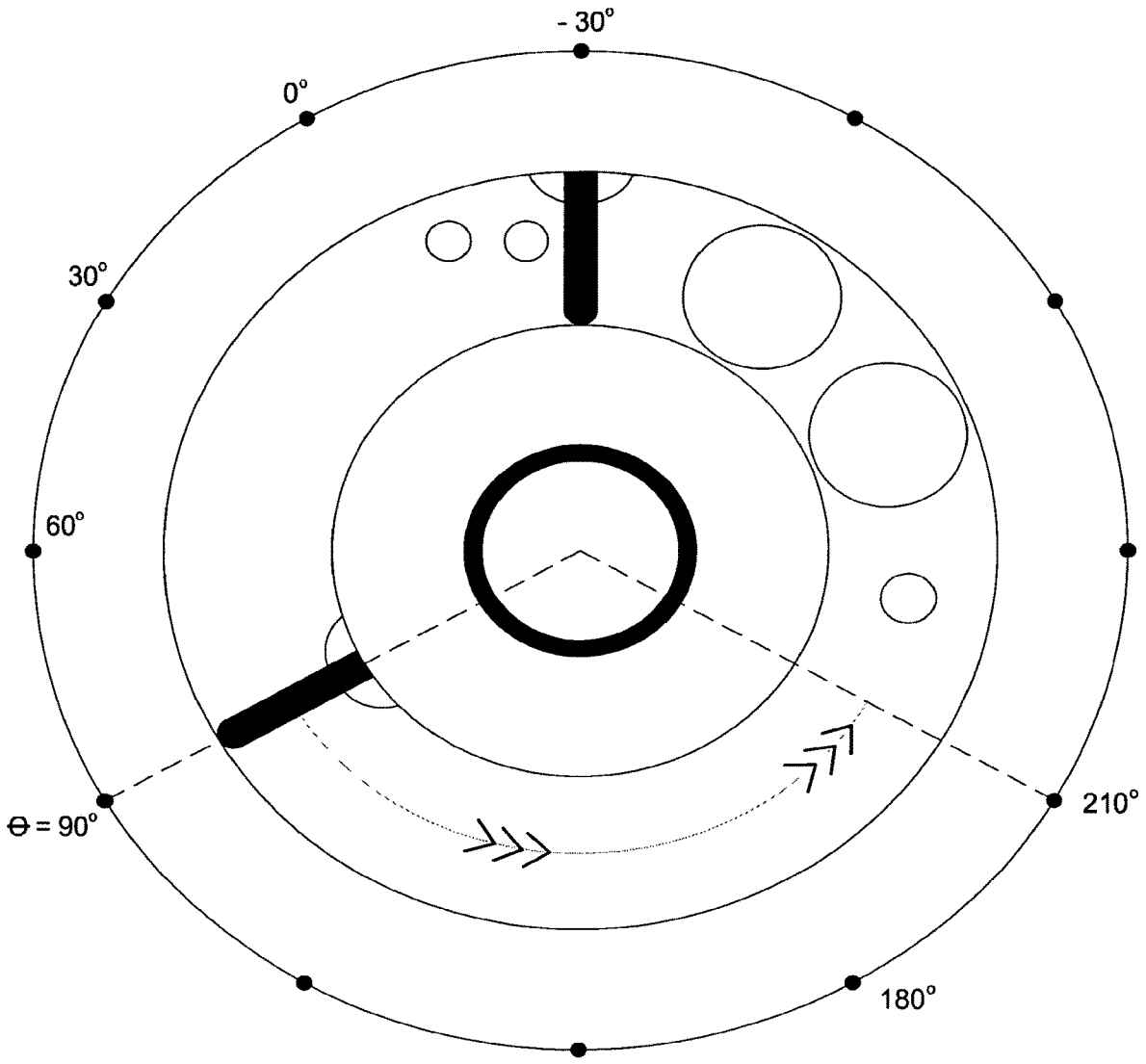
FIG. 9C shows Piston A in Position at 90 Degrees in the Mud Motor Assembly during its Power Stroke.

FIG. 9C shows Piston A in Position at 90 Degrees in the Mud Motor Assembly during its Power Stroke.

Figure 9D:
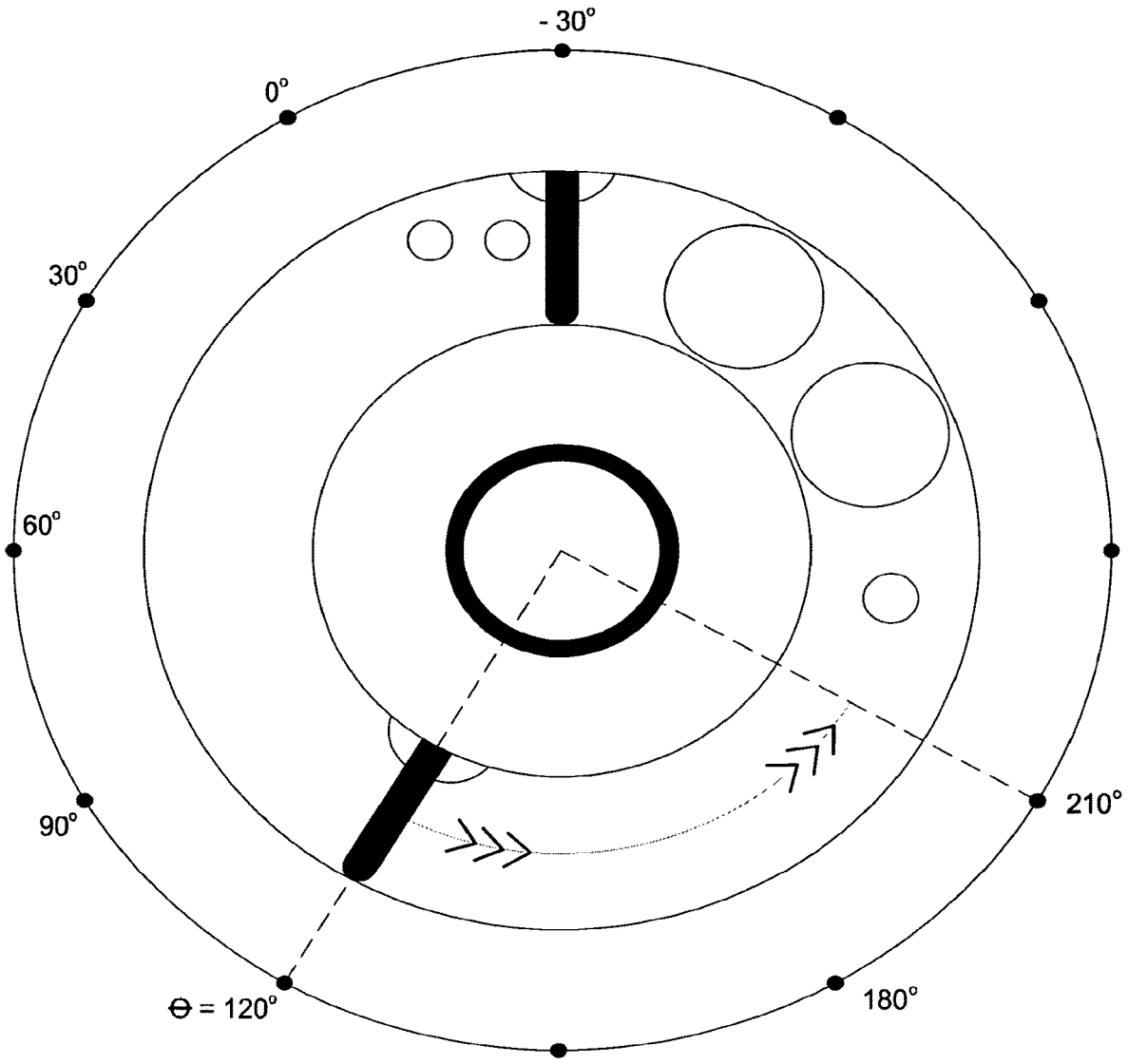
FIG. 9D shows Piston A in Position at 120 Degrees in the Mud Motor Assembly during its Power Stroke.

FIG. 9D shows Piston A in Position at 120 Degrees in the Mud Motor Assembly during its Power Stroke.

Figure 9E:
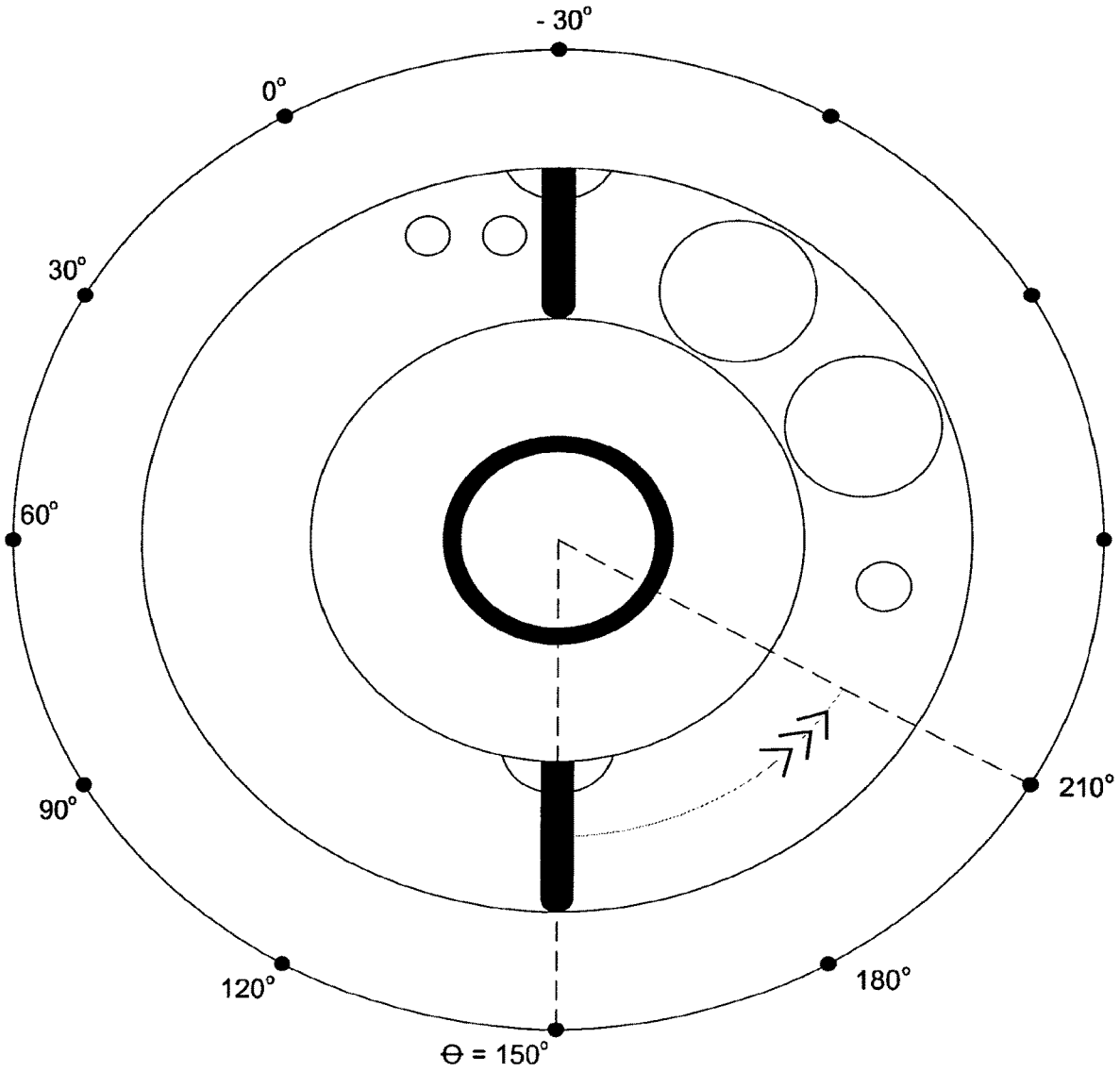
FIG. 9E shows Piston A in Position at 150 Degrees in the Mud Motor Assembly during its Power Stroke.

FIG. 9E shows Piston A in Position at 150 Degrees in the Mud Motor Assembly during its Power Stroke.

Figure 9F:
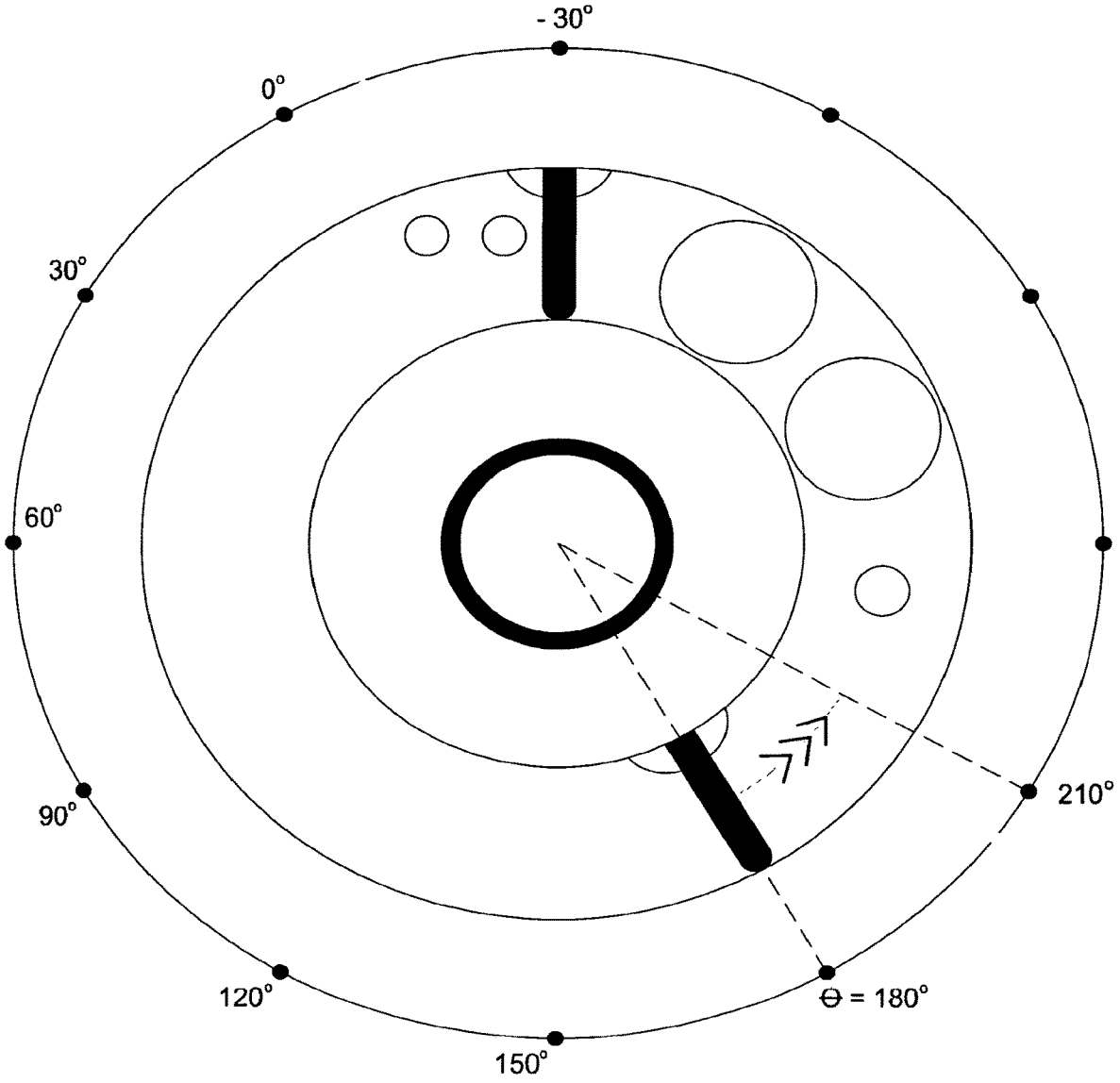
FIG. 9F shows Piston A in Position at 180 Degrees in the Mud Motor Assembly during its Power Stroke.

FIG. 9F shows Piston A in Position at 180 Degrees in the Mud Motor Assembly during its Power Stroke.

Figure 9G:
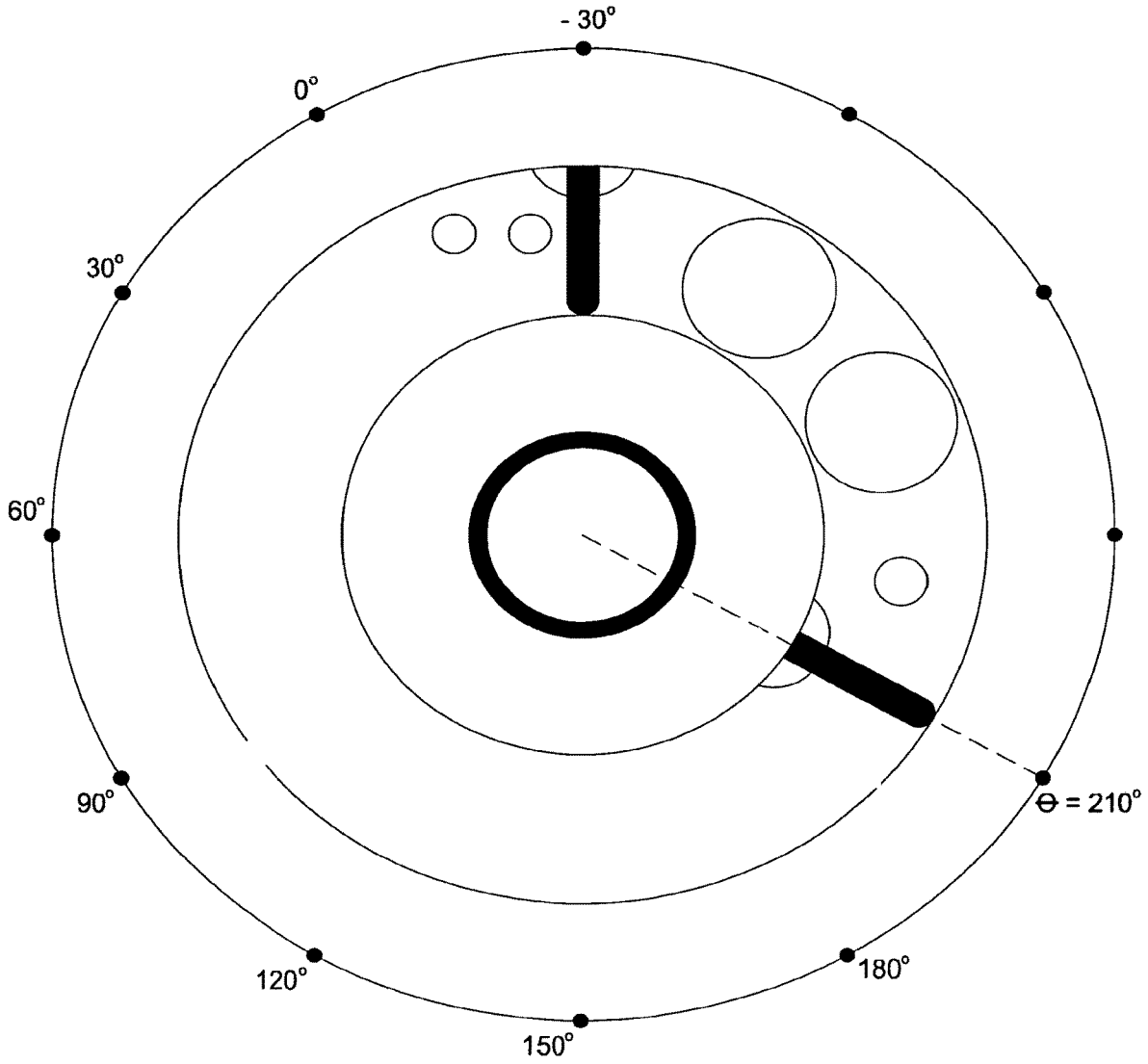
FIG. 9G shows Piston A in Position at 210 Degrees in the Mud Motor Assembly at the end of its 100% full strength Power Stroke.

FIG. 9G shows Piston A in Position at 210 Degrees in the Mud Motor Assembly at the end of its 100% full strength Power Stroke.

Figure 9H:
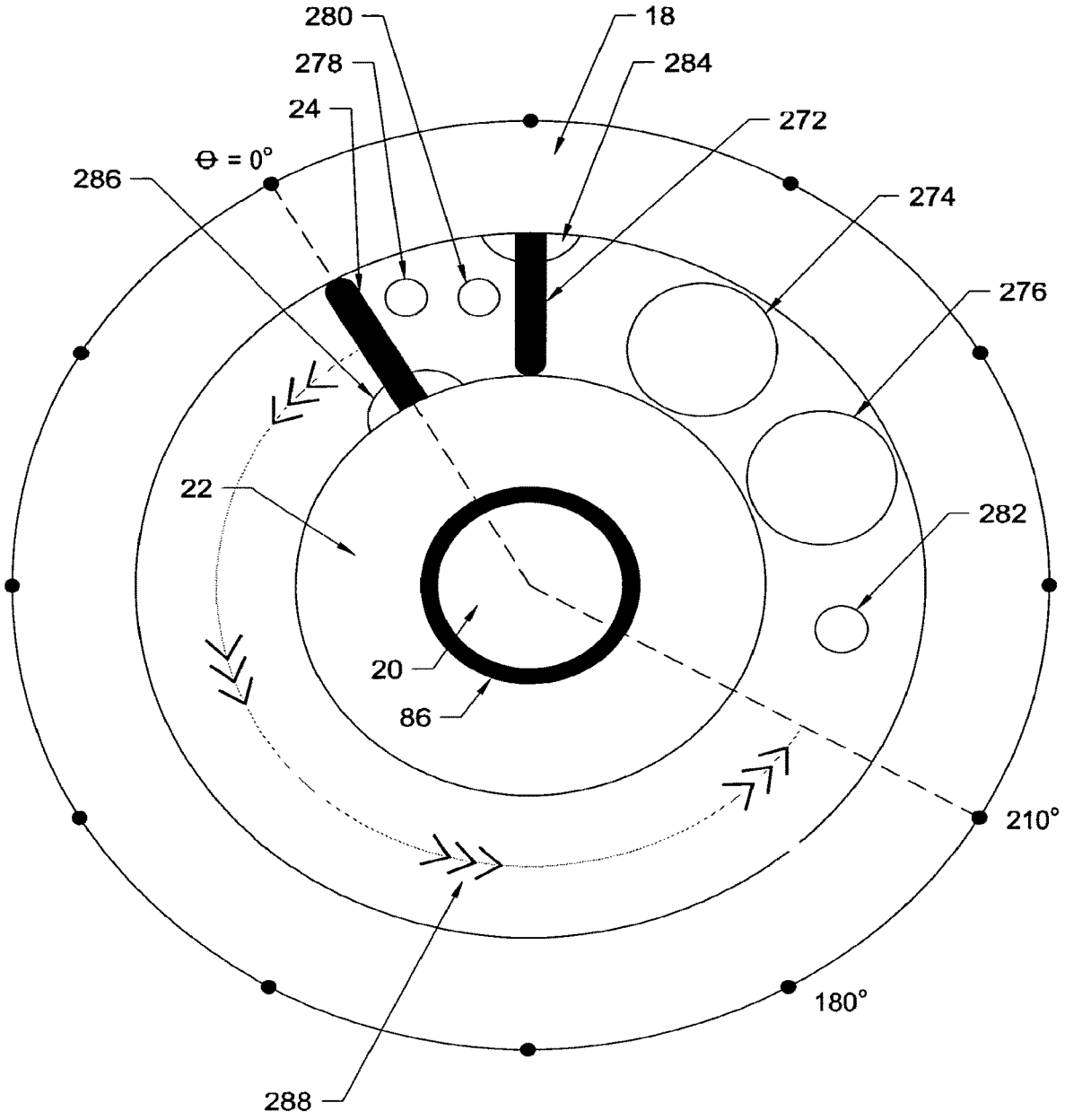
FIG. 9H shows the various components within cross section FF in FIG. 6C.

FIG. 9H shows the various components within cross section FF in FIG. 6C. Numerals 18, 20, 22, 24 and 86 had been previously defined. Numerals 272, 274, 276, 278, 280, 282, 284, and 286 are defined in FIGS. 10, 10A, . . . , 10L, 10M which follow. Element 288 in this direction looking uphole shows the direction of the Power Stroke for Piston A.

Figure 9J:
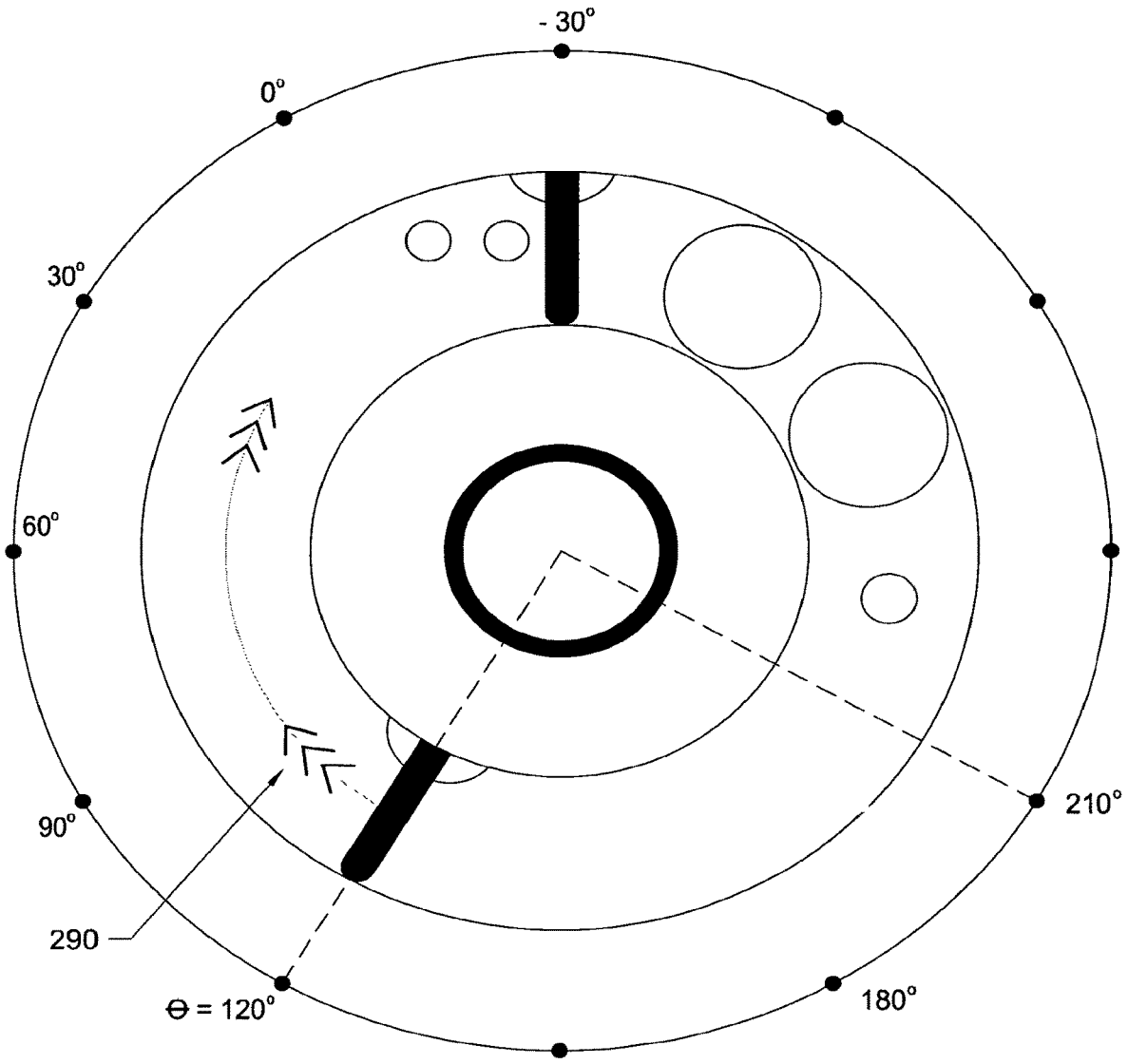
FIG. 9J shows Piston A during a portion of its Reset Stroke, or its Return Stroke.

FIG. 9J shows Piston A during a portion of its Reset Stroke, or its Return Stroke, where Piston A rotates clockwise looking uphole (counter-clockwise looking downhole), until it reaches at "Stop" at theta equals 0 degrees. As will be described later, the "Stop" it may be mechanical in nature, or may be hydraulic in nature. Element 290 is this direction looking uphole shows the direction of the Reset Stroke, or Return Stroke, of Piston A.

Figure 9K:
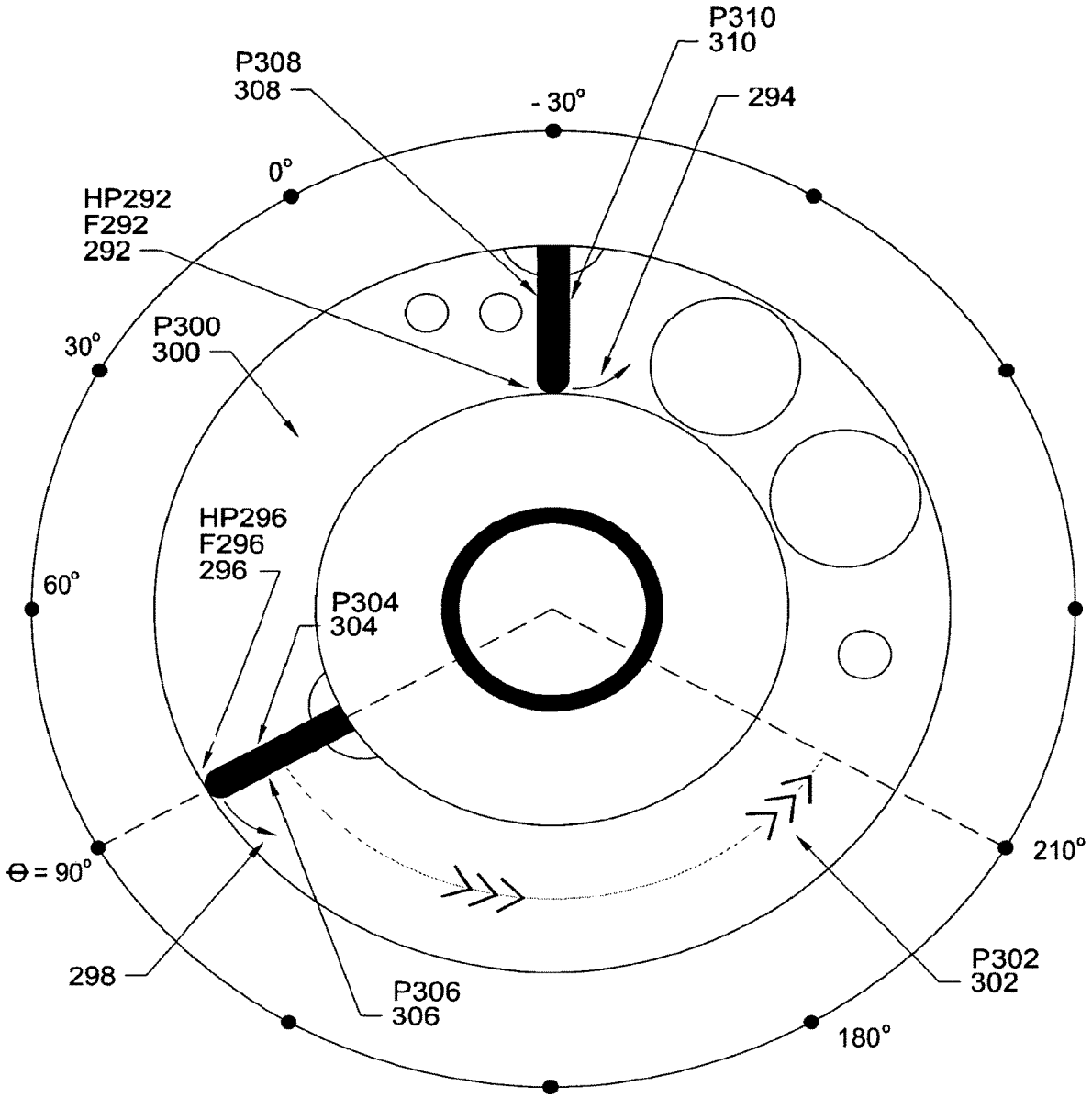
FIG. 9K shows Piston A during a portion of its Power Stroke.

FIG. 9K shows Piston A during a portion of its Power Stroke. During the Power Stroke of Piston A, leaky seal 292 may produce mud flowing in a direction past the seal shown as element 294 in FIG. 9K. F292 is the flow rate in gpm through leaky seal 292. HP292 is the horsepower dissipated by the mud flow F292 through leaky seal 292. F292 and HP292 are expected, of course, to be dependent upon the average pressure acting on Piston A during its Power Stroke. Here, the term "average pressure" includes a spatial or volumetric average, but that average may be at just one instant in time. The "average pressure" may be time dependent. Similar comments apply below to the usage "average pressure".

During the Power Stroke of Piston A, leaky seal 296 may produce mud flowing in a direction past the seal shown as element 298 in FIG. 9K. F296 is the flow rate in gpm through leaky seal 296. HP296 is the horsepower dissipated by the mud flow F296 through leaky seal 296. F296 and HP296 are expected, of course, to be dependent upon the average pressure acting on Piston A during its Power Stroke.

Element 300 in FIG. 9K defines the region called the Power Chamber. Pressurized mud in the Power Chamber 300 acts upon Piston A to cause it to move during its Power Stroke. The average pressure acting upon Piston A during its Power Stroke is defined to be P300. The pressure within the Power Chamber 300 may vary with position, and that knowledge is a minor variation of this invention.

Element 302 in FIG. 9K defines the region called the Backstop Chamber. The mud within the Backstop Chamber 302 may will have an average pressure acting upon the "back side" Piston A. The average pressure acting upon the back side of Piston A during its Power Stroke is defined to be P302. The pressure within the Backstop Chamber may vary with position, and that knowledge is a minor variation of this invention.

The portion of Piston A facing the Power Chamber 300 is designated by numeral 304, and has average pressure P304 acting on that portion 304.

The portion of Piston A facing the Backstop Chamber 302 is designated by numeral 306, and has average pressure P306 acting on that portion 306.

The portion of the Backstop facing the Power Chamber 300 is designated by numeral 308, and has average pressure P308 acting on that portion 308. The portion of the Backstop facing the Backstop Chamber 302 is designated by numeral 310, and has average pressure P310 on that portion of 310.

Figure 9L:
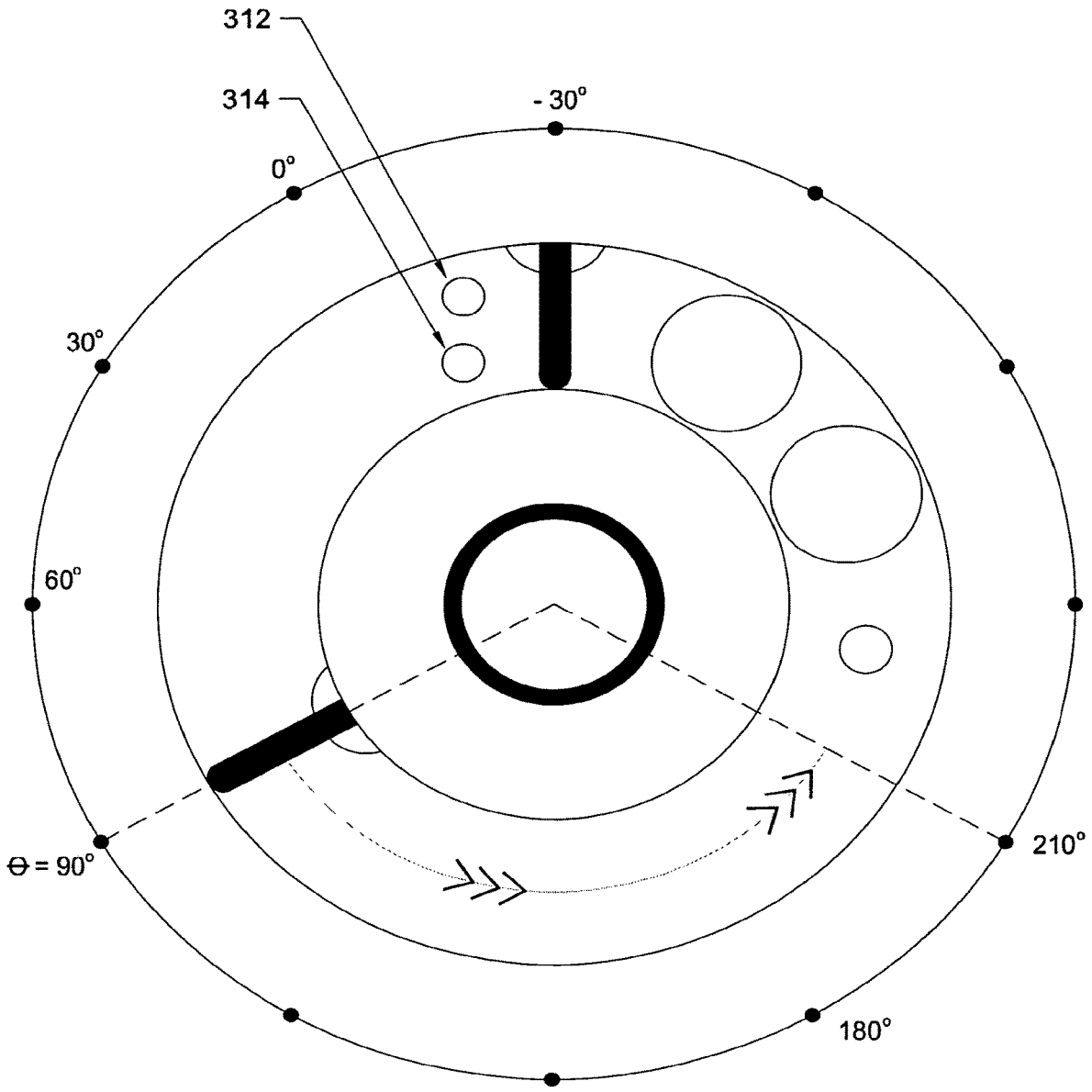
FIG. 9L shows new positions for previous elements 278 and 280.

FIG. 9L shows new positions for previous elements 278 and 280. Element 312 corresponds to original 278 ("DPCHA"). Element 314 corresponds to original element 280 ("EPCHA"). As shown in FIG. 9L, centers of elements 312 and 314 are now at different radii in this embodiment which may assist in the design of the proper operation of intake and exhaust valuing. Either of these new elements can be put at different radial positions than the radial position of the center of 282 ("EPCHA"). See FIGS. 10H, 10J, and 10K.

Cross Section Views of the Mud Motor Assembly (Thirteen Figures)

Note: There are not a sufficient number of unique shadings for drawing components which can be used to identify all of the individual components of the Mud Motor Assembly and which satisfy the drawing rules at the USPTO. Consequently, in this series of figures, the same identical double cross-hatching is used in each figure to identify a specific component on any one figure, but the same looking double cross-hatching shading is used in all the different figures in this series of figures for component labeling purposes. On any one figure, there is only one component identified with double cross-hatching, but the meaning of that double cross-hatching is unique and applies solely and only to that one figure. In general, the meaning of the double cross-hatching is defined by a relevant box on the face of the figure having an appropriate legend. These comments pertain to FIGS. 10, 10A, . . . 10L, and 10M. The below Cross-Sections pertain to Cross Section FF in FIG. 6C.

Figure 10:
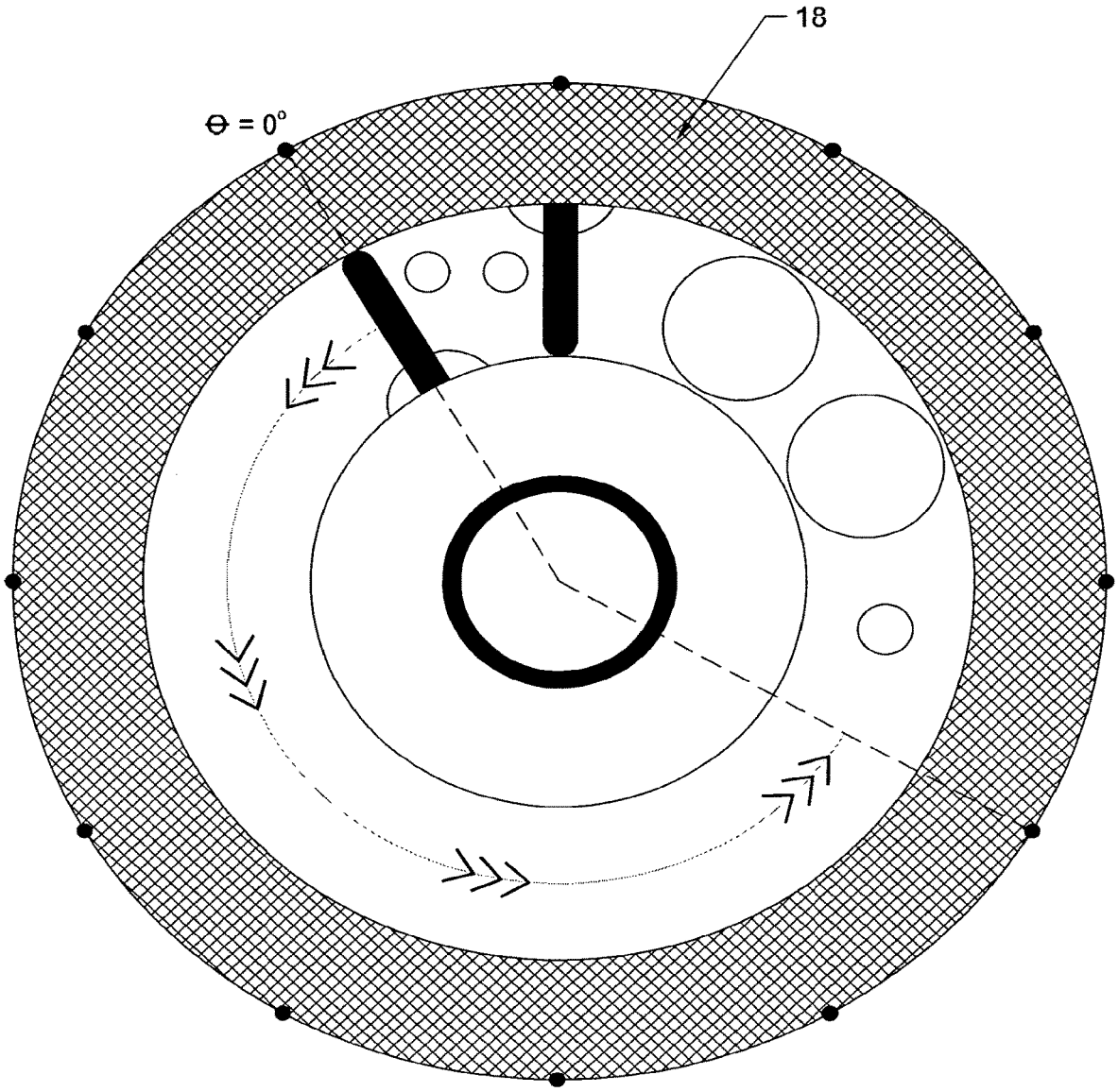
FIG. 10 shows a Cross-Section View of the Housing 18 in the Mud Motor Assembly. Special shadings are used for the series of FIG. 10 drawings as discussed in the specification.

FIG. 10 shows a Cross-Section View of the Housing 18 in the Mud Motor Assembly.

Figure 10A:
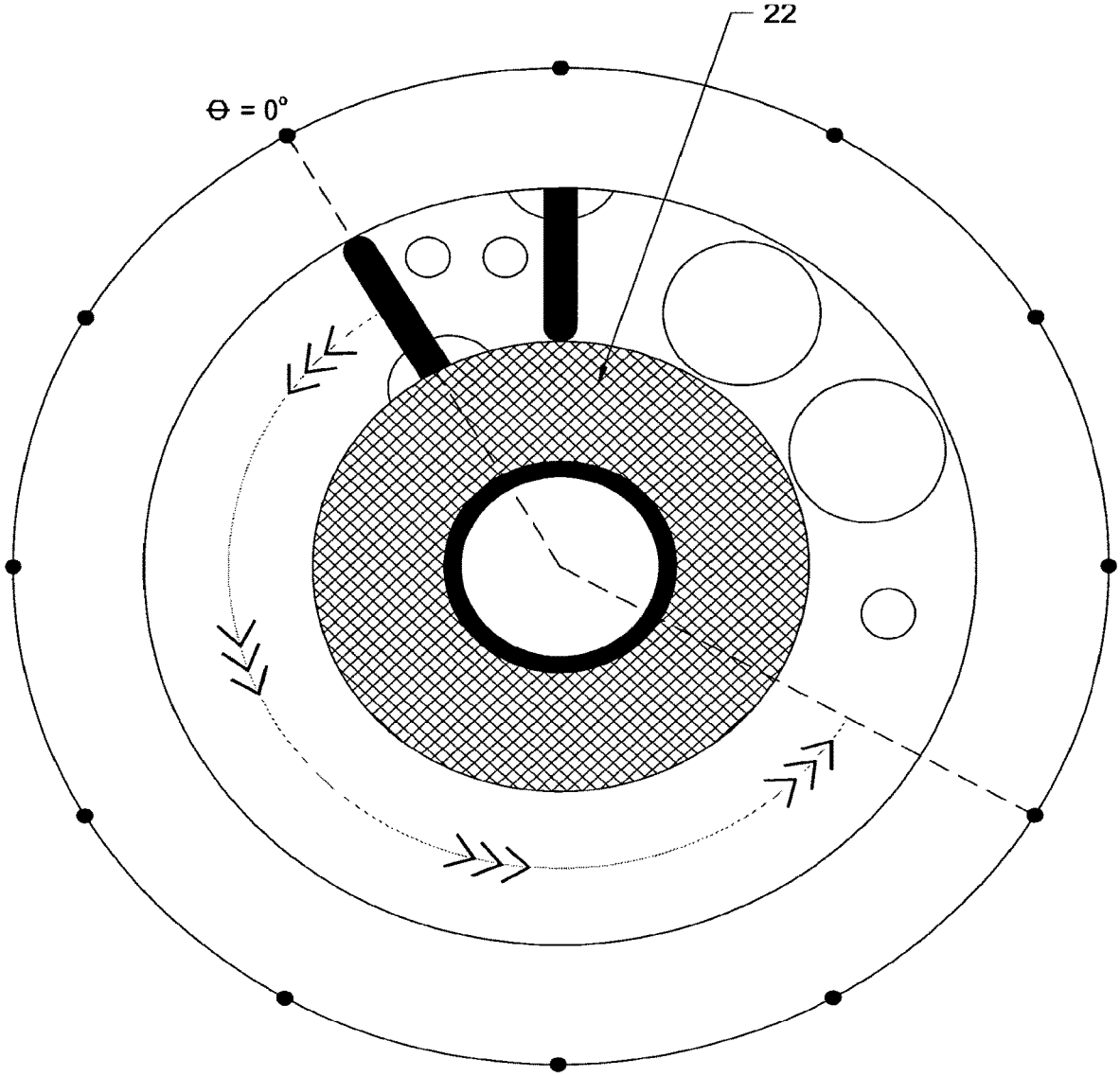
FIG. 10A shows a Cross-Section View of Crankshaft A 22 in the Mud Motor Assembly.

FIG. 10A shows a Cross-Section View of Crankshaft A 22 in the Mud Motor Assembly.

Figure 10B:
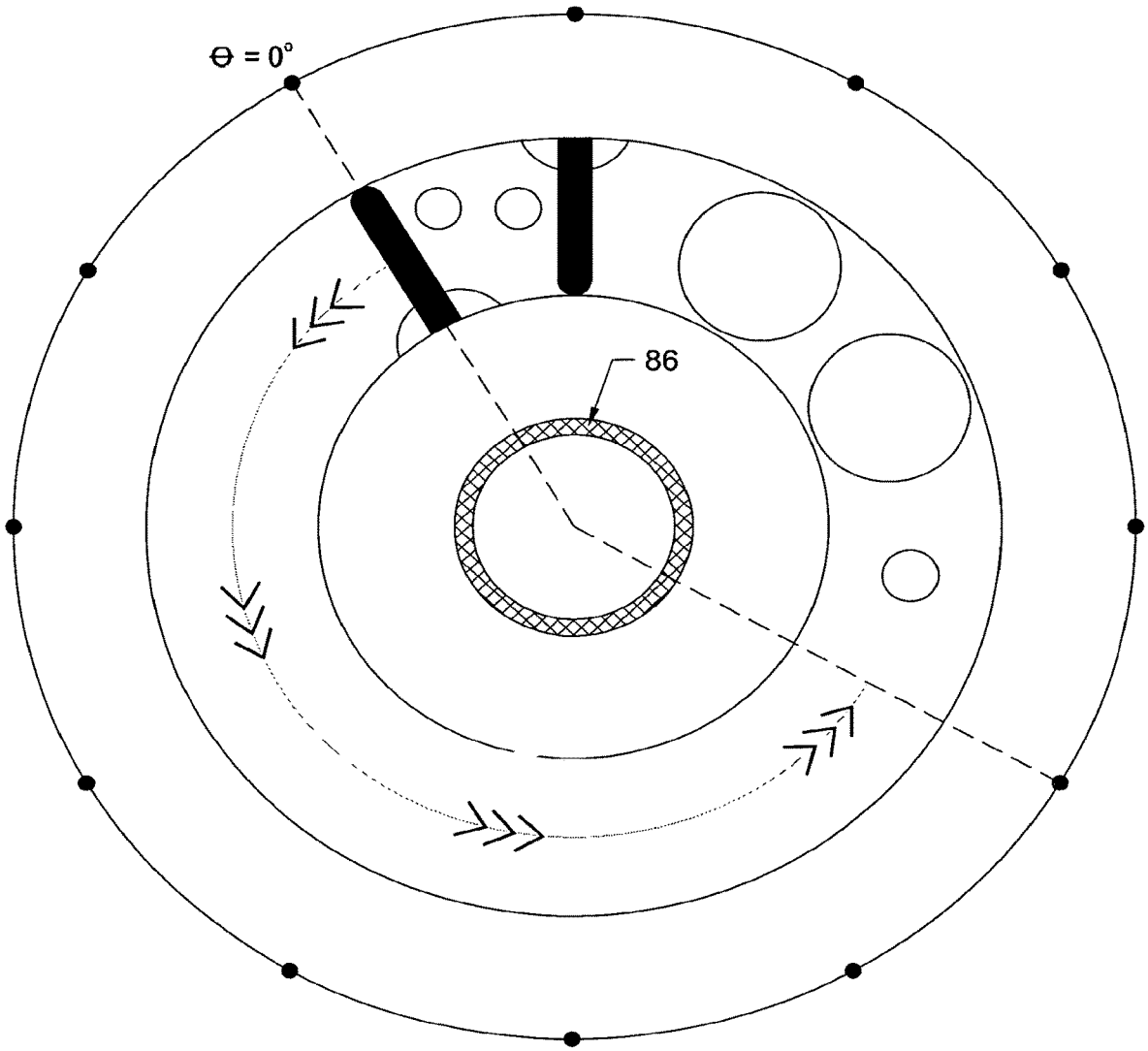
FIG. 10B shows a Cross-Section View of the Internal Crankshaft A Bearing 86 in the Mud Motor Assembly.

FIG. 10B shows a Cross-Section View of the Internal Crankshaft A Bearing 86 in the Mud Motor Assembly.

Figure 10C:
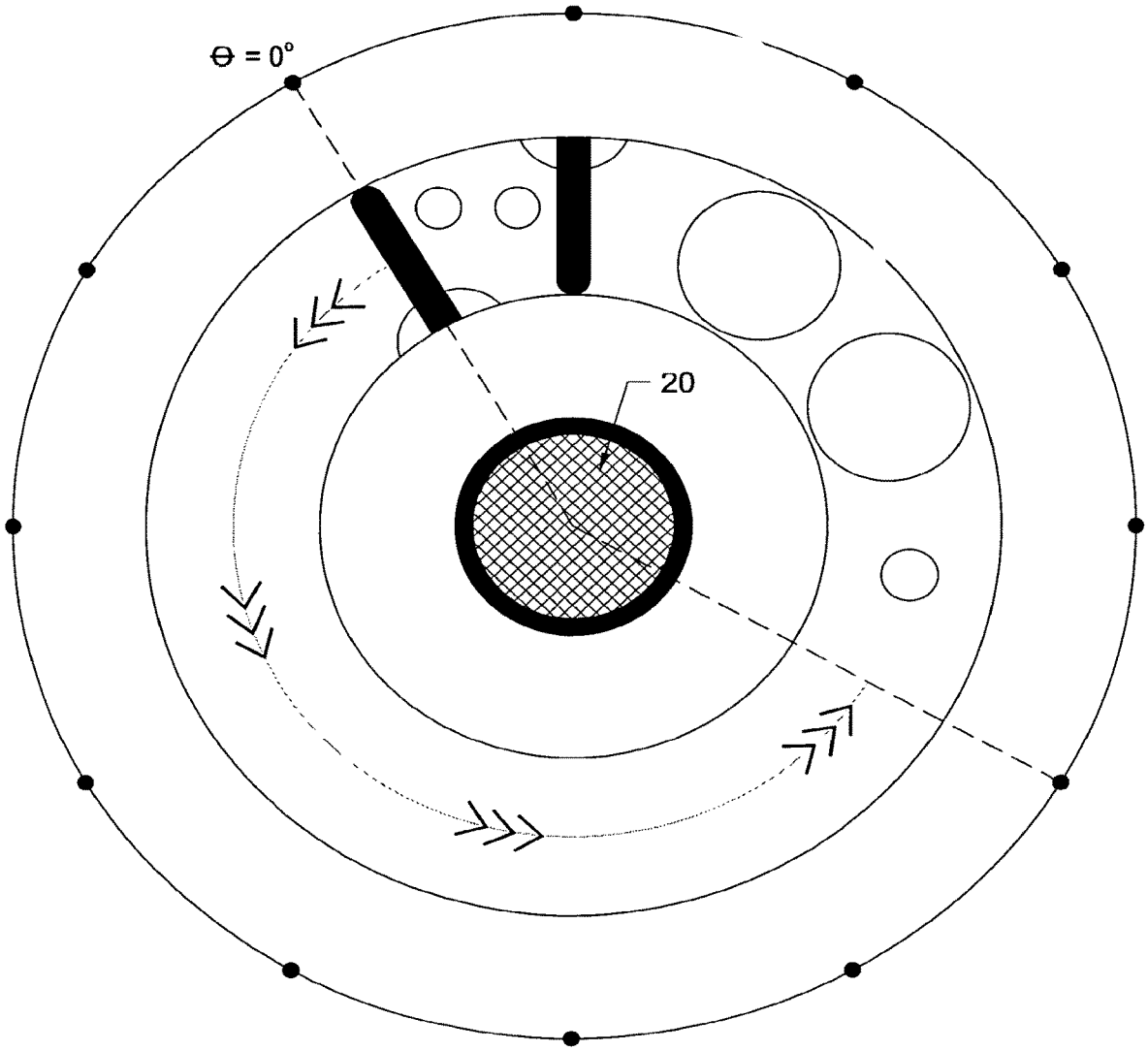
FIG. 10C shows a Cross-Section View of the Drive Shaft 20 in the Mud Motor Assembly.

FIG. 10C shows a Cross-Section View of the Drive Shaft 20 in the Mud Motor Assembly.

Figure 10D:
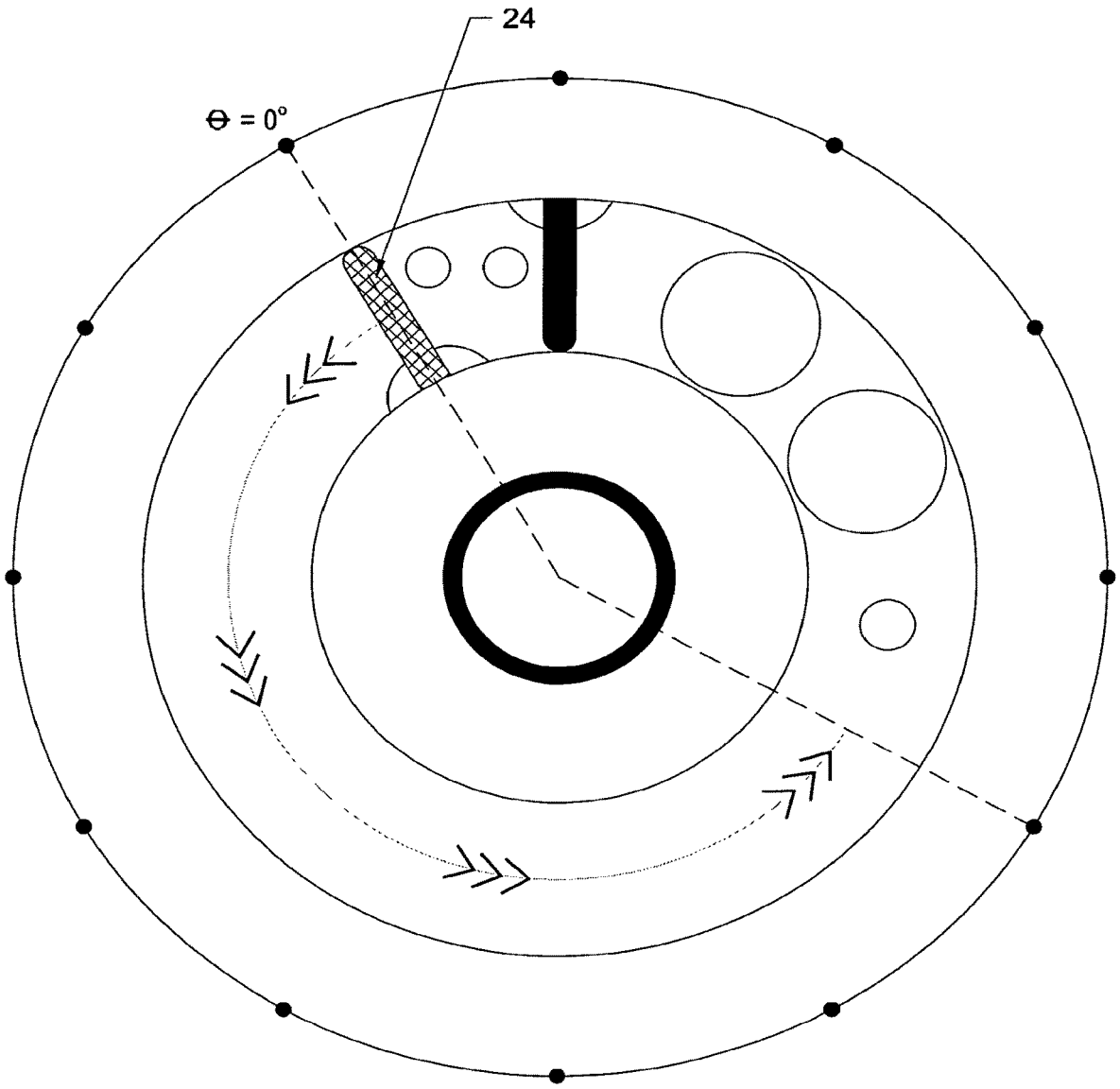
FIG. 10D shows a Cross-Section of Piston A 24 in the Mud Motor Assembly.

FIG. 10D shows a Cross-Section of Piston A 24 in the Mud Motor Assembly.

Figure 10E:
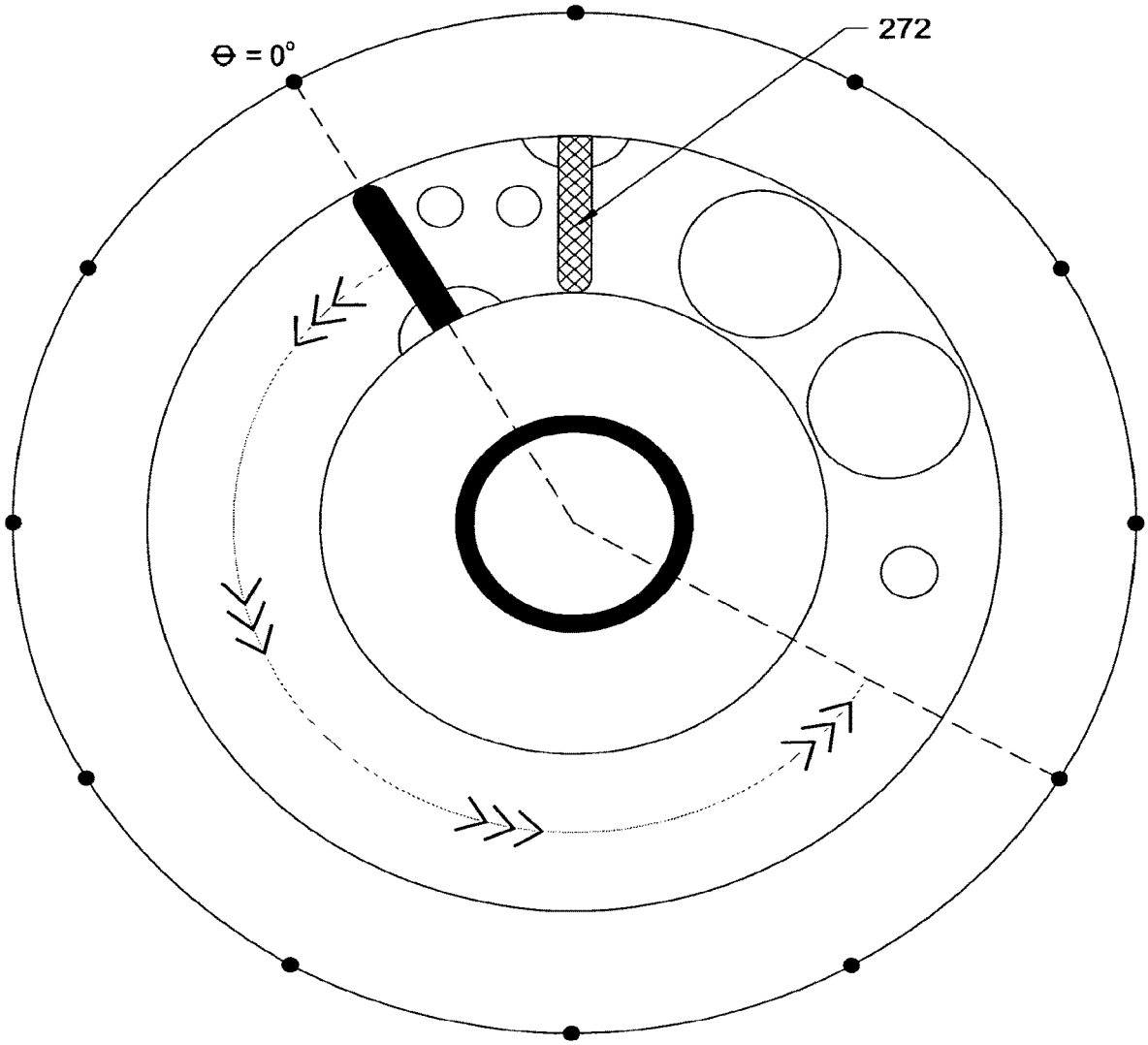
FIG. 10E shows a Cross-Section of Backstop A 272 in the Mud Motor Assembly.

FIG. 10E shows a Cross-Section of Backstop A 272 in the Mud Motor Assembly.

Figure 10F:
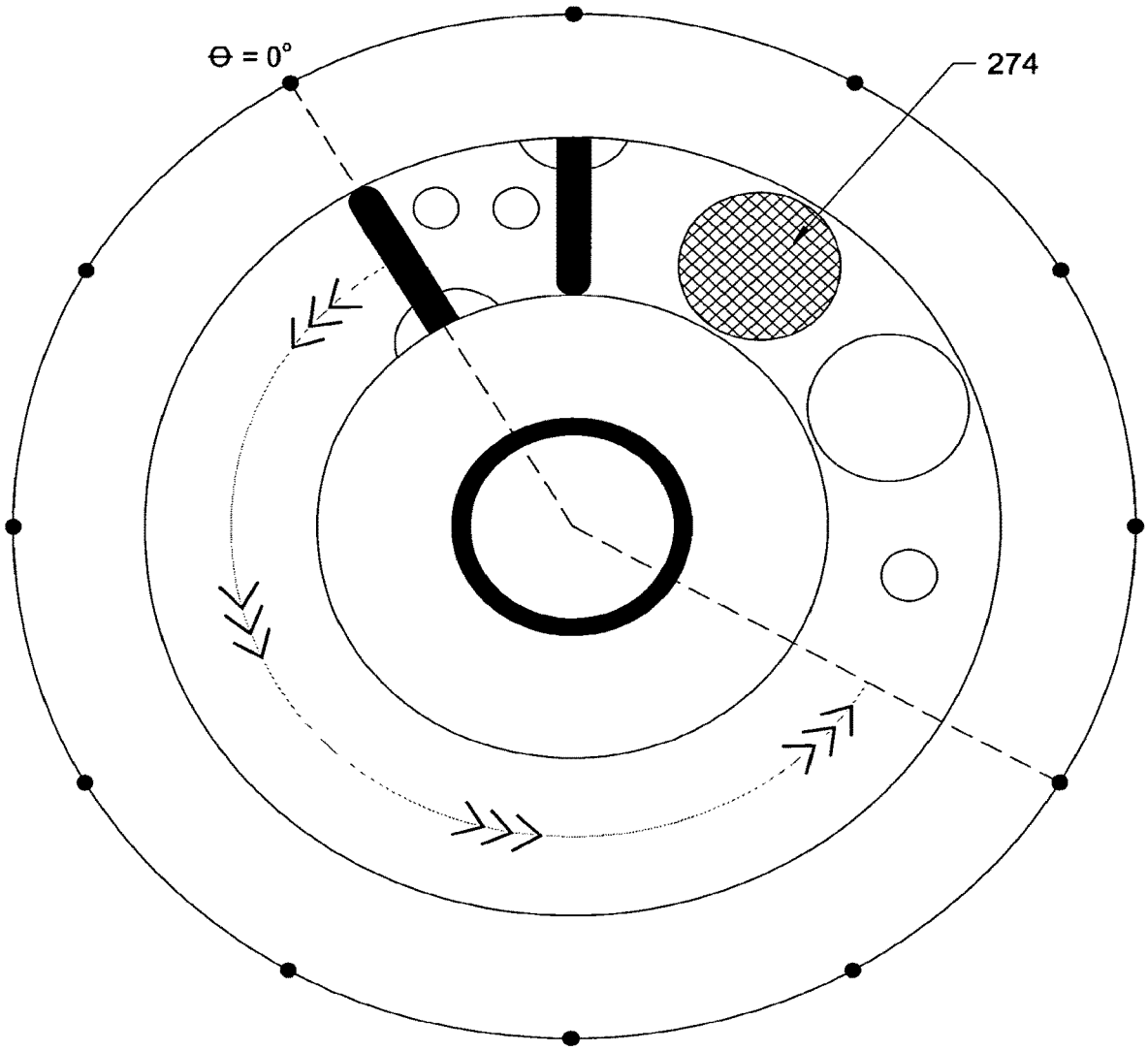
FIG. 10F shows a Cross-Section of Bypass Tube A-1 274 in the Mud Motor Assembly.

FIG. 10F shows a Cross-Section of Bypass Tube A-1 274 in the Mud Motor Assembly.

Figure 10G:
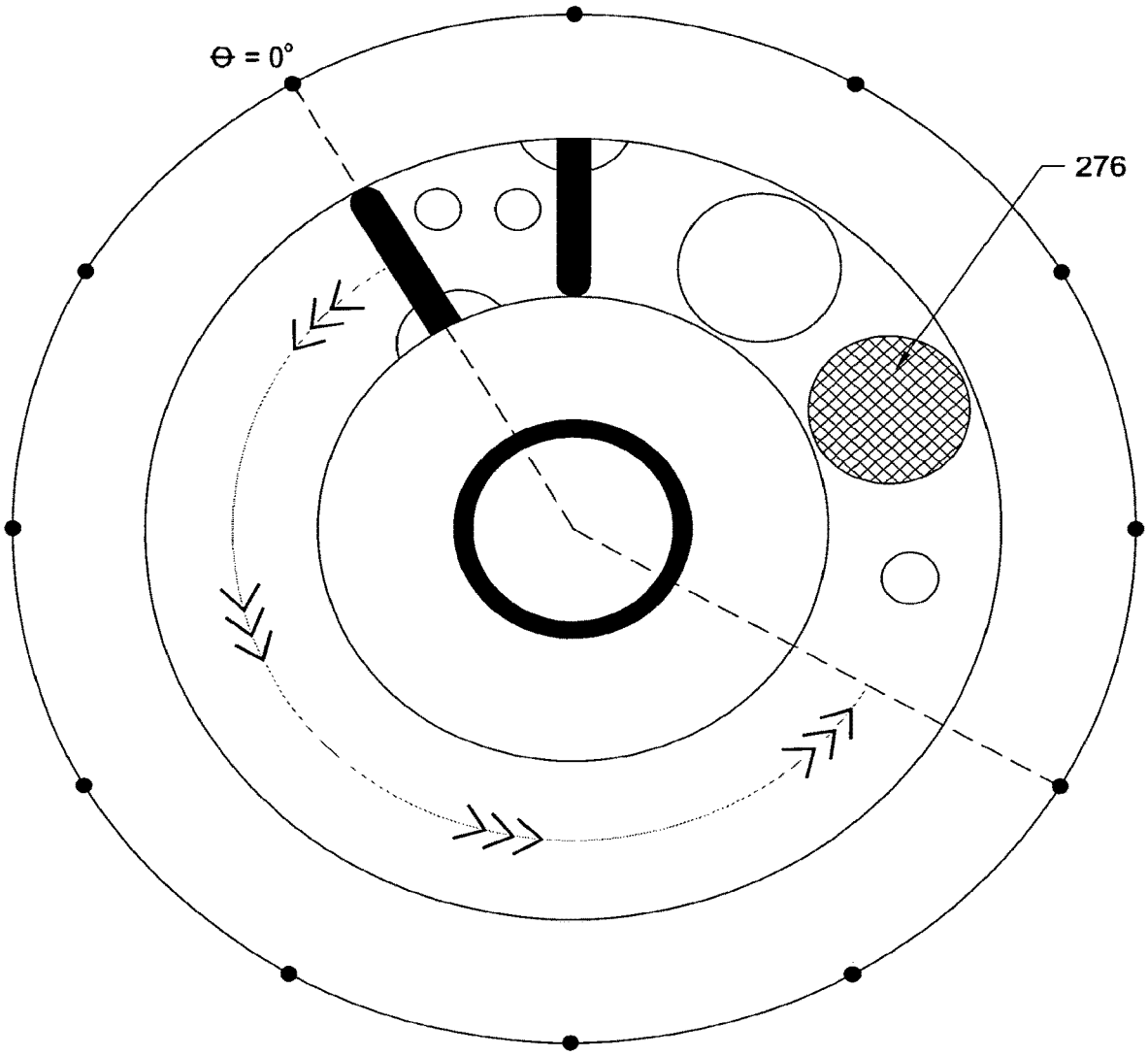
FIG. 10G shows a Cross-Section of Bypass Tube A-2 276 in the Mud Motor Assembly.

FIG. 10G shows a Cross-Section of Bypass Tube A-2 276 in the Mud Motor Assembly.

Figure 10H:
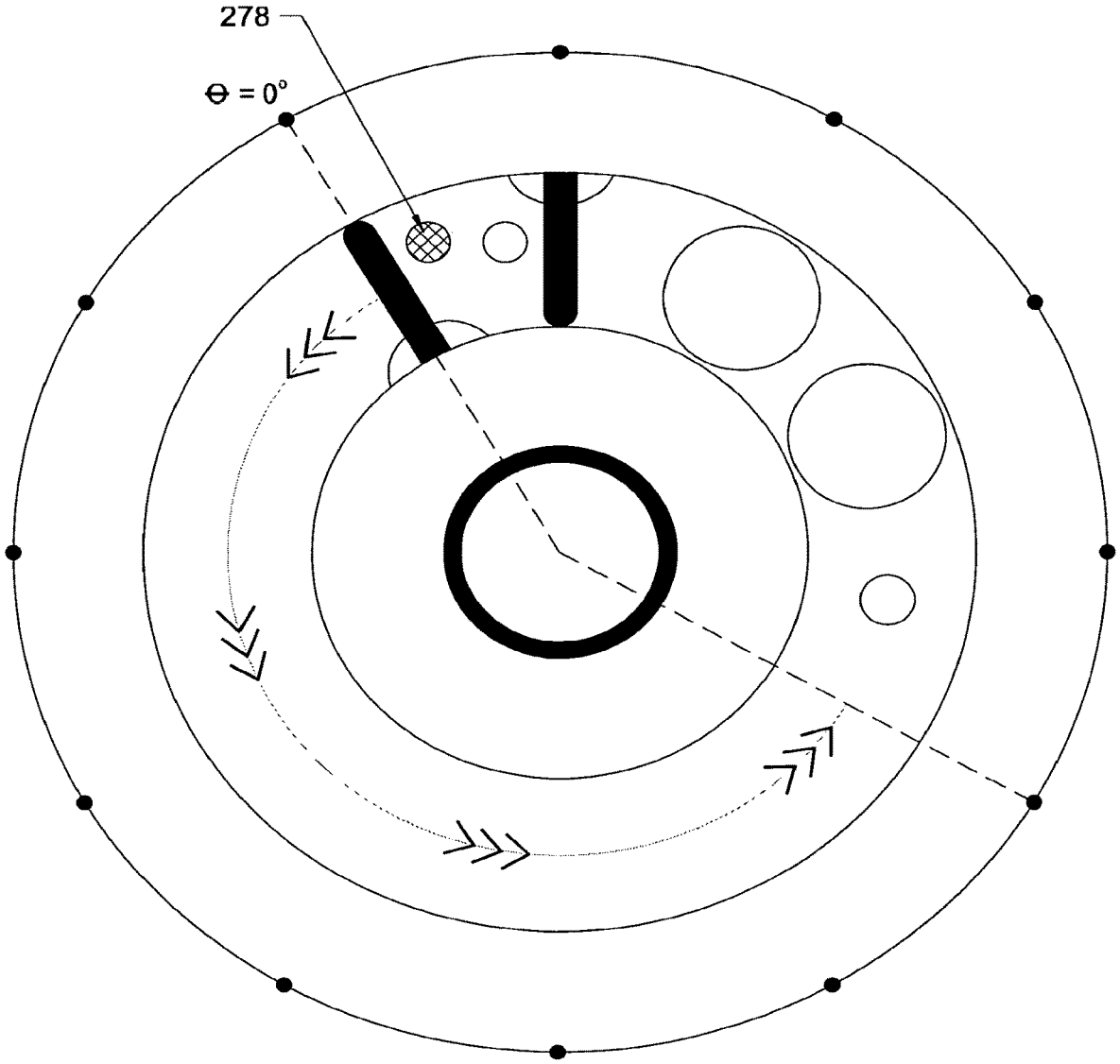
FIG. 10H shows a Cross-Section of the Drive Port of Chamber A ("DPCHA") 278 in the Mud Motor Assembly.

FIG. 10H shows a Cross-Section of the Drive Port of Chamber A ("DPCHA") 278 in the Mud Motor Assembly.

Figure 10J:
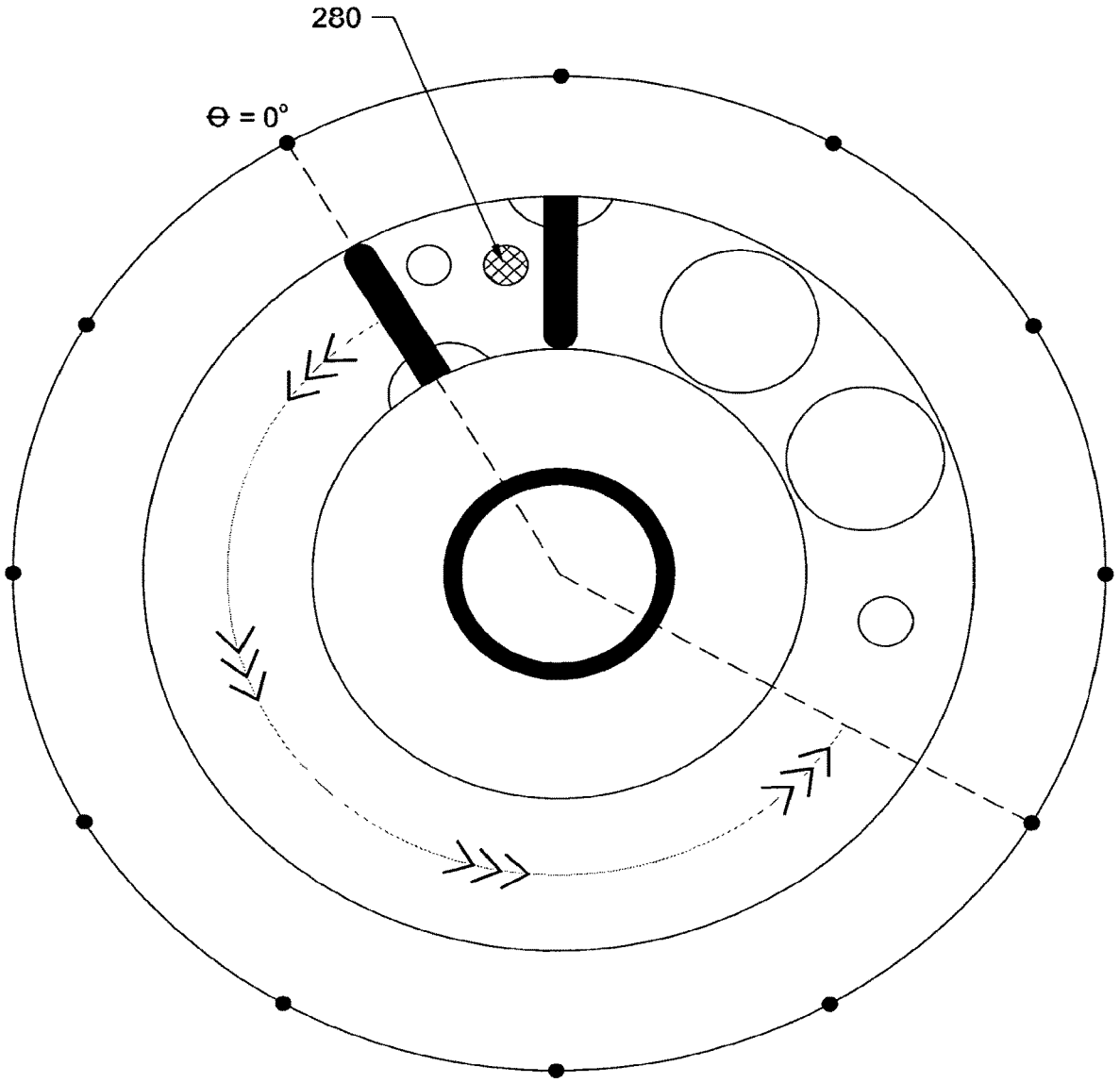
FIG. 10J shows a Cross-Section of the Exhaust Port of Chamber A ("EPCHA") 280 in the Mud Motor Assembly.

FIG. 10J shows a Cross-Section of the Exhaust Port of Chamber A ("EPCHA") 280 in the Mud Motor Assembly.

Figure 10K:
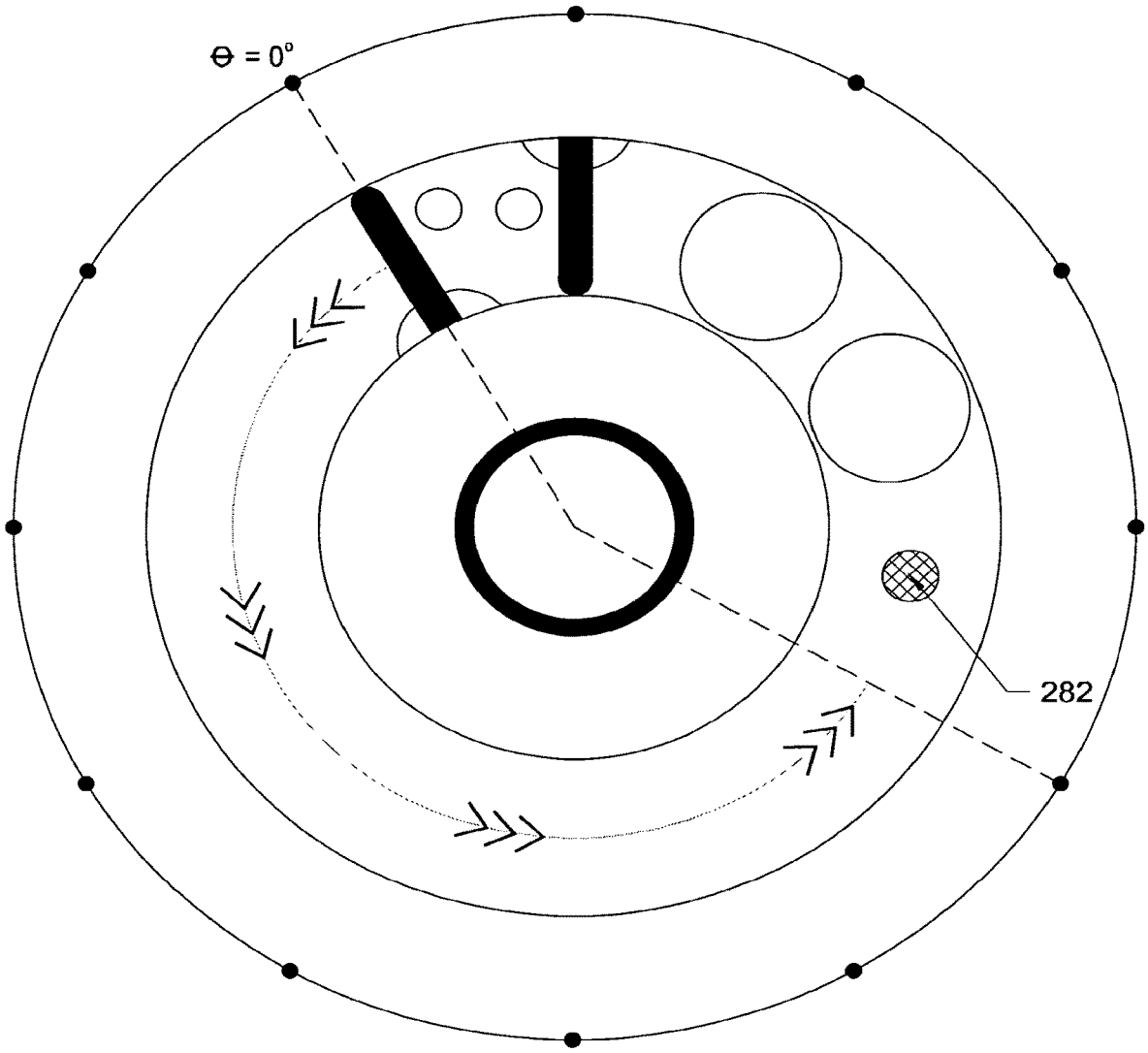
FIG. 10K shows a Cross-Section of the Backstop Port of Chamber A ("BPCHA") 282 in the Mud Motor Assembly.

FIG. 10K shows a Cross-Section of the Backstop Port of Chamber A ("BPCHA") 282 in the Mud Motor Assembly.

Figure 10L:
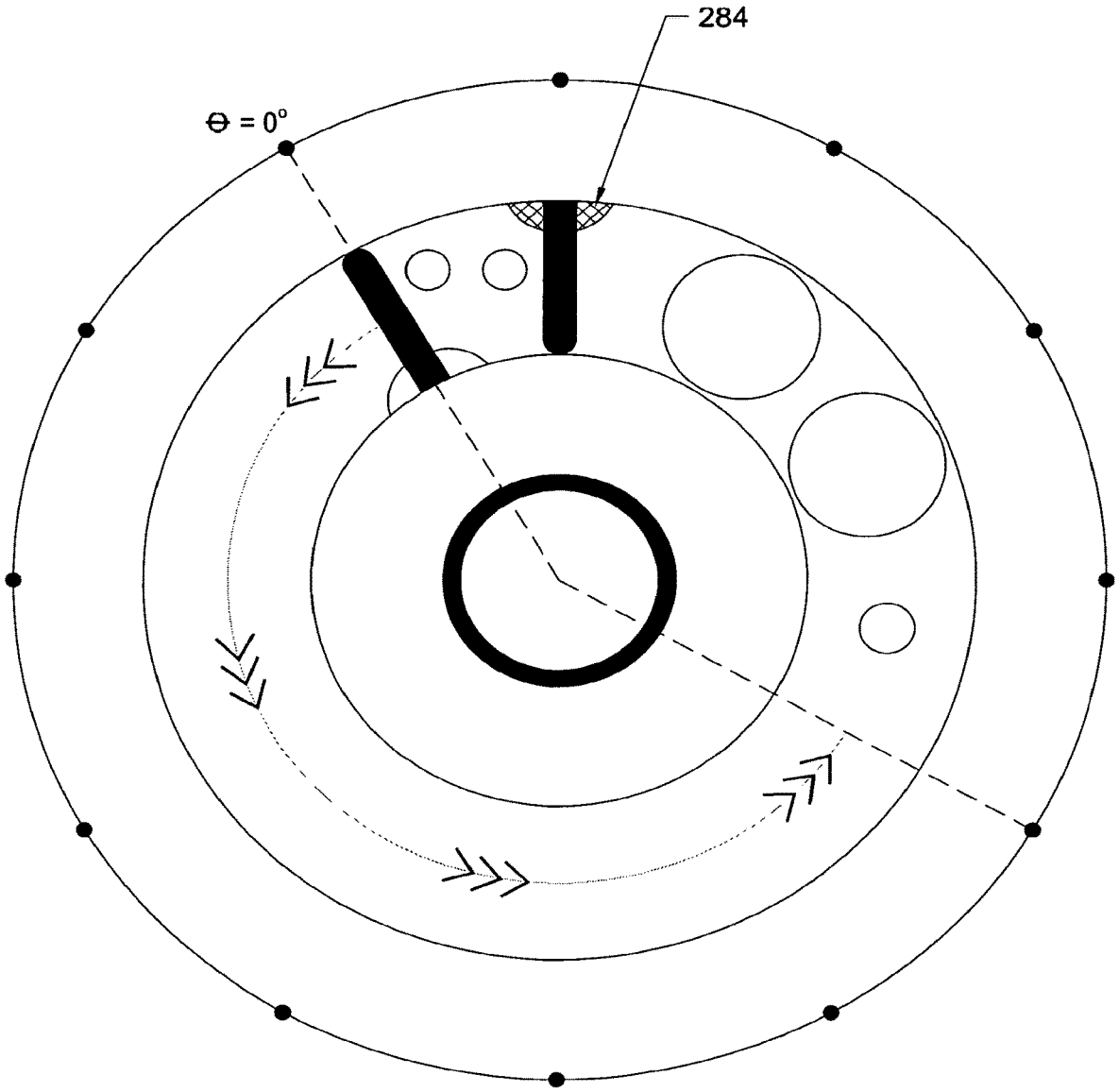
FIG. 10L shows a Cross-Section of the Backstop to Housing Weld 284 in the Mud Motor Assembly.

FIG. 10L shows a Cross-Section of the Backstop to Housing Weld 284 in the Mud Motor Assembly.

Figure 10M:
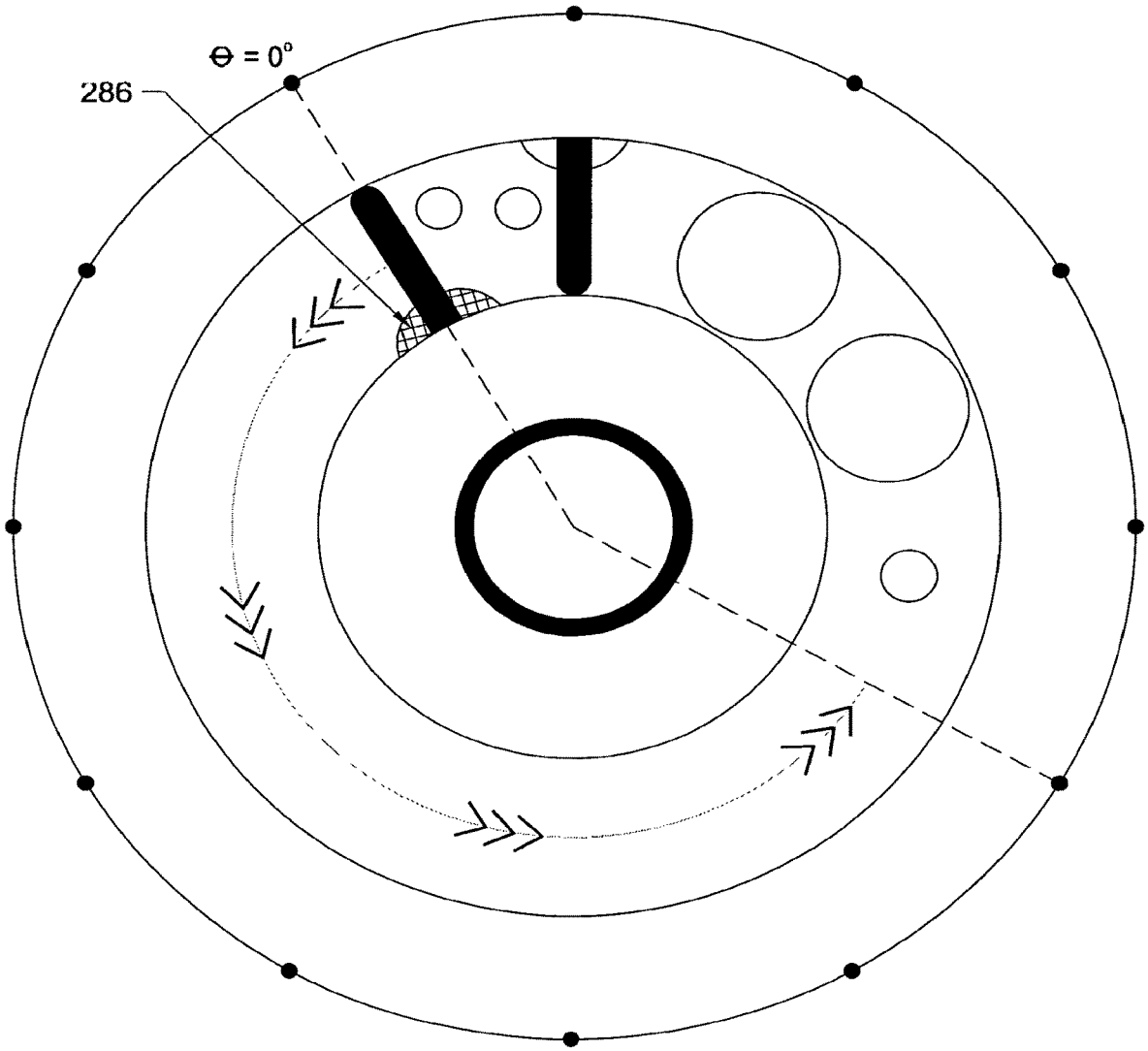
FIG. 10M shows a Cross-Section of Piston A to Crankshaft A Weld 286 in the Mud Motor Assembly.

FIG. 10M shows a Cross-Section of Piston A to Crankshaft A Weld 286 in the Mud Motor Assembly.

6¼ Inch OD Mud Motor

Figure 11:
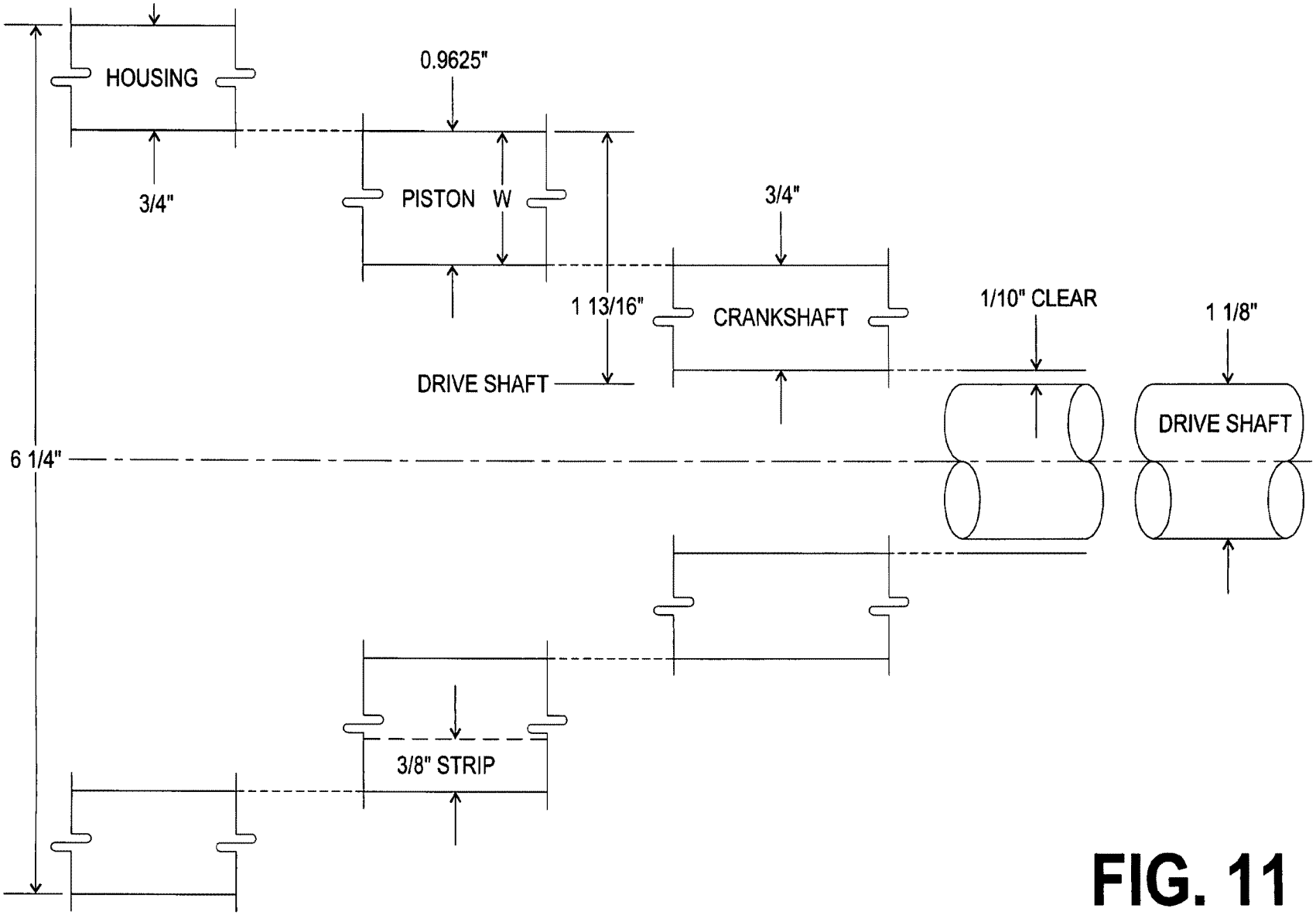
FIG. 11 shows the Basic Component Dimensions for a preferred embodiment of the Mud Motor Assembly having an OD of 6¼ Inches.

FIG. 11 shows the Basic Component Dimensions for a preferred embodiment of the Mud Motor Assembly having an OD of 6¼ Inches. The original source drawing used to generate FIG. 1 herein was a scale drawing that showed on a 1:1 scale the parts that would be used to make a 6¼ inch OD Mud Motor Assembly. Many of those details appear in Ser. No. 61/687,394 which contains many drawings (which is 601 pages long).

There is a legend on FIG. 11 that is quoted as follows: ⅜" STRIP. It is applicant's understanding that for a typical 6½ inch OD mud motor now presently manufactured having a progressing cavity design, that the torque and horsepower output is often calculated based upon having an average ⅜ inch wide strip of effective differential piston area that is subject to the mud pressure that generates the torque on the rotor within the stator. The total area causing the torque in such a presently designed and manufactured mud motor is then given by ⅜ inch×the length of the rotor.

By contrast, the present design for a 6¼ inch OD Mud Motor Assembly shows that the effective piston width (the legend "PISTON W" in FIG. 11), is 0.9625 inches wide. So, the width available to produce torque inside the new design is a factor of 2.6 greater. This is the reason why the new Mud Motor Assembly should be at least twice as powerful per unit length as a presently manufactured progressing cavity type mud motor. Furthermore, no "wiggle shaft" is needed with the new design, thereby again, making the present invention much more powerful per unit length (other factors being equal.)

Bearings

Figure 12:
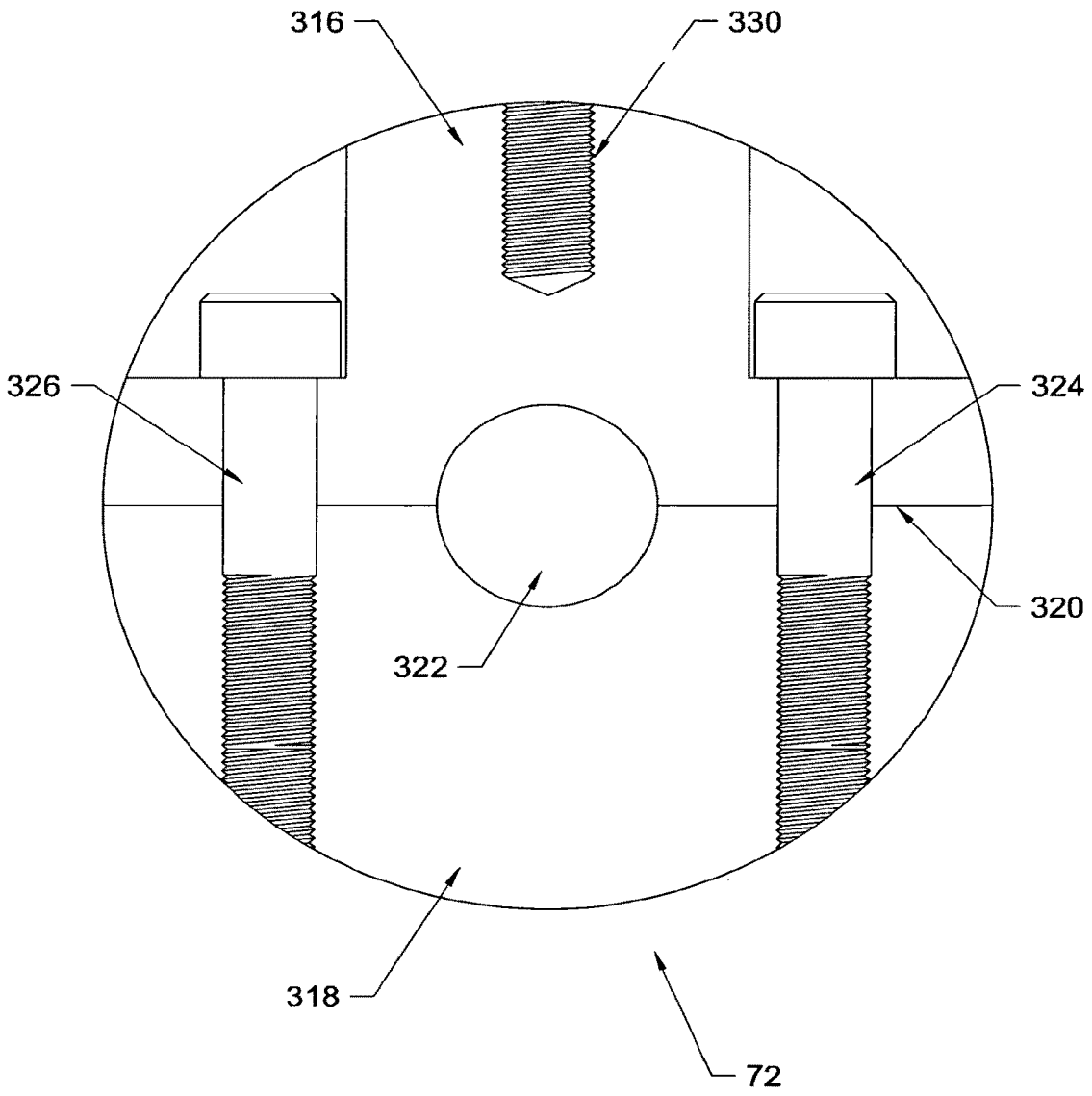
FIG. 12 shows an Uphole View of the Upper Main Bearing 72 in the Mud Motor Assembly.
Figure 20:
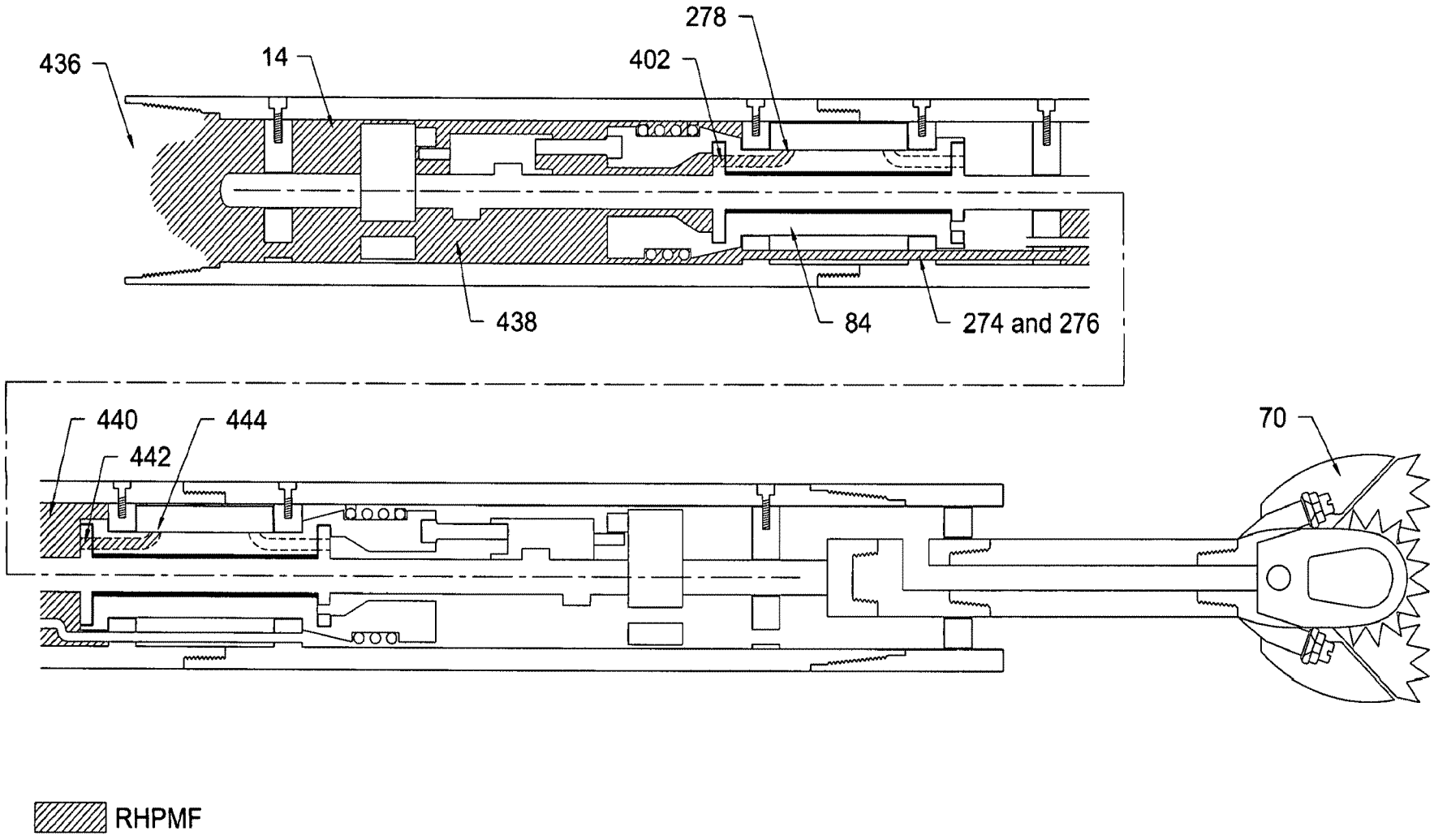
FIG. 20 shows the Relatively High Pressure Mud Flow ("RHPMF") through various ports, valves, and channels within the Mud Motor Apparatus.

FIG. 12 shows an Uphole View of the Upper Main Bearing 72 in the Mud Motor Assembly. It is a "split bearing" having an upper bearing part 316 and a lower bearing part 318. The bearing joining line is shown as element 320. It has a hole 322 that is designed to have the proper clearance around the drive shaft during operation. The split bearing is assembled over the proper portion of the drive shaft, and then Allen head cap screws 324 and 326 are tightened in place. When first placed on the drive shaft, and after the caps screws are tightened, bearing 72 will rotate about the center line of the drive shaft. The entire interior portion of the mud motor assembly is designed to slip into the housing. Then, external Allen head cap screws such as those designed by numeral 328 in FIG. 20 are used to hold the bearing in place within the housing by screwing into threaded hole 330. To get threaded hole 330 lined up, a narrow tool can be inserted into the hole in the housing used to accept the cap screw, and that tool can be used to rotate the bearing into proper orientation. Small holes on the radial exterior of the bearing called "indexing holes" 332 (not shown) can be used to conveniently line up the bearing before the cap screw is put into place through the housing to engage threaded hole 330. Typical assembly methods and apparatus known to those having ordinary skill in the art are employed to design and install such split bearings. Bearing materials are chosen so as not to gall against the drive shaft.

Figure 12A:
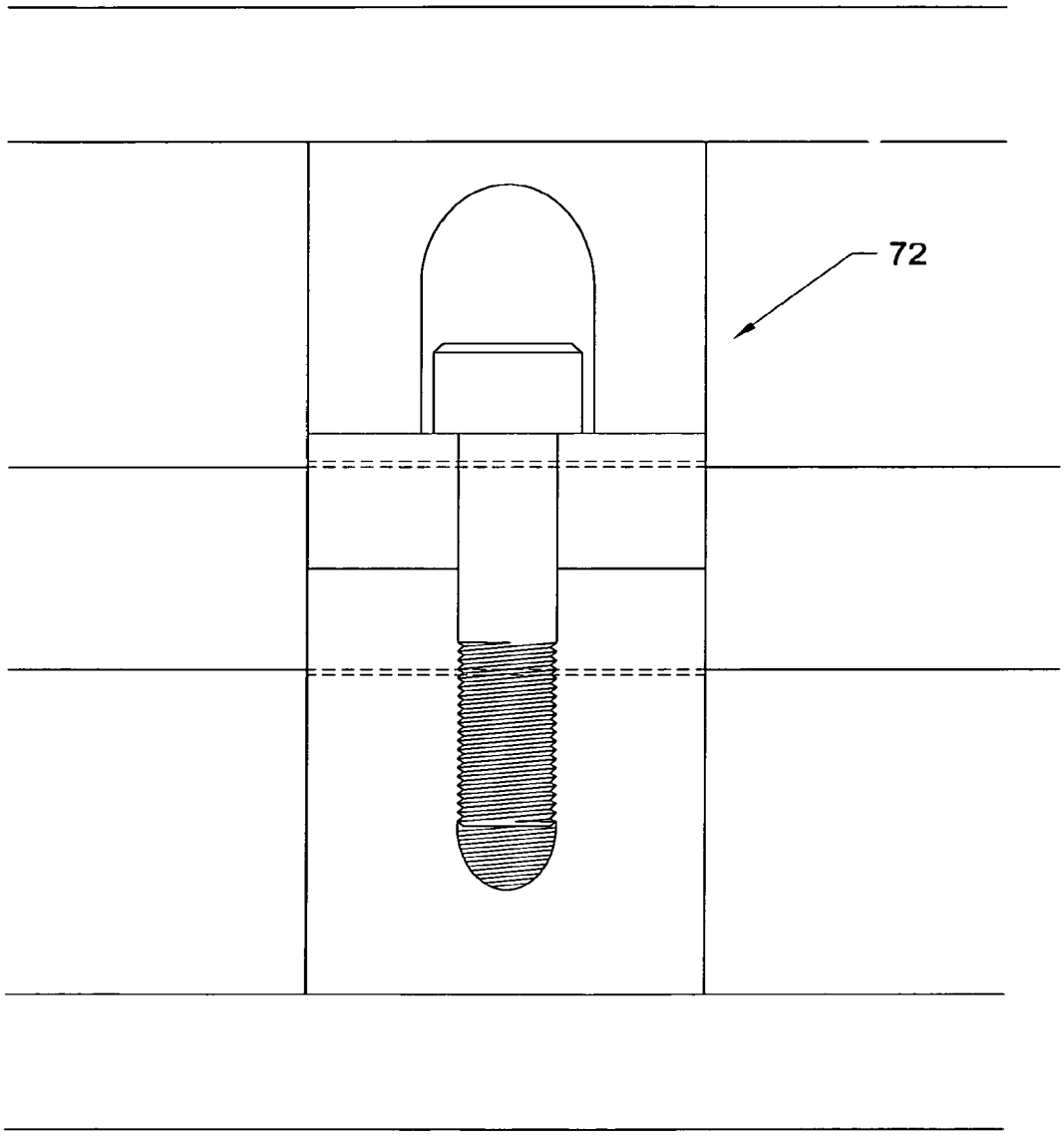
FIG. 12A shows a Section View of the Upper Main Bearing 72 in the Mud Motor Assembly.

FIG. 12A shows a Section View of the Upper Main Bearing 72 in the Mud Motor Assembly.

Figure 12B:
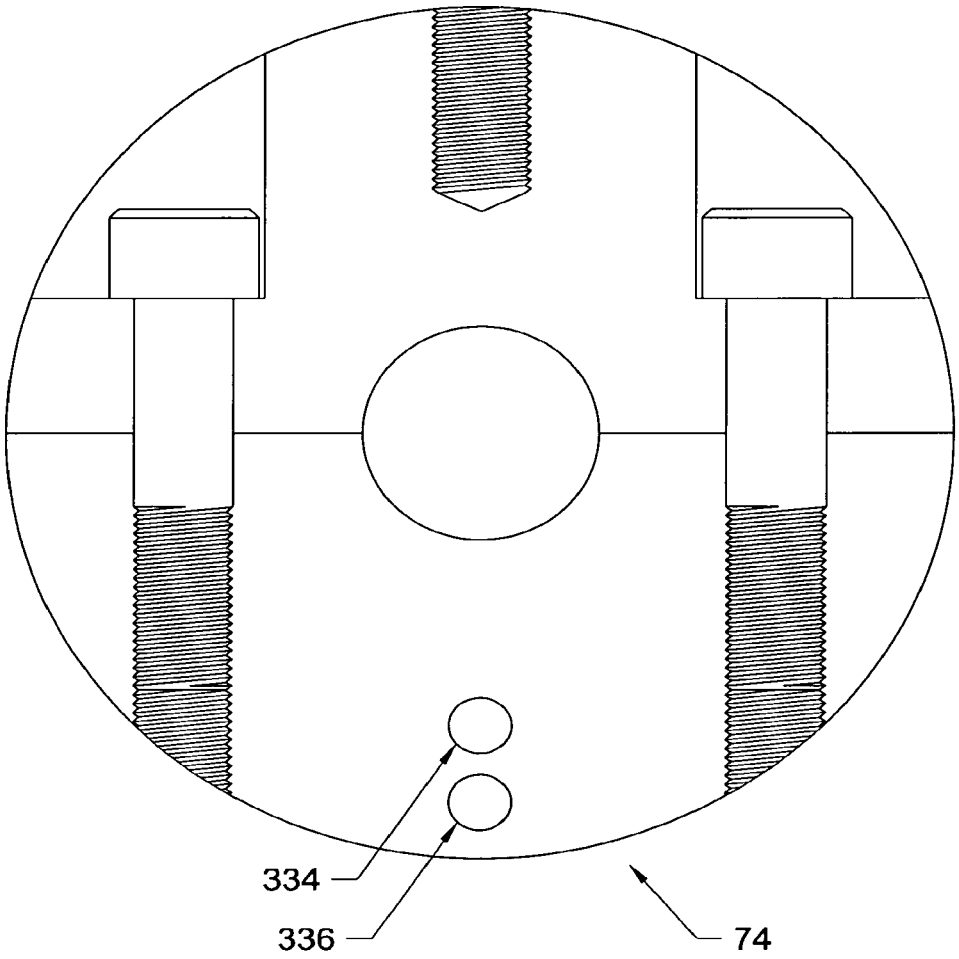
FIG. 12B shows an Uphole View of the Middle Main Bearing 74 in the Mud Motor Assembly having passageways.

FIG. 12B shows an Uphole View of the Middle Main Bearing 74 in the Mud Motor Assembly. Hole passageways 334 and 336 are shown in FIG. 12B. These are typical of the various types of passageways through a bearing for the pass-through of tubing above and below a bearing as may be typically required.

Figure 12C:
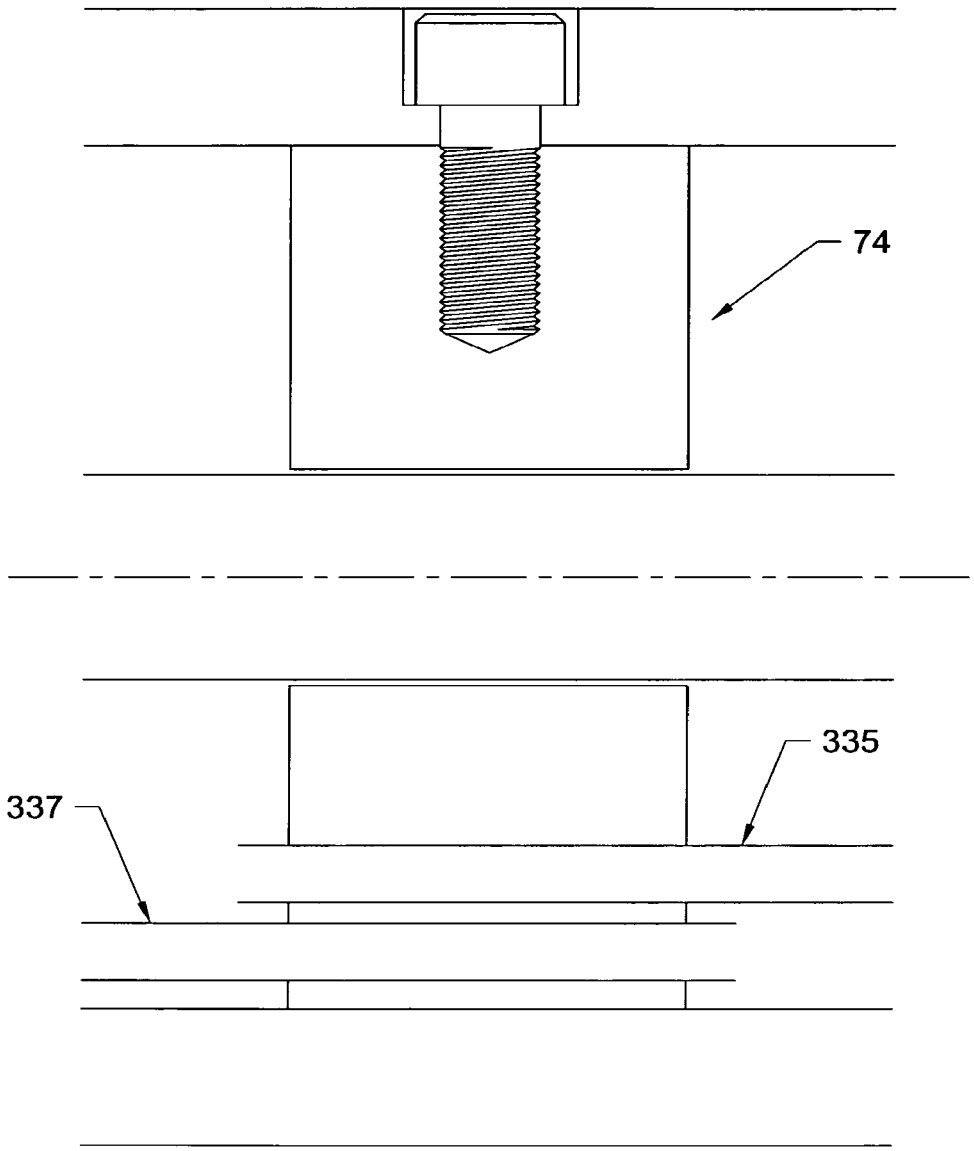
FIG. 12C shows a Section View of the Middle Main Bearing 74 in the Mud Motor Assembly.

FIG. 12C shows a Section View of the Middle Main Bearing 74 in the Mud Motor Assembly. Tubing 335 is shown passing through the hole 334 shown in FIG. 12B. Tubing 337 is shown passing through the hole 336 shown in FIG. 12B. During assembly, such tubing is first passed through the bearing, and then the entire assembly is pushed into the Housing for further assembly as previously described.

Return Spring A

Figure 13:
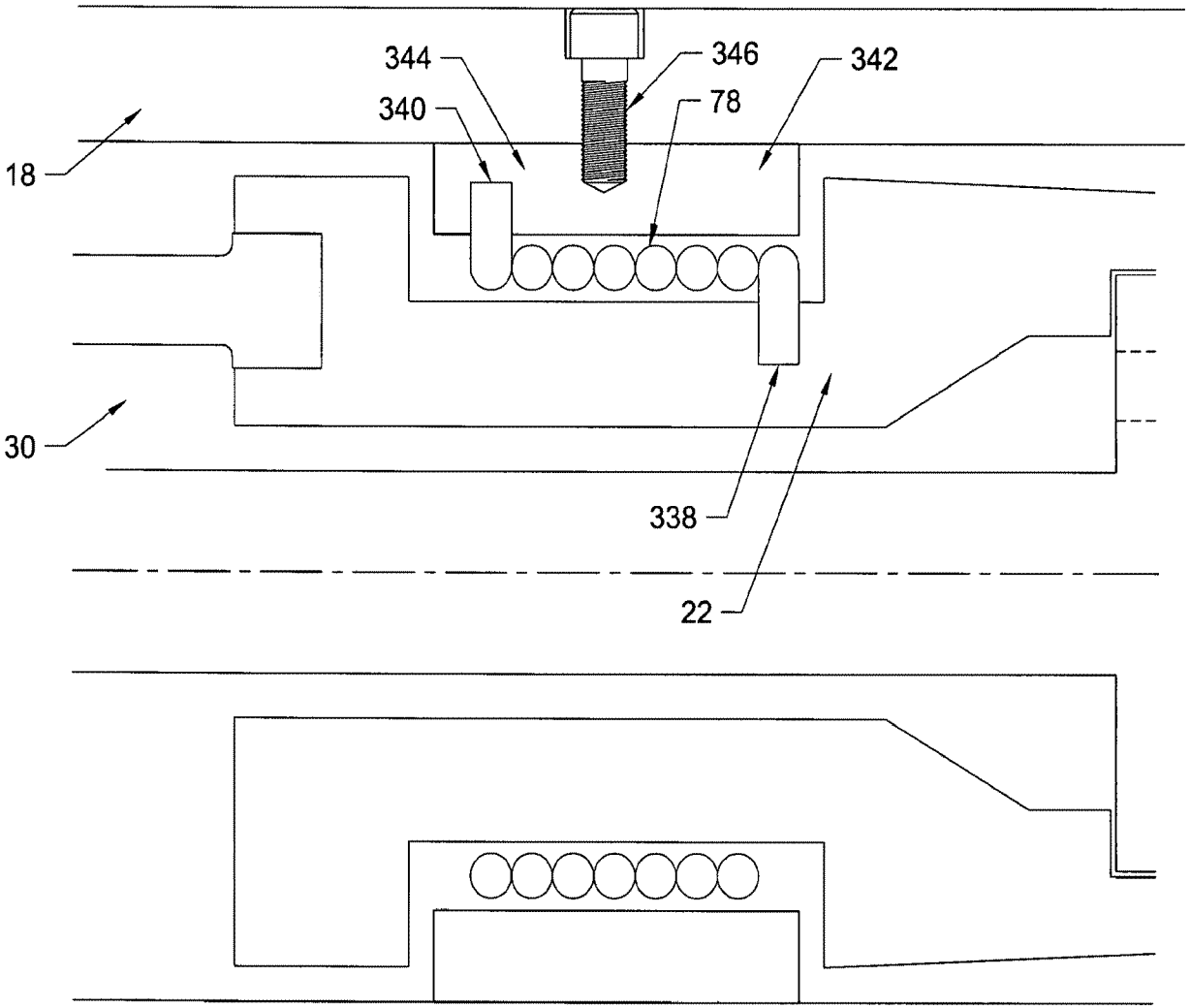
FIG. 13 shows a Section View of Installed Return Spring A 78 Which is a Portion of Ratchet Assembly A 30 in the Mud Motor Assembly.

FIG. 13 shows a Section View of Installed Return Spring A 78 Which is a Portion of Ratchet Assembly A 30 in the Mud Motor Assembly. In this embodiment, one end 338 of the Return Spring A is positively anchored into a portion of Crankshaft A 22. The other end 340 of the Return Spring A is positively anchored into a split-bearing-like structure 344 held in place to the housing 18 by Allen cap screw 346 as is typical with such parts in the Mud Motor Assembly.

Return Spring A 78 is a type of torsion spring. Typical design and testing procedures are used that are well known to individuals having ordinary skill in the art. Adequate space is to be made available to allow the Return Spring A to suitably change its radial dimensions during operation.

Figure 13A:
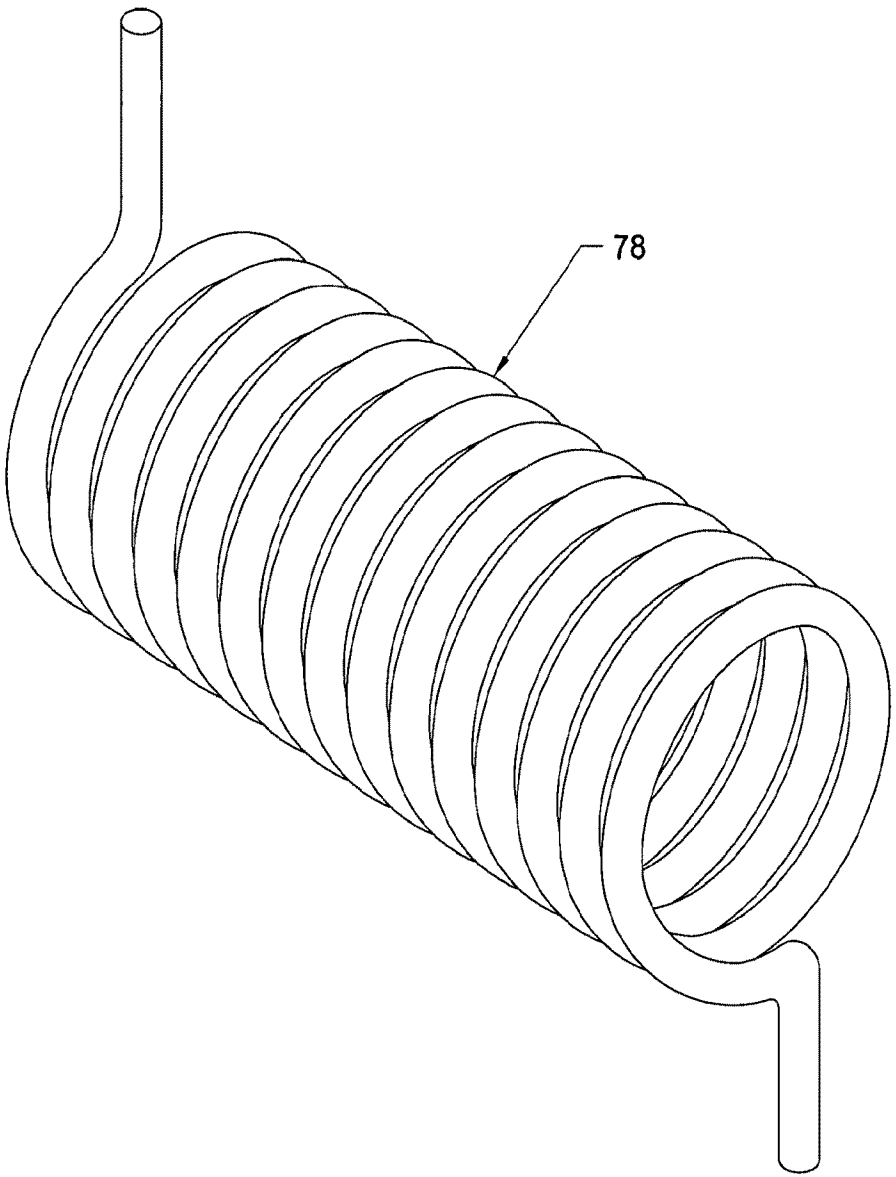
FIG. 13A shows a Perspective View of Return Spring A 78 in the Mud Motor Assembly.

FIG. 13A shows a Perspective View of Return Spring A 78 in the Mud Motor Assembly.

Cross Sections of Ratchet Assembly A (Eight Figures)

Figure 14:
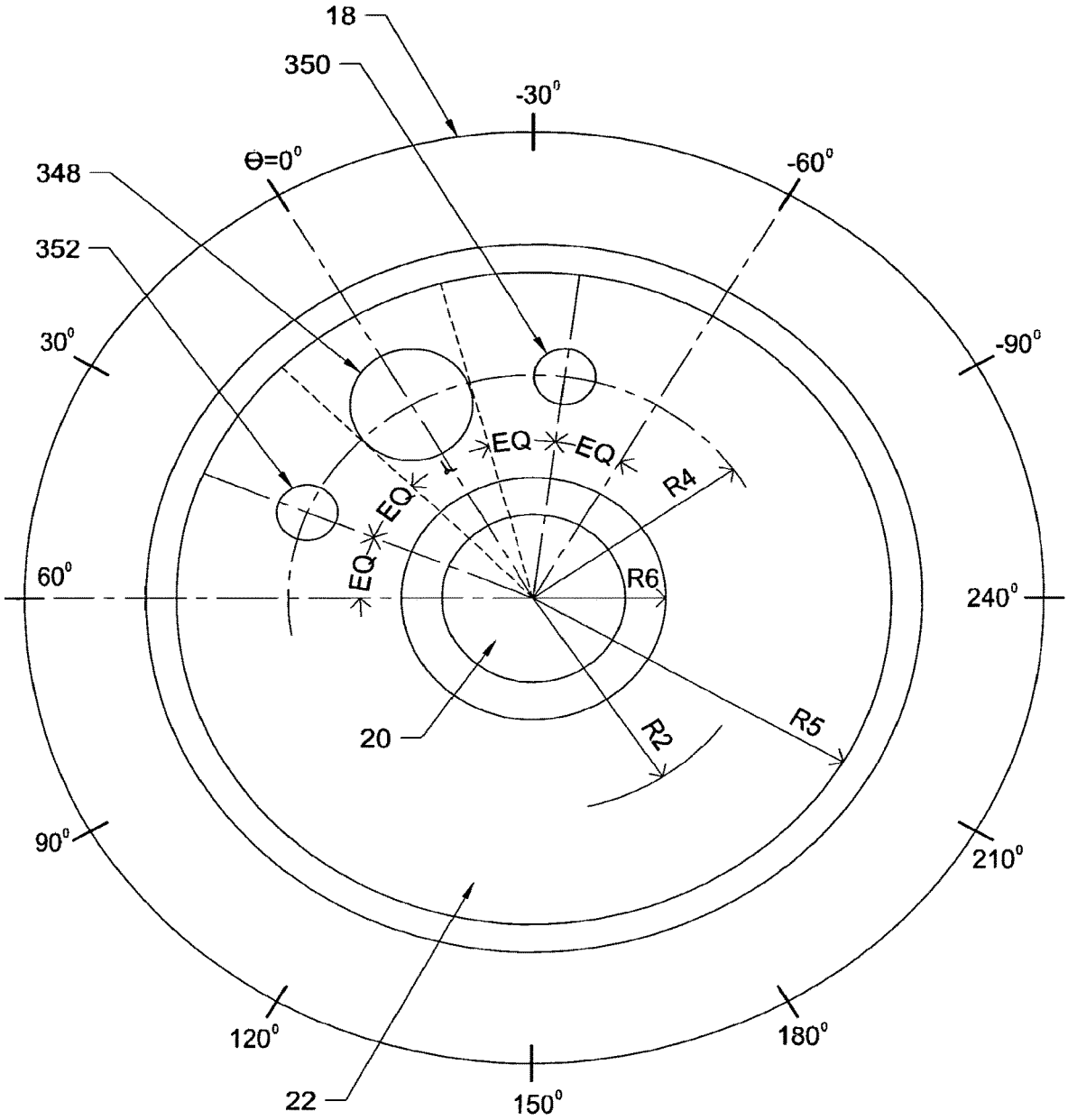
FIG. 14 shows a Cross Section View CC of Ratchet Assembly A in the Mud Motor Assembly.
Figure 14A:
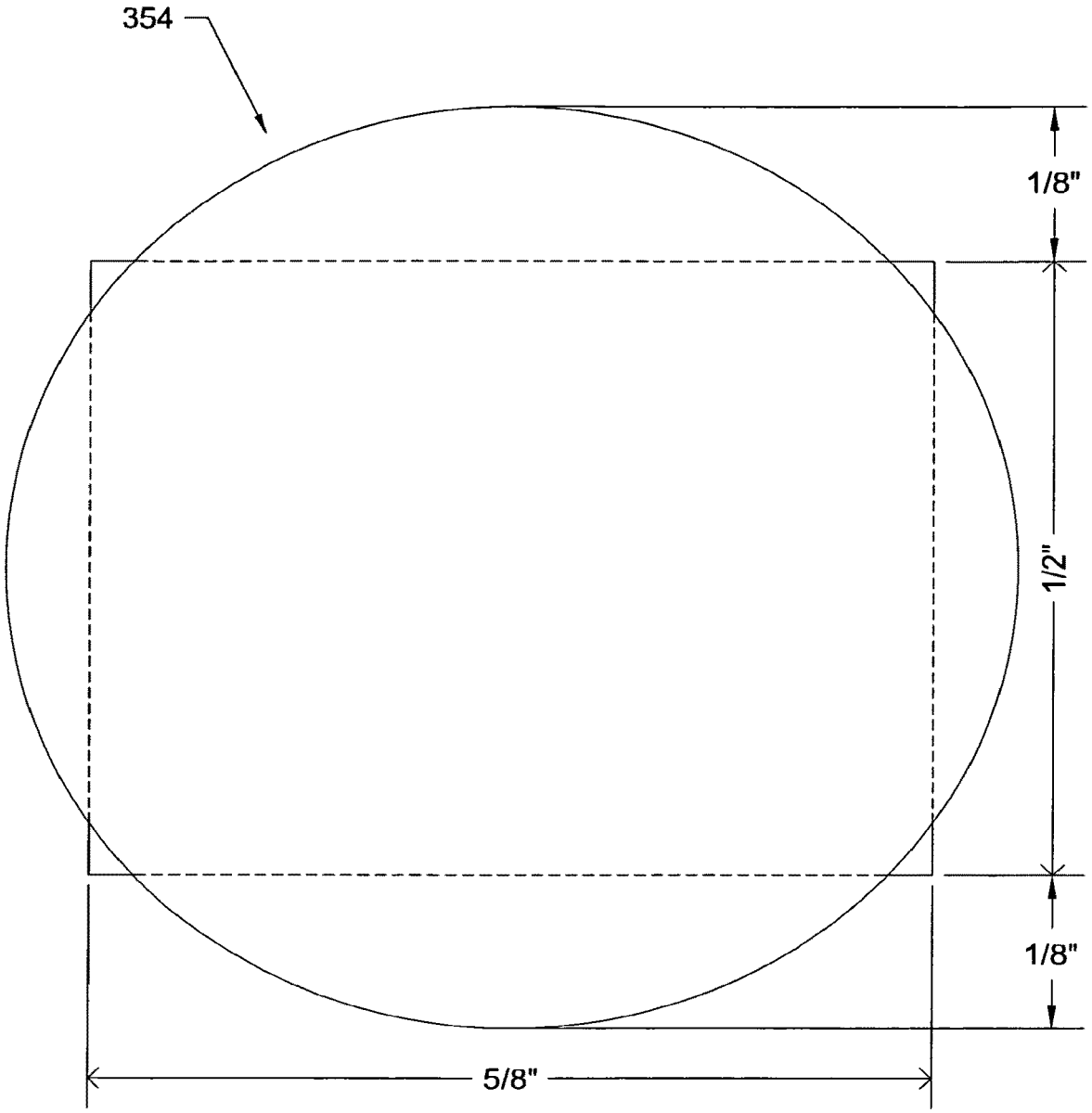
FIG. 14A shows a cross section portion 354 of Drive Pin A for a Preferred Embodiment of the Mud Motor Assembly Having an OD of 6¼ Inches.

FIG. 14 shows a Cross Section View CC of Ratchet Assembly A in the Mud Motor Assembly. Housing 18, drive shaft 20, and Crankshaft A 22 have already been defined. This Cross Section CC is marked on FIG. 6B. This figure derives from a 1:1 scale drawing for a 6¼ inch OD Mud Motor Assembly. The detailed dimensions can be found in Ser. No. 61/687,394. In one embodiment, the rounded base portion 348 of the Drive Pin A 42 may be chosen to be a robust ¾ inches OD. First torsion rod return spring 350 and second torsion rod return spring 352 are shown. The first and second torsion rod return springs provide the spring forces to drive the Pawl A 40 onto the Pawl A Latch Lobe 44 during the final portion of the Return Stroke of Piston A. The symbol EQ stands for equal angles, and convenient choices may be made. There are many different choices for other dimensions including the radii identified by the legends R2, R4, R5 and R6. One particular choice radial dimensions for one embodiment invention may be found in Ser. No. 61/687,394 that are appropriate for a 6¼ inch OD Mud Motor Assembly.

FIG. 14 A shows a cross section portion 354 of Drive Pin A 42 for a Preferred Embodiment of the Mud Motor Assembly Having an OD of 6¼ Inches.

Figure 14B:
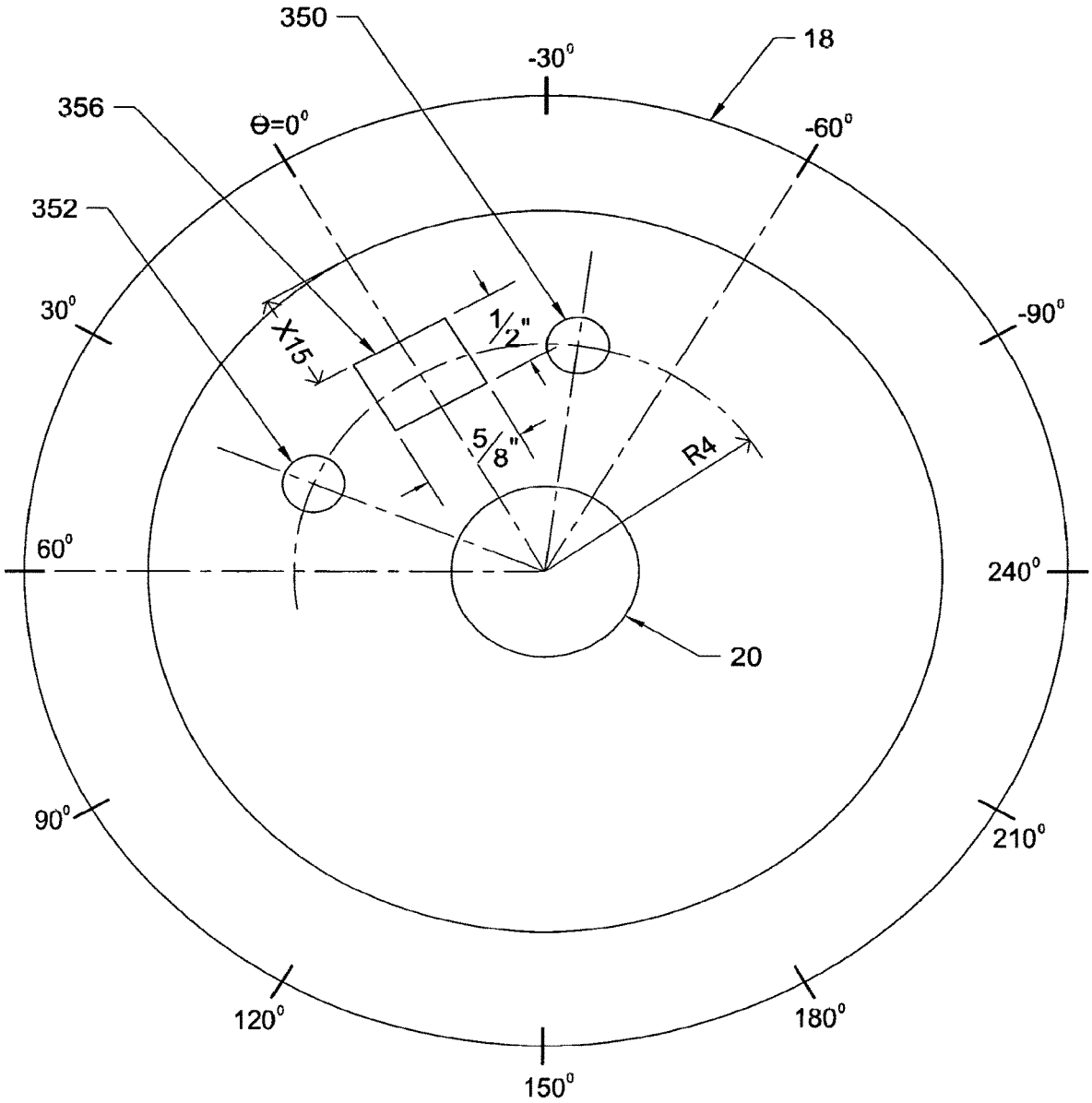
FIG. 14B shows a Cross Section View DD of one embodiment of Ratchet Assembly A in the Mud Motor Assembly.

FIG. 14B shows a Cross Section View DD of one embodiment of Ratchet Assembly A in the Mud Motor Assembly. This Cross Section DD is marked on FIG. 6B. Portion 356 of Drive Pin A 42 is shown. First and second torsion rods 350 and 352 are also shown. Various dimensions are shown that are appropriate for a 6¼ inch OD Mud Motor Assembly. There are many different choices for other dimensions including the radius R4 and a distance of separation X15. One particular choice of these dimensions for one embodiment invention may be found in Ser. No. 61/687,394 that are appropriate for a 6¼ inch OD Mud Motor Assembly.

Figure 14C:
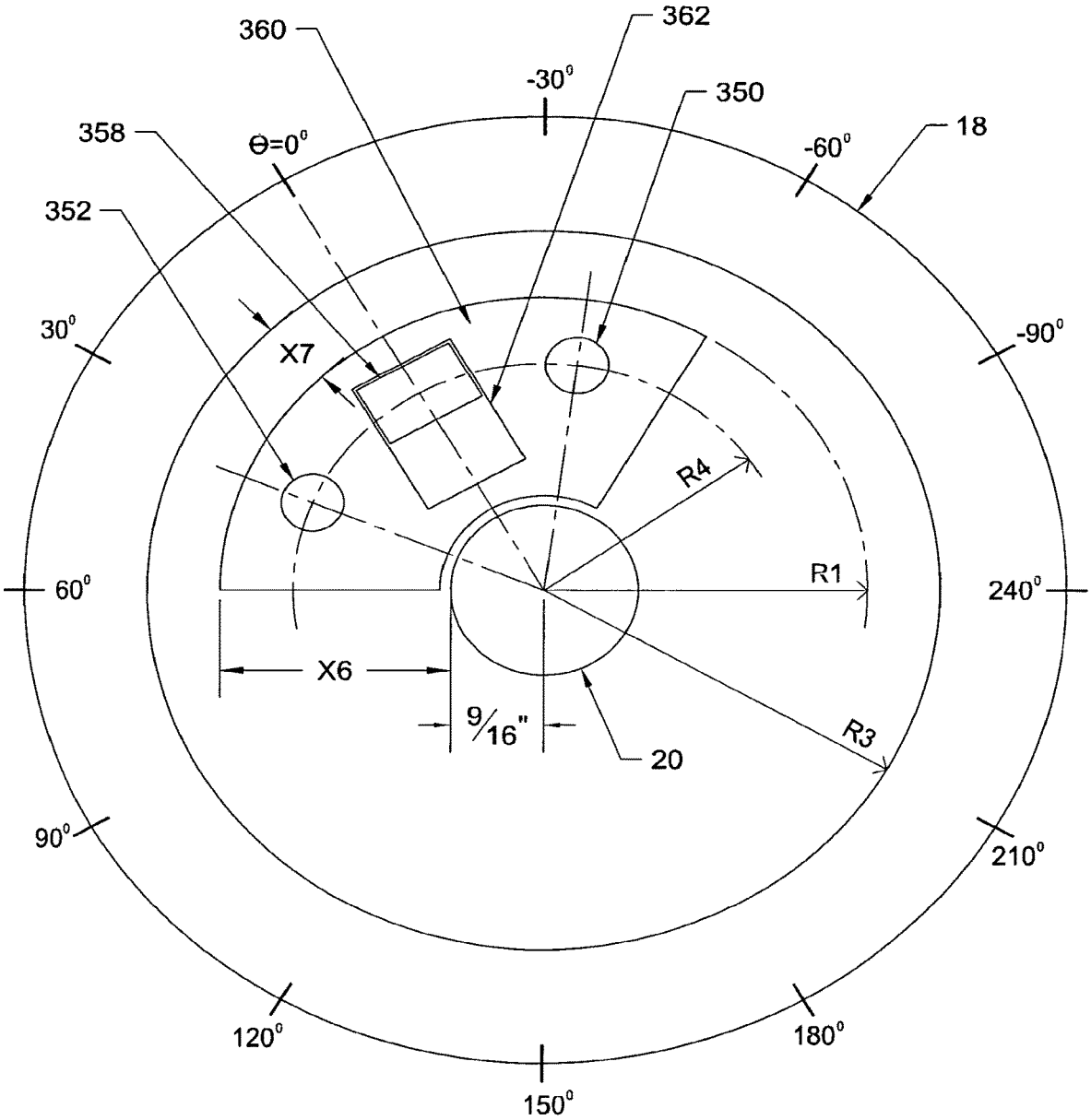
FIG. 14C shows a Cross Section View EE of one embodiment of Ratchet Assembly A in the Mud Motor Assembly.

FIG. 14C shows a Cross Section View EE of one embodiment of Ratchet Assembly A in the Mud Motor Assembly. This Cross Section EE is marked on FIG. 6B. Portion 358 of Drive Pin A 42 is shown. First and second torsion rods 350 and 352 are also shown. A portion 360 of Pawl A 40 is shown. Drive Pin A Slot 362 is also shown. Various dimensions are shown that are appropriate for a 6¼ inch OD Mud Motor Assembly. There are many different choices for other dimensions including the radii identified by the legends R2 and R4, and the distances identified by the legends X6 and X7. One particular choice of these dimensions for one embodiment invention may be found in Ser. No. 61/687,394 that are appropriate for a 6¼ inch OD Mud Motor Assembly.

Figure 14D:
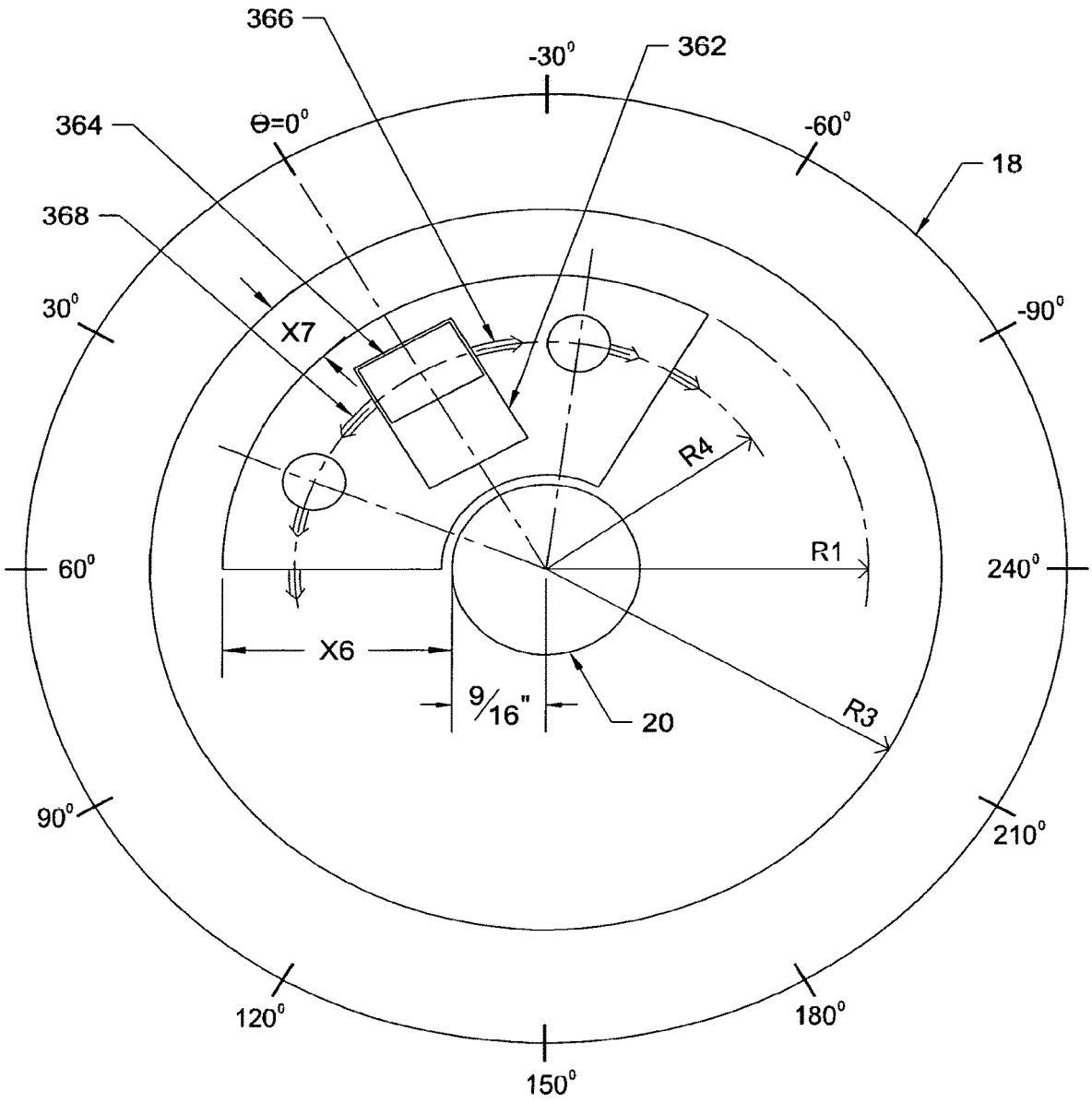
FIG. 14D shows How to Utilize a Larger Drive Pin 364 than that shown in FIG. 14C.

FIG. 14D shows How to Utilize a Larger Drive Pin 364 than that shown in FIG. 14C. Arrows 366 and 368 show the directions of the enlargement of the Drive Pin A Slot 362. The dimensions shown are appropriate for a 6¼ inch OD Mud Motor Assembly. The remainder of the legends have been previously defined.

Figure 14E:
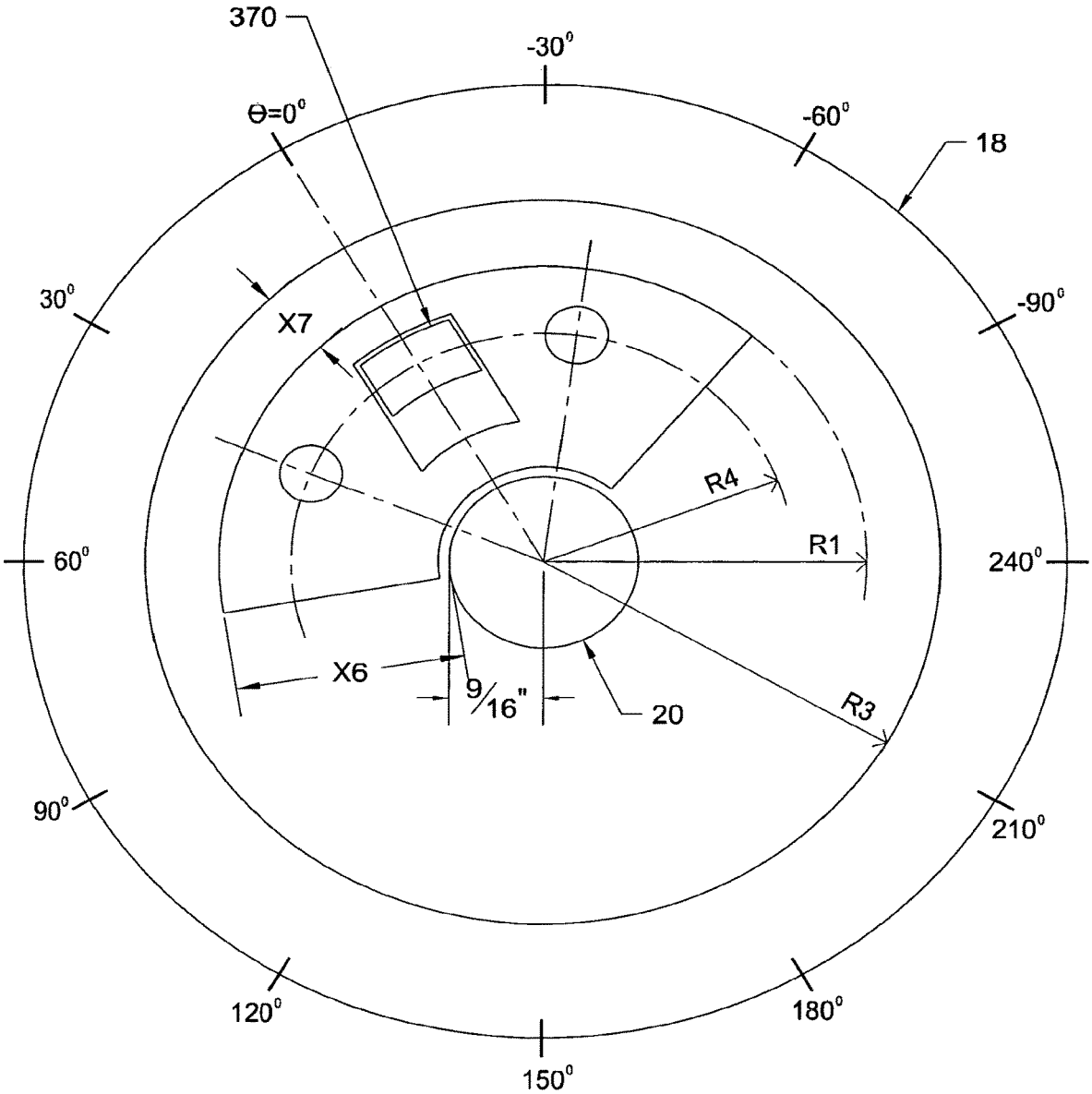
FIG. 14E shows an Optional Larger and Different Shaped Drive Pin 370 than in FIG. 14C.

FIG. 14E shows an Optional Larger and Different Shaped Drive Pin 370 than in FIG. 14C. The dimensions shown are appropriate for a 6¼ inch OD Mud Motor Assembly. The remainder of the legends have been previously defined.

Figure 14F:
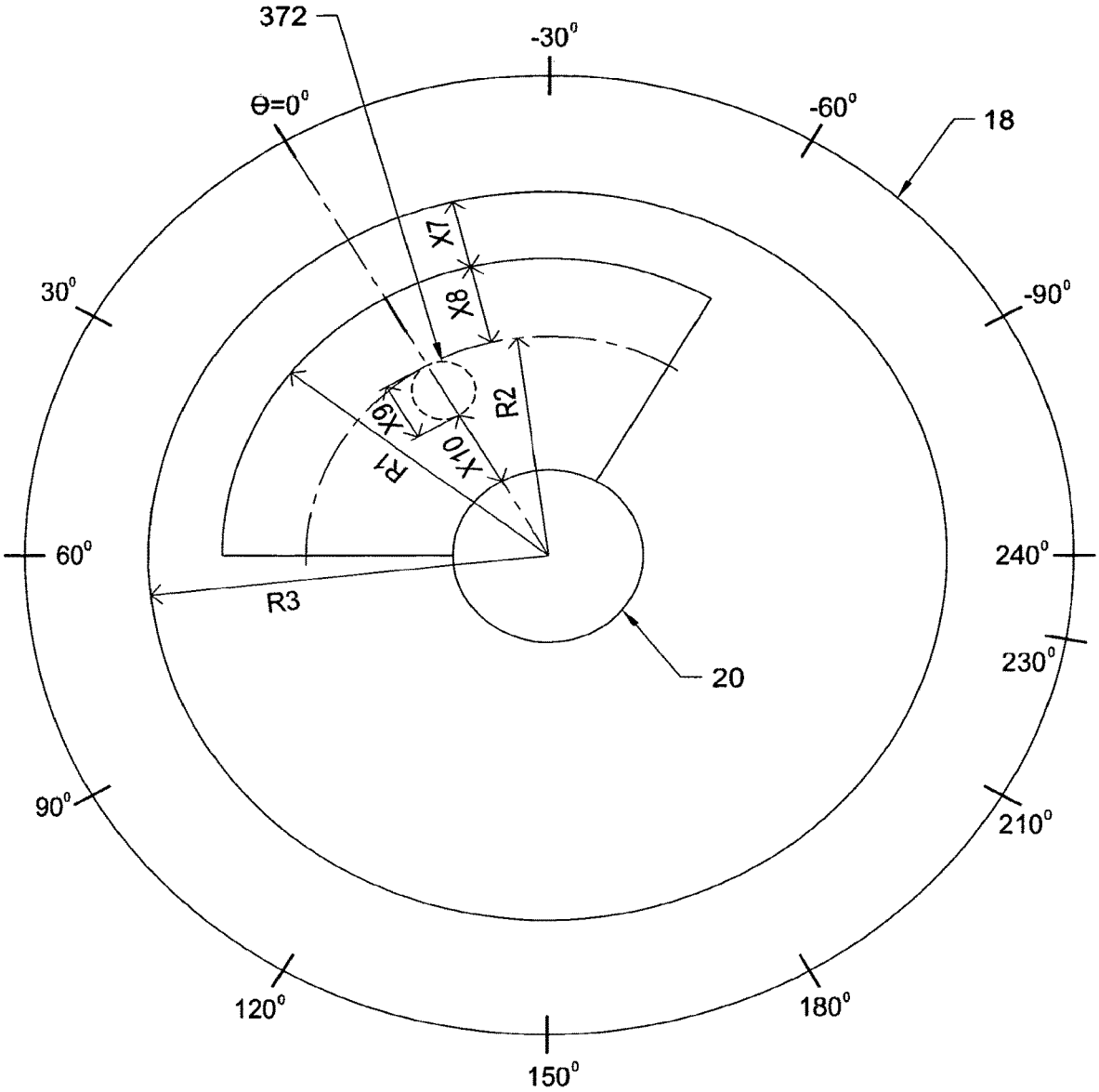
FIG. 14F shows a Cross Section View AA of Ratchet Assembly A in the Mud Motor Assembly.

FIG. 14F shows a Cross Section View AA of Ratchet Assembly A in the Mud Motor Assembly. This Cross Section AA is marked on FIG. 6B. Pawl A Capture Pin 38 is shown in its "down position" 372 seated against the OD of Drive Shaft 20. This drawing was derived from a 1:1 scale drawing for a Mud Motor Assembly having an OD of 6¼ inches. There are many different choices for other dimensions including the radii identified by the legends R1, R2, and R3, and the distances identified by the legends X7, X8, and X9. One particular choice of these dimensions for one embodiment invention may be found in Ser. No. 61/687,394 that are appropriate for a 6¼ inch OD Mud Motor Assembly.

Figure 14G:
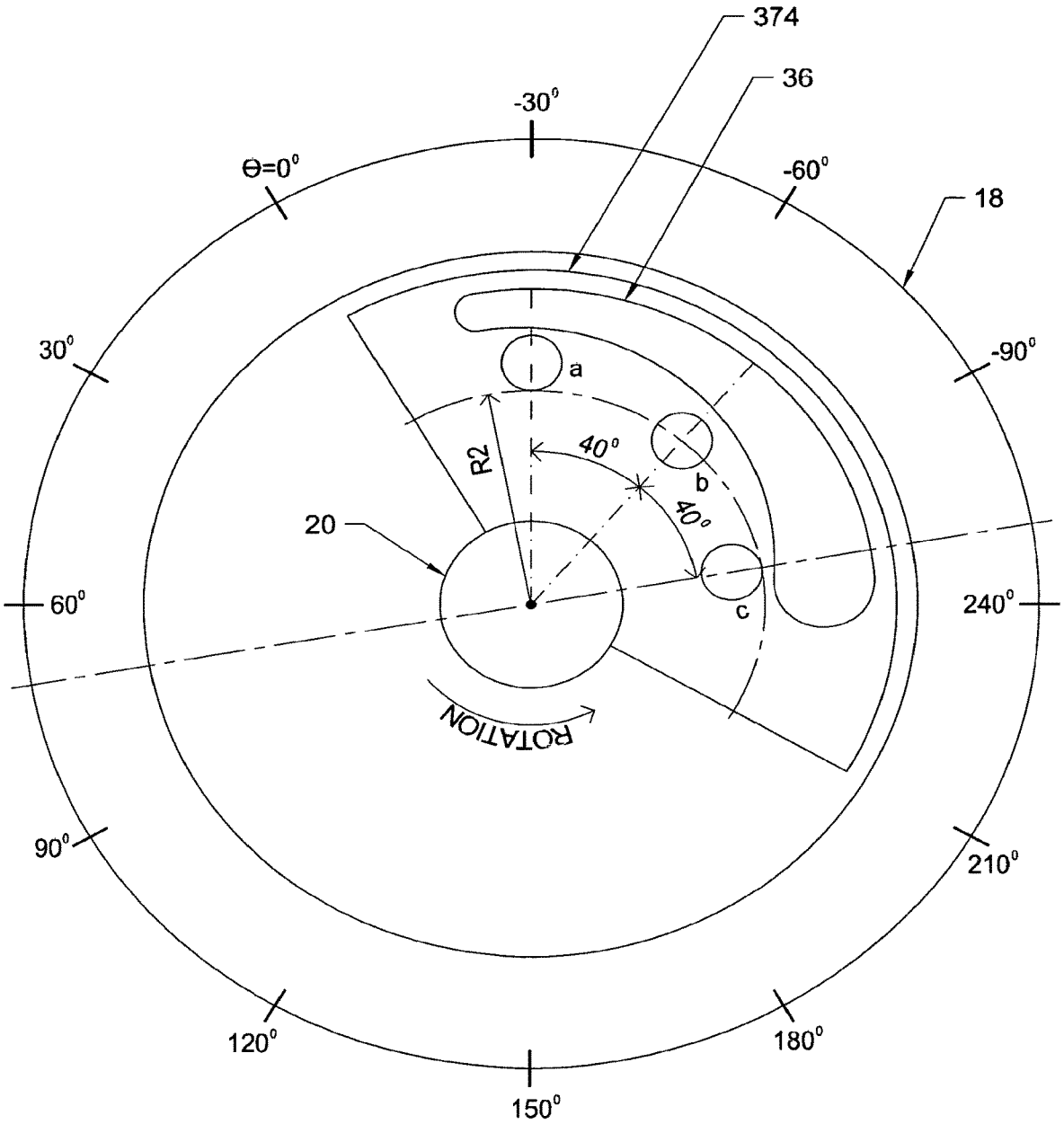
FIG. 14G shows an Uphole View of Flywheel A and Raised Guide for Pawl A Capture Pin in Section BB of Ratchet Assembly A Showing Sequential Movement of Pawl A Capture Pin in the Mud Motor Assembly.

FIG. 14G shows an Uphole View of Flywheel A and Raised Guide for Pawl A Capture Pin in Section BB of Ratchet Assembly A.

Showing Sequential Movement of Pawl A Capture Pin in the Mud Motor Assembly

A portion 374 of Flywheel 40 is shown. Raised Guide for Pawl A Capture Pin 36 is also shown. Sequential positions a, b, and c of the Pawl A Capture Pin 38 shows how that pin is captured so that the Pawl A 40 is returned to its proper seated position at the end of the Reset Stroke of Piston A. In position "a", the Pawl A Capture Pin is shown in its maximum radial distance R2 away from the center of rotation of the Drive Shaft 20, which is its maximum "up position" and which can be identified herein as R2(*a*). In position "c", the Pawl A Capture Pin is in its closest radial distance R2 away from the center of rotation of the Drive Shaft 20, which is it's "down position" and which can be identified herein as R2(*c*). Position "b" shows an intermediate position of the Pawl A Capture Pin. In one preferred embodiment of the invention, the mathematical difference R2(*a*)−R2(*c*)=⅜ inch plus 1/32 inch. It that embodiment, the Pawl A Seat Width ("PASW") is chosen to be ⅜" (see element 377 in FIG. 15A), so that the clearance distance 379 is 1/32" between the Tip of Pawl A lifter Lobe 381 and the ID 383 of the Pawl A 40 in FIG. 15A.

There are many choices for Flywheel A. In one preferred embodiment, the energy stored in Flywheel A and in Flywheel B is sufficient to keep the rotary drill bit turning through 360 degrees even if the mud pressure through the drill string drops significantly.

Pawl A and Pawl A Latch Lobe

Figure 15:
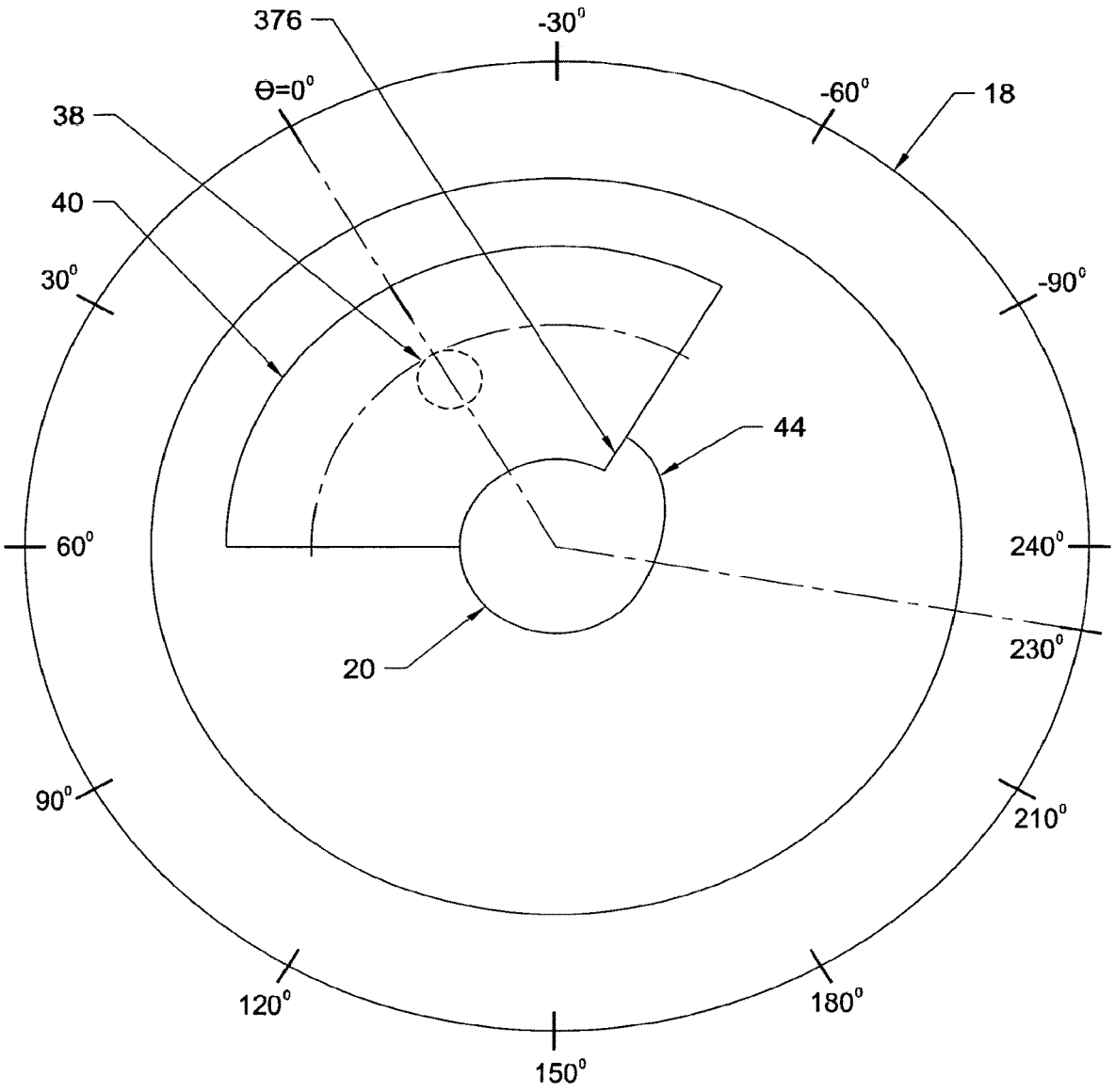
FIG. 15 shows one embodiment of the Pawl A Latch Lobe 44 Fully Engaged With Pawl A 40 at mating position 376 in the Mud Motor Assembly.

FIG. 15 shows one embodiment of the Pawl A Latch Lobe 44 Fully Engaged With Pawl A 40 at mating position 376 in the Mud Motor Assembly. As shown, the Pawl A Capture Pin 38 is opposite theta of 0 degrees ready for the beginning of the Power Stroke of Piston A.

Figure 15A:
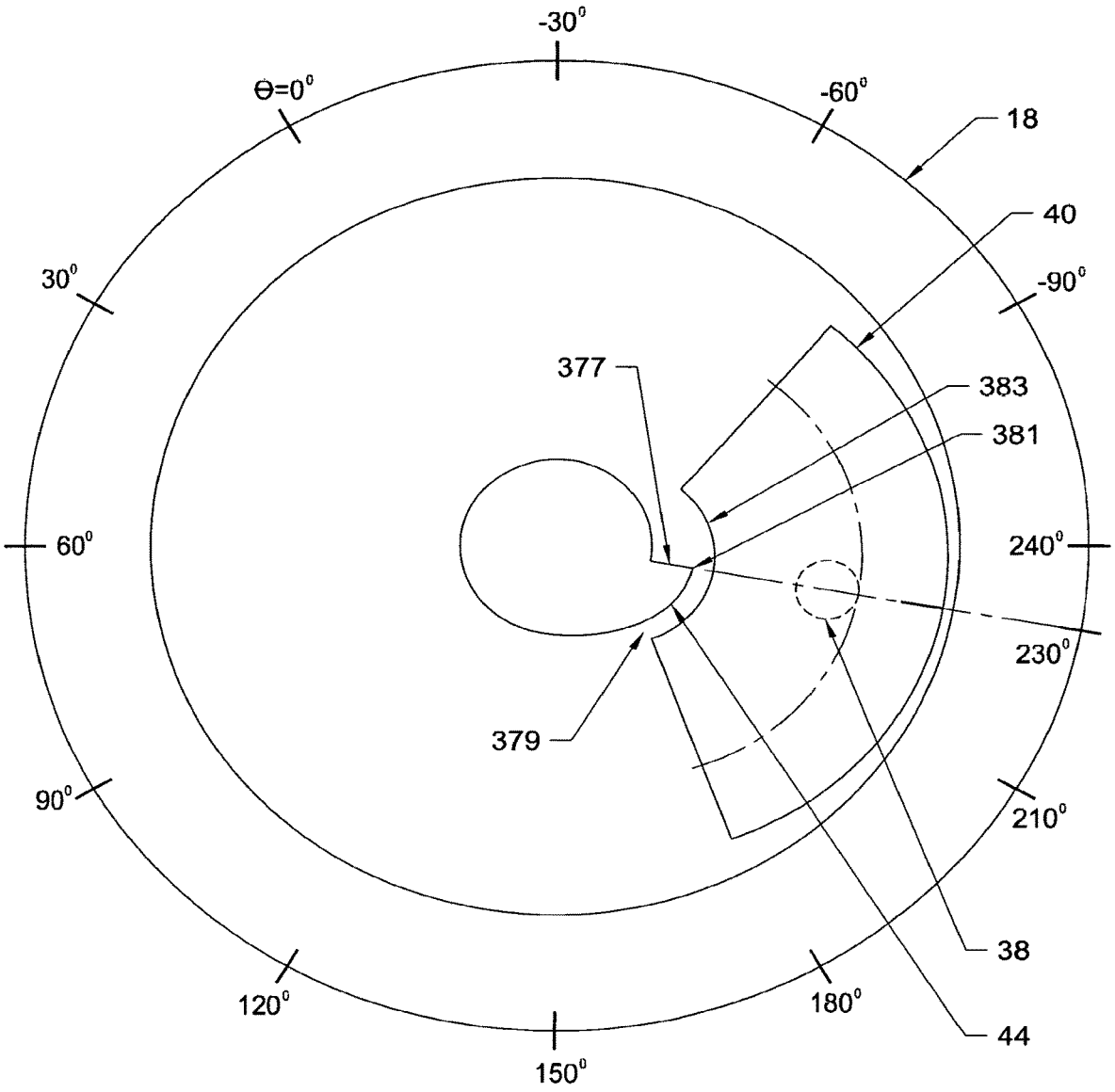
FIG. 15A shows one embodiment of the Pawl A Latch Lobe 44 Completely Disengaged From Pawl A 40 in the Mud Motor Assembly.

FIG. 15A shows one embodiment of the Pawl A Latch Lobe 44 Completely Disengaged From Pawl A 40 in the Mud Motor Assembly. Here the Pawl A Capture Pin is opposite an angle theta slightly in excess of 230 degrees. Pawl A 40 has been lifted into this position by the Pawl A Lifter Lobe 46 of the Mud Motor Assembly, and is ready to begin its return with the Return Stoke of Piston A. Numeral 377 is to designate the Pawl A Seat Width ("PASW"). In several preferred embodiments of the 6¼ inch OD Mud Motor Assembly, PASW is chosen to be ⅜". FIG. 15A shows the clearance distance 379 between the Tip of Pawl A Lifter Lobe 381 and the ID 383 of the Pawl A 40. As explained in relation to FIG. 14G, the clearance distance 379 is chosen to be 1/32 inch in one preferred embodiment.

Figure 15B:
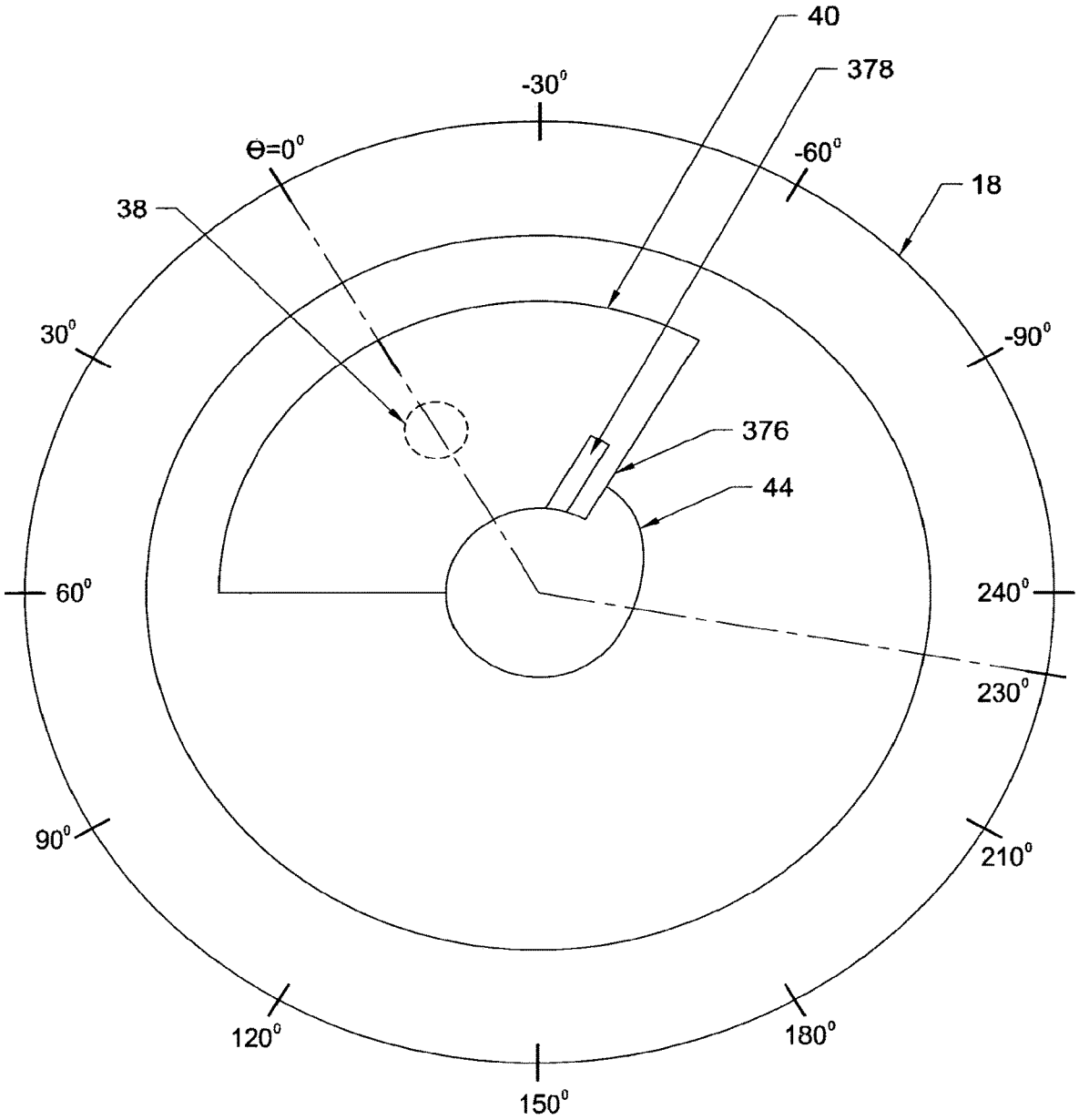
FIG. 15B shows an Optional Slot 378 Cut in Pawl A 40 to Make Torsion Cushion at mating position 376 During Impact of Pawl A Latch Lobe in the Mud Motor Assembly.

FIG. 15B shows a Optional Slot 378 Cut in Pawl A 40 to Make Torsion Cushion at mating position 376 During Impact of Pawl A Latch Lobe in the Mud Motor Assembly.

Pawl A Lifter Lobe and Pawl A

Figure 16:
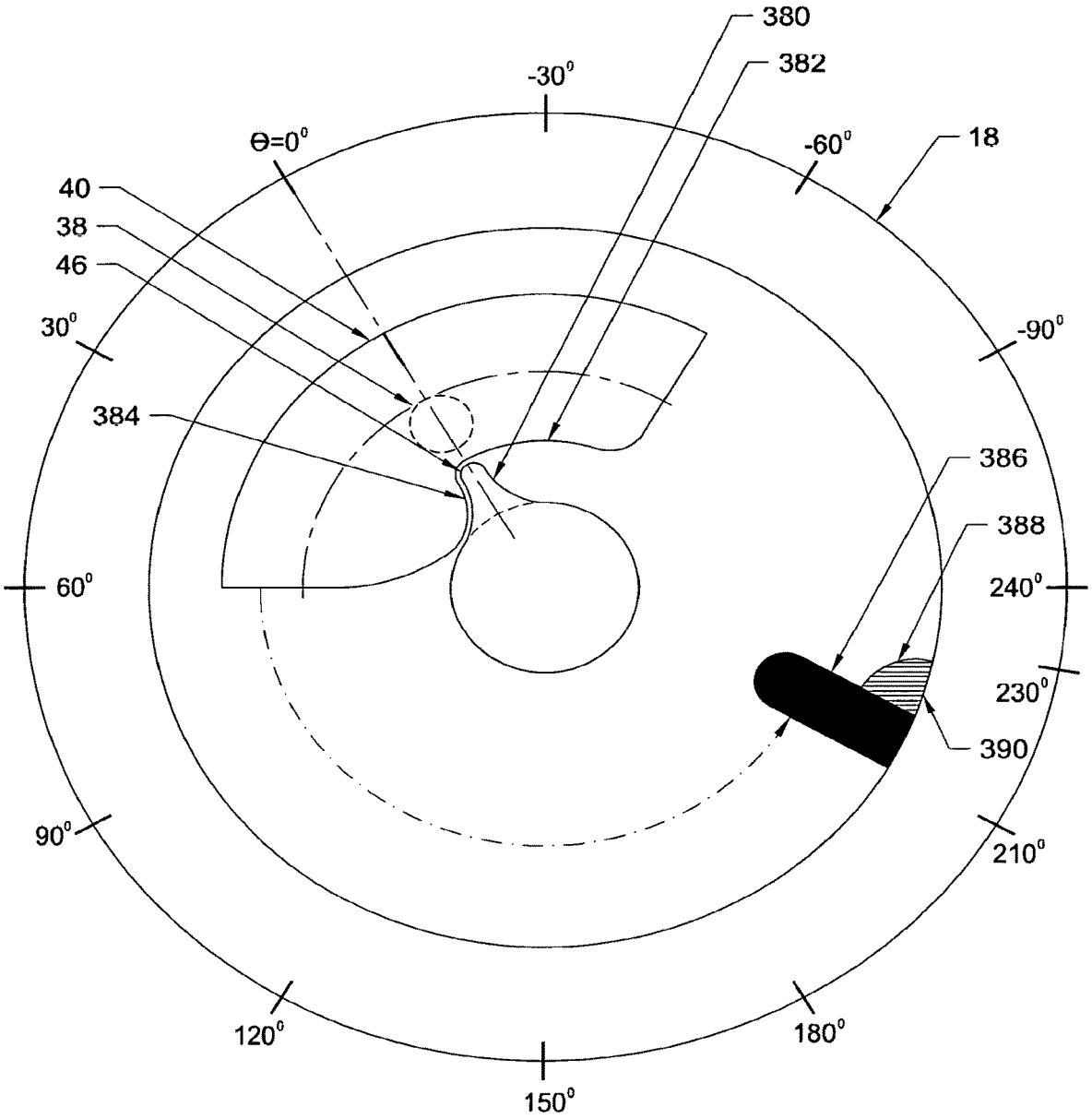
FIG. 16 shows the Pawl A Lifter Lobe at theta of 0 Degrees in the Mud Motor Assembly.

FIG. 16 shows the Pawl A Lifter Lobe at theta of 0 Degrees in the Mud Motor Assembly. One embodiment of the Pawl A Lifter Lobe 46 in shown in FIG. 16. Pawl A 40 is also shown. The Pawl A Lifter Lobe 46 has Lifter Lobe Profile 380 that rides within Pawl A Lifter Recession 382. At theta equals 0 degrees, the Pawl A Lobe Lifter 46 does NOT contact any portion of the Pawl A Lifter Recession 382. There is a clearance 384 between the Pawl A Lobe Lifter 46 and any portion of the Pawl A. Pawl A Stop 386 is shown that is welded in place with weld 388 to the Housing 18 at location 390.

Figure 16A:
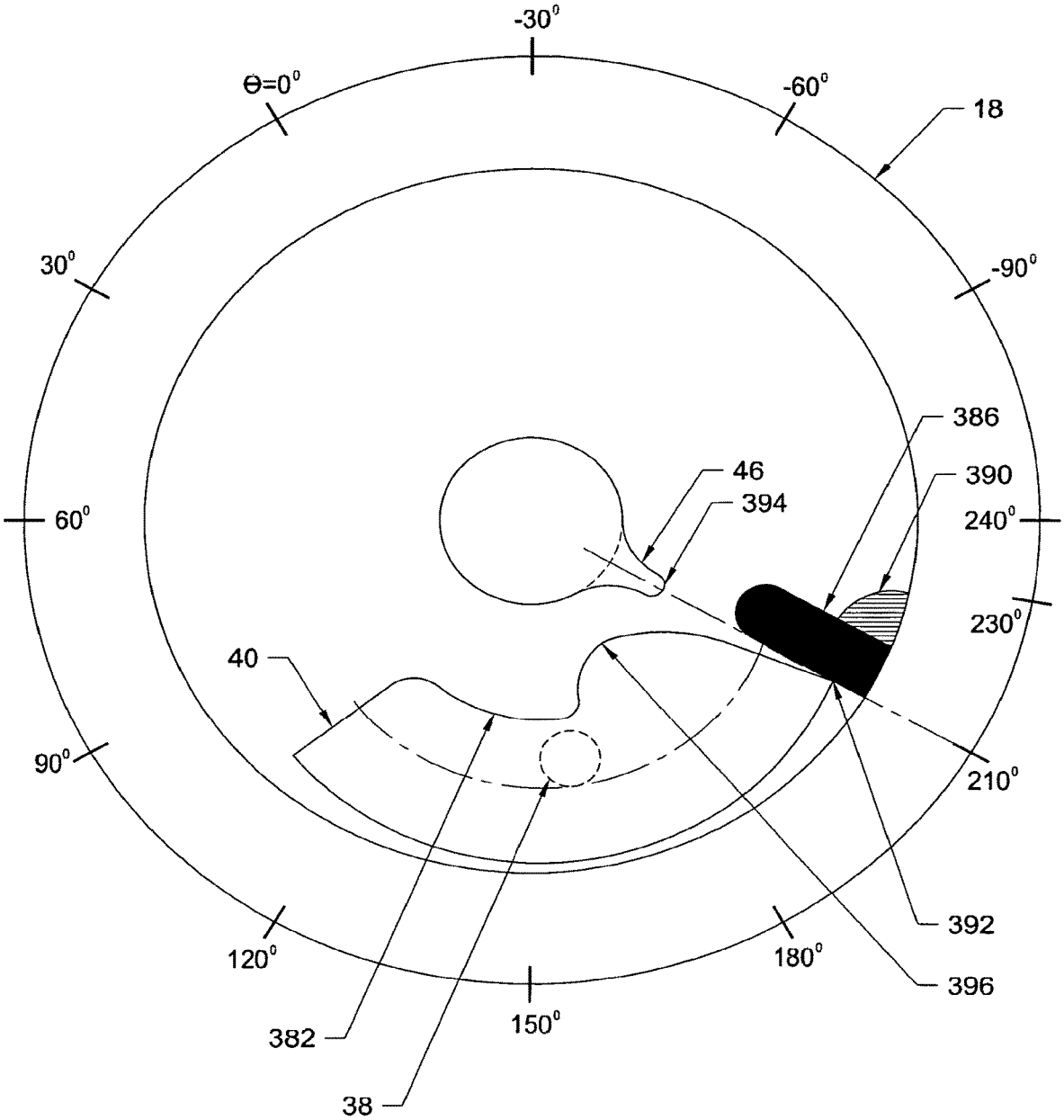
FIG. 16A shows the Pawl A Lifter Lobe at 210 Degrees in the Mud Motor Assembly.

FIG. 16A shows the Pawl A Lifter Lobe at 210 Degrees in the Mud Motor Assembly. Here, the leading edge 392 of Pawl A has made contact with the Pawl A Stop 386, and when that happens, the Pawl A Lifter Lobe makes contact with the Pawl A Lift Recession 382, and drives the Pawl A radially away from the center line of the Mud Motor Assembly. Eventually, the tip of the Pawl A Lifter Lobe 394 rides on the interior portion of the maximum excursion 396 of the Pawl A Lifter Recession 382. As time moves forward from the event shown in FIG. 16A, the Pawl A Lifter Lobe that is a part of the Drive Shaft 20 continues its clockwise rotation looking downhole. Meanwhile, Pawl A will begin its return ruing the Return Stroke of Piston A.

Figure 16B:
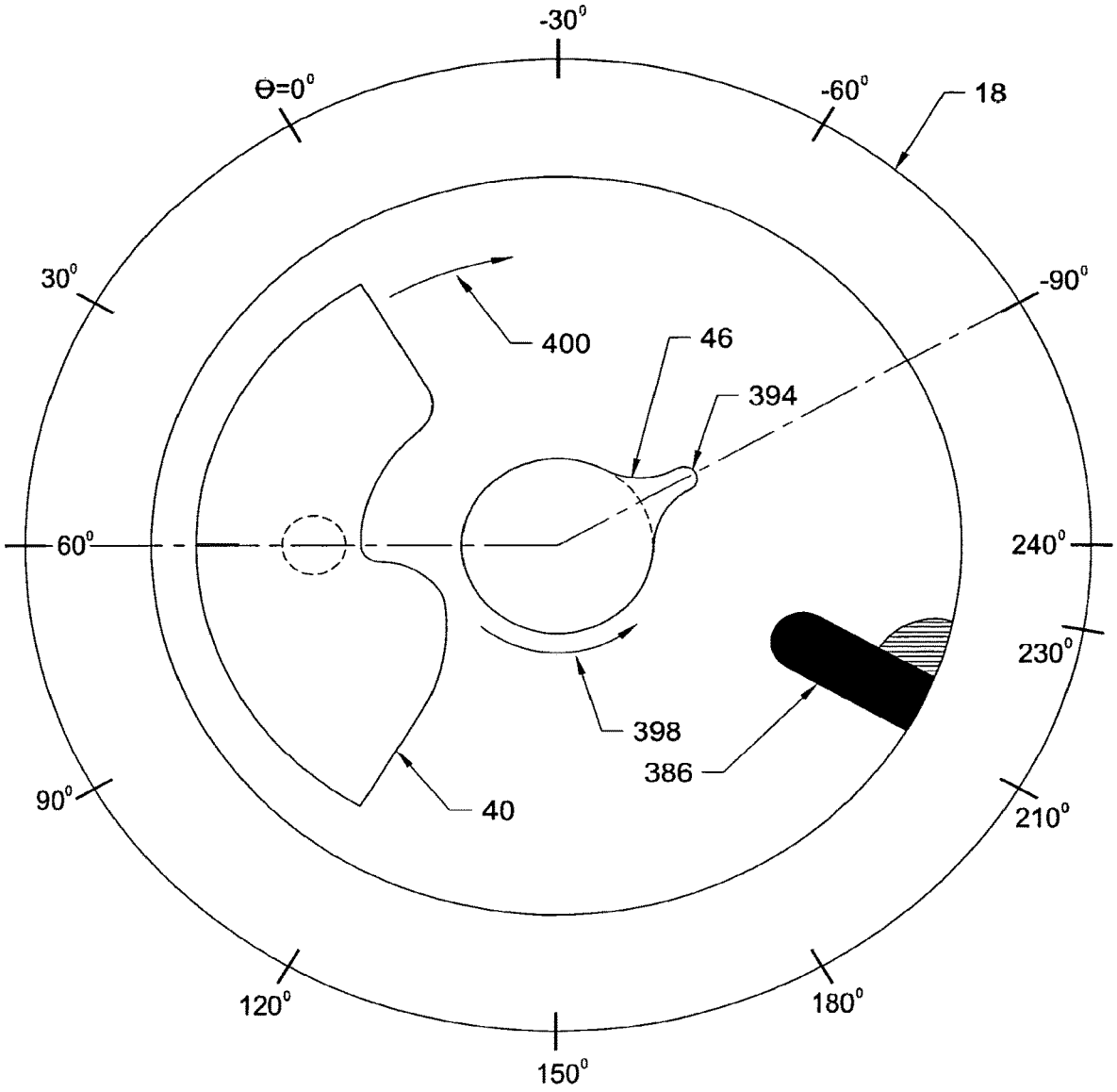
FIG. 16B shows the Pawl A Lifter Lobe 46 at −90 Degrees and the Partial Return of Pawl A 40 in the Mud Motor Assembly.

FIG. 16B shows the Pawl A Lifter Lobe 46 at −90 Degrees and the Partial Return of Pawl A 40 in the Mud Motor Assembly. The Pawl A Lifter Lobe 46 is rotating clockwise 398 looking downhole. The Pawl A in FIG. 16 is rotating counter-clockwise 400 looking downhole.

Intake Valve A (Seven Figures)

Figure 17:
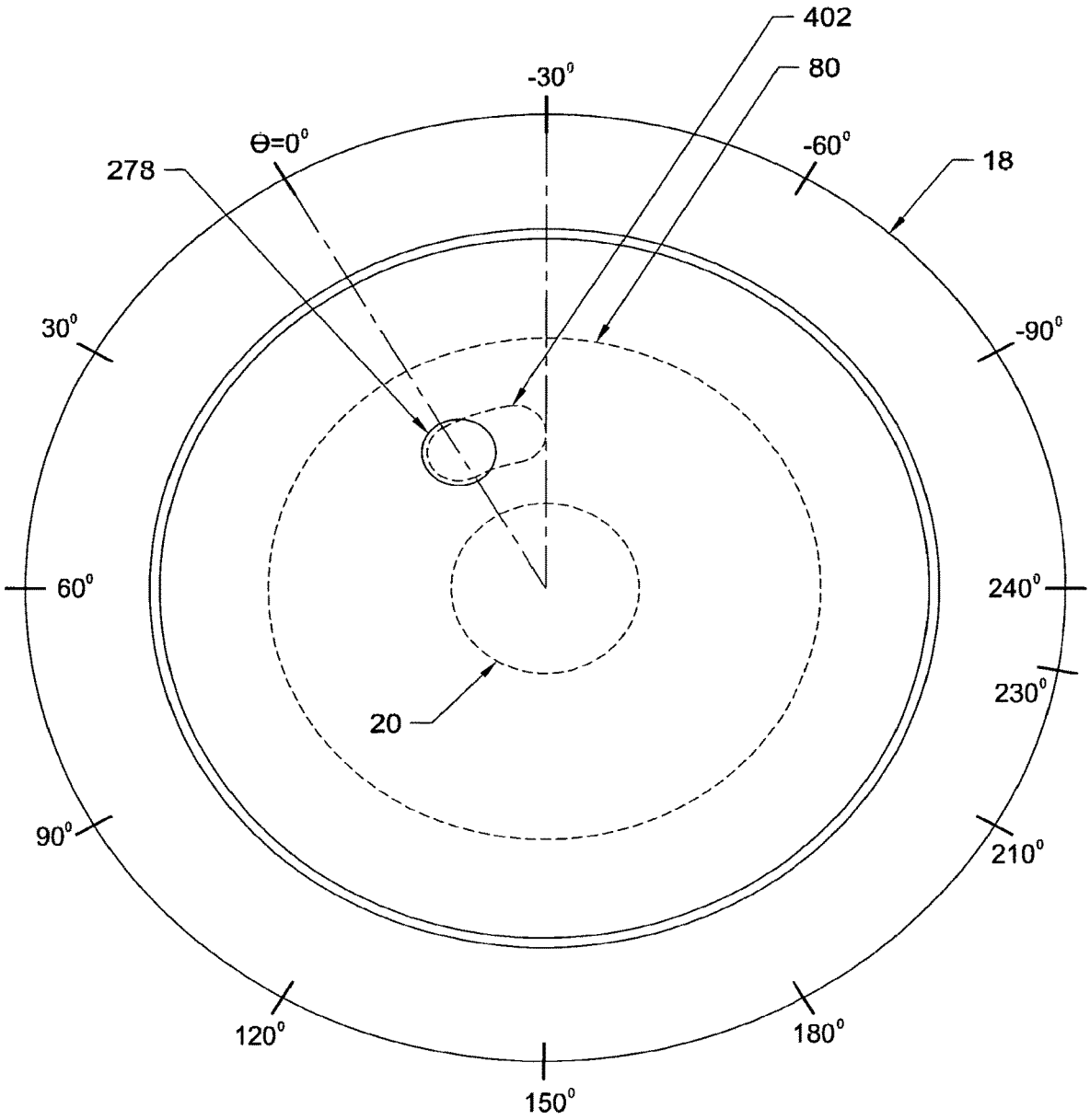
FIG. 17 shows Intake Port A 402 in Intake Valve A 80 Passing theta of 0 Degrees allowing relatively high pressure mud to flow through the Intake Port A 402 and then through the Drive Port of Chamber A ("DPCHA") 278 and thereafter into Chamber A, thus beginning the Power Stroke of Piston A in the Mud Motor Assembly.

FIG. 17 shows Intake Port A 402 in Intake Valve A 80 Passing theta of 0 Degrees allowing relatively high pressure mud to flow through the Intake Port A 402 and then through the Drive Port of Chamber A ("DPCHA") 278 and thereafter into Chamber A, thus beginning the Power Stroke of Piston A in the Mud Motor Assembly. This portion of mud flowing through this route is designated as numeral 492 (not shown). The Intake Port A 402 in Intake Valve A 80 is shown as a dotted line; the Drive Port of Chamber A ("DPCHA") 278 is shown as a solid circle; and these conventions will be the same in the following through FIG. 17F. These views are looking uphole. The distance of separation between Intake Port A 402 in Valve 80 and the Drive Port of Chamber A ("DPCHA") 278 is discussed in relation to FIGS. 20A and 20B.

Figure 17A:
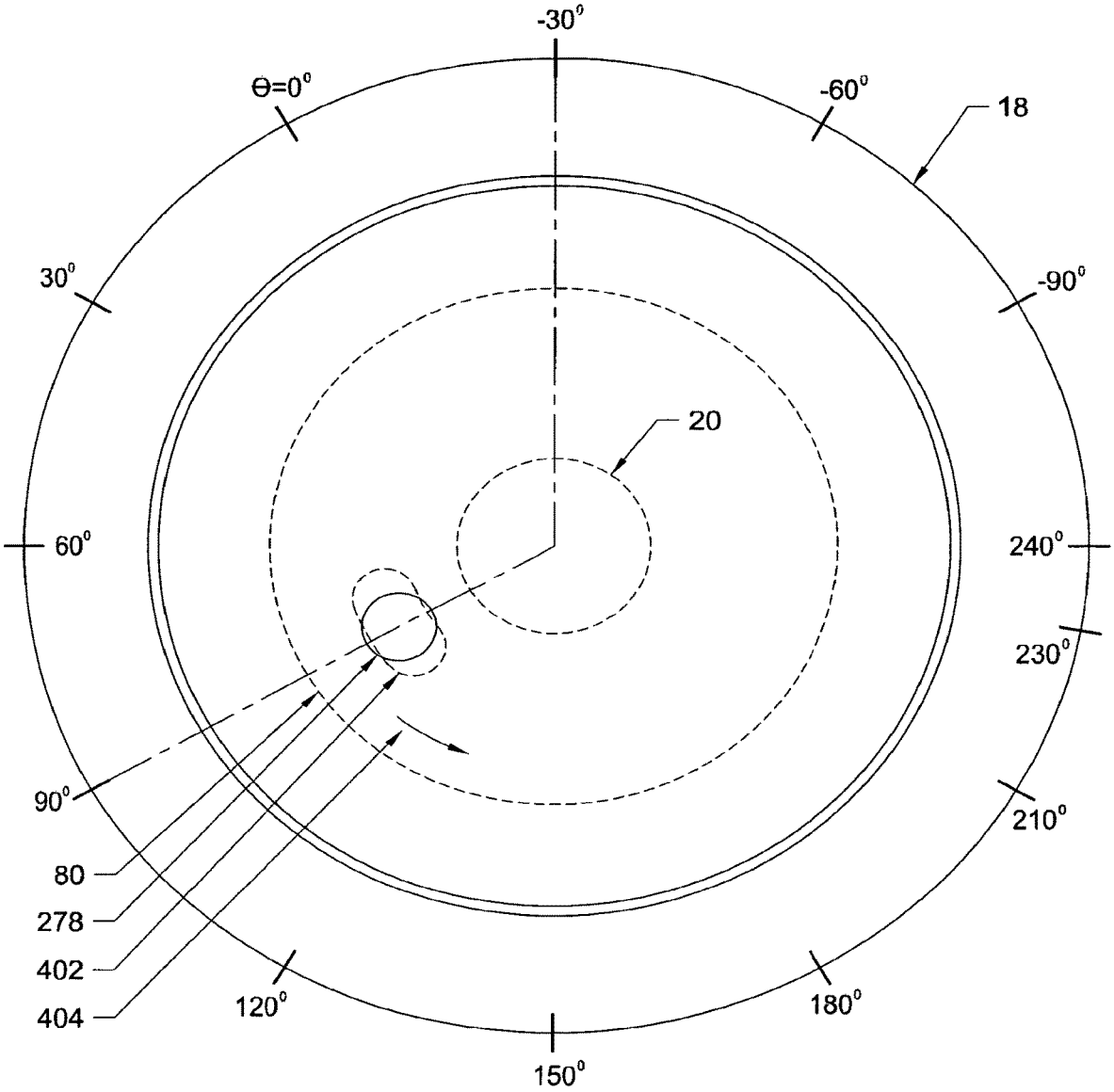
FIG. 17A shows the Intake Port A 402 in Intake Valve A 80 Passing theta of 90 degrees during the Power Stroke of Piston A in the Mud Motor Assembly.

FIG. 17A shows the Intake Port A 402 in Intake Valve A 80 Passing theta of 90 degrees during the Power Stroke of Piston A in the Mud Motor Assembly. When the input power to the Mud Motor Assembly matches the output power delivered, then under ideal circumstances, the Drive Port of Chamber A ("DPCHA") 278 synchronously tracks Intake Port A 402 in Intake Valve A 80. By "synchronously tracks" means that the two travel at the same angular velocity and they overlap.

Figure 17B:
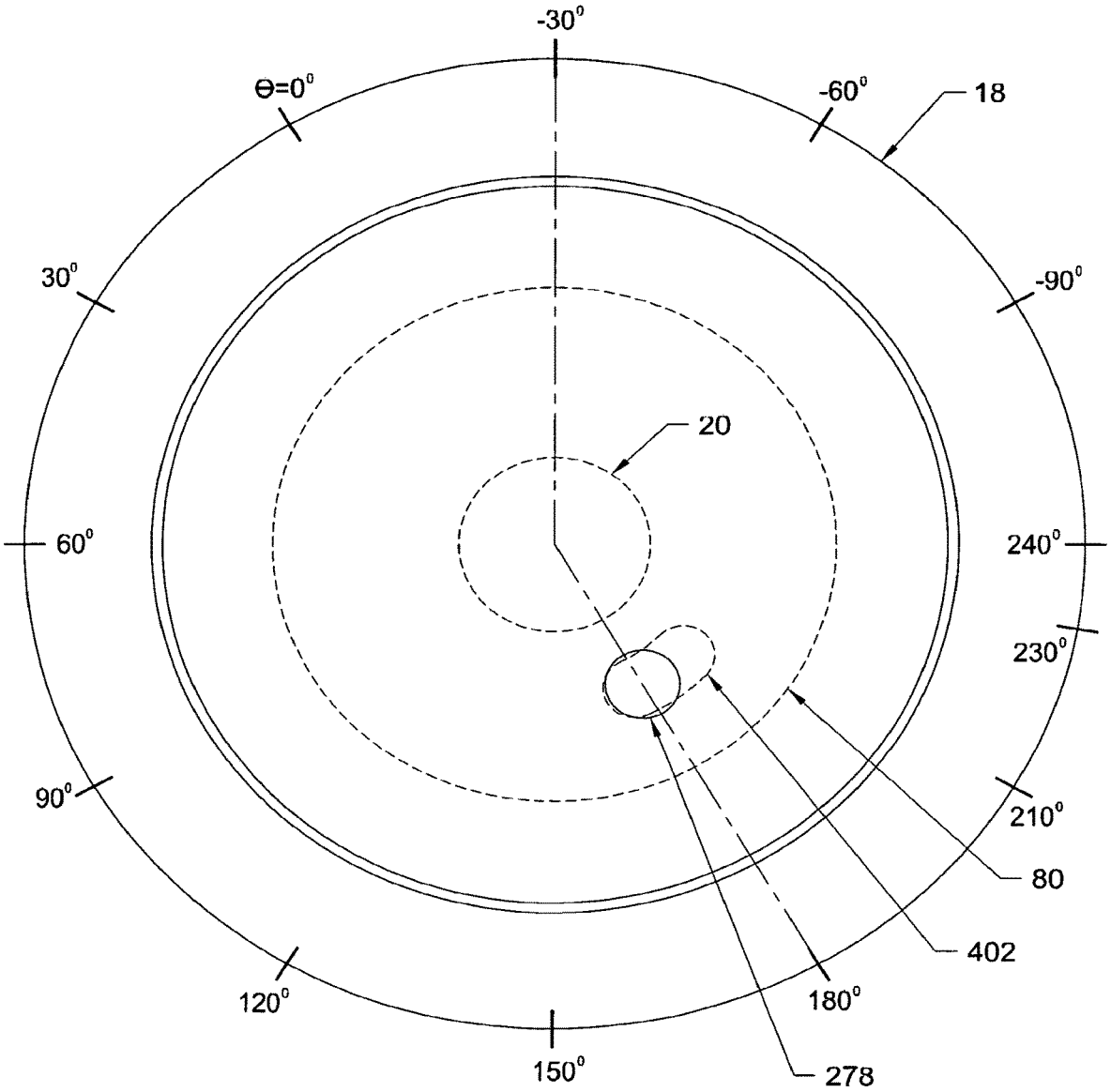
FIG. 17B shows the Intake Port A 402 in Intake Valve A 80 Passing theta of 180 degrees during the Power Stroke of Piston A in the Mud Motor Assembly.

FIG. 17B shows the Intake Port A 402 in Intake Valve A 80 Passing theta of 180 degrees during the Power Stroke of Piston A in the Mud Motor Assembly. The Drive Port of Chamber A ("DPCHA") 278 is shown still synchronously tracking the Intake Port 402 while rotating in the clockwise direction 404.

Figure 17C:
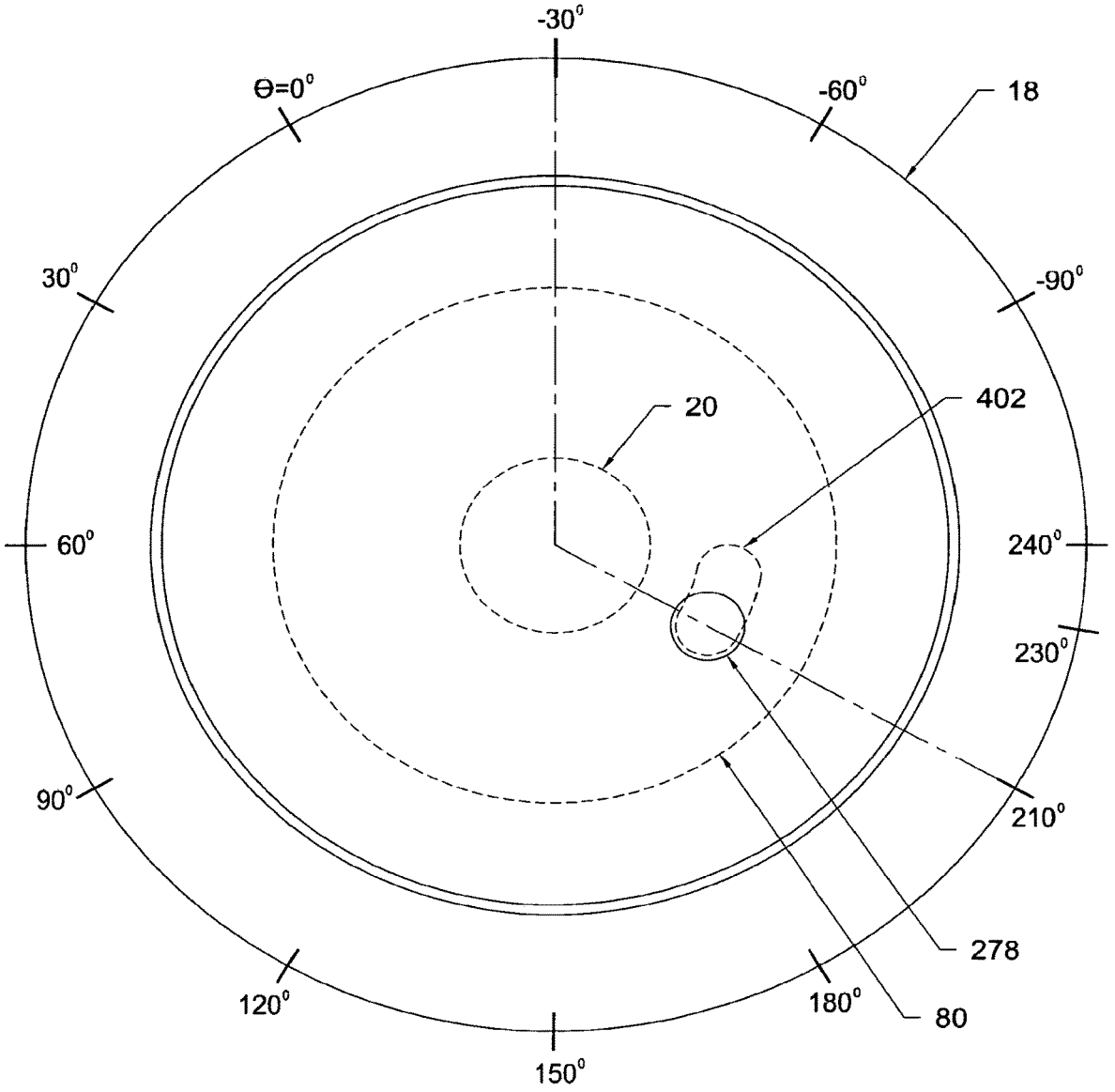
FIG. 17C shows the Intake Port A 402 in Intake Valve A 80 Passing theta of 210 degrees during the very end of the Power Stroke of Piston A in the Mud Motor Assembly.

FIG. 17C shows the Intake Port A 402 in Intake Valve A 80 Passing theta of 210 degrees during the very end of the Power Stroke of Piston A in the Mud Motor Assembly. The Drive Port of Chamber A ("DPCHA") 278 is shown still synchronously tracking the Intake Port A 402.

Figure 17D:
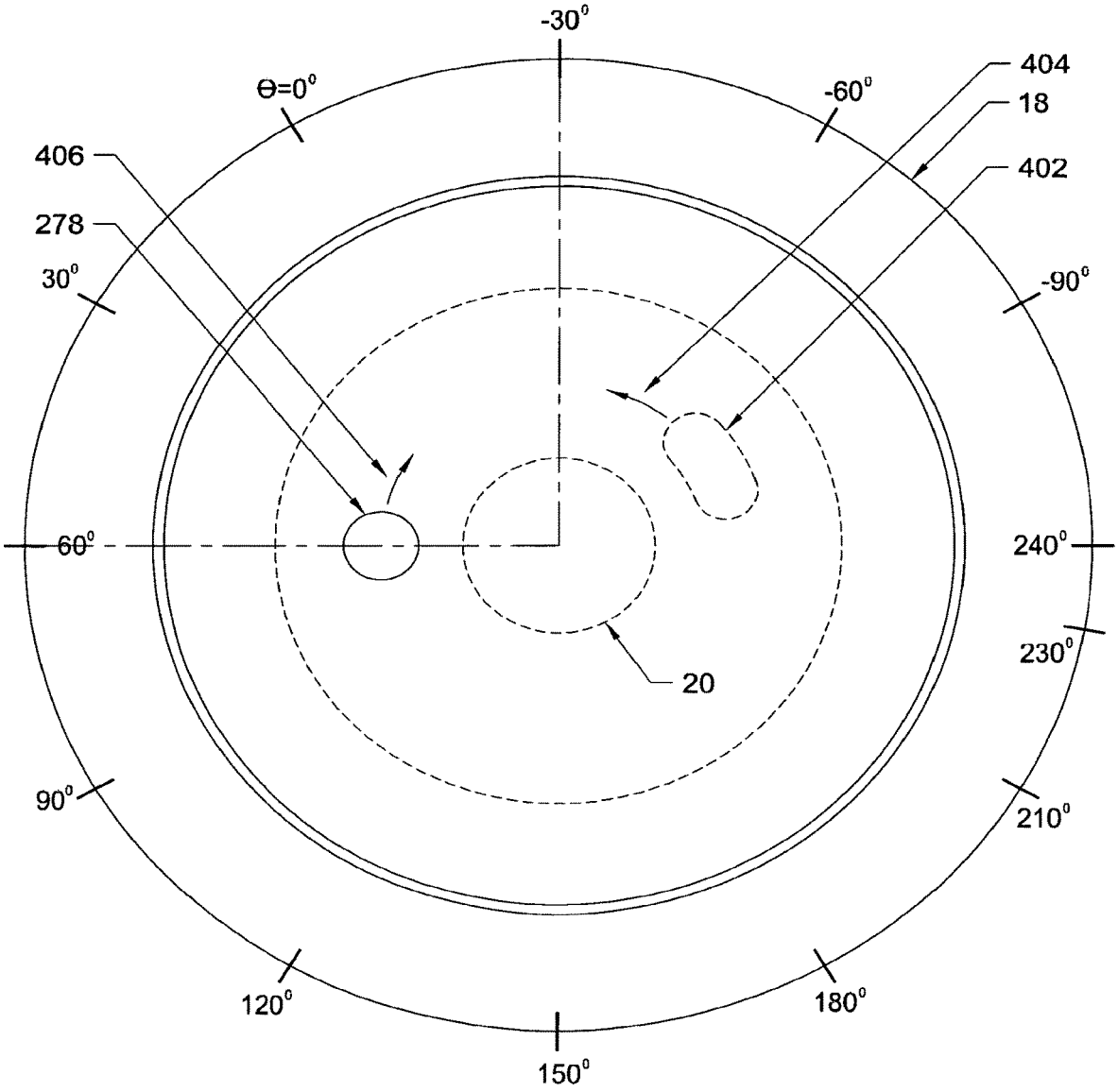
FIG. 17D shows Intake Port A 402 in Intake Valve A 80 Passing theta of 240 degrees after the Power Stroke of Piston A has ended.

FIG. 17D shows Intake Port A 402 in Intake Valve A 80 Passing theta of 240 degrees after the Power Stroke of Piston A has ended. The Port A 402 in Intake Valve A 80 is an integral part of the Drive Shaft 20, and continues to rotate in the clockwise direction 404 looking downhole. The Drive Port of Chamber A ("DPCHA") 278 is shown during its counter-clockwise motion during the Return Stroke of Piston A that is rotating in the counter-clockwise direction 406 looking downhole.

Figure 17E:
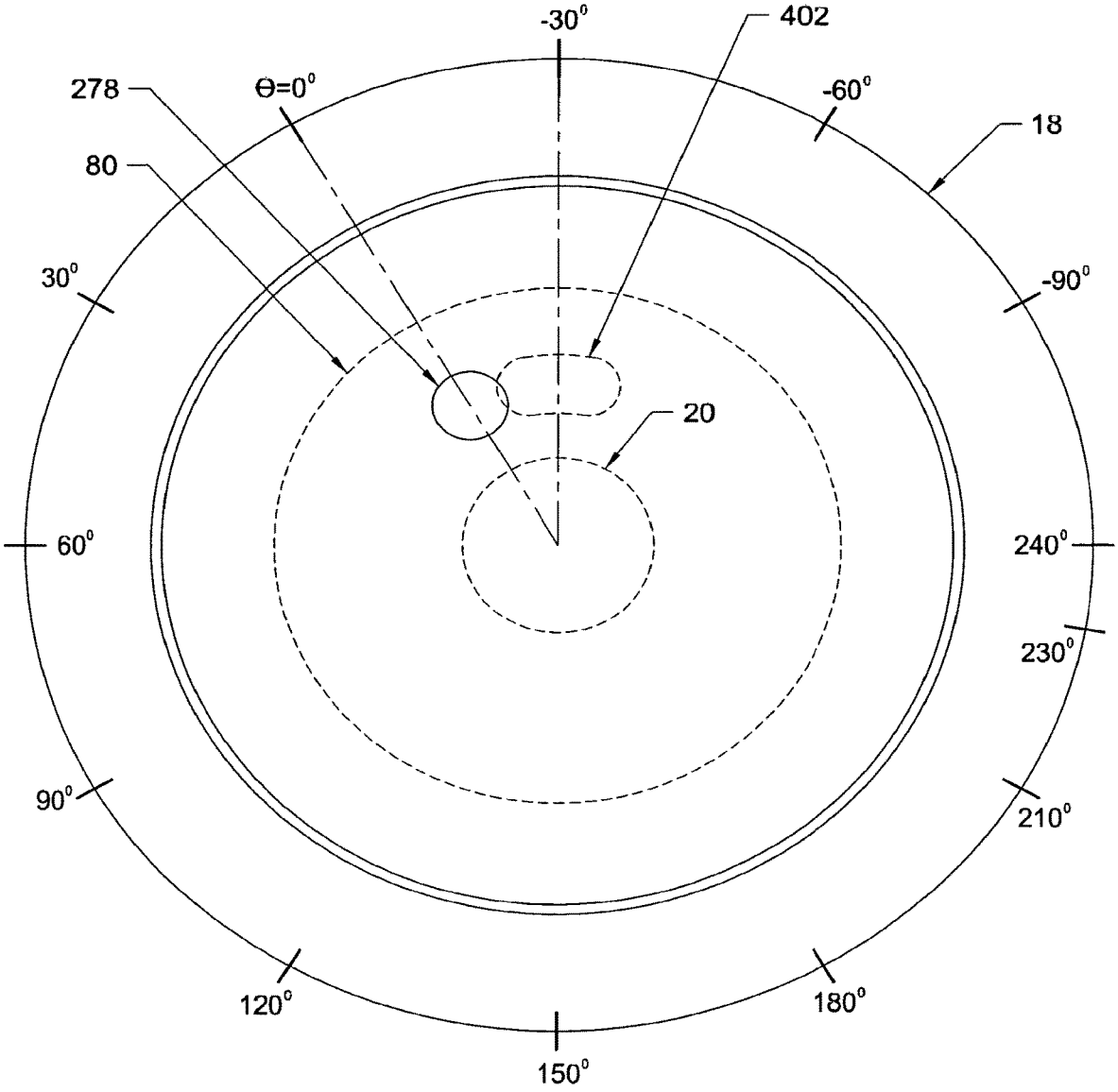
FIG. 17E shows Intake Port A 402 in Intake Valve A 80 at theta of −30 Degrees in the Mud Motor Assembly During the Return Stroke of Piston A.

FIG. 17E shows Intake Port A 402 in Intake Valve A 80 at theta of −30 Degrees in the Mud Motor Assembly During the Return Stroke of Piston A. The Drive Port of Chamber A ("DPCHA") 278 is shown at the end of the Return Stroke of Piston A.

Figure 17F:
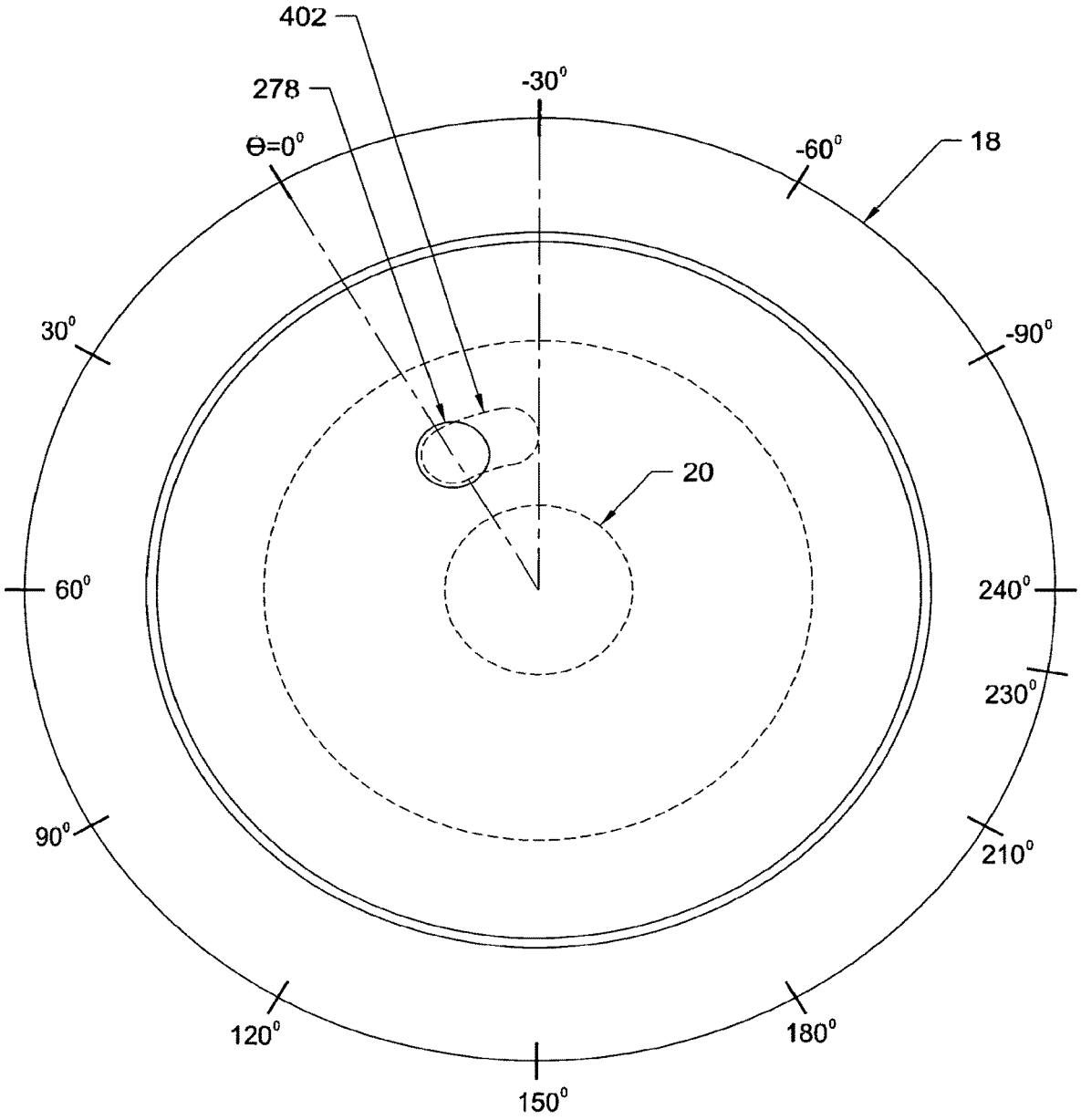
FIG. 17F shows Intake Port A 402 in Intake Valve A again passing theta of 0 degrees that begins the Power Stroke of Piston A in the Mud Motor Assembly.

FIG. 17F shows Intake Port A 402 in Intake Valve A again passing theta of 0 degrees that begins the Power Stroke of Piston A in the Mud Motor Assembly. That Power Stroke of Piston A begins when relatively high pressure mud flows through Intake Port A 402 in Intake Valve A and then through the Drive Port of Chamber A ("DPCHA") 278 and then into Chamber A that in turns puts a torque on Piston A.

Directional Drilling, MWD & LWD

Figure 18:
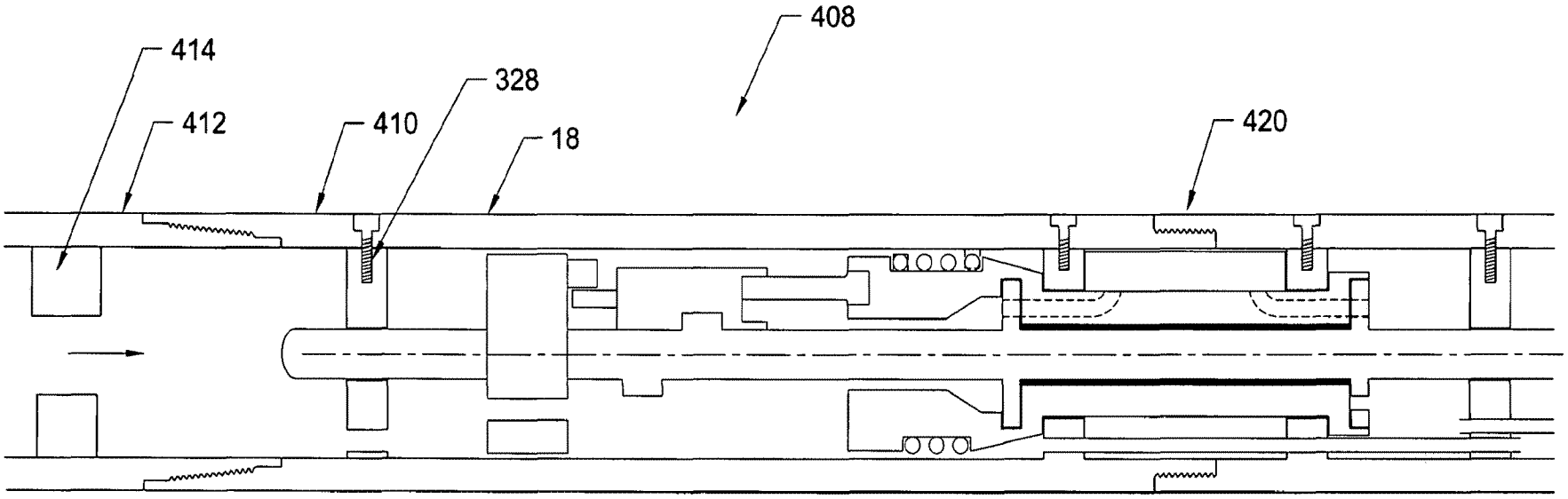
FIG. 18 shows the upper portion of the Bottom Hole Assembly 408 that includes the Mud Motor Assembly 12.

FIG. 18 shows the upper portion of the Bottom Hole Assembly 408 that includes the Mud Motor Assembly 12. The upper threaded portion 410 of the housing 18 accepts the lower threaded portion 412 of the Instrumentation and Control System 414. The upper threaded portion 484 of the Instrumentation and Control System 414 is attached to the drill pipe 486 (not shown) that receives mud from the mud pumps 488 (not shown) located on the surface near the hoist 490 (not shown). The Instrumentation and Control System may include directional drilling systems, rotary steerable systems, Measurement-While-Drilling ("MWD") Systems, Logging-While-Drilling Systems ("LWD"), data links, communications links, systems to generate and determine bid weight, and all the other typical components used in the oil and gas industries to drill wellbores, particularly those that are used in conjunction with currently used progressing cavity mud motors. The uphole portion of the Bottom Hole Assembly 408 is connected to the drill string 416 (not shown) that is in turn connected to suitable surface hoist equipment typically used by the oil and gas industries 418 (not shown). For handling convenience, housing 18 may be optionally separated into shorter threaded sections by the use of suitable threaded joints such the one that is identified as element 420. The threads 420 may also be conveniently used when assembling Piston A and related parts into Chamber A. Similar threads are used in the Housing near Chamber B that is element 512 (not shown). Other threads 514 (not shown) are also in the Housing. Element 328 is representative of the Allen head caps screws used to hold bearings and other components in place that is further referenced in relation to FIG. 12.

Downhole Portion of BHA

Figure 19:
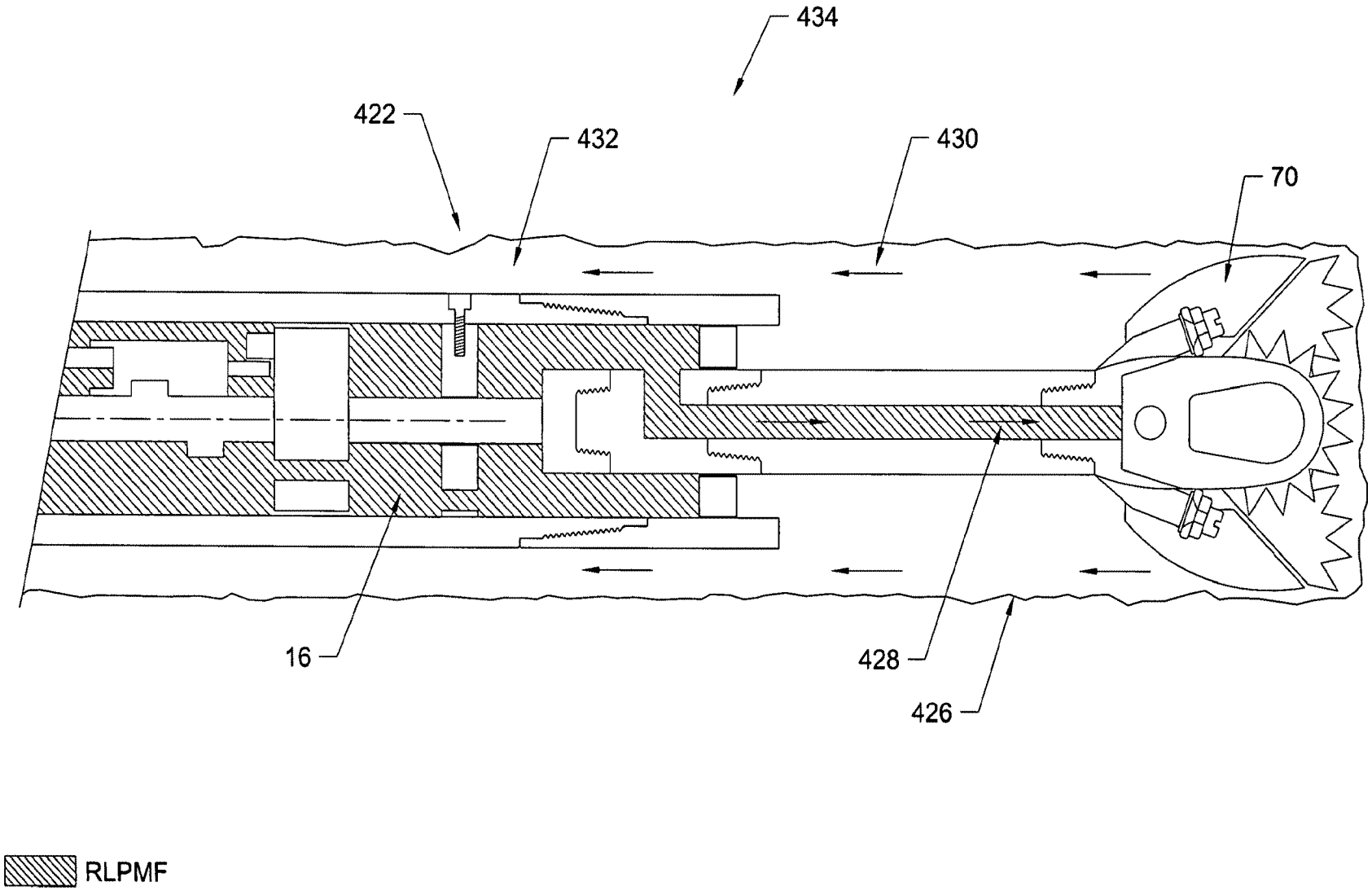
FIG. 19 shows the downhole portion of the Bottom Hole Assembly 422.

The downhole portion of the Bottom Hole Assembly 422 is shown in FIG. 19. The entire Bottom Hole Assembly 424 (not shown) is comprised of elements 408 and 422 and is being used to drill borehole 426. Downward flowing mud 428 is used to cool the bit and to carry rock chips with the mud flowing uphole 430 in annulus 432 that is located in geological formation 434. The legend RLPMF stands for Relatively Low Pressure Mud Flow (RLPMF) 16 designated by the unique shading used only for this purpose in this application (see FIG. 2A).

Mud Flow Paths Identified

FIG. 20 shows the Relatively High Pressure Mud Flow ("RHPMF") through the Mud Motor Apparatus. See FIG. 2. The paths for mud flow through the apparatus is described. Whether or not fluid actually flows is, of course, dependent upon whether or not certain valves are open, and in turn, that depends upon the "Timing State" of the apparatus.

The Mud Motor Apparatus 12 receives its input of mud flow 436 from the drill pipe 484 (not shown) and through the Instrument and Control System 414. The RHPMF then flows through upper apparatus A flow channels 438 and proceeds to two different places (dictated by the timing of the apparatus):

(a) through Intake Port A 402 in Intake Valve A 80 and then through the Drive Port of Chamber A ("DPCHA") 278 and thereafter into Chamber A 84, thus providing the RHPMF for the Power Stroke of Piston A 24 in the Mud Motor Assembly, and the portion of mud flowing through this route is designated as numeral 492 (not shown) that produces a first portion of rotational torque 494 (not shown) on drive shaft 20; and (b) through Bypass Tube A-1 274 and Bypass Tube A-2 276 through upper apparatus B flow channels 440 to Intake Port B 442 in Intake Valve B 94 and then through the Drive Port of Chamber B ("DPCHB") 444 and thereafter into Chamber B 98 thus providing the RHPMF for the Power Stroke of Piston B 28 in the Mud Motor Assembly, and the portion of mud flowing through this route is designated as numeral 496 (not shown) that produces a second portion of torque 498 (not shown) on drive shaft 20.

Figure 20A:
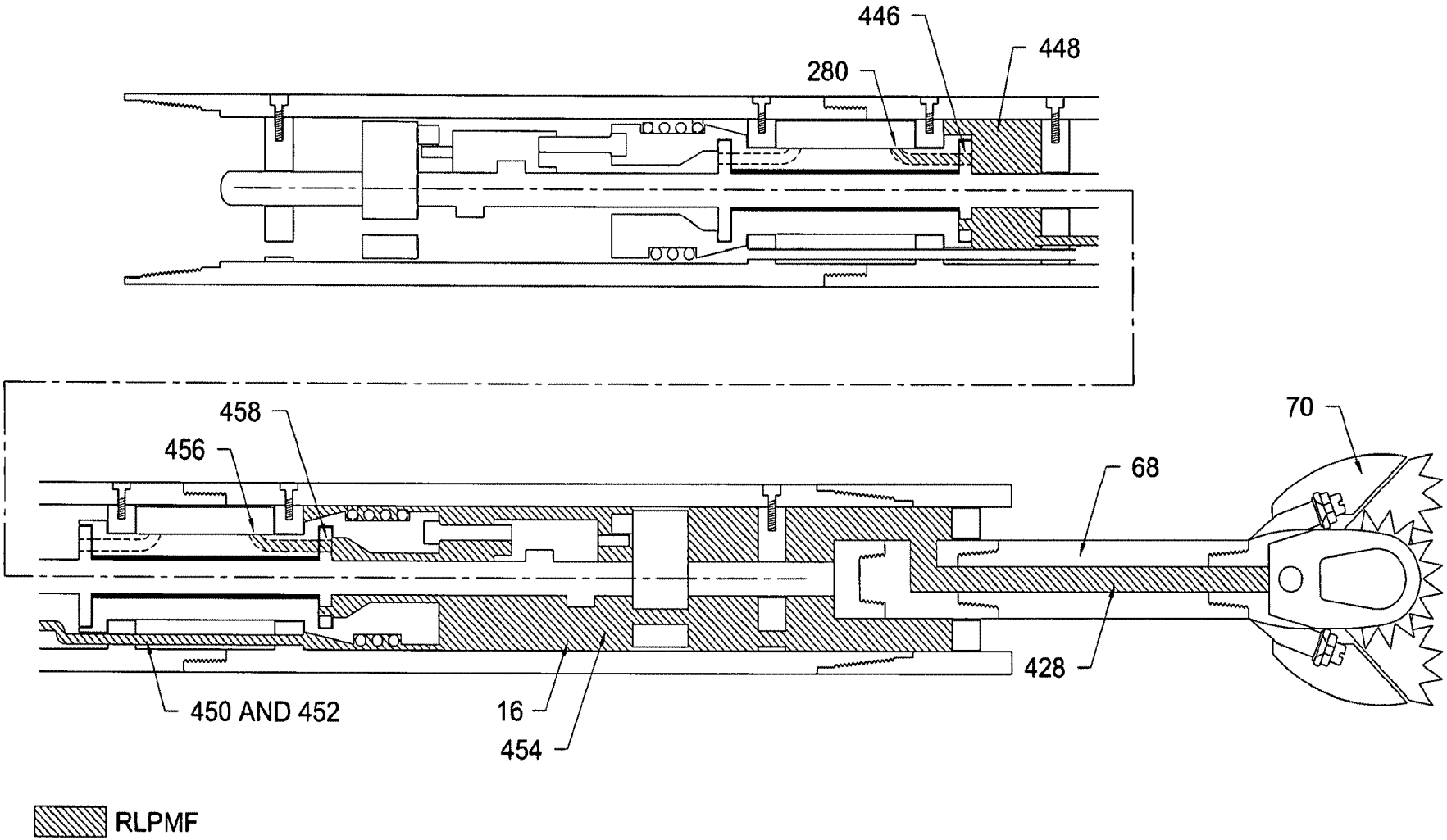
FIG. 20A shows the Relatively Low Pressure Mud Flow ("RLPMF") through various ports, valves, and channels within the Mud Motor Apparatus.

FIG. 20A shows the Relatively Low Pressure Mud Flow ("RLPMF") through the Mud Motor Apparatus. See FIG. 2A. The paths for mud flow through the apparatus is described. Whether or not fluid actually flows is, of course, dependent upon whether or not certain valves are open, and in turn, that depends upon the "Timing State" of the apparatus. Mud flows to the drill bit as follows:

(c) during the Return Stroke of Piston A 24 in the Mud Motor Apparatus, RLPMF exhausts through the Exhaust Port of Chamber A ("EPCHA") 280, and then through Exhaust Port A 446 of Exhaust Valve A 90, and then into lower apparatus A flow channels 448, and then through Bypass Tube B-1 450 and Bypass Tube B-2 452, and then into RLPMF co-mingle chamber 454, and thereafter as a portion of co-mingled mud flow 428 through drill pipe 68 to the drill bit 70; and (d) during the Return Stoke of Piston B 28 in the Mud Motor apparatus, RLPMF exhaust through the Exhaust Port of Chamber B ("EPCHB") 456 and then through Exhaust Port B 458 of Exhaust Valve B 104, and then into RLPMF co-mingle chamber 454, and thereafter as a portion of co-mingled mud flow 428 through drill pipe 68 to the drill bit 70.

It should be noted that there are many ways to assemble the Intake Valve A 80 into its mating position with Crankshaft A 22. The Intake Valve A 80 can be a split member itself, and welded or bolted in place before the entire assembly is slipped into the Housing 10. Similar comments apply to the other intake and exhaust valves.

There are many mating parts where one or both move. The distance of separation between any of the parts shown in FIG. 20 can chosen depending upon the application. In some preferred embodiments, such distances are chosen to be 1/32 of an inch for many mating parts. In other embodiments, distances of separation of 0.010 inches may be chosen. There are many alternatives.

In several preferred embodiments, the customer chooses the desired mud flow rate, the RPM, and the required HP (horsepower). If a pressure drop across the Mud Motor Assembly is then chosen to be a specific number, such as 750 psi for example, then the internal geometry of the Chambers and Pistons can thereafter be determined using techniques known to anyone having ordinary skill in the art.

Timing Diagrams for the Mud Motor Assembly

Figure 21:
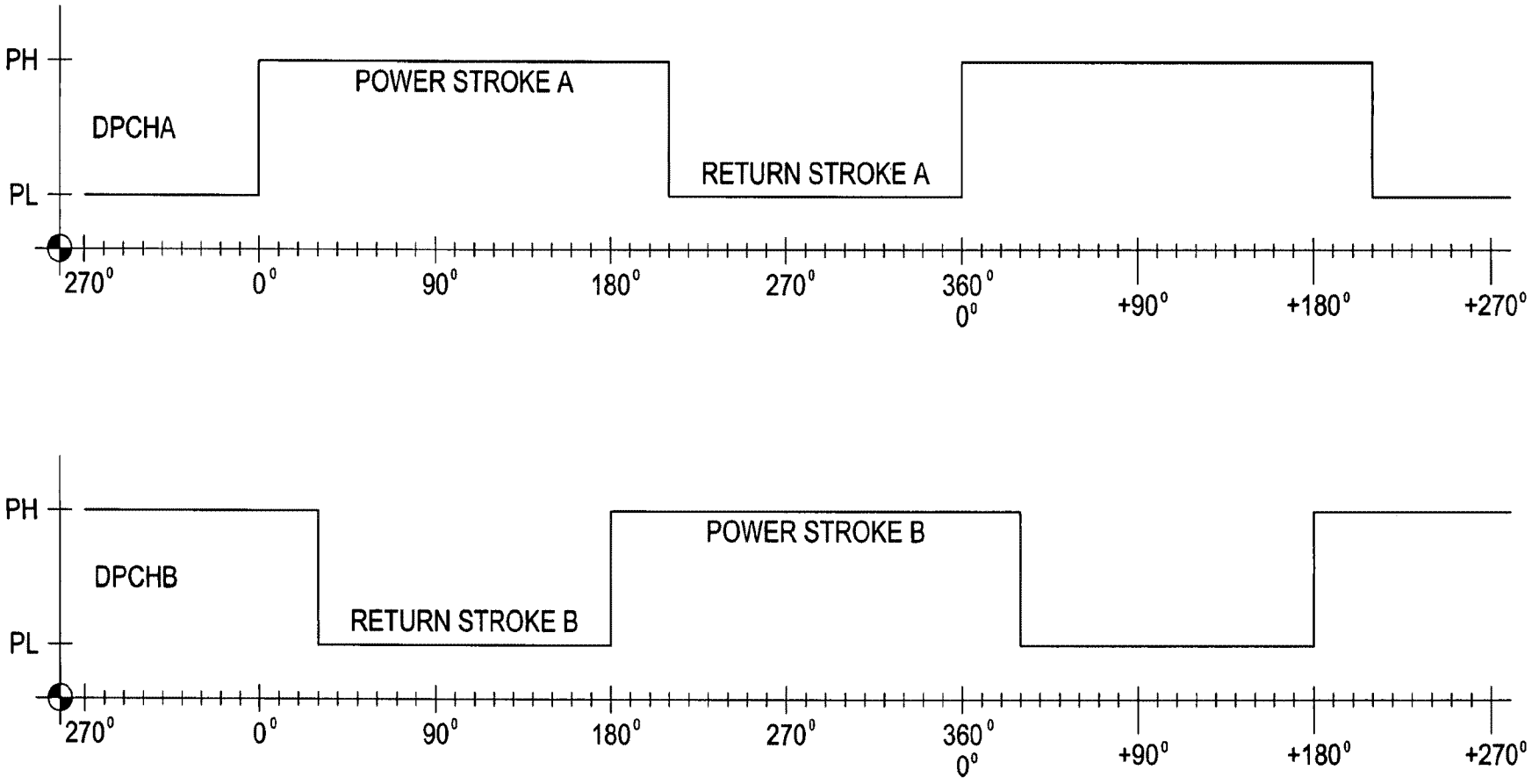
FIG. 21 compares the pressure applied to the Drive Port of Chamber B ("DPCHB") to the pressure applied to Drive Port of Chamber A ("DPCHA").

FIG. 21 compares the pressure applied to the Drive Port of Chamber B ("DPCHB") to the pressure applied to Drive Port of Chamber A ("DPCHA"). The pressure applied to the DPCHB lags that applied to DPCHA by 180 degrees. Here, PH stands for higher pressure, and PL stands for lower pressure.

Figure 21A:
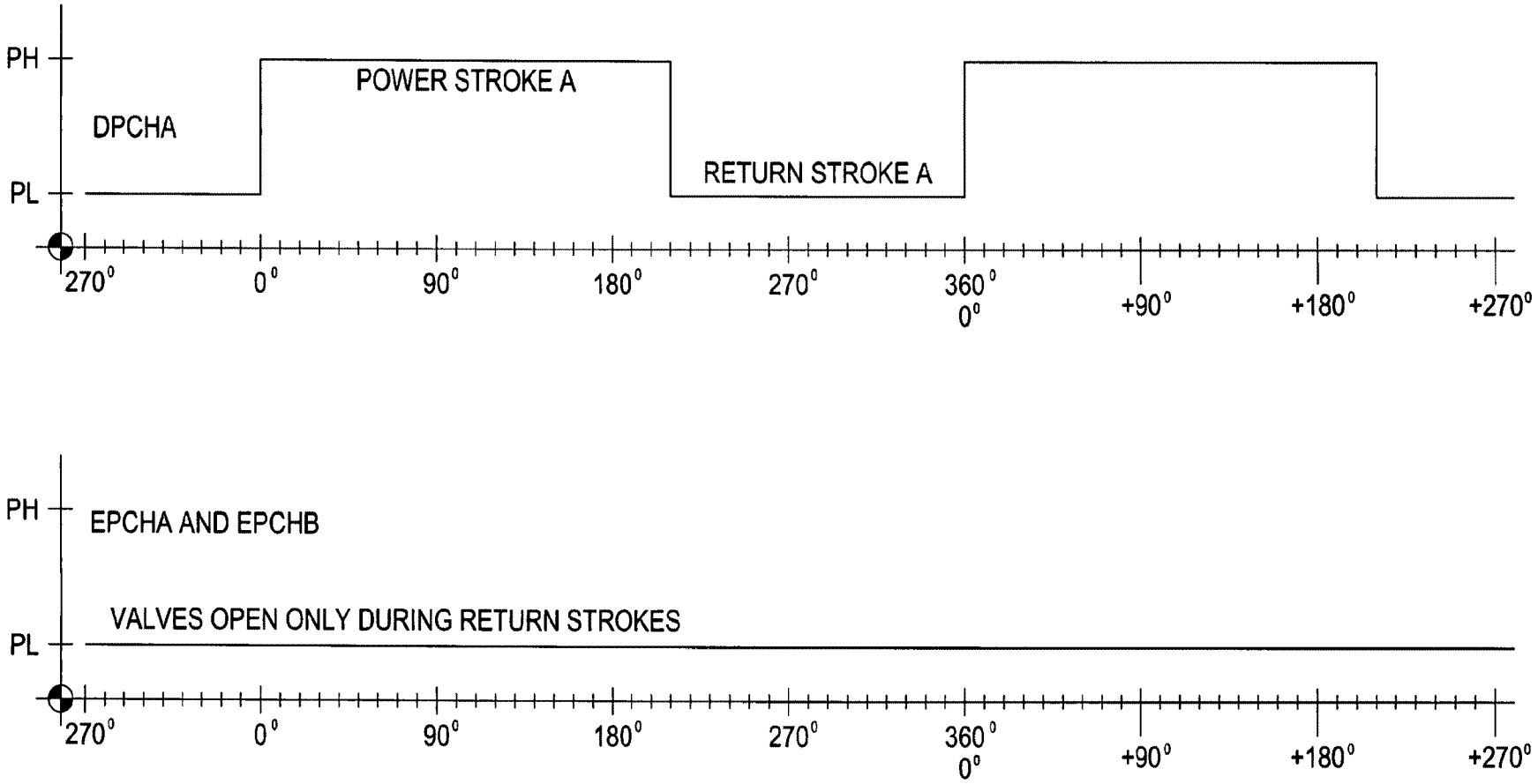
FIG. 21A shows that a low pressure PL is applied to the Exhaust Port of Chamber A ("EPCHA") and to the Exhaust Port of Chamber B ("EPCHB") during the appropriate Return Strokes.

FIG. 21A shows that a low pressure PL is applied to the Exhaust Port of Chamber A ("EPCHA") and to the Exhaust Port of Chamber B ("EPCHB") during the appropriate Return Strokes.

Figure 21B:
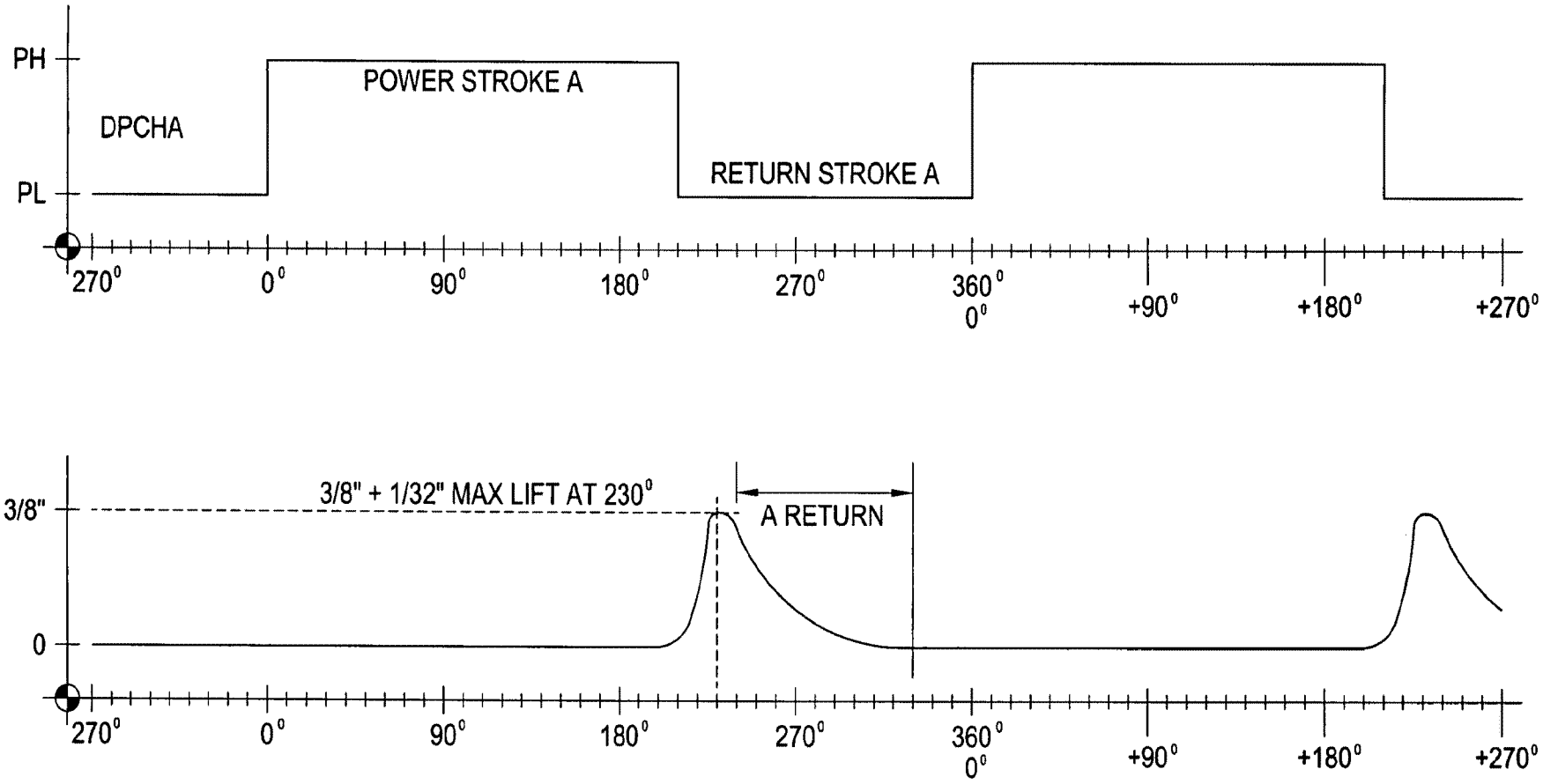

FIG. 21B shows the relationship between the maximum lift of the tip of the Paw A Lifter Lobe 394 and the pressure applied to the Drive Port of Chamber A ("DPCHA").

Analogous Figures for Chamber B and Piston B

FIGS. 9, 9A, 9B, 9C, 9D, 9E, 9F, and 9G show a Power Stroke for Chamber A. Analogous figures can be made for the Power Stroke for Chamber B. Those for "B" strongly resemble those for "A". If relative angles are used, then they would look very similar. If absolute angles are used, then the starting position for the Power Stroke for Piston B in Chamber B would start at 180 degrees on FIG. 9 and proceed clockwise (180 degrees plus 210 degrees). This analogous second set of Figures for the Power Stoke for Chamber B is called numeral 502 herein for reference purposes, but it is not shown on any figures.

In the above disclosure, much effort has been directed at disclosing how Chamber A, Piston A, and related portions of the Mud Motor Assembly work. In the interests of brevity, many of those drawings were not repeated for Chamber B, Piston B, and related portions of the Mud Motor Assembly. Chamber B and Piston B work analogously to that of Chamber A and Piston A. Anybody with ordinary skill in the art can take the first description to get to second one. For example, the first torsion rod spring 350 and second torsion rod spring 352 apply to Crankshaft A and Chamber A. But analogous structures exist in relation to Crankshaft B and Chamber B.

Anyone with ordinary skill in the art would know that these structures are present from the figures presented so far even if they were not numbered. These elements could be hypothetically numbered b350 and b352—meaning they are analogous for Chamber B. Accordingly, all numerals herein defined are also defined for any numeral adding a "b" in front as stated. In the interests of brevity, applicant has decided not to do that explicitly herein. Instead, for example:

The third torsion rod return spring for Crankshaft B is 504 (also b350).

The fourth torsion rod return spring for Crankshaft B is 506 (also b352)

FIG. 9J pertains to Chamber A. The analogous figure pertaining to Chamber B is numeral 508 (not shown).

FIG. 16B pertains to Chamber A. The analogous figure pertaining to Chamber B is 510 (not shown).

Other Comments

The Mud Motor Assembly 12 is also called equivalently the Mud Motor Apparatus 12.

Theta describes the angle shown on many of the Figures including FIG. 9. The word "theta" describes in the text the symbol shown opposite Piston A in FIG. 9.

FIG. 3F shows Ratchet Assembly A 30 of the Mud Motor Assembly. However, Ratchet Assembly A 30 is an example of a ratchet means. Similar comments apply to other parts in the Mud Motor Assembly. Any such part can be an example of a "means".

Elements 520, 521, . . . are reserved in the event that these are necessary to replace legends on the various figures.

Flared Portions of Hydraulic Pistons

FIG. 9M

Figure 9M:
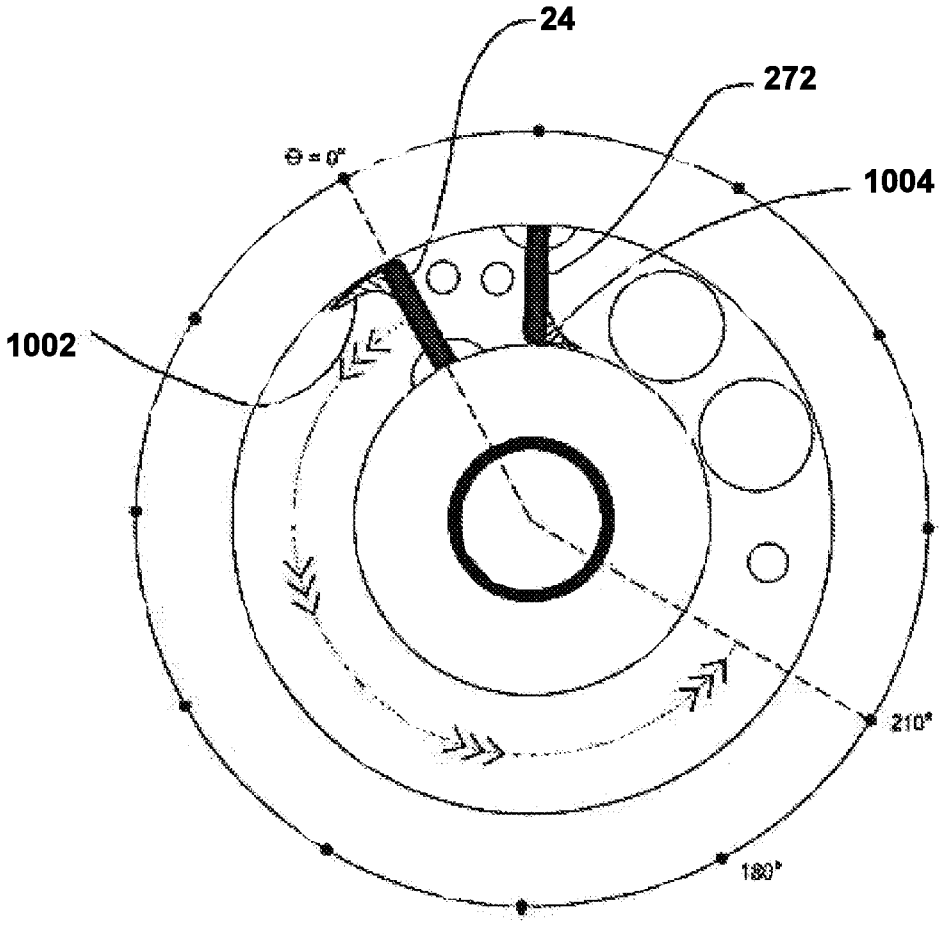
FIG. 9M shows a Flared Portion of Piston A and a Flared Portion of Backstop A.

The following is basically quoted from U.S. Provisional Patent Application Ser. No. 61/744,188, having the Filing Date of Sep. 20, 2013 (PPA-51), said quote substantially appearing in the following eleven paragraphs:

"Design of Leaky Seal Interfaces & Flared Portions of Components:

Please refer to the marked-up version of FIG. 9M from Seals-3. Hand-marked element 24 is identified as Piston A 24 of the Mud Motor Assembly in Seals-3. Hand-marked element 272 is identified as Backstop A 272 in the Mud Motor Assembly.

A Flared Portion 1002 of Piston A is shown protruding from a portion of Piston A. The purpose of this Flared Portion 1002 is to further constrain the volume and area of the channel available to fluids leaking between the interior of the housing and the outer radial portion of Piston A and its Flared Portion. For a given pressure within Chamber A, the fluid flow rate past this combined radial portion of Piston A and its Flared Portion will be reduced substantially from what it would otherwise be flowing by only the extreme radial portion of Piston A (having no Flared Portion). In one embodiment of the Flared Portion, it follows the radial contour of Chamber A, but with a fixed distance of separation. In one embodiment, this fixed distance of separation is chosen to be 0.010 inches for example.

Similar comments apply to Flared Portion 1004 protruding from a portion of Backstop A. In general, the addition of Flared Portions to suitable elements within the Mark IV can be used to reduce mud flow rates of leaky seals. In particular, and with reference to FIG. 7 of Seals-3, suitable Flared Portions can be used to reduce mud flow rates associated with leaky seals 154, 158, 168 and 174. Those mud flow rates are respectively F154, F158, F168, and F174 as defined in FIG. 7 and in the related Specification thereto (in particular, please refer to lines 8-9 on page 32 of Seals-3).

The following is used as an illustrative example. Suppose an initial design is chosen for The Mark IV that had no Flared Portions. Suppose further that it was found by calculation, or experiment, that 20% of the horsepower available from the input mud flow was being dissipated by fluids flowing past the leaky seals within the motor. Suppose further that it is desired to reduce this to 10% of the horsepower available. Then, Flared Portions may be chosen to reduce the flow rate past the Leaky Seals so that no more than 10% of the horsepower available from the input mud flow is dissipated by the fluids flowing past the Leaky Seals.

In several preferred embodiments, the Flared Portion may be made out of the same material as the element to which it is attached. For example, Piston A and its associated Flared Portion may be made from a steel alloy.

In other preferred embodiments, the Flared Portion may be made out of any suitable material that may be different from the material comprising the element to which it is attached.

In general, many suitable materials may be used to make the pistons and the other components of the Mark IV that comprise elements of the various leaky seals. These materials include steel, many different types of metallic alloys, different elastomers, and fiber-reinforced materials—to name just a few choices. Different alloys of steel in particular may be chosen to prevent galling.

The above described Flared Portions of components are examples of means to reduce fluid flow through leaky seals for a given ambient pressure differentials across the leaky seals. Such Flared Portions are examples of flared portion means. Any flared portion means is an embodiment of the invention described herein. Any method of using flared portion means to reduce the flow rate through leaky seals is an embodiment of the invention described herein."

Of course, Seals-3 has been defined earlier as co-pending U.S. patent application Ser. No. 13/506,887, filed on May 22, 2012, that is entitled "Mud Motor Assembly".

In view of the above disclosure, one embodiment of the invention is a method to add a flared portion means to a loosely fitting piston means that forms a moving hydraulic seal within a pressurized hydraulic chamber so as to reduce any flow rate of fluids bypassing the loosely fitting piston means.

In further view of the above disclosure, another embodiment of the invention is a method to add a flared portion means to a loosely fitting piston means that forms a moving leaking seal within a pressurized hydraulic chamber so as to reduce any mud flow rate of fluids bypassing the leaking seal.

New 4 Piston Mud Motor

Figure 22:
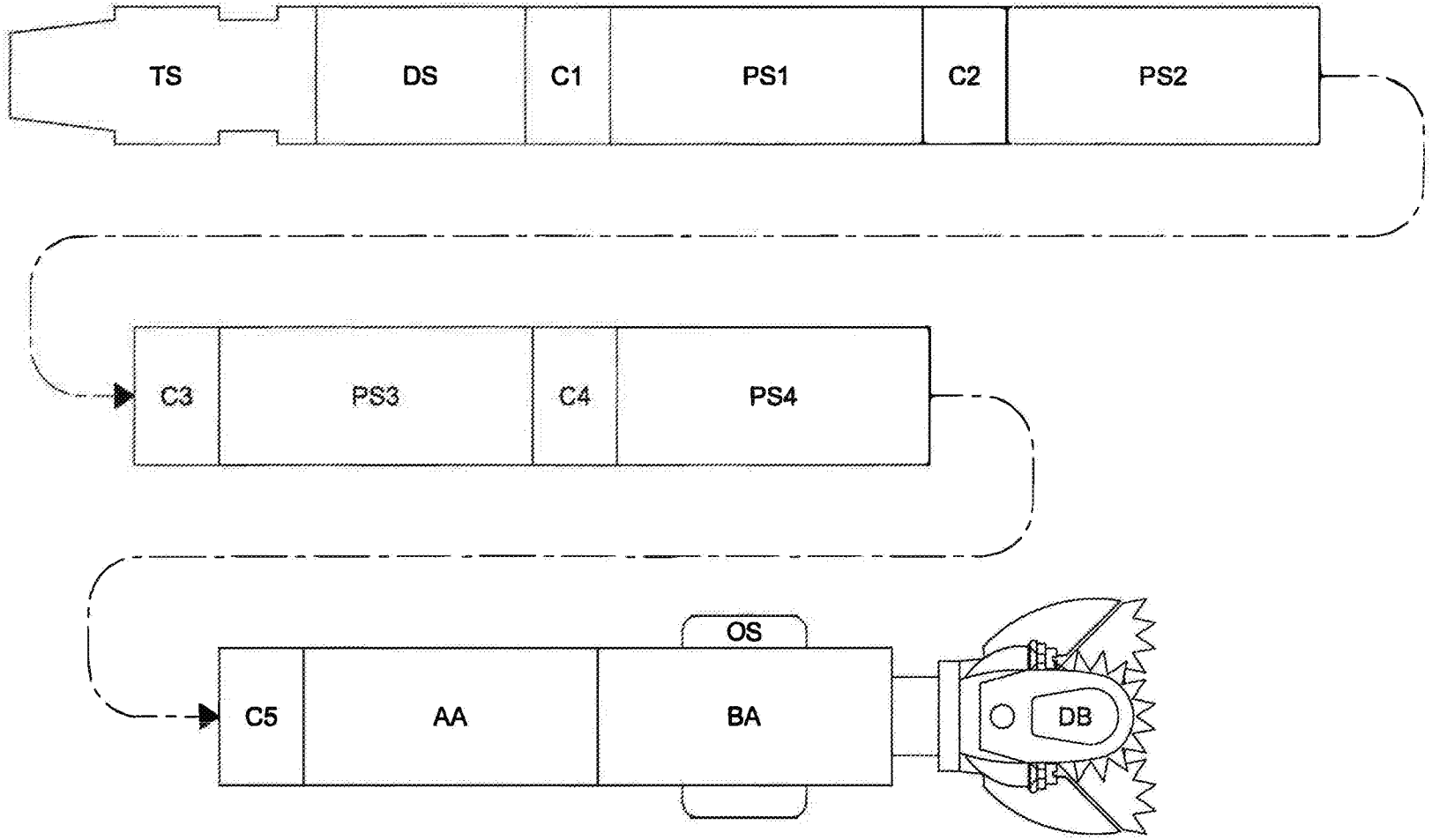

FIG. 22 shows a side view of one embodiment of the N4PMM. This is a four piston version of The Mark IV Mud Motor.

The elements of the N4PMM in FIG. 22 are labeled with various legends. These legends are defined in Table A which is set forth below.

TABLE A

Legends for FIG. 22

| Component | Abbreviation |
|---|---|
| Top Sub | TS |
| Dump Sub | DS |
| Coupling Sub 1 | C1 |
| Power Section 1 | PS1 |
| Coupling Sub 2 | C2 |
| Power Section 2 | PS2 |
| Coupling Sub 3 | C3 |
| Power Section 3 | PS3 |
| Coupling Sub 4 | C4 |
| Power Section 4 | PS4 |
| Coupling Sub 5 | C5 |
| Bent Sub | AA |
| Bearing Assembly | BA |
| Optional Stabilizer | OS |
| Drill Bit | DB |

Figure 23:
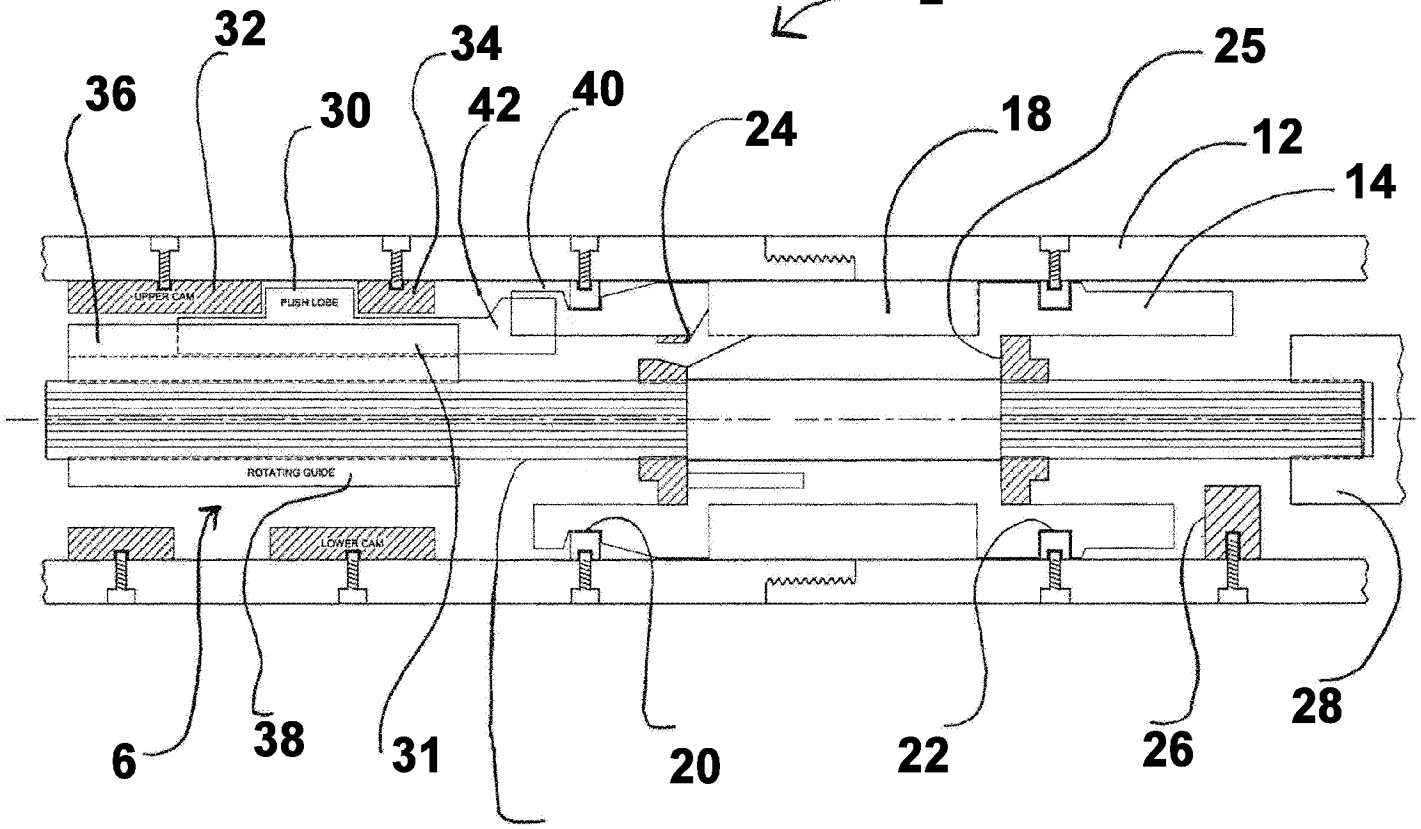

FIG. 23 shows a section view of one embodiment of a typical Power Section 2.

FIG. 23 shows Threaded Housing 12, Crankshaft 14, Splined Drive Shaft 16, Upper Bearing 20, Lower Bearing 22, Top Valve Assembly 24, Lower Valve Assembly 25, Crank Shaft Stop 26, and Coupling 28 to the Adjacent Lower Power Section 4 (not shown). These particular elements have been described elsewhere in relation to other embodiments of the invention.

The Ratchet Mechanism is generally shown as numeral 6 in FIG. 23. The Push Lobe 30 of the Sliding Bar 31 is trapped between two surfaces provided by the Upper Cam 32 and the Lower Cam 34. The Push Lobe pushes the Sliding Bar back-and-forth along the axis of the Motor. The Sliding Bar slides within a slot 36 in the Rotating Guide 38 that which rotates 360 degrees because it is connected to the splines of the Drive Shaft. During the Power Stroke, torque is delivered from the top most extent of the Crankshaft 40 to the Engagement Face 42 of the Sliding Bar. The motion produced by the Push Lobe interacting with the Upper Cam and the Lower Cam establish proper timing and necessary clearances. The path traced by the Push Lobe somewhat resembles the path provided by a fixed dot placed on the circumference of a rotating "wobble plate". The Rotating Guide has an eccentric shape to provide adequate support for the Sliding Bar in one quadrant (looking end-on), but minimizes its size in another quadrant to minimize resistance to mud flow. To assemble: (a) beginning outside of the Motor, slip the Push Lobe into place below the Upper Cam and feed onto body of the Rotating Guide; (b) slip Lower Cam onto body of Rotating Guide; and (c) slide over the splines of the Drive Shaft the entire assembly from the top of the Motor Section for starting of Piston at 0 degrees. Alternatively, the Upper Cam can be a split part that is bolted together over the body of the Rotating Guide in Step (a).

It is known that a length of 2 inches of such splines reliably delivers 10,000 ft-lbs to any one rear tire of such a vehicle (from our study of limited slips and Detroit Lockers where all the torque from a 300 HP engine can be delivered to just one single drive tire). Therefore, the engagement length of splines in the N4PMM is chosen to be 6 inches, which gives a safety margin of 3×—while using ordinary common steels for such axles in automotive production, specifically including type 1541 steel. Many other steels are available for automotive use which are stronger, less susceptible to corrosion, and provide the required ability for torsional twisting during use to prevent the stripping of splines and breakage of axles under periodic loads (during off-road "tire grabbing"). Steels not actually used for such automotive axles are NOT acceptable. After-market suppliers of such automotive axles have the in-house knowledge about acceptable materials and the know-how to make such splines. Such automotive splines and materials are very cost effective which is another reason for their use.

Different Embodiments of Bypass Tubes

Many preferred embodiments of the invention have a First Bypass Tube and a Second Bypass Tube. In such preferred embodiments, the First Bypass Tube passes high pressure mud from the drill pipe attached to the mud motor along its length from top to bottom. In such preferred embodiments, the Second Bypass Tube passes low pressure from below the mud motor along its length from bottom to top.

In various preferred embodiments, the First Bypass Tube provides high pressure mud to a first location above the Piston in each Power Section. High pressure mud flows from each such location into the area having the Piston.

In various preferred embodiments, the Second Bypass Tube provides low pressure mud to a second location below the Piston in each Power Section. Low pressure mud flows from the area having the Piston into this location.

However, there are many alternatives.

In various embodiments, fluid flow channels, or entrances, into the First and Second Bypass Tubes are used to provide high pressure mud or low pressure mud as desired to any location within the N4PMM.

In other embodiments, mud flows from the bottom of any first Power Section into the top of any second Power Section. Such embodiments are called "longitudinal flow" embodiments. In this case, as the mud flows in sequence down the mud motor, the pressure of the mud applied to each successive Piston drops in sequence.

In yet other embodiments, mud flows from the top of any first Power Section into the bottom of any Second Power Section above it.

Yet other embodiments use suitable mixes of First Bypass Tubes, Second Bypass Tubes, and "longitudinal flow" designs.

Any embodiment may have any number of First Bypass Tubes, any number of Second Bypass Tubes.

Any embodiment may have any number of First Bypass Tubes, any number of Second Bypass Tubes, and any number of "longitudinal flow" portions.

Any means to provide suitable high and low pressure mud to the Piston Chambers is are embodiments of this invention.

Any method may be used to provide suitable high and low pressure mud to the Piston Chambers of this invention.

Different Embodiments of Ports to Annulus

In various embodiments of the invention, any portion of the drill string, the N4PMM, or any apparatus below the N4PMM may have a port that allows mud to flow from within any of these elements to the annulus.

In various embodiments of the invention, any portion of the drill string, the N4PMM, or any apparatus below the N4PMM may have one or more ports which allow mud to flow from within any of these elements to the annulus.

In various embodiments of the invention, a port may be connected to any one of the elements in FIG. 22. Those elements are further defined in Table A.

In various embodiments off the invention, one or more ports may be connected to any one or more of the elements in FIG. 22. Those elements are further defined in Table A.

In various embodiments of the invention, ports may be connected to any Bypass Tube.

In various embodiments of the invention, one or more ports may be connected to one or more Bypass Tubes at any location within the N4PMM.

Different Embodiments of Dump Subs

A Dump Sub provides a port to the annulus so that mud can be "dumped" from within the drill string, mud motor, and any apparatus below the mud motor to more easily allow the drill string and bottom hole assembly to be pulled from the wellbore.

A Dump Sub in the industry typically provides a port to the annulus. Ports used for various reasons are described in the previous section entitled "Different Embodiments of Ports to Annulus".

In various embodiments, a Dump Sub may be placed above, or below the N4PMM.

In various embodiments, a Dump Sub may be made integral with the N4PMM.

In various embodiments, one or more Dump Subs may be placed above, or below the N4PMM.

In various embodiments, one or more Dump Subs may be made integral with the N4PMM.

In various embodiments, a Dump Sub may be made as an integral portion of any element shown in FIG. 22. Those elements are further identified in Table A.

REFERENCES

The below references provide a description of what is known by anyone having ordinary skill in the art. In view of the above disclosure, particular preferred embodiments of the invention may use selected features of the below defined methods and apparatus.

References Cited in the Description of the Related Art:

Paper No. CSUG/SPE 137821, entitled "New Approach to Improve Horizontal Drilling", by Vestavik, et. al., Oct. 19-21, 2010, an entire copy of which is incorporated herein by reference.

Paper No. SPE 89505, entitled "Reverse Circulation With Coiled Tubing—Results of 1600+Jobs", by Michel, et. al., Mar. 23-24, 2004, an entire copy of which is incorporated herein by reference.

Paper No. IADC/SPE 122281, entitled "Managed-Pressure Drilling: What It Is and What It is Not", by Malloy, et. al., Feb. 12-13, 2009, an entire copy of which is incorporated herein by reference.

Paper No. SPE 124891, entitled "Reelwell Drilling Method—A Unique Combination of MPD and Liner Drilling", by Vestavik of ReelWell a.s., et. al., Sep. 8-11, 2009, an entire copy of which is incorporated herein by reference.

U.S. Pat. No. 6,585,043, entitled "Friction Reducing Tool", inventor Geoffrey Neil Murray, issued Jul. 1, 2003, assigned to Weatherford, an entire copy of which is incorporated herein by reference.

U.S. Pat. No. 7,025,136, entitled "Torque Reduction Tool", inventors Tulloch, et. al., issued Apr. 11, 2006, an entire copy of which is incorporated herein by reference.

U.S. Pat. No. 7,025,142, entitled "Bi-Directional Thruster Pig Apparatus and Method of Utilizing Same", inventor James R. Crawford, issued Apr. 11, 2006, an entire copy of which is incorporated herein by reference.

Paper No. OTC 8675, entitled "Extended Reach Pipeline Blockage Remediation", by Baugh, et. al., May 4-7, 1998, an entire copy of which is incorporated herein by reference.

Standard Text Books on Fluid Flow and Mud Properties Include:

The book entitled "Fluid Mechanics and Hydraulics", Third Edition, by Giles, et. al., Schaum's Outline Series, McGraw-Hill, 1994, an entire copy of which is incorporated herein by reference.

The book entitled "Well Production Practical Handbook", by H. Cholet, Editions Technip, 2008, an entire copy of which is incorporated herein by reference.

The book entitled "Applied Drilling Engineering", by Bourgoyne, Jr., et. al., Society of Petroleum Engineers, 1991, an entire copy of which is incorporated herein by reference.

The book entitled "Petroleum Well Construction", by Economides, et. al., John Wiley & Sons, 1988, an entire copy of which is incorporated herein by reference.

The book entitled "Drilling Mud and Cement Slurry Rheology Manual", Edited by R. Monicard, Editions Technip, Gulf Publishing Company, 1982, an entire copy of which is incorporated herein by reference.

The book entitled "Downhole Drilling Tools, Theory and Practice for Engineers and Students", G. Robello Samuel, Gulf Publishing Company, 2007, an entire copy of which is incorporated herein by reference.

Other Standard References:

The book entitled "Dictionary of Petroleum Exploration, Drilling & Production", by Norman J. Hyne, Ph.D., Pennwell Publishing Company, 1991, an entire copy of which is incorporated herein by reference.

The book entitled "The Illustrated Petroleum Reference Dictionary", 4th Edition, Edited by Robert D. Langenkamp, Pennwell Publishing Company, 1994, an entire copy of which is incorporated herein by reference.

The book entitled "Handbook of Oil Industry Terms & Phrases", R. D. Langenkamp, Pennwell Books, Pennwell Publishing Company, Tulsa, Okla., 5th Edition, 1994, an entire copy of which is incorporated herein by reference.

The book entitled "Physics, Parts I and II, Combined", David Halliday and Robert Resnick, John Wiley & Sons, Third Edition, 1978, an entire copy of which is incorporated herein by reference.

Rotary Drilling Series and Related References:

Typical procedures used in the oil and gas industries to drill and complete wells are well documented. For example, such procedures are documented in the entire "Rotary Drilling Series" published by the Petroleum Extension Service of The University of Texas at Austin, Austin, Tex. that is incorporated herein by reference in its entirety that is comprised of the following:

Unit I—"The Rig and Its Maintenance" (12 Lessons);

Unit II—"Normal Drilling Operations" (5 Lessons);

Unit III—Nonroutine Rig Operations (4 Lessons);

Unit IV—Man Management and Rig Management (1 Lesson);

and Unit V—Offshore Technology (9 Lessons).

All of the individual Glossaries of all of the above Lessons in this Rotary Drilling Series are also explicitly incorporated herein by reference, and all definitions in those Glossaries are also incorporated herein by reference.

Additional procedures used in the oil and gas industries to drill and complete wells are well documented in the series entitled "Lessons in Well Servicing and Workover" published by the Petroleum Extension Service of The University of Texas at Austin, Austin, Tex. that is incorporated herein by reference in its entirety that is comprised of all 12 Lessons. All of the individual Glossaries of all of the above Lessons are incorporated herein by reference, and definitions in those Glossaries are also incorporated herein by reference.

Reference Related to Feedback and Control Systems:

The book entitled "Feedback and Control Systems", Second Edition, by DiStefano, III, Ph.D., et. al., Schaum's Outline Series, McGraw-Hill, 1990, an entire copy of which is incorporated herein by reference, which describes the general features used in feedback control systems particularly including Chapter 2 "Control Systems Terminology"; and Chapter 7, "Block Diagram Algebra and Transfer Functions of Systems".

Additional References Related to Reelwell:

Paper No. SPE 96412, entitled "New Concept for Drilling Hydraulics", by Vestavik of ReelWell a.s., Sep. 6-9, 2005, an entire copy of which is incorporated herein by reference.

Paper No. SPE 116838, entitled "Feasibility Study of Combining Drilling with Casing and Expandable Casing", by Shen, et. al., Oct. 28-30, 2006, an entire copy of which is incorporated herein by reference.

Paper No. SPE/IADC 119491, entitled "Reelwell Drilling Method", by Vestavik of ReelWell a.s., et. al., Mar. 17-19, 2009, an entire copy of which is incorporated herein by reference.

Paper No. SPE 123953, entitled "Application of Reelwell Drilling Method in Offshore Drilling to Address Many Related Challenges", by Rajabi, et. al., Aug. 4-6, 2009, an entire copy of which is incorporated herein by reference.

Paper No. SPE/IADC 125556, entitled "A New Riserless Method Enable Us to Apply Managed Pressure Drilling in Deepwater Environments", by Rajabi, et. al, Oct. 26-28, 2009, an entire copy of which is incorporated herein by reference.

Paper No. IADC/SPE 126148, entitled "Riserless Reelwell Drilling Method to Address Many Deepwater Drilling Challenges", by Rajabi, et. al., Feb. 2-4, 2010, an entire copy of which is incorporated herein by reference.

References Related to Thruster Pigs:

U.S. Pat. No. 6,315,498, entitled "Thruster Pig Apparatus For Injecting Tubing Down Pipelines", inventor Benton F. Baugh, issued Nov. 13, 2001, an entire copy of which is incorporated herein by reference.

In the following, to save space, U.S. Pat. No. 6,315,498 will be abbreviated as U.S. Pat. No. 6,315,498, and other references will be similarly shorted. References cited in U.S. Pat. No. 6,315,498 include the following, entire copies of which are incorporated herein by reference: U.S. Pat. No. 3,467,196 entitled "Method for running tubing using fluid pressure"; U.S. Pat. No. 3,495,546 entitled "Speed control device for pipeline inspection apparatus"; U.S. Pat. No. 3,525,401 entitled "Pumpable plastic pistons and their use"; U.S. Pat. No. 3,763,896 entitled "Plugging a home service sewer line"; U.S. Pat. No. 3,827,487 entitled "Tubing injector and stuffing box construction"; U.S. Pat. No. 4,073,302 entitled "Cleaning apparatus for sewer pipes and the like"; U.S. Pat. No. 4,360,290 entitled "Internal pipeline plug for deep subsea pipe-to-pipe pull-in connection operations"; U.S. Pat. No. 4,585,061 entitled "Apparatus for inserting and withdrawing coiled tubing with respect to a well"; U.S. Pat. No. 4,729,429 entitled "Hydraulic pressure propelled device for making measurements and interventions during injection or production in a deflected well"; U.S. Pat. No. 4,756,510 entitled "Method and system for installing fiber optic cable and the like in fluid transmission pipelines"; U.S. Pat. No. 4,919,204 entitled "Apparatus and methods for cleaning a well"; U.S. Pat. No. 5,069,285 entitled "Dual wall well development tool"; U.S. Pat. No. 5,180,009 entitled "Wireline delivery tool"; U.S. Pat. No. 5,188,174 entitled "Apparatus for inserting and withdrawing coil tubing into a well"; U.S. Pat. No. 5,208,936 entitled "Variable speed pig for pipelines"; U.S. Pat. No. 5,209,304 entitled "Propulsion apparatus for positioning selected tools in tubular members"; U.S. Pat. No. 5,309,990 entitled "Coiled tubing injector"; U.S. Pat. No. 5,309,993 entitled "Chevron seal for a well tool"; U.S. Pat. No. 5,316,094 entitled "Well orienting tool and/or thruster"; U.S. Pat. No. 5,429,194 entitled "Method for inserting a wireline inside coiled tubing"; U.S. Pat. No. 5,445,224 entitled "Hydrostatic control valve"; U.S. Pat. No. 5,447,200 entitled "Method and apparatus for downhole sand clean-out operations in the petroleum industry"; U.S. Pat. No. 5,494,103 entitled "Well jetting apparatus"; U.S. Pat. No. 5,497,807 entitled "Apparatus for introducing sealant into a clearance between an existing pipe and a replacement pipe"; U.S. Pat. No. 5,566,764 entitled "Improved coil tubing injector unit"; U.S. Pat. No. 5,692,563 entitled "Tubing friction reducer"; U.S. Pat. No. 5,695,009 entitled "Downhole oil well tool running and pulling with hydraulic release using deformable ball valving member"; U.S. Pat. No. 5,704,393 entitled "Coiled tubing apparatus"; U.S. Pat. No. 5,795,402 entitled "Apparatus and method for removal of paraffin deposits in pipeline systems"; U.S. Pat. No. 6,003,606 entitled "Puller-thruster downhole tool"; and U.S. Pat. No. 6,024,515 entitled "Live service pipe insertion apparatus and method". Again, entire copies of all the references cited above are incorporated herein by reference.

Further, other patents cite U.S. Pat. No. 6,315,498, which are listed as follows, entire copies of which are incorporated herein by reference: U.S. Pat. No. 7,406,738 entitled "Thruster pig"; U.S. Pat. No. 7,279,052 entitled "Method for hydrate plug removal"; U.S. Pat. No. 7,044,226 entitled "Method and a device for removing a hydrate plug"; U.S. Pat. No. 7,025,142 entitled "Bi-directional thruster pig apparatus and method of utilizing same"; U.S. Pat. No. 6,651,744 entitled "Bi-directional thruster pig apparatus and method of utilizing same"; U.S. Pat. No. 6,481,930 entitled "Apparatus and method for inserting and removing a flexible first material into a second material"; and U.S. Pat. No. 6,382,875 entitled "Process for laying a tube in a duct and device for pressurizing a tube during laying". Again, entire copies of all the references cited above are incorporated herein by reference.

References Related to Managed Pressure Drilling:

Paper No. IADC/SPE 143093, entitled "Managed Pressure Drilling Enables Drilling Beyond the Conventional Limit on an HP/HT Deepwater Well in the Mediterranean Sea", by Kemche, et. al., Apr. 5-6, 2011, an entire copy of which is incorporated herein by reference.

Paper No. IADC/DPE 143102, entitled "The Challenges and Results of Applying Managed Pressure Drilling Techniques on an Exploratory Offshore Well in India—A Case History", by Ray and Vudathu, Apr. 5-6, 2011, an entire copy of which is incorporated herein by reference.

References Related to Closed Loop Drilling Systems:

U.S. Pat. No. 5,842,149, entitled "Closed Loop Drilling System", inventors of Harrell, et. al., issued Nov. 24, 1998, an entire copy of which is incorporated herein by reference.

In the following, to save space, U.S. Pat. No. 5,842,149 will be abbreviated as US582149, and other references will be similarly shorted. References cited in US582149 include the following, entire copies of which are incorporated herein by reference: U.S. Pat. No. 3,497,019 entitled "Automatic drilling system"; U.S. Pat. No. 4,662,458 entitled "Method and apparatus for bottom hole measurement"; U.S. Pat. No. 4,695,957 entitled "Drilling monitor with downhole torque and axial load transducers"; U.S. Pat. No. 4,794,534 entitled "Method of drilling a well utilizing predictive simulation with real time data"; U.S. Pat. No. 4,854,397 entitled "System for directional drilling and related method of use"; U.S. Pat. No. 4,972,703 entitled "Method of predicting the torque and drag in directional wells"; U.S. Pat. No. 5,064,006 entitled "Downhole combination tool"; U.S. Pat. No. 5,163,521 entitled "System for drilling deviated boreholes"; U.S. Pat. No. 5,230,387 entitled "Downhole combination tool"; U.S. Pat. No. 5,250,806 entitled "Stand-off compensated formation measurements apparatus and method". Again, entire copies of all the references cited above are incorporated herein by reference.

Further, other patents cite U.S. Pat. No. 5,842,149, which are listed as follows, entire copies of which are incorporated herein by reference: USRE42245 entitled "System and method for real time reservoir management"; U.S. Pat. No. 7,866,415 entitled "Steering device for downhole tools"; U.S. Pat. No. 7,866,413 entitled "Methods for designing and fabricating earth-boring rotary drill bits having predictable walk characteristics and drill bits configured to exhibit predicted walk characteristics"; U.S. Pat. No. 7,857,052 entitled "Stage cementing methods used in casing while drilling"; USRE41999 entitled "System and method for real time reservoir management"; U.S. Pat. No. 7,849,934 entitled "Method and apparatus for collecting drill bit performance data"; U.S. Pat. No. 7,832,500 entitled "Wellbore drilling method"; U.S. Pat. No. 7,823,655 entitled "Directional drilling control"; U.S. Pat. No. 7,802,634 entitled "Integrated quill position and toolface orientation display"; U.S. Pat. No. 7,730,965 entitled "Retractable joint and cementing shoe for use in completing a wellbore"; U.S. Pat. No. 7,712,523 entitled "Top drive casing system"; U.S. Pat.

No. 7,669,656 entitled "Method and apparatus for rescaling measurements while drilling in different environments"; U.S. Pat. No. 7,650,944 entitled "Vessel for well intervention"; U.S. Pat. No. 7,645,124 entitled "Estimation and control of a resonant plant prone to stick-slip behavior"; U.S. Pat. No. 7,617,866 entitled "Methods and apparatus for connecting tubulars using a top drive"; U.S. Pat. No. 7,607,494 entitled "Earth penetrating apparatus and method employing radar imaging and rate sensing"; U.S. Pat. No. 7,604,072 entitled "Method and apparatus for collecting drill bit performance data"; U.S. Pat. No. 7,584,165 entitled "Support apparatus, method and system for real time operations and maintenance"; U.S. Pat. No. 7,509,722 entitled "Positioning and spinning device"; U.S. Pat. No. 7,510,026 entitled "Method and apparatus for collecting drill bit performance data"; U.S. Pat. No. 7,506,695 entitled "Method and apparatus for collecting drill bit performance data"; U.S. Pat. No. 7,503,397 entitled "Apparatus and methods of setting and retrieving casing with drilling latch and bottom hole assembly"; U.S. Pat. No. 7,500,529 entitled "Method and apparatus for predicting and controlling secondary kicks while dealing with a primary kick experienced when drilling an oil and gas well"; U.S. Pat. No. 7,497,276 entitled "Method and apparatus for collecting drill bit performance data"; U.S. Pat. No. 7,413,034 entitled "Steering tool"; U.S. Pat. No. 7,413,020 entitled "Full bore lined wellbores"; U.S. Pat. No. 7,395,877 entitled "Apparatus and method to reduce fluid pressure in a wellbore"; U.S. Pat. No. 7,370,707 entitled "Method and apparatus for handling wellbore tubulars"; U.S. Pat. No. 7,363,717 entitled "System and method for using rotation sensors within a borehole"; U.S. Pat. No. 7,360,594 entitled "Drilling with casing latch"; U.S. Pat. No. 7,358,725 entitled "Correction of NMR artifacts due to axial motion and spin-lattice relaxation"; U.S. Pat. No. 7,350,410 entitled "System and method for measurements of depth and velocity of instrumentation within a wellbore"; U.S. Pat. No. 7,334,650 entitled "Apparatus and methods for drilling a wellbore using casing"; U.S. Pat. No. 7,325,610 entitled "Methods and apparatus for handling and drilling with tubulars or casing"; U.S. Pat. No. 7,313,480 entitled "Integrated drilling dynamics system"; U.S. Pat. No. 7,311,148 entitled "Methods and apparatus for wellbore construction and completion"; U.S. Pat. No. 7,303,022 entitled "Wired casing"; U.S. Pat. No. 7,301,338 entitled "Automatic adjustment of NMR pulse sequence to optimize SNR based on real time analysis"; U.S. Pat. No. 7,287,605 entitled "Steerable drilling apparatus having a differential displacement side-force exerting mechanism"; U.S. Pat. No. 7,284,617 entitled "Casing running head"; U.S. Pat. No. 7,277,796 entitled "System and methods of characterizing a hydrocarbon reservoir"; U.S. Pat. No. 7,264,067 entitled "Method of drilling and completing multiple wellbores inside a single caisson"; U.S. Pat. No. 7,245,101 entitled "System and method for monitoring and control"; U.S. Pat. No. 7,234,539 entitled "Method and apparatus for rescaling measurements while drilling in different environments"; U.S. Pat. No. 7,230,543 entitled "Downhole clock synchronization apparatus and methods for use in a borehole drilling environment"; U.S. Pat. No. 7,228,901 entitled "Method and apparatus for cementing drill strings in place for one pass drilling and completion of oil and gas wells"; U.S. Pat. No. 7,225,550 entitled "System and method for using microgyros to measure the orientation of a survey tool within a borehole"; U.S. Pat. No. 7,219,730 entitled "Smart cementing systems"; U.S. Pat. No. 7,219,744 entitled "Method and apparatus for connecting tubulars using a top drive"; U.S. Pat. No. 7,219,747 entitled "Providing a local response to a local condition in an oil well"; U.S. Pat. No. 7,216,727 entitled "Drilling bit for drilling while running casing"; U.S. Pat. No. 7,213,656 entitled "Apparatus and method for facilitating the connection of tubulars using a top drive"; U.S. Pat. No. 7,209,834 entitled "Method and apparatus for estimating distance to or from a geological target while drilling or logging"; U.S. Pat. No. 7,195,083 entitled "Three dimensional steering system and method for steering bit to drill borehole"; U.S. Pat. No. 7,193,414 entitled "Downhole NMR processing"; U.S. Pat. No. 7,191,840 entitled "Casing running and drilling system"; U.S. Pat. No. 7,188,685 entitled "Hybrid rotary steerable system"; U.S. Pat. No. 7,188,687 entitled "Downhole filter"; U.S. Pat. No. 7,172,038 entitled "Well system"; U.S. Pat. No. 7,168,507 entitled "Recalibration of downhole sensors"; U.S. Pat. No. 7,165,634 entitled "Method and apparatus for cementing drill strings in place for one pass drilling and completion of oil and gas wells"; U.S. Pat. No. 7,158,886 entitled "Automatic control system and method for bottom hole pressure in the underbalance drilling"; U.S. Pat. No. 7,147,068 entitled "Methods and apparatus for cementing drill strings in place for one pass drilling and completion of oil and gas wells"; U.S. Pat. No. 7,143,844 entitled "Earth penetrating apparatus and method employing radar imaging and rate sensing"; U.S. Pat. No. 7,140,445 entitled "Method and apparatus for drilling with casing"; U.S. Pat. No. 7,137,454 entitled "Apparatus for facilitating the connection of tubulars using a top drive"; U.S. Pat. No. 7,136,795 entitled "Control method for use with a steerable drilling system"; U.S. Pat. No. 7,131,505 entitled "Drilling with concentric strings of casing"; U.S. Pat. No. 7,128,161 entitled "Apparatus and methods for facilitating the connection of tubulars using a top drive"; U.S. Pat. No. 7,128,154 entitled "Single-direction cementing plug"; U.S. Pat. No. 7,117,957 entitled "Methods for drilling and lining a wellbore"; U.S. Pat. No. 7,117,605 entitled "System and method for using microgyros to measure the orientation of a survey tool within a borehole"; U.S. Pat. No. 7,111,692 entitled "Apparatus and method to reduce fluid pressure in a wellbore"; U.S. Pat. No. 7,108,084 entitled "Methods and apparatus for cementing drill strings in place for one pass drilling and completion of oil and gas wells"; U.S. Pat. No. 7,100,710 entitled "Methods and apparatus for cementing drill strings in place for one pass drilling and completion of oil and gas wells"; U.S. Pat. No. 7,093,675 entitled "Drilling method"; U.S. Pat. No. 7,090,021 entitled "Apparatus for connecting tubulars using a top drive"; U.S. Pat. No. 7,090,023 entitled "Apparatus and methods for drilling with casing"; U.S. Pat. No. 7,082,821 entitled "Method and apparatus for detecting torsional vibration with a downhole pressure sensor"; U.S. Pat. No. 7,083,005 entitled "Apparatus and method of drilling with casing"; U.S. Pat. No. 7,073,598 entitled "Apparatus and methods for tubular makeup interlock"; U.S. Pat. No. 7,054,750 entitled "Method and system to model, measure, recalibrate, and optimize control of the drilling of a borehole"; U.S. Pat. No. 7,048,050 entitled "Method and apparatus for cementing drill strings in place for one pass drilling and completion of oil and gas wells"; U.S. Pat. No. 7,046,584 entitled "Compensated ensemble crystal oscillator for use in a well borehole system"; U.S. Pat. No. 7,043,370 entitled "Real time processing of multicomponent induction tool data in highly deviated and horizontal wells"; U.S. Pat. No. 7,036,610 entitled "Apparatus and method for completing oil and gas wells"; U.S. Pat. No. 7,028,789 entitled "Drilling assembly with a steering device for coiled-tubing operations"; U.S. Pat. No. 7,026,950 entitled "Motor pulse controller"; U.S. Pat. No. 7,027,922 entitled "Deep resistivity transient method for MWD applications using asymptotic filtering"; U.S. Pat. No. 7,020,597 entitled "Methods for evaluating and improving drilling operations"; U.S. Pat. No. 7,002,484 entitled "Supplemental referencing techniques in borehole surveying"; U.S. Pat. No. 6,985,814 entitled "Well twinning techniques in borehole surveying"; U.S. Pat. No. 6,968,909 entitled "Realtime control of a drilling system using the output from combination of an earth model and a drilling process model"; U.S. Pat. No. 6,957,575 entitled "Apparatus for weight on bit measurements, and methods of using same"; U.S. Pat. No. 6,957,580 entitled "System and method for measurements of depth and velocity of instrumentation within a wellbore"; U.S. Pat. No. 6,944,547 entitled "Automated rig control management system"; U.S. Pat. No. 6,937,023 entitled "Passive ranging techniques in borehole surveying"; U.S. Pat. No. 6,923,273 entitled "Well system"; U.S. Pat. No. 6,899,186 entitled "Apparatus and method of drilling with casing"; U.S. Pat. No. 6,883,638 entitled "Accelerometer transducer used for seismic recording"; U.S. Pat. No. 6,882,937 entitled "Downhole referencing techniques in borehole surveying"; U.S. Pat. No. 6,868,906 entitled "Closed-loop conveyance systems for well servicing"; U.S. Pat. No. 6,863,137 entitled "Well system"; U.S. Pat. No. 6,857,486 entitled "High power umbilicals for subterranean electric drilling machines and remotely operated vehicles"; U.S. Pat. No. 6,854,533 entitled "Apparatus and method for drilling with casing"; U.S. Pat. No. 6,845,819 entitled "Down hole tool and method"; U.S. Pat. No. 6,843,332 entitled "Three dimensional steerable system and method for steering bit to drill borehole"; U.S. Pat. No. 6,837,313 entitled "Apparatus and method to reduce fluid pressure in a wellbore"; U.S. Pat. No. 6,814,142 entitled "Well control using pressure while drilling measurements"; U.S. Pat. No. 6,802,215 entitled "Apparatus for weight on bit measurements, and methods of using same"; U.S. Pat. No. 6,785,641 entitled "Simulating the dynamic response of a drilling tool assembly and its application to drilling tool assembly design optimization and drilling performance optimization"; U.S. Pat. No. 6,755,263 entitled "Underground drilling device and method employing down-hole radar"; U.S. Pat. No. 6,727,696 entitled "Downhole NMR processing"; U.S. Pat. No. 6,719,071 entitled "Apparatus and methods for drilling"; U.S. Pat. No. 6,719,069 entitled "Underground boring machine employing navigation sensor and adjustable steering"; U.S. Pat. No. 6,662,110 entitled "Drilling rig closed loop controls"; U.S. Pat. No. 6,659,200 entitled "Actuator assembly and method for actuating downhole assembly"; U.S. Pat. No. 6,609,579 entitled "Drilling assembly with a steering device for coiled-tubing operations"; U.S. Pat. No. 6,607,044 entitled "Three dimensional steerable system and method for steering bit to drill borehole"; U.S. Pat. No. 6,601,658 entitled "Control method for use with a steerable drilling system"; U.S. Pat. No. 6,598,687 entitled "Three dimensional steerable system"; U.S. Pat. No. 6,484,818 entitled "Horizontal directional drilling machine and method employing configurable tracking system interface"; U.S. Pat. No. 6,470,976 entitled "Excavation system and method employing adjustable down-hole steering and above-ground tracking"; U.S. Pat. No. 6,467,341 entitled "Accelerometer caliper while drilling"; U.S. Pat. No. 6,469,639 entitled "Method and apparatus for low power, micro-electronic mechanical sensing and processing"; U.S. Pat. No. 6,443,242 entitled "Method for wellbore operations using calculated wellbore parameters in real time"; U.S. Pat. No. 6,427,783 entitled "Steerable modular drilling assembly"; U.S. Pat. No. 6,397,946 entitled "Closed-loop system to compete oil and gas wells"; U.S. Pat. No. 6,386,297 entitled "Method and apparatus for determining potential abrasivity in a wellbore"; U.S. Pat. No. 6,378,627 entitled "Autonomous downhole oilfield tool"; U.S. Pat. No. 6,353,799 entitled "Method and apparatus for determining potential interfacial severity for a formation"; U.S. Pat. No. 6,328,119 entitled "Adjustable gauge downhole drilling assembly"; U.S. Pat. No. 6,315,062 entitled "Horizontal directional drilling machine employing inertial navigation control system and method"; U.S. Pat. No. 6,308,787 entitled "Real-time control system and method for controlling an underground boring machine"; U.S. Pat. No. 6,296,066 entitled "Well system"; U.S. Pat. No. 6,276,465 entitled "Method and apparatus for determining potential for drill bit performance"; U.S. Pat. No. 6,267,185 entitled "Apparatus and method for communication with downhole equipment using drill string rotation and gyroscopic sensors"; U.S. Pat. No. 6,257,356 entitled "Magnetorheological fluid apparatus, especially adapted for use in a steerable drill string, and a method of using same"; U.S. Pat. No. 6,256,603 entitled "Performing geoscience interpretation with simulated data"; U.S. Pat. No. 6,255,962 entitled "Method and apparatus for low power, microelectronic mechanical sensing and processing"; U.S. Pat. No. 6,237,404 entitled "Apparatus and method for determining a drilling mode to optimize formation evaluation measurements"; U.S. Pat. No. 6,233,498 entitled "Method of and system for increasing drilling efficiency"; U.S. Pat. No. 6,208,585 entitled "Acoustic LWD tool having receiver calibration capabilities"; U.S. Pat. No. 6,205,851 entitled "Method for determining drill collar whirl in a bottom hole assembly and method for determining borehole size"; U.S. Pat. No. 6,166,654 entitled "Drilling assembly with reduced stick-slip tendency"; U.S. Pat. No. 6,166,994 entitled "Seismic detection apparatus and method"; U.S. Pat. No. 6,152,246 entitled "Method of and system for monitoring drilling parameters"; U.S. Pat. No. 6,142,228 entitled "Downhole motor speed measurement method"; U.S. Pat. No. 6,101,444 entitled "Numerical control unit for wellbore drilling"; U.S. Pat. No. 6,073,079 entitled "Method of maintaining a borehole within a multidimensional target zone during drilling"; U.S. Pat. No. 6,044,326 entitled "Measuring borehole size"; U.S. Pat. No. 6,035,952 entitled "Closed loop fluid-handling system for use during drilling of wellbores"; U.S. Pat. No. 6,012,015 entitled "Control model for production wells". Again, entire copies of all the references cited above are incorporated herein by reference.

Still further, the Abstract for U.S. Pat. No. 5,842,149 states: "The present invention provides a closed-loop drilling system for drilling oilfield boreholes. The system includes a drilling assembly with a drill bit, a plurality of sensors for providing signals relating to parameters relating to the drilling assembly, borehole, and formations around the drilling assembly. Processors in the drilling system process sensors signal and compute drilling parameters based on models and programmed instructions provided to the drilling system that will yield further drilling at enhanced drilling rates and with extended drilling assembly life. The drilling system then automatically adjusts the drilling parameters for continued drilling. The system continually or periodically repeats this process during the drilling operations. The drilling system also provides severity of certain dysfunctions to the operator and a means for simulating the drilling assembly behavior prior to effecting changes in the drilling parameters."

Yet further, Claim 1 of U.S. Pat. No. 5,842,149 states the following: "What is claimed is: 1. An automated drilling system for drilling oilfield wellbores at enhanced rates of penetration and with extended life of drilling assembly, comprising: (a) a tubing adapted to extend from the surface into the wellbore; (b) a drilling assembly comprising a drill bit at an end thereof and a plurality of sensors for detecting selected drilling parameters and generating data representative of said drilling parameters; (c) a computer comprising at least one processor for receiving signals representative of said data; (d) a force application device for applying a predetermined force on the drill bit within a range of forces; (e) a force controller for controlling the operation of the force application device to apply the predetermined force; (f) a source of drilling fluid under pressure at the surface for supplying a drilling fluid (g) a fluid controller for controlling the operation of the fluid source to supply a desired predetermined pressure and flow rate of the drilling fluid; (h) a rotator for rotating the bit at a predetermined speed of rotation within a range of rotation speeds; (i) receivers associated with the computer for receiving agnate signals representative of the data; (j) transmitters associated with the computer for sending control signals directing the force controller, fluid controller and rotator controller to operate the force application device, source of drilling fluid under pressure and rotator to achieve enhanced rates of penetration and extended drilling assembly life."

References Related to Closed-Loop Drilling Rig Controls:

U.S. Pat. No. 6,662,110, entitled "Drilling Rig Closed Loop Controls", inventors of Bargach, et. al., issued Dec. 9, 2003, an entire copy of which is incorporated herein by reference.

In the following, to save space, U.S. Pat. No. 6,662,110 will be abbreviated as U.S. Pat. No. 6,662,110, and other references will be similarly shorted. References cited in U.S. Pat. No. 6,662,110 include the following, entire copies of which are incorporated herein by reference: U.S. Pat. No. 4,019,148 entitled "Lock-in noise rejection circuit"; U.S. Pat. No. 4,254,481 entitled "Borehole telemetry system automatic gain control"; U.S. Pat. No. 4,507,735 entitled "Method and apparatus for monitoring and controlling well drilling parameters"; U.S. Pat. No. 4,954,998 entitled "Method for reducing noise in drill string signals"; U.S. Pat. No. 5,160,925 entitled "Short hop communication link for downhole MWD system"; U.S. Pat. No. 5,220,963 entitled "System for controlled drilling of boreholes along planned profile"; U.S. Pat. No. 5,259,468 entitled "Method of dynamically monitoring the orientation of a curved drilling assembly and apparatus"; U.S. Pat. No. 5,269,383 entitled "Navigable downhole drilling system"; U.S. Pat. No. 5,314,030 entitled "System for continuously guided drilling"; U.S. Pat. No. 5,332,048 entitled "Method and apparatus for automatic closed loop drilling system"; U.S. Pat. No. 5,646,611 entitled "System and method for indirectly determining inclination at the bit"; U.S. Pat. No. 5,812,068 entitled "Drilling system with downhole apparatus for determining parameters of interest and for adjusting drilling direction in response thereto"; U.S. Pat. No. 5,842,149 entitled "Closed loop drilling system"; U.S. Pat. No. 5,857,530 entitled "Vertical positioning system for drilling boreholes"; U.S. Pat. No. 5,880,680 entitled "Apparatus and method for determining boring direction when boring underground"; U.S. Pat. No. 6,012,015 entitled "Control model for production wells"; U.S. Pat. No. 6,021,377 entitled "Drilling system utilizing downhole dysfunctions for determining corrective actions and simulating drilling conditions"; U.S. Pat. No. 6,023,658 entitled "Noise detection and suppression system and method for wellbore telemetry"; U.S. Pat. No. 6,088,294 entitled "Drilling system with an acoustic measurement-while-driving system for determining parameters of interest and controlling the drilling direction"; U.S. Pat. No. 6,092,610 entitled "Actively controlled rotary steerable system and method for drilling wells"; U.S. Pat. No. 6,101,444 entitled "Numerical control unit for wellbore drilling"; U.S. Pat. No. 6,206,108 entitled "Drilling system with integrated bottom hole assembly"; U.S. Pat. No. 6,233,524 entitled "Closed loop drilling system"; U.S. Pat. No. 6,272,434 entitled "Drilling system with downhole apparatus for determining parameters of interest and for adjusting drilling direction in response thereto"; U.S. Pat. No. 6,296,066 entitled "Well system"; U.S. Pat. No. 6,308,787 entitled "Real-time control system and method for controlling an underground boring machine"; U.S. Pat. No. 6,310,559 entitled "Monitoring performance of downhole equipment"; U.S. Pat. No. 6,405,808 entitled "Method for increasing the efficiency of drilling a wellbore, improving the accuracy of its borehole trajectory and reducing the corresponding computed ellipse of uncertainty"; U.S. Pat. No. 6,415,878 entitled "Steerable rotary drilling device"; U.S. Pat. No. 6,419,014 entitled "Apparatus and method for orienting a downhole tool"; US20020011358 entitled "Steerable drill string"; US20020088648 entitled "Drilling assembly with a steering device for coiled-tubing operations". Again, entire copies of all the references cited above are incorporated herein by reference.

Further, other patents cite U.S. Pat. No. 6,662,110, which are listed as follows, entire copies of which are incorporated herein by reference: U.S. Pat. No. 7,921,937 entitled "Drilling components and systems to dynamically control drilling dysfunctions and methods of drilling a well with same"; U.S. Pat. No. 7,832,500 entitled "Wellbore drilling method"; U.S. Pat. No. 7,823,656 entitled "Method for monitoring drilling mud properties"; U.S. Pat. No. 7,814,989 entitled "System and method for performing a drilling operation in an oilfield"; U.S. Pat. No. 7,528,946 entitled "System for detecting deflection of a boring tool"; U.S. Pat. No. 7,461,831 entitled "Telescoping workover rig"; U.S. Pat. No. 7,222,681 entitled "Programming method for controlling a downhole steering tool"; U.S. Pat. No. 7,128,167 entitled "System and method for rig state detection"; U.S. Pat. No. 7,054,750 entitled "Method and system to model, measure, recalibrate, and optimize control of the drilling of a borehole"; U.S. Pat. No. 6,892,812 entitled "Automated method and system for determining the state of well operations and performing process evaluation"; U.S. Pat. No. 6,854,532 entitled "Subsea wellbore drilling system for reducing bottom hole pressure". Again, entire copies of all the references cited above are incorporated herein by reference.

References Related to Closed-Loop Circulating Systems:

U.S. Pat. No. 7,650,950, entitled "Drilling System and Method", inventor of Leuchenberg, issued Jan. 26, 2010, an entire copy of which is incorporated herein by reference.

In the following, to save space, U.S. Pat. No. 7,650,950 will be abbreviated as U.S. Pat. No. 7,650,950, and other references will be similarly shortened. References cited in U.S. Pat. No. 7,650,950 include the following, entire copies of which are incorporated herein by reference: U.S. Pat. No. 3,429,385 entitled "Apparatus for controlling the pressure in a well"; U.S. Pat. No. 3,443,643 entitled "Apparatus for controlling the pressure in a well"; U.S. Pat. No. 3,470,971 entitled "Apparatus and method for automatically controlling fluid pressure in a well bore"; U.S. Pat. No. 3,470,972 entitled "Bottom-hole pressure regulation apparatus"; U.S. Pat. No. 3,550,696 entitled "Control of a well"; U.S. Pat. No. 3,552,502 entitled "Apparatus for automatically controlling the killing of oil and gas wells"; U.S. Pat. No. 3,677,353 entitled "Apparatus for controlling oil well pressure"; U.S. Pat. No. 3,827,511 entitled "Apparatus for controlling well pressure"; U.S. Pat. No. 4,440,239 entitled "Method and apparatus for controlling the flow of drilling fluid in a wellbore"; U.S. Pat. No. 4,527,425 entitled "System for detecting blow out and lost circulation in a borehole"; U.S. Pat. No. 4,570,480 entitled "Method and apparatus for determining formation pressure"; U.S. Pat. No. 4,577,689 entitled "Method for determining true fracture pressure"; U.S. Pat. No. 4,606,415 entitled "Method and system for detecting and identifying abnormal drilling conditions"; U.S. Pat. No. 4,630,675 entitled "Drilling choke pressure limiting control system"; U.S. Pat. No. 4,653,597 entitled "Method for circulating and maintaining drilling mud in a wellbore"; U.S. Pat. No. 4,700,739 entitled "Pneumatic well casing pressure regulating system"; U.S. Pat. No. 4,709,900 entitled "Choke valve especially used in oil and gas wells"; U.S. Pat. No. 4,733,232 entitled "Method and apparatus for borehole fluid influx detection"; U.S. Pat. No. 4,733,233 entitled "Method and apparatus for borehole fluid influx detection"; U.S. Pat. No. 4,840,061 entitled "Method of detecting a fluid influx which could lead to a blow-out during the drilling of a borehole"; U.S. Pat. No. 4,867,254 entitled "Method of controlling fluid influxes in hydrocarbon wells"; U.S. Pat. No. 4,878,382 entitled "Method of monitoring the drilling operations by analyzing the circulating drilling mud"; U.S. Pat. No. 5,005,406 entitled "Monitoring drilling mud composition using flowing liquid junction electrodes"; U.S. Pat. No. 5,006,845 entitled "Gas kick detector"; U.S. Pat. No. 5,010,966 entitled "Drilling method"; U.S. Pat. No. 5,063,776 entitled "Method and system for measurement of fluid flow in a drilling rig return line"; U.S. Pat. No. 5,070,949 entitled "Method of analyzing fluid influxes in hydrocarbon wells"; U.S. Pat. No. 5,080,182 entitled "Method of analyzing and controlling a fluid influx during the drilling of a borehole"; U.S. Pat. No. 5,115,871 entitled "Method for the estimation of pore pressure within a subterranean formation"; U.S. Pat. No. 5,144,589 entitled "Method for predicting formation pore-pressure while drilling"; U.S. Pat. No. 5,154,078 entitled "Kick detection during drilling"; U.S. Pat. No. 5,161,409 entitled "Analysis of drilling solids samples"; U.S. Pat. No. 5,168,932 entitled "Detecting outflow or inflow of fluid in a wellbore"; U.S. Pat. No. 5,200,929 entitled "Method for estimating pore fluid pressure"; U.S. Pat. No. 5,205,165 entitled "Method for determining fluid influx or loss in drilling from floating rigs"; U.S. Pat. No. 5,205,166 entitled "Method of detecting fluid influxes"; U.S. Pat. No. 5,305,836 entitled "System and method for controlling drill bit usage and well plan"; U.S. Pat. No. 5,437,308 entitled "Device for remotely actuating equipment comprising a bean-needle system"; U.S. Pat. No. 5,443,128 entitled "Device for remote actuating equipment comprising delay means"; U.S. Pat. No. 5,474,142 entitled "Automatic drilling system"; U.S. Pat. No. 5,635,636 entitled "Method of determining inflow rates from underbalanced wells"; U.S. Pat. No. 5,857,522 entitled "Fluid handling system for use in drilling of wellbores"; U.S. Pat. No. 5,890,549 entitled "Well drilling system with closed circulation of gas drilling fluid and fire suppression apparatus"; U.S. Pat. No. 5,975,219 entitled "Method for controlling entry of a drillstem into a wellbore to minimize surge pressure"; U.S. Pat. No. 6,035,952 entitled "Closed loop fluid-handling system for use during drilling of wellbores"; U.S. Pat. No. 6,119,772 entitled "Continuous flow cylinder for maintaining drilling fluid circulation while connecting drill string joints"; U.S. Pat. No. 6,176,323 entitled "Drilling systems with sensors for determining properties of drilling fluid downhole"; U.S. Pat. No. 6,189,612 entitled "Subsurface measurement apparatus, system, and process for improved well drilling, control, and production"; U.S. Pat. No. 6,234,030 entitled "Multiphase metering method for multiphase flow"; U.S. Pat. No. 6,240,787 entitled "Method of determining fluid inflow rates"; U.S. Pat. No. 6,325,159 entitled "Offshore drilling system"; U.S. Pat. No. 6,352,129 entitled "Drilling system"; U.S. Pat. No. 6,374,925 entitled "Well drilling method and system"; U.S. Pat. No. 6,394,195 entitled "Methods for the dynamic shut-in of a subsea mudlift drilling system"; U.S. Pat. No. 6,410,862 entitled "Device and method for measuring the flow rate of drill cuttings"; U.S. Pat. No. 6,412,554 entitled "Wellbore circulation system"; U.S. Pat. No. 6,434,435 entitled "Application of adaptive object-oriented optimization software to an automatic optimization oilfield hydrocarbon production management system"; U.S. Pat. No. 6,484,816 entitled "Method and system for controlling well bore pressure"; U.S. Pat. No. 6,527,062 entitled "Well drilling method and system"; U.S. Pat. No. 6,571,873 entitled "Method for controlling bottomhole pressure during dual-gradient drilling"; U.S. Pat. No. 6,575,244 entitled "System for controlling the operating pressures within a subterranean borehole"; U.S. Pat. No. 6,618,677 entitled "Method and apparatus for determining flow rates"; U.S. Pat. No. 6,668,943 entitled "Method and apparatus for controlling pressure and detecting well control problems during drilling of an offshore well using a gas-lifted riser"; U.S. Pat. No. 6,820,702 entitled "Automated method and system for recognizing well control events"; U.S. Pat. No. 6,904,981 entitled "Dynamic annular pressure control apparatus and method"; U.S. Pat. No. 7,044,237 entitled "Drilling system and method"; U.S. Pat. No. 7,278,496 entitled "Drilling system and method"; US20020112888 entitled "Drilling system and method"; US20030168258 entitled "Method and system for controlling well fluid circulation rate"; US20040040746 entitled "Automated method and system for recognizing well control events"; US20060037781 entitled "Drilling system and method"; US20060113110 entitled "Drilling system and method". Again, entire copies of all the references cited above are incorporated herein by reference.

References Related to Closed-Loop Underbalanced Drilling:

U.S. Pat. No. 7,178,592, entitled "Closed Loop Multiphase Underbalanced Drilling Process", inventors of Chitty, et. al., issued Feb. 20, 2007, an entire copy of which is incorporated herein by reference.

In the following, to save space, U.S. Pat. No. 7,178,592 will be abbreviated as U.S. Pat. No. 7,178,592, and other references will be similarly shorted. References cited in U.S. Pat. No. 7,178,592 include the following, entire copies of which are incorporated herein by reference: U.S. Pat. No. 4,020,642 entitled "Compression systems and compressors"; U.S. Pat. No. 4,099,583 entitled "Gas lift system for marine drilling riser"; U.S. Pat. No. 4,319,635 entitled "Method for enhanced oil recovery by geopressured waterflood"; U.S. Pat. No. 4,477,237 entitled "Fabricated reciprocating piston pump"; U.S. Pat. No. 4,553,903 entitled "Two-stage rotary compressor"; U.S. Pat. No. 4,860,830 entitled "Method of cleaning a horizontal wellbore"; U.S. Pat. No. 5,048,603 entitled "Lubricator corrosion inhibitor treatment"; U.S. Pat. No. 5,048,604 entitled "Sucker rod actuated intake valve assembly for insert subsurface reciprocating pumps"; U.S. Pat. No. 5,156,537 entitled "Multiphase fluid mass transfer pump"; U.S. Pat. No. 5,226,482 entitled "Installation and method for the offshore exploitation of small fields"; U.S. Pat. No. 5,295,546 entitled "Installation and method for the offshore exploitation of small fields"; U.S. Pat. No. 5,390,743 entitled "Installation and method for the offshore exploitation of small fields"; U.S. Pat. No. 5,415,776 entitled "Horizontal separator for treating under-balance drilling fluid"; U.S. Pat. No. 5,496,466 entitled "Portable water purification system with double piston pump"; U.S. Pat. No. 5,501,279 entitled "Apparatus and method for removing production-inhibiting liquid from a wellbore"; U.S. Pat. No. 5,638,904 entitled "Safeguarded method and apparatus for fluid communication using coiled tubing, with application to drill stem testing"; U.S. Pat. No. 5,660,532 entitled "Multiphase piston-type pumping system and applications of this system"; U.S. Pat. No. 5,775,442 entitled "Recovery of gas from drilling fluid returns in underbalanced drilling"; U.S. Pat. No. 5,857,522 entitled "Fluid handling system for use in drilling of wellbores"; U.S. Pat. No. 5,992,517 entitled "Downhole reciprocating plunger well pump system"; U.S. Pat. No. 6,007,306 entitled "Multiphase pumping system with feedback loop"; U.S. Pat. No. 6,032,747 entitled "Water-based drilling fluid deacidification process and apparatus"; U.S. Pat. No. 6,035,952 entitled "Closed loop fluid-handling system for use during drilling of wellbores"; U.S. Pat. No. 6,089,322 entitled "Method and apparatus for increasing fluid recovery from a subterranean formation"; U.S. Pat. No. 6,138,757 entitled "Apparatus and method for downhole fluid phase separation"; U.S. Pat. No. 6,164,308 entitled "System and method for handling multiphase flow"; U.S. Pat. No. 6,209,641 entitled "Method and apparatus for producing fluids while injecting gas through the same wellbore"; U.S. Pat. No. 6,216,799 entitled "Subsea pumping system and method for deepwater drilling"; U.S. Pat. No. 6,234,258 entitled "Methods of separation of materials in an under-balanced drilling operation"; U.S. Pat. No. 6,315,813 entitled "Method of treating pressurized drilling fluid returns from a well"; U.S. Pat. No. 6,318,464 entitled "Vapor extraction of hydrocarbon deposits"; U.S. Pat. No. 6,325,147 entitled "Enhanced oil recovery process with combined injection of an aqueous phase and of at least partially water-miscible gas"; U.S. Pat. No. 6,328,118 entitled "Apparatus and methods of separation of materials in an under-balanced drilling operation"; U.S. Pat. No. 6,454,542 entitled "Hydraulic cylinder powered double acting duplex piston pump"; U.S. Pat. No. 6,592,334 entitled "Hydraulic multiphase pump"; U.S. Pat. No. 6,607,607 entitled "Coiled tubing wellbore cleanout"; U.S. Pat. No. 6,629,566 entitled "Method and apparatus for removing water from well-bore of gas wells to permit efficient production of gas"; U.S. Pat. No. 6,668,943 entitled "Method and apparatus for controlling pressure and detecting well control problems during drilling of an offshore well using a gas-lifted riser"; US20030085036 entitled "Combination well kick off and gas lift booster unit"; US20040031622 entitled "Methods and apparatus for drilling with a multiphase pump"; US20040197197 entitled "Multistage compressor for compressing gases"; US20060202122 entitled "Detecting gas in fluids"; US20060207795 entitled "Method of dynamically controlling open hole pressure in a wellbore using wellhead pressure control". Again, entire copies of all the references cited above are incorporated herein by reference.

Further, other patents cite U.S. Pat. No. 7,178,592, which are listed as follows, entire copies of which are incorporated herein by reference: U.S. Pat. No. 7,740,455 entitled "Pumping system with hydraulic pump"; U.S. Pat. No. 7,650,944 entitled "Vessel for well intervention".

References Related to Friction Reduction:

U.S. Pat. No. 6,585,043, entitled "Friction Reducing Tool", inventor of Murray issued Jul. 1, 2003, an entire copy of which is incorporated herein by reference.

U.S. Pat. No. 7,025,136, entitled "Torque Reduction Tool", inventors of Tulloch, et. al., issued Apr. 11, 2006, an entire copy of which is incorporated herein by reference.

While the above description contains many specificities, these should not be construed as limitations on the scope of the invention, but rather as exemplification of preferred embodiments thereto. As have been briefly described, there are many possible variations. Accordingly, the scope of the invention should be determined not only by the embodiments illustrated, but by the appended claims and their legal equivalents.

What is claimed is:

1. A method to provide torque and power to a rotary drill bit rotating clockwise attached to a drive shaft of a mud motor assembly comprising at least the following steps:

a. providing relatively high pressure mud from a drill pipe attached to an uphole end of said mud motor assembly;

b. passing at least a first portion of said relatively high pressure mud through a first hydraulic chamber having a first piston that rotates a first crankshaft clockwise about its own rotation axis from its first relative starting position at 0 degrees through a first angle of at least 180 degrees, but less than 360 degrees during its first power stroke;

c. mechanically coupling said first crankshaft by a first ratchet means to a first portion of said drive shaft to provide clockwise rotational power to said drive shaft during said first power stroke;

d. passing at least a second portion of said relatively high pressure mud through a second hydraulic chamber having a second piston that rotates a second crankshaft clockwise about its own rotation axis from its second relative starting position of 0 degrees through a second angle of at least 180 degrees, but less than 360 degrees during its second power stroke;

e. mechanically coupling said second crankshaft by a second ratchet means to a second portion of said drive shaft to provide clockwise rotational power to said drive shaft during said second power stroke; and f. providing first control means of said first ratchet means, and providing second control means of said second ratchet means, to control the relative timing of rotations of said first crankshaft and said second crankshaft so that at the particular time that said first crankshaft has rotated from its first relative starting position through at least 180 degrees and said second crankshaft begins its rotational motion from its second relative starting position of 0 degrees and said second crankshaft begins its second power stroke and wherein the first crankshaft is mechanically decoupled from the first ratchet means during at least a portion of the second power stroke.

2. A method to provide torque and power to a rotary drill bit rotating clockwise attached to a drive shaft of a mud motor assembly comprising at least the following steps:

a. providing relatively high pressure mud from a drill pipe attached to an uphole end of said mud motor assembly;

b. passing at least a first portion of said relatively high pressure mud through a first hydraulic chamber having a first piston that rotates a first crankshaft clockwise about its own rotation axis from its first relative starting position at 0 degrees through a first angle of at least 120 degrees, but less than 360 degrees during its first power stroke;

c. mechanically coupling said first crankshaft by a first ratchet means to a first portion of said drive shaft to provide clockwise rotational power to said drive shaft during said first power stroke; and d. passing at least a second portion of said relatively high pressure mud through a second hydraulic chamber having a second piston that rotates a second crankshaft clockwise about its own rotation axis from its second relative starting position of 0 degrees through a second angle of at least 120 degrees, but less than 360 degrees during its second power stroke;

e. mechanically coupling said second crankshaft by a second ratchet means to a second portion of said drive shaft to provide clockwise rotational power to said drive shaft during said second power stroke;

f. passing at least a third portion of said relatively high pressure mud through a third hydraulic chamber having a third piston that rotates a third crankshaft clockwise about its own rotation axis from its third relative starting position of 0 degrees through a third angle of at least 120 degrees, but less than 360 degrees during its third power stroke;

g. mechanically coupling said third crankshaft by a third ratchet means to a third portion of said drive shaft to provide clockwise rotational power to said drive shaft during said third power stroke; and h. providing first control means of said first ratchet means, and providing second control means of said second ratchet means, and providing third control means of third ratchet means to control the relative timing of delivery of power from said first crankshaft and from said second crankshaft and from said third crankshaft to said drive shaft, so that during a first particular time duration said first crankshaft rotates from its first relative starting position through its first relative angle of at least 120 degrees to the completion of its said first power stroke at a first maximum relative angle of at least 120 degrees, and so that during a second particular time duration said second crankshaft rotates from its second relative starting position through its second relative angle of at least 120 degrees to the completion of its said second power stroke at a second maximum relative angle of at least 120 degrees, and so that during a third particular time duration said third crankshaft rotates from its third relative starting position through a third relative angle of at least 120 degrees to the completion of its said third power stroke at a third maximum relative angle of at least 120degrees, so that at any instant in time, at least one of said pistons within one of said hydraulic chambers is in its respective power stroke and during at least a portion of the power stroke of each hydraulic chamber the crankshaft and associated ratchet means of the other hydraulic chambers are decoupled.

3. A method to provide torque and power to a rotary drill bit rotating clockwise attached to a drive shaft of a mud motor assembly comprising at least the following steps:

a. providing relatively high pressure mud from a drill pipe attached to an uphole end of said mud motor assembly;

b. passing at least a first portion of said relatively high pressure mud through a first hydraulic chamber having a first piston that rotates a first crankshaft clockwise about its own rotation axis from its first relative starting position at 0 degrees through a first angle of at least 90degrees, but less than 360 degrees during its first power stroke;

c. mechanically coupling said first crankshaft by a first ratchet means to a first portion of said drive shaft to provide clockwise rotational power to said drive shaft during said first power stroke; and d. passing at least a second portion of said relatively high pressure mud through a second hydraulic chamber having a second piston that rotates a second crankshaft clockwise about its own rotation axis from its second relative starting position of 0 degrees through a second angle of at least 90 degrees, but less than 360 degrees during its second power stroke;

e. mechanically coupling said second crankshaft by a second ratchet means to a second portion of said drive shaft to provide clockwise rotational power to said drive shaft during said second power stroke;

f. passing at least a third portion of said relatively high pressure mud through a third hydraulic chamber having a third piston that rotates a third crankshaft clockwise about its own rotation axis from its third relative starting position of 0 degrees through a second angle of at least 90 degrees, but less than 360 degrees during its third power stroke;

g. mechanically coupling said third crankshaft by a third ratchet means to a third portion of said drive shaft to provide clockwise rotational power to said drive shaft during said third power stroke;

h. passing at least a fourth portion of said relatively high pressure mud through a fourth hydraulic chamber having a fourth piston that rotates a fourth crankshaft clockwise about its own rotation axis from its fourth relative starting position of 0 degrees through a fourth angle of at least 90 degrees, but less than 360 degrees during its third power stroke;

i. mechanically coupling said fourth crankshaft by a fourth ratchet means to a fourth portion of said drive shaft to provide clockwise rotational power to said drive shaft during said fourth power stroke; and j. providing first control means of said first ratchet means, and providing second control means of said second ratchet means, and providing third control means of third ratchet means and providing fourth control means of fourth ratchet means to control the relative timing of delivery of power from said first crankshaft and from said second crankshaft and from said third crankshaft and from said fourth crankshaft to said drive shaft, so that during a first particular time duration said first crankshaft rotates from its first relative starting position through a first relative angle of at least 90 degrees to the completion of its said first power stroke at a first maximum relative angle of at least 90 degrees, and so that during a second particular time duration said second crankshaft rotates from its second relative starting position through a second relative angle of at least 90 degrees to the completion of its said second power stroke at a second maximum relative angle of at least 90degrees, and so that during a third particular time duration said third crankshaft rotates from its third relative starting position through a third relative angle of at least 90 degrees to the completion of its said third power stroke at a third maximum relative angle of at least 90 degrees, so that during a fourth particular time duration said fourth crankshaft rotates from its fourth relative starting position through a fourth relative angle of at least 90 degrees to the completion of its said fourth power stroke at a fourth maximum relative angle of at least 90degrees, so that at any instant in time, at least two of said pistons within two of said hydraulic chambers are in their respective power strokes and during at least a portion of the respective power strokes the pistons that are not within a power stroke are decoupled from the drive shaft.

4. The method in claim 3 that includes the step of passing at least a fifth portion of said relatively high pressure mud through a fifth hydraulic chamber having a fifth piston that rotates a fifth crankshaft clockwise about its own rotation axis from its fifth relative starting position of 0 degrees through a fifth angle of at least 90 degrees, but less than 360 degrees during its fifth power stroke.

5. The method in claim 4 that includes the step of passing at least a sixth portion of said relatively high pressure mud through a sixth hydraulic chamber having a sixth piston that rotates a sixth crankshaft clockwise about its own rotation axis from its sixth relative starting position of 0 degrees through a sixth angle of at least 90degrees, but less than 360 degrees during its sixth power stroke.

6. The method in claim 5 that includes the step of passing at least a seventh portion of said relatively high pressure mud through a seventh hydraulic chamber having a seventh piston that rotates a seventh crankshaft clockwise about its own rotation axis from its seventh relative starting position of 0 degrees through a seventh angle of at least 90 degrees, but less than 360 degrees during its seventh power stroke.

7. The method in claim 6 that includes the step of passing at least an eighth portion of said relatively high pressure mud through an eighth hydraulic chamber having an eighth piston that rotates an eighth crankshaft clockwise about its own rotation axis from its eighth relative starting position of 0 degrees through an eight angle of at least 90 degrees, but less than 360 degrees during its seventh power stroke.

8. The method in claim 3 that includes the step of passing at least a portion of said relatively high pressure mud through at least one additional hydraulic chamber having its piston that rotates its crankshaft clockwise about its own rotation axis from its relative starting position of 0 degrees through an angle of at least 90 degrees, but less than 360 degrees during its power stroke.

9. A method to provide torque and power from a downhole assembly to a downhole shaft rotating clockwise comprising at least the following steps:

a. providing relatively high pressure mud from a drill pipe attached to an uphole end of said downhole assembly;

b. passing at least a first portion of said relatively high pressure mud through a first hydraulic chamber having a first piston that rotates a first crankshaft clockwise about its own rotation axis from its first relative starting position at 0 degrees through a first angle of at least 30 degrees, but less than 360 degrees during its first power stroke;

c. mechanically coupling said first piston and first crankshaft to said downhole shaft;

d. passing at least a second portion of said relatively high pressure mud through a second hydraulic chamber having a second piston that rotates a second crankshaft clockwise about its own rotation access from its first relative starting position at 0 degrees through a first angle of at least 30 degrees, but less than 360 degrees during a second power stroke;

e. mechanically coupling said second piston and second crankshaft to said downhole shaft; and f. wherein said downhole shaft is connected to at least one of a downhole electric generator, a downhole pump, a portion of a downhole drilling apparatus, a portion of an MWD apparatus, and a portion of a LWD apparatus, and wherein during at least a portion of the power stroke of said first hydraulic chamber said second piston is decoupled from said downhole shaft.

10. The method of claim 9, wherein during at least a portion of the power stroke of said second hydraulic chamber said first piston is decoupled from said downhole shaft.

* * * * *